US008831936B2

(12) United States Patent
Toman et al.

(10) Patent No.: US 8,831,936 B2
(45) Date of Patent: Sep. 9, 2014

(54) SYSTEMS, METHODS, APPARATUS, AND COMPUTER PROGRAM PRODUCTS FOR SPEECH SIGNAL PROCESSING USING SPECTRAL CONTRAST ENHANCEMENT

(75) Inventors: Jeremy Toman, San Diego, CA (US); Hung Chun Lin, Cardiff by the Sea, CA (US); Erik Visser, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 856 days.

(21) Appl. No.: 12/473,492

(22) Filed: May 28, 2009

(65) Prior Publication Data

US 2009/0299742 A1 Dec. 3, 2009

Related U.S. Application Data

(60) Provisional application No. 61/057,187, filed on May 29, 2008.

(51) Int. Cl.
*G10L 21/02* (2013.01)

(52) U.S. Cl.
USPC ..... 704/228

(58) Field of Classification Search
USPC ..... 704/228
See application file for complete search history.

(56) References Cited

U.S. PATENT DOCUMENTS

| | | | |
|---|---|---|---|
| 4,641,344 | A | 2/1987 | Kasai et al. |
| 5,105,377 | A | 4/1992 | Ziegler, Jr. |
| 5,388,185 | A | 2/1995 | Terry et al. |
| 5,485,515 | A | 1/1996 | Allen et al. |
| 5,524,148 | A | 6/1996 | Allen et al. |
| 5,526,419 | A | 6/1996 | Allen et al. |
| 5,553,134 | A | 9/1996 | Allen et al. |
| 5,646,961 | A | 7/1997 | Shoham et al. |
| 5,699,382 | A | 12/1997 | Shoham et al. |
| 5,764,698 | A | 6/1998 | Sudharsanan et al. |
| 5,794,187 | A | 8/1998 | Franklin et al. |
| 5,937,070 | A | 8/1999 | Todter et al. |
| 6,002,776 | A | 12/1999 | Bhadkamkar et al. |
| 6,064,962 | A | 5/2000 | Oshikiri |
| 6,240,192 | B1 | 5/2001 | Brennan et al. |

(Continued)

FOREIGN PATENT DOCUMENTS

| | | | |
|---|---|---|---|
| CN | 85105410 | A | 1/1987 |
| CN | 1684143 | A | 10/2005 |

(Continued)

OTHER PUBLICATIONS

Aichner R et al :"POST-Processing for convolutive blind source separation" Acoustics, speech and signal processing, 2006. ICASSP 2006 proceedings. 2006 IEEE International Conference on Toulouse, France May 14-19, 2006, Piscataway, NJ, USA, May 14, 2006, Piscataway, NJ, USA,IEEE Piscataway, NJ, USA, May 14, 2006, p. V XP031387071, p. 37, left-hand column, line 1-p. 39, left-hand column, line 39.

(Continued)

*Primary Examiner* — Susan McFadden
(74) *Attorney, Agent, or Firm* — Espartaco Diaz Hidalgo

(57) ABSTRACT

Systems, methods, and apparatus for spectral contrast enhancement of speech signals, based on information from a noise reference that is derived by a spatially selective processing filter from a multichannel sensed audio signal, are disclosed.

35 Claims, 87 Drawing Sheets

(56) References Cited

U.S. PATENT DOCUMENTS

| | | | | |
|---|---|---|---|---|
| 6,411,927 | B1 * | 6/2002 | Morin et al. | 704/224 |
| 6,415,253 | B1 | 7/2002 | Johnson | |
| 6,616,481 | B2 | 9/2003 | Ichio | |
| 6,678,651 | B2 | 1/2004 | Gao | |
| 6,704,428 | B1 | 3/2004 | Wurtz | |
| 6,732,073 | B1 * | 5/2004 | Kluender et al. | 704/233 |
| 6,757,395 | B1 | 6/2004 | Fang et al. | |
| 6,834,108 | B1 | 12/2004 | Schmidt | |
| 6,885,752 | B1 | 4/2005 | Chabries et al. | |
| 6,937,738 | B2 | 8/2005 | Armstrong et al. | |
| 6,968,171 | B2 | 11/2005 | Vanderhelm et al. | |
| 6,970,558 | B1 | 11/2005 | Schmidt | |
| 6,980,665 | B2 | 12/2005 | Kates | |
| 6,993,480 | B1 | 1/2006 | Klayman | |
| 7,010,133 | B2 | 3/2006 | Chalupper et al. | |
| 7,010,480 | B2 | 3/2006 | Gao | |
| 7,020,288 | B1 | 3/2006 | Ohashi | |
| 7,031,460 | B1 | 4/2006 | Zheng et al. | |
| 7,050,966 | B2 | 5/2006 | Schneider et al. | |
| 7,099,821 | B2 * | 8/2006 | Visser et al. | 704/226 |
| 7,103,188 | B1 | 9/2006 | Jones | |
| 7,120,579 | B1 | 10/2006 | Licht | |
| 7,181,034 | B2 | 2/2007 | Armstrong | |
| 7,242,763 | B2 | 7/2007 | Etter | |
| 7,336,662 | B2 * | 2/2008 | Hassan-Ali et al. | 370/395.21 |
| 7,382,886 | B2 | 6/2008 | Henn et al. | |
| 7,433,481 | B2 | 10/2008 | Armstrong et al. | |
| 7,444,280 | B2 | 10/2008 | Vandali | |
| 7,492,889 | B2 | 2/2009 | Ebenezer | |
| 7,516,065 | B2 | 4/2009 | Marumoto | |
| 7,564,978 | B2 | 7/2009 | Engdegard et al. | |
| 7,676,374 | B2 | 3/2010 | Tammi | |
| 7,711,552 | B2 | 5/2010 | Villemoes | |
| 7,729,775 | B1 * | 6/2010 | Saoji et al. | 607/57 |
| 8,095,360 | B2 * | 1/2012 | Gao | 704/205 |
| 8,102,872 | B2 | 1/2012 | Spindola et al. | |
| 8,160,273 | B2 * | 4/2012 | Visser et al. | 381/94.7 |
| 8,265,297 | B2 | 9/2012 | Shiraishi | |
| 8,538,749 | B2 * | 9/2013 | Visser et al. | 704/228 |
| 2001/0001853 | A1 | 5/2001 | Mauro | |
| 2002/0076072 | A1 | 6/2002 | Cornelisse | |
| 2002/0193130 | A1 * | 12/2002 | Yang et al. | 455/501 |
| 2003/0023433 | A1 | 1/2003 | Erell et al. | |
| 2003/0081804 | A1 | 5/2003 | Kates | |
| 2003/0093268 | A1 | 5/2003 | Zinser | |
| 2003/0152167 | A1 | 8/2003 | Taenzer | |
| 2003/0158726 | A1 | 8/2003 | Philippe | |
| 2003/0198357 | A1 | 10/2003 | Schneider et al. | |
| 2004/0125973 | A1 | 7/2004 | Fang et al. | |
| 2004/0136545 | A1 | 7/2004 | Sarpeshkar | |
| 2004/0161121 | A1 | 8/2004 | Choi | |
| 2004/0196994 | A1 | 10/2004 | Kates | |
| 2004/0252846 | A1 | 12/2004 | Nonaka et al. | |
| 2004/0252850 | A1 | 12/2004 | Turicchia | |
| 2005/0141737 | A1 | 6/2005 | Hansen | |
| 2005/0165603 | A1 | 7/2005 | Bessette | |
| 2005/0165608 | A1 | 7/2005 | Suzuki | |
| 2005/0207585 | A1 | 9/2005 | Christoph | |
| 2006/0008101 | A1 | 1/2006 | Kates | |
| 2006/0069556 | A1 | 3/2006 | Nadjar et al. | |
| 2006/0149532 | A1 | 7/2006 | Boillot | |
| 2006/0222184 | A1 | 10/2006 | Buck et al. | |
| 2006/0262938 | A1 | 11/2006 | Gauger, Jr. et al. | |
| 2006/0262939 | A1 | 11/2006 | Buchner et al. | |
| 2006/0270467 | A1 | 11/2006 | Song | |
| 2006/0293882 | A1 | 12/2006 | Giesbrecht et al. | |
| 2007/0053528 | A1 | 3/2007 | Kim et al. | |
| 2007/0092089 | A1 | 4/2007 | Seefeldt et al. | |
| 2007/0100605 | A1 | 5/2007 | Renevey et al. | |
| 2007/0110042 | A1 | 5/2007 | Li et al. | |
| 2008/0039162 | A1 | 2/2008 | Anderton | |
| 2008/0112569 | A1 | 5/2008 | Asada | |
| 2008/0130929 | A1 | 6/2008 | Arndt et al. | |
| 2008/0175422 | A1 | 7/2008 | Kates | |
| 2008/0186218 | A1 | 8/2008 | Ohkuri et al. | |
| 2008/0215332 | A1 | 9/2008 | Zeng | |
| 2008/0243496 | A1 | 10/2008 | Wang | |
| 2008/0269926 | A1 | 10/2008 | Xiang | |
| 2009/0024185 | A1 | 1/2009 | Kulkarni | |
| 2009/0034748 | A1 | 2/2009 | Sibbald | |
| 2009/0111507 | A1 | 4/2009 | Chen | |
| 2009/0170550 | A1 | 7/2009 | Foley | |
| 2009/0192803 | A1 | 7/2009 | Nagaraja et al. | |
| 2009/0254340 | A1 | 10/2009 | Sun et al. | |
| 2009/0271187 | A1 | 10/2009 | Yen et al. | |
| 2010/0017205 | A1 | 1/2010 | Visser et al. | |
| 2010/0131269 | A1 | 5/2010 | Park et al. | |
| 2010/0296666 | A1 | 11/2010 | Lin | |
| 2010/0296668 | A1 | 11/2010 | Lee et al. | |
| 2011/0007907 | A1 | 1/2011 | Park et al. | |
| 2011/0099010 | A1 | 4/2011 | Zhang | |
| 2011/0137646 | A1 | 6/2011 | Ahgren et al. | |
| 2011/0293103 | A1 | 12/2011 | Park et al. | |
| 2012/0263317 | A1 | 10/2012 | Shin et al. | |

FOREIGN PATENT DOCUMENTS

| | | | |
|---|---|---|---|
| CN | 101105941 | A | 1/2008 |
| EP | 0643881 | A1 | 3/1995 |
| EP | 1081685 | A2 | 7/2001 |
| EP | 0742548 | B1 | 8/2001 |
| EP | 1232494 | A1 | 8/2002 |
| EP | 1522206 | A1 | 4/2005 |
| JP | 03266899 | | 11/1991 |
| JP | 6175691 | A | 6/1994 |
| JP | 9006391 | A | 1/1997 |
| JP | 10268873 | A | 10/1998 |
| JP | 11298990 | A | 10/1999 |
| JP | 2000082999 | A | 3/2000 |
| JP | 2001292491 | A | 10/2001 |
| JP | 2002369281 | | 12/2002 |
| JP | 2003218745 | A | 7/2003 |
| JP | 2003271191 | A | 9/2003 |
| JP | 2004289614 | A | 10/2004 |
| JP | 2005168736 | | 6/2005 |
| JP | 2006340391 | A | 12/2006 |
| JP | 2008507926 | A | 3/2008 |
| JP | 2008193421 | A | 8/2008 |
| JP | 2009031793 | A | 2/2009 |
| KR | 19970707648 | | 12/1997 |
| TW | I238012 | B | 8/2005 |
| TW | 200623023 | | 7/2006 |
| TW | I279775 | B | 4/2007 |
| TW | I289025 | B | 10/2007 |
| WO | WO9326085 | A1 | 12/1993 |
| WO | WO9711533 | A1 | 3/1997 |
| WO | WO2005069275 | A1 | 7/2005 |
| WO | WO2006012578 | | 2/2006 |
| WO | 2006028587 | | 3/2006 |
| WO | WO2008138349 | A2 | 11/2008 |
| WO | 2009092522 | A1 | 7/2009 |

OTHER PUBLICATIONS

Araki S et al: "Subband based blind source separation for convolutive mixtures of speech"Proceedings of International Conference on Acoustics, Speech and Signal Processing (ICASSP'OS) Apr. 6-10, 2003 Hong Kong, China; [IEEE International Conference on Acoustics, Speech, and.

Signal Processing (ICASSP)], 2003 IEEE International Conference, vol. 5, Apr. 6, 2003, pp. V__509-V__512, XP0106393201SBN: 9780780376632.

International Search Report and Written Opinion-PCT/US2009/045676-ISA/EPO-Dec. 30, 2009.

Shin. "Perceptual Reinforcement of Speech Signal Based on Partial Specific Loudness," IEEE Signal Processing Letters. Nov. 2007, pp. 887-890, vol. 14. No. 11.

Valin J-M et al: "Microphone array post-filter for separation of simultaneous non-stationary sources"Acoustics, Speech, and Signal Processing, 2004. Proceedings. (ICASSP ' 04). IEEE International Conference on Montreal, Quebec, Canada May 17-21, 2004, Piscataway, NJ, USA.IEEE, vol. 1, May 17, 2004, pp. 221-224, XP0107176051SBN: 9780780384842.

(56) References Cited

OTHER PUBLICATIONS

Visser, et al.: Blind source separation in mobile environments using a priori knowledge Acoustics, speech, and signal processing, 2004 Proceedings ICASSP 2004, IEEE Intl Conference, Montreal, Quebec, Canada, May 17-21, 2004, Piscataway, NJ, US, IEEE vol. 3 May 17, 2004, pp. 893-896, ISBN: 978-0-7803-8484-2.

De Diego, M., et al., An adaptive algorithms comparison for real multichannel active noise control. EUSIPCO (European Signal Processing Conference) 2004, Sep. 6-10, 2004, Vienna, AT, vol. II, pp. 925-928.

Jiang, F., et al., New Robust Adaptive Algorithm for Multichannel Adaptive Active Noise Control. Proc. 1997 IEEE Int'l Conf. Control Appl., Oct. 5-7, 1997, pp. 528-533.

Payan, R. Parametric Equalization on TMS320C6000 DSP. Application Report SPRA867, Dec. 2002, Texas Instruments, Dallas, TX. 29 pp.

Streeter, A. et al. Hybrid Feedforward-Fedback Active Noise Control. Proc. 2004 Amer. Control Conf., Jun. 30-Jul. 2, 2004, Amer. Auto. Control Council, pp. 2876-81, Boston, MA.

T. Baer et al. Spectral contrast enhancement of speech in noise for listeners with sensorineural hearing impairment: effects on intelligibility, quality, and response times. J. Rehab. Research and Dev., vol. 20, No. 1, 1993, pp. 49-72.

T. Hasegawa et al. Environmental Acoustic Noise Cancelling based on Formant Enhancement. Studia Phonologica XVIII (1984), pp. 59-68.

K. Hermansen. ASPI-project proposal(9-10 sem.): Speech Enhancement. Aalborg University, DK, 4 pp. Last accessed Mar. 16, 2009 at http://kom.aau.dk/~rdk/aspi08/sites/aspi9/P9-E08-speech-enhanc-general.pdf.

J.B. Laflen et al. A Flexible, Analytical Framework for Applying and Testing Alternative Spectral Enhancement Algorithms (poster). International Hearing Aid Convention (IHCON) 2002. (original document is a poster, submitted here as 3 pp.) Last accessed Mar. 16, 2009 at http://spin.ecn.purdue.edu/fmri/publications/ConfPoters/2002/2002_IHCON_Laflen.pdf.

J.B. Laflen et al. A Flexible, Analytical Framework for Applying and Testing Alternative Spectral Enhancement Algorithms (abstract). International Hearing Aid Convention (IHCON) 2002. Last accessed Mar. 16, 2009 at http://spin.ecn.purdue.edu/fmri/publications/ConfAbstracts/2002/2002_IHCON_Laflen_Abs.pdf.

L. Turicchia et al. A Bio-Inspired Companding Strategy for Spectral Enhancement. IEEE Transactions on Speech and Audio Processing, vol. 13, No. 2, Mar. 2005, p. 243-253.

J. Yang et al. Spectral contrast enhancement: Algorithms and comparisons. Speech Communication 39 (2003) 33-46.

Brian C. J. Moore, et al., "A Model for the Prediction of Thresholds, Loudness, and Partial Loudness", J. Audio Eng. Soc., pp. 224-240, vol. 45, No. 4, Apr. 1997.

Esben Skovenborg, et al., "Evaluation of Different Loudness Models with Music and Speech Material", Oct. 28-31, 2004.

* cited by examiner

```
min = ( (EN(i,k) < eta_max) ? EN(i,k) : eta_max );
max = ( (min > eta_min) ? min : eta_min );
eta(i,k) = ( (max - eta_min) / (eta_max - eta_min) );
G(i,k) = ( (eta(i,k) * EC(i,k)) + ( (1 - eta(i,k)) * ES(i,k) ) ) / (ES(i,k) + eps);
if (G(i,k) <= G(i,k-1)) { G(i,k) = beta_dec * G(i,k-1); }
else { G(i,k) = (beta_att * G(i,k-1)) + ((1 - beta_att) * G(i,k)); }
```

FIG. 34A

```
min = ( (EN(i,k) < eta_max) ? EN(i,k) : eta_max );
max = ( (min > eta_min) ? min : eta_min );
eta(i,k) = ( (max - eta_min) / (eta_max - eta_min) );
G(i,k) = ( (eta(i,k) * EC(i,k)) + ( (1 - eta(i,k)) * ES(i,k) ) ) / (ES(i,k) + eps);
if (G(i,k) <= G(i,k-1)) {
   if (hangover(i) > 0) { hangover(i)--; }
   if (hangover(i) == 0) { G(i,k) = beta_dec * G(i,k-1); }
   else { G(i,k) = G(i,k-1); }
}
else {
  hangover(i) = hangover_max(i);
  G(i,k) = (beta_att * G(i,k-1)) + ((1 - beta_att) * G(i,k));
}
```

FIG. 34B

```
min = ( (EN(i,k) < eta_max) ? EN(i,k) : eta_max );
max = ( (min > eta_min) ? min : eta_min );
eta(i,k) = ( (max - eta_min) / (eta_max - eta_min) );
G(i,k) = ( (eta(i,k) * EC(i,k)) + ( (1 - eta(i,k)) * ES(i,k) ) ) / (ES(i,k) + eps);
if (G(i,k) <= G(i,k-1)) {
  G(i,k) = beta_dec * G(i,k-1);
  if (G(i,k) < LB) { G(i,k) = LB; }
}
else {
  if (G(i,k) > UB) { G(i,k) = UB; }
  G(i,k) = (beta_att * G(i,k-1)) + ((1 - beta_att) * G(i,k));
}
```

FIG. 35A

```
min = ( (EN(i,k) < eta_max) ? EN(i,k) : eta_max );
max = ( (min > eta_min) ? min : eta_min );
eta(i,k) = ( (max - eta_min) / (eta_max - eta_min) );
G(i,k) = ( (eta(i,k) * EC(i,k)) + ( (1 - eta(i,k)) * ES(i,k) ) ) / (ES(i,k) + eps);
if (G(i,k) <= G(i,k-1)) {
   if (hangover(i) > 0) { hangover(i)--; }
   if (hangover(i) == 0) {
     G(i,k) = beta_dec * G(i,k-1);
     if (G(i,k) < LB) { G(i,k) = LB; }
   }
   else { G(i,k) = G(i,k-1); }
}
else {
  hangover(i) = hangover_max(i);
  if (G(i,k) > UB) { G(i,k) = UB; }
  G(i,k) = (beta_att * G(i,k-1)) + ((1 - beta_att) * G(i,k));
}
```

FIG. 35B

```
if VAD == 1 {
  min = ( (EN(i,k) < eta_max) ? EN(i,k) : eta_max );
  max = ( (min > eta_min) ? min : eta_min );
  eta(i,k) = ( (max - eta_min) / (eta_max - eta_min) );
  G(i,k) = ( (eta(i,k) * EC(i,k)) + ( (1 - eta(i,k)) * ES(i,k) ) ) / (ES(i,k) + eps);
  if (G(i,k) <= G(i,k-1)) {
    G(i,k) = beta_dec * G(i,k-1);
    if (G(i,k) < LB) { G(i,k) = LB; }
  }
  else {
    if (G(i,k) > UB) { G(i,k) = UB; }
    G(i,k) = (beta_att * G(i,k-1)) + ((1 - beta_att) * G(i,k));
  }
}
```

FIG. 41

```
if VAD == 1 {
  min = ( (EN(i,k) < eta_max) ? EN(i,k) : eta_max );
  max = ( (min > eta_min) ? min : eta_min );
  eta(i,k) = ( (max - eta_min) / (eta_max - eta_min) );
  G(i,k) = ( (eta(i,k) * EC(i,k)) + ( (1 - eta(i,k)) * ES(i,k) ) ) / (ES(i,k) + eps);
  if (G(i,k) <= G(i,k-1)) {
    G(i,k) = beta_dec * G(i,k-1);
    if (G(i,k) < LB) { G(i,k) = LB; }
  }
  else {
    if (G(i,k) > UB) { G(i,k) = UB; }
    G(i,k) = (beta_att * G(i,k-1)) + ((1 - beta_att) * G(i,k));
  }
}
else { G(i,k) = (beta_dec * G(i,k-1)) + (1 - beta_dec); }
```

FIG. 42

```
pkdiff = peak_lim - abs(sig(k));

if (pkdiff < 0) { diffgain = 1 + (pkdiff/peak_lim); }
else { diffgain = 1; }

if (diffgain > g_pk) { g_pk = (gamma_att * g_pk) + ((1 - gamma_att) * diffgain); }
else { g_pk = (gamma_dec * g_pk) + ((1 - gamma_dec) * diffgain); }

sig(k) = sig(k) * g_pk;
```

FIG. 45A

```
if (abs(sig(k)) > peak_lim) { diffgain = 2 - ( abs(sig(k))/peak_lim ); }
else { diffgain = 1; }

if (diffgain > g_pk) { g_pk = (gamma_att * g_pk) + ((1 - gamma_att) * diffgain); }
else { g_pk = (gamma_dec * g_pk) + ((1 - gamma_dec) * diffgain); }

sig(k) = sig(k) * g_pk;
```

FIG. 45B

SYSTEMS, METHODS, APPARATUS, AND COMPUTER PROGRAM PRODUCTS FOR SPEECH SIGNAL PROCESSING USING SPECTRAL CONTRAST ENHANCEMENT

CLAIM OF PRIORITY UNDER 35 U.S.C. §119

The present application for patent claims priority to Provisional Application No. 61/057,187, entitled "SYSTEMS, METHODS, APPARATUS, AND COMPUTER PROGRAM PRODUCTS FOR IMPROVED SPECTRAL CONTRAST ENHANCEMENT OF SPEECH AUDIO IN A DUAL-MICROPHONE AUDIO DEVICE," filed May 29, 2008, which is assigned to the assignee hereof.

REFERENCE TO CO-PENDING APPLICATIONS FOR PATENT

The present application for patent is related to the co-pending U.S. patent application Ser. No. 12/277,283 by Visser et al., entitled "SYSTEMS, METHODS, APPARATUS, AND COMPUTER PROGRAM PRODUCTS FOR ENHANCED INTELLIGIBILITY," filed Nov. 24, 2008.

BACKGROUND

1. Field

This disclosure relates to speech processing.

2. Background

Many activities that were previously performed in quiet office or home environments are being performed today in acoustically variable situations like a car, a street, or a café. For example, a person may desire to communicate with another person using a voice communication channel. The channel may be provided, for example, by a mobile wireless handset or headset, a walkie-talkie, a two-way radio, a car-kit, or another communications device. Consequently, a substantial amount of voice communication is taking place using mobile devices (e.g., handsets and/or headsets) in environments where users are surrounded by other people, with the kind of noise content that is typically encountered where people tend to gather. Such noise tends to distract or annoy a user at the far end of a telephone conversation. Moreover, many standard automated business transactions (e.g., account balance or stock quote checks) employ voice recognition based data inquiry, and the accuracy of these systems may be significantly impeded by interfering noise.

For applications in which communication occurs in noisy environments, it may be desirable to separate a desired speech signal from background noise. Noise may be defined as the combination of all signals interfering with or otherwise degrading the desired signal. Background noise may include numerous noise signals generated within the acoustic environment, such as background conversations of other people, as well as reflections and reverberation generated from each of the signals. Unless the desired speech signal is separated from the background noise, it may be difficult to make reliable and efficient use of it.

A noisy acoustic environment may also tend to mask, or otherwise make it difficult to hear, a desired reproduced audio signal, such as the far-end signal in a phone conversation. The acoustic environment may have many uncontrollable noise sources that compete with the far-end signal being reproduced by the communications device. Such noise may cause an unsatisfactory communication experience. Unless the far-end signal may be distinguished from background noise, it may be difficult to make reliable and efficient use of it.

SUMMARY

A method of processing a speech signal according to a general configuration includes using a device that is configured to process audio signals to perform a spatially selective processing operation on a multichannel sensed audio signal to produce a source signal and a noise reference; and to perform a spectral contrast enhancement operation on the speech signal to produce a processed speech signal. In this method, performing a spectral contrast enhancement operation includes calculating a plurality of noise subband power estimates based on information from the noise reference; generating an enhancement vector based on information from the speech signal; and producing the processed speech signal based on the plurality of noise subband power estimates, information from the speech signal, and information from the enhancement vector. In this method, each of a plurality of frequency subbands of the processed speech signal is based on a corresponding frequency subband of the speech signal.

An apparatus for processing a speech signal according to a general configuration includes means for performing a spatially selective processing operation on a multichannel sensed audio signal to produce a source signal and a noise reference and means for performing a spectral contrast enhancement operation on the speech signal to produce a processed speech signal. The means for performing a spectral contrast enhancement operation on the speech signal includes means for calculating a plurality of noise subband power estimates based on information from the noise reference; means for generating an enhancement vector based on information from the speech signal; and means for producing the processed speech signal based on the plurality of noise subband power estimates, information from the speech signal, and information from the enhancement vector. In this apparatus, each of a plurality of frequency subbands of the processed speech signal is based on a corresponding frequency subband of the speech signal.

An apparatus for processing a speech signal according to another general configuration includes a spatially selective processing filter configured to perform a spatially selective processing operation on a multichannel sensed audio signal to produce a source signal and a noise reference and a spectral contrast enhancer configured to perform a spectral contrast enhancement operation on the speech signal to produce a processed speech signal. In this apparatus, the spectral contrast enhancer includes a power estimate calculator configured to calculate a plurality of noise subband power estimates based on information from the noise reference and an enhancement vector generator configured to generate an enhancement vector based on information from the speech signal. In this apparatus, the spectral contrast enhancer is configured to produce the processed speech signal based on the plurality of noise subband power estimates, information from the speech signal, and information from the enhancement vector. In this apparatus, each of a plurality of frequency subbands of the processed speech signal is based on a corresponding frequency subband of the speech signal.

A computer-readable medium according to a general configuration includes instructions which when executed by at least one processor cause the at least one processor to perform a method of processing a multichannel audio signal. These instructions include instructions which when executed by a processor cause the processor to perform a spatially selective processing operation on a multichannel sensed audio signal to produce a source signal and a noise reference; and instructions which when executed by a processor cause the processor to perform a spectral contrast enhancement operation on the speech signal to produce a processed speech signal. The instructions to perform a spectral contrast enhancement operation include instructions to calculate a plurality of noise subband power estimates based on information from the noise reference; instructions to generate an enhancement vector based on information from the speech signal; and instructions to produce the processed speech signal based on the plurality of noise subband power estimates, information from the speech signal, and information from the enhancement vector. In this method, each of a plurality of frequency subbands of the processed speech signal is based on a corresponding frequency subband of the speech signal.

A method of processing a speech signal according to a general configuration includes using a device that is configured to process audio signals to smooth a spectrum of the speech signal to obtain a first smoothed signal; to smooth the first smoothed signal to obtain a second smoothed signal; and to produce a contrast-enhanced speech signal that is based on a ratio of the first and second smoothed signals. Apparatus configured to perform such a method are also disclosed, as well as computer-readable media having instructions which when executed by at least one processor cause the at least one processor to perform such a method.

BRIEF DESCRIPTION OF THE DRAWINGS

FIG. 34A shows a pseudocode listing.

FIG. 34B shows a modification of the pseudocode listing of FIG. 34A.

FIGS. 35A and 35B show modifications of the pseudocode listings of FIGS. 34A and 34B, respectively.

FIG. 41 shows a modification of the pseudocode listing of FIG. 35A.

FIG. 42 shows another modification of the pseudocode listing of FIG. 35A.

FIG. 45A shows a pseudocode listing that describes one example of a peak limiting operation.

FIG. 45B shows another version of the pseudocode listing of FIG. 45A.

FIG. 83A shows a block diagram of an apparatus F100 according to a general configuration.

FIG. 83B shows a block diagram of an implementation F110 of apparatus F100.

FIG. 84A shows a block diagram of an implementation F120 of apparatus F100.

FIG. 84B shows a block diagram of an implementation G230 of means G130.

FIG. 85A shows a block diagram of an implementation G240 of means G140.

FIG. 85B shows a block diagram of an implementation G340 of means G240.

FIG. 85C shows a block diagram of an implementation F130 of apparatus F110.

FIG. 86A shows a block diagram of an implementation F140 of apparatus F100.

FIG. 86B shows a block diagram of a apparatus F200 according to a general configuration.

Figure 1:
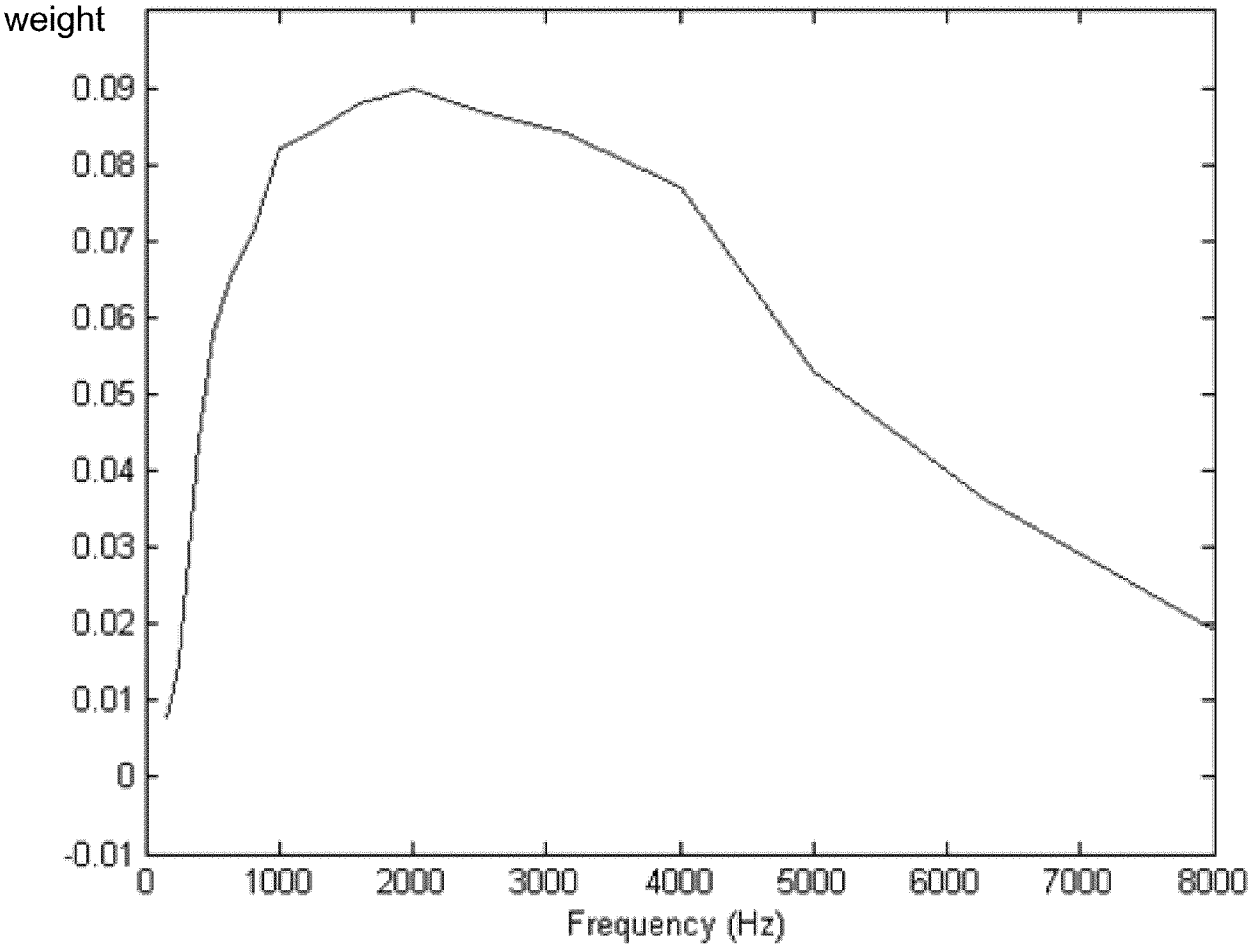
FIG. 1 shows an articulation index plot.

In these drawings, uses of the same label indicate instances of the same structure, unless context dictates otherwise.

DETAILED DESCRIPTION

Noise affecting a speech signal in a mobile environment may include a variety of different components, such as competing talkers, music, babble, street noise, and/or airport noise. As the signature of such noise is typically nonstationary and close to the frequency signature of the speech signal, the noise may be hard to model using traditional single microphone or fixed beamforming type methods. Single microphone noise reduction techniques typically require significant parameter tuning to achieve optimal performance. For example, a suitable noise reference may not be directly available in such cases, and it may be necessary to derive a noise reference indirectly. Therefore multiple microphone based advanced signal processing may be desirable to support the use of mobile devices for voice communications in noisy environments. In one particular example, a speech signal is sensed in a noisy environment, and speech processing methods are used to separate the speech signal from the environmental noise (also called "background noise" or "ambient noise"). In another particular example, a speech signal is reproduced in a noisy environment, and speech processing methods are used to separate the speech signal from the environmental noise. Speech signal processing is important in many areas of everyday communication, since noise is almost always present in real-world conditions.

Systems, methods, and apparatus as described herein may be used to support increased intelligibility of a sensed speech signal and/or a reproduced speech signal, especially in a noisy environment. Such techniques may be applied generally in any recording, audio sensing, transceiving and/or audio reproduction application, especially mobile or otherwise portable instances of such applications. For example, the range of configurations disclosed herein includes communications devices that reside in a wireless telephony communication system configured to employ a code-division multiple-access (CDMA) over-the-air interface. Nevertheless, it would be understood by those skilled in the art that a method and apparatus having features as described herein may reside in any of the various communication systems employing a wide range of technologies known to those of skill in the art, such as systems employing Voice over IP (VoIP) over wired and/or wireless (e.g., CDMA, TDMA, FDMA, TD-SCDMA, or OFDM) transmission channels.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, smoothing, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Where the term "comprising" is used in the present description and claims, it does not exclude other elements or operations. The term "based on" (as in "A is based on B") is used to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B"). Similarly, the term "in response to" is used to indicate any of its ordinary meanings, including "in response to at least."

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose." Any incorporation by reference of a portion of a document shall also be understood to incorporate definitions of terms or variables that are referenced within the portion, where such definitions appear elsewhere in the document, as well as any figures referenced in the incorporated portion.

The terms "coder," "codec," and "coding system" are used interchangeably to denote a system that includes at least one encoder configured to receive and encode frames of an audio signal (possibly after one or more pre-processing operations, such as a perceptual weighting and/or other filtering operation) and a corresponding decoder configured to receive the encoded frames and produce corresponding decoded representations of the frames. Such an encoder and decoder are typically deployed at opposite terminals of a communications link. In order to support a full-duplex communication, instances of both of the encoder and the decoder are typically deployed at each end of such a link.

In this description, the term "sensed audio signal" denotes a signal that is received via one or more microphones. An audio sensing device, such as a communications or recording device, may be configured to store a signal based on the sensed audio signal and/or to output such a signal to one or more other devices coupled to the audio sending device via a wire or wirelessly.

In this description, the term "reproduced audio signal" denotes a signal that is reproduced from information that is retrieved from storage and/or received via a wired or wireless connection to another device. An audio reproduction device, such as a communications or playback device, may be configured to output the reproduced audio signal to one or more loudspeakers of the device. Alternatively, such a device may be configured to output the reproduced audio signal to an earpiece, other headset, or external loudspeaker that is coupled to the device via a wire or wirelessly. With reference to transceiver applications for voice communications, such as telephony, the sensed audio signal is the near-end signal to be transmitted by the transceiver, and the reproduced audio signal is the far-end signal received by the transceiver (e.g., via a wired and/or wireless communications link). With reference to mobile audio reproduction applications, such as playback of recorded music or speech (e.g., MP3s, audiobooks, podcasts) or streaming of such content, the reproduced audio signal is the audio signal being played back or streamed.

The intelligibility of a speech signal may vary in relation to the spectral characteristics of the signal. For example, the articulation index plot of FIG. 1 shows how the relative contribution to speech intelligibility varies with audio frequency. This plot illustrates that frequency components between 1 and 4 kHz are especially important to intelligibility, with the relative importance peaking around 2 kHz.

Figure 2:
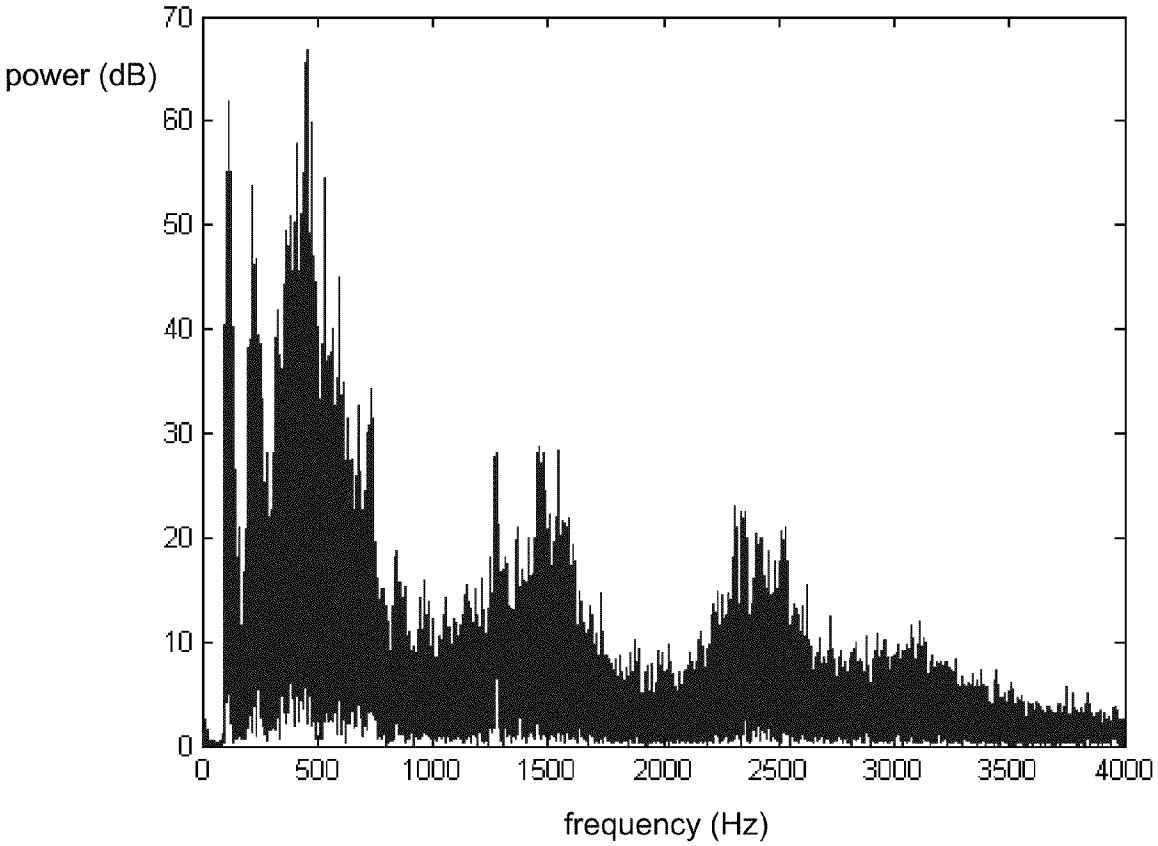
FIG. 2 shows a power spectrum for a reproduced speech signal in a typical narrowband telephony application.

FIG. 2 shows a power spectrum for a speech signal as transmitted into and/or as received via a typical narrowband channel of a telephony application. This diagram illustrates that the energy of such a signal decreases rapidly as frequency increases above 500 Hz. As shown in FIG. 1, however, frequencies up to 4 kHz may be very important to speech intelligibility. Therefore, artificially boosting energies in frequency bands between 500 and 4000 Hz may be expected to improve intelligibility of a speech signal in such a telephony application.

As audio frequencies above 4 kHz are not generally as important to intelligibility as the 1 kHz to 4 kHz band, transmitting a narrowband signal over a typical band-limited communications channel is usually sufficient to have an intelligible conversation. However, increased clarity and better communication of personal speech traits may be expected for cases in which the communications channel supports transmission of a wideband signal. In a voice telephony context, the term "narrowband" refers to a frequency range from about 0-500 Hz (e.g., 0, 50, 100, or 200 Hz) to about 3-5 kHz (e.g., 3500, 4000, or 4500 Hz), and the term "wideband" refers to a frequency range from about 0-500 Hz (e.g., 0, 50, 100, or 200 Hz) to about 7-8 kHz (e.g., 7000, 7500, or 8000 Hz).

It may be desirable to increase speech intelligibility by boosting selected portions of a speech signal. In hearing aid applications, for example, dynamic range compression techniques may be used to compensate for a known hearing loss in particular frequency subbands by boosting those subbands in the reproduced audio signal.

The real world abounds from multiple noise sources, including single point noise sources, which often transgress into multiple sounds resulting in reverberation. Background acoustic noise may include numerous noise signals generated by the general environment and interfering signals generated by background conversations of other people, as well as reflections and reverberation generated from each of the signals.

Environmental noise may affect the intelligibility of a sensed audio signal, such as a near-end speech signal, and/or of a reproduced audio signal, such as a far-end speech signal. For applications in which communication occurs in noisy environments, it may be desirable to use a speech processing method to distinguish a speech signal from background noise and enhance its intelligibility. Such processing may be important in many areas of everyday communication, as noise is almost always present in real-world conditions.

Figure 3:
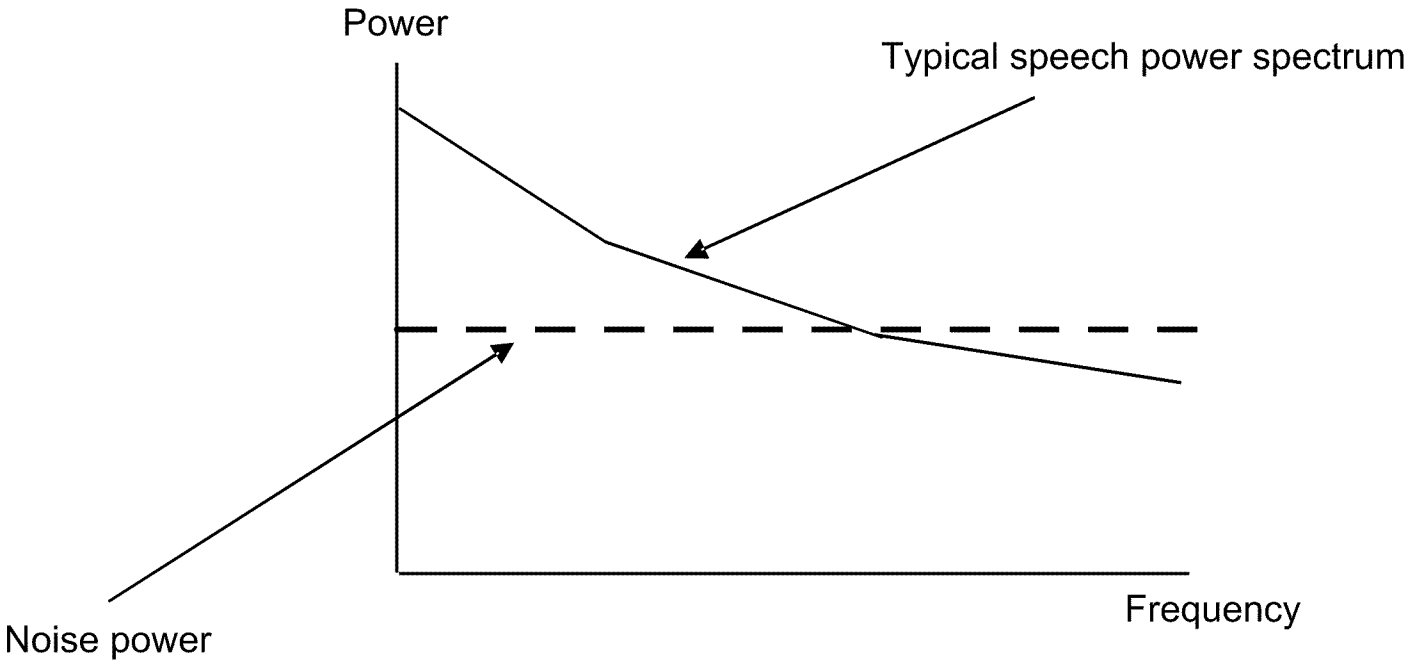
FIG. 3 shows an example of a typical speech power spectrum and a typical noise power spectrum.
Figure 4B:
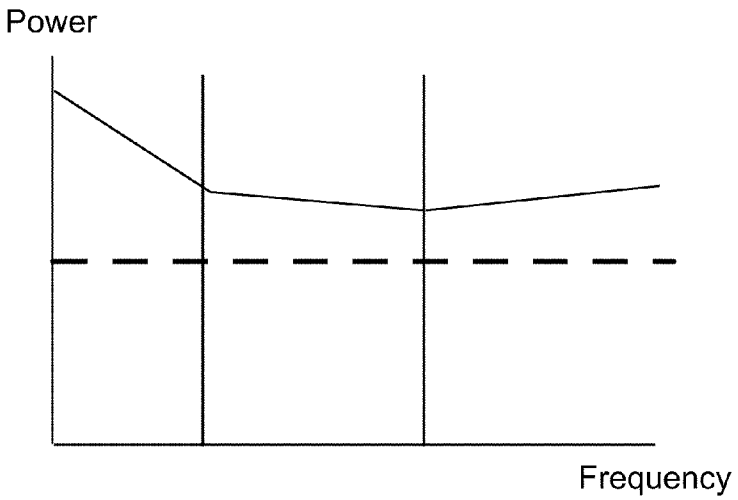
FIG. 4B illustrates an application of subband equalization to the example of FIG. 3.
Figure 4A:
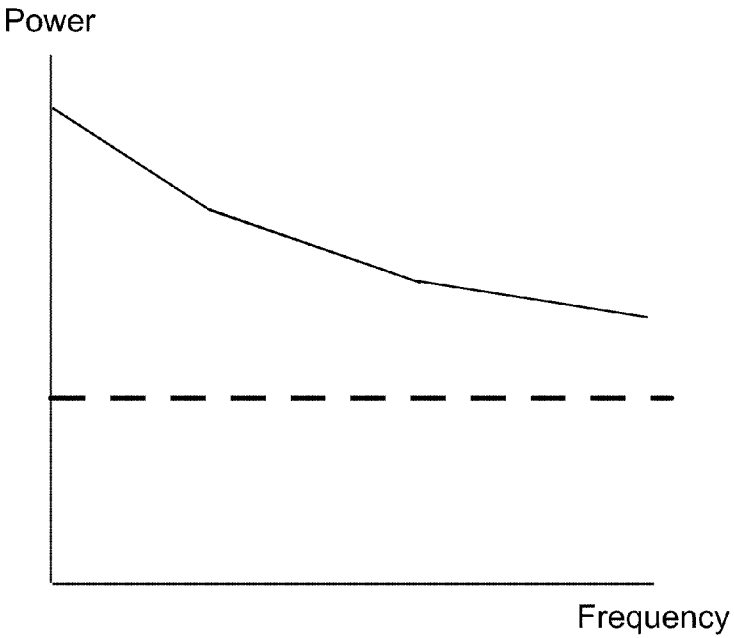
FIG. 4A illustrates an application of automatic volume control to the example of FIG. 3.

Automatic gain control (AGC, also called automatic volume control or AVC) is a processing method that may be used to increase intelligibility of an audio signal that is sensed or reproduced in a noisy environment. An automatic gain control technique may be used to compress the dynamic range of the signal into a limited amplitude band, thereby boosting segments of the signal that have low power and decreasing energy in segments that have high power. FIG. 3 shows an example of a typical speech power spectrum, in which a natural speech power roll-off causes power to decrease with frequency, and a typical noise power spectrum, in which power is generally constant over at least the range of speech frequencies. In such case, high-frequency components of the speech signal may have less energy than corresponding components of the noise signal, resulting in a masking of the high-frequency speech bands. FIG. 4A illustrates an application of AVC to such an example. An AVC module is typically implemented to boost all frequency bands of the speech signal indiscriminately, as shown in this figure. Such an approach may require a large dynamic range of the amplified signal for a modest boost in high-frequency power.

Background noise typically drowns high frequency speech content much more quickly than low frequency content, since speech power in high frequency bands is usually much smaller than in low frequency bands. Therefore simply boosting the overall volume of the signal will unnecessarily boost low frequency content below 1 kHz which may not significantly contribute to intelligibility. It may be desirable instead to adjust audio frequency subband power to compensate for noise masking effects on a speech signal. For example, it may be desirable to boost speech power in inverse proportion to the ratio of noise-to-speech subband power, and disproportionally so in high frequency subbands, to compensate for the inherent roll-off of speech power towards high frequencies.

It may be desirable to compensate for low voice power in frequency subbands that are dominated by environmental noise. As shown in FIG. 4B, for example, it may be desirable to act on selected subbands to boost intelligibility by applying different gain boosts to different subbands of the speech signal (e.g., according to speech-to-noise ratio). In contrast to the AVC example shown in FIG. 4A, such equalization may be expected to provide a clearer and more intelligible signal, while avoiding an unnecessary boost of low-frequency components.

In order to selectively boost speech power in such manner, it may be desirable to obtain a reliable and contemporaneous estimate of the environmental noise level. In practical applications, however, it may be difficult to model the environmental noise from a sensed audio signal using traditional single microphone or fixed beamforming type methods. Although FIG. 3 suggests a noise level that is constant with frequency, the environmental noise level in a practical application of a communications device or a media playback device typically varies significantly and rapidly over both time and frequency.

The acoustic noise in a typical environment may include babble noise, airport noise, street noise, voices of competing talkers, and/or sounds from interfering sources (e.g., a TV set or radio). Consequently, such noise is typically nonstationary and may have an average spectrum is close to that of the user's own voice. A noise power reference signal as computed from a single microphone signal is usually only an approximate stationary noise estimate. Moreover, such computation generally entails a noise power estimation delay, such that corresponding adjustments of subband gains can only be performed after a significant delay. It may be desirable to obtain a reliable and contemporaneous estimate of the environmental noise.

Figure 5:
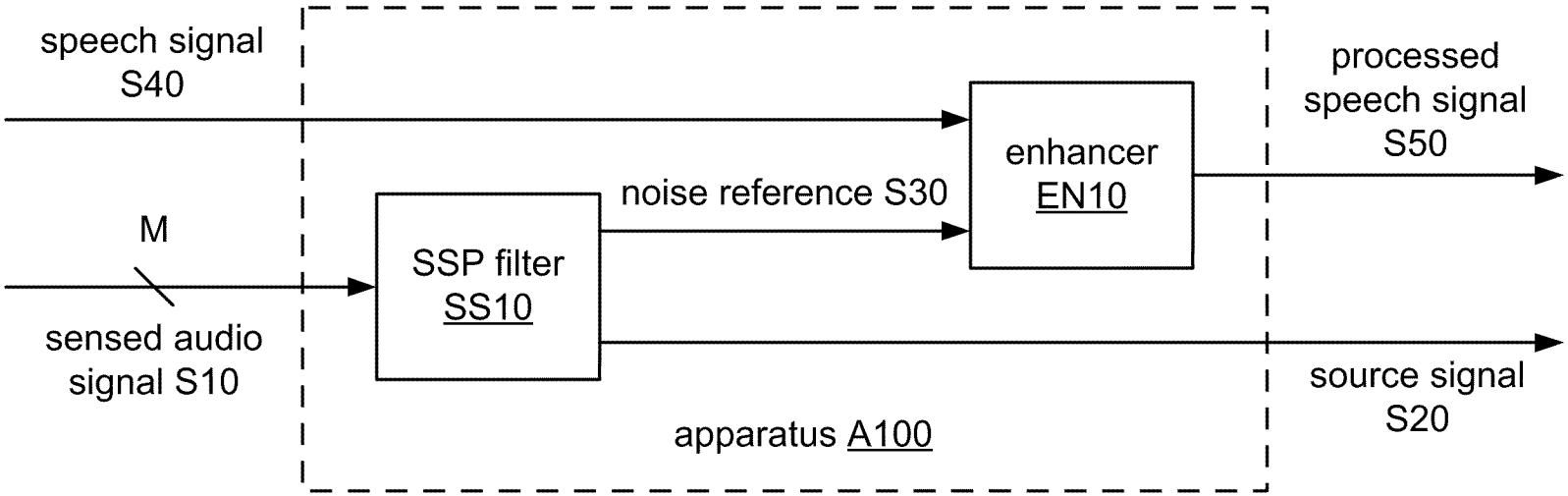
FIG. 5 shows a block diagram of an apparatus A100 according to a general configuration.

FIG. 5 shows a block diagram of an apparatus configured to process audio signals A100 according to a general configuration that includes a spatially selective processing filter SS10 and a spectral contrast enhancer EN10. Spatially selective processing (SSP) filter SS10 is configured to perform a spatially selective processing operation on an M-channel sensed audio signal S10 (where M is an integer greater than one) to produce a source signal S20 and a noise reference S30. Enhancer EN10 is configured to dynamically alter the spectral characteristics of a speech signal S40 based on information from noise reference S30 to produce a processed speech signal S50. For example, enhancer EN10 may be configured to use information from noise reference S30 to boost and/or attenuate at least one frequency subband of speech signal S40 relative to at least one other frequency subband of speech signal S40 to produce processed speech signal S50.

Figure 6A:
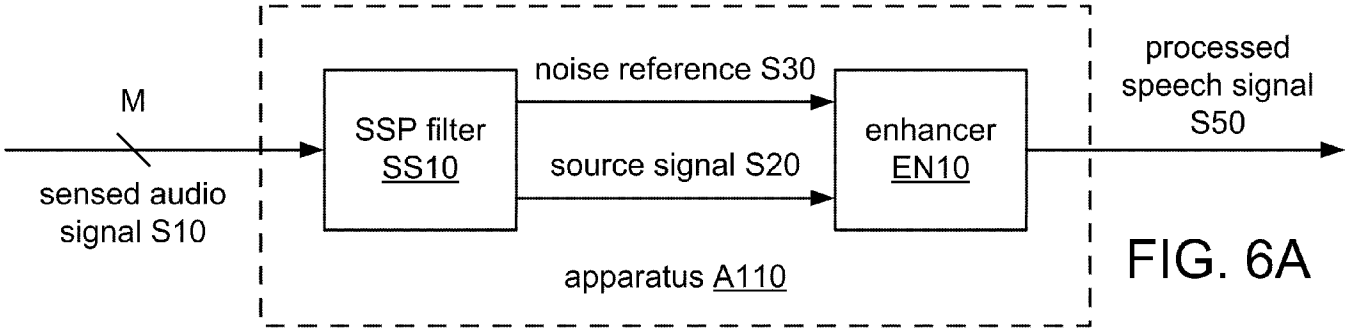
FIG. 6A shows a block diagram of an implementation A110 of apparatus A100.
Figure 6B:
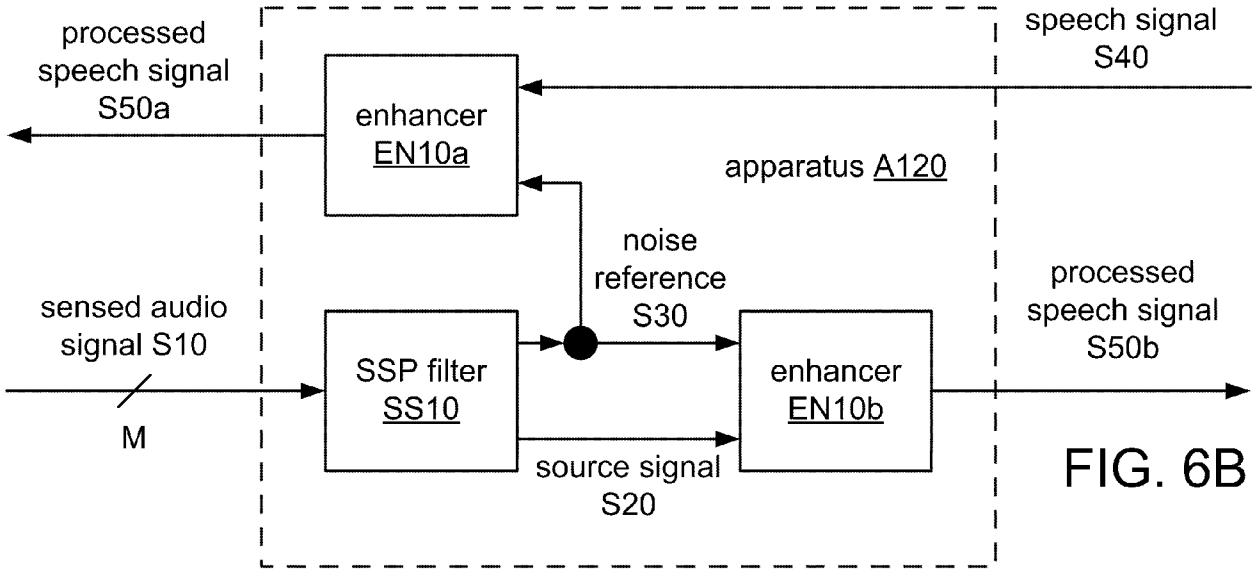
FIG. 6B shows a block diagram of an implementation A120 of apparatus A100 (and of apparatus A110).

Apparatus A100 may be implemented such that speech signal S40 is a reproduced audio signal (e.g., a far-end signal). Alternatively, apparatus A100 may be implemented such that speech signal S40 is a sensed audio signal (e.g., a near-end signal). For example, apparatus A100 may be implemented such that speech signal S40 is based on multichannel sensed audio signal S10. FIG. 6A shows a block diagram of such an implementation A110 of apparatus A100 in which enhancer EN10 is arranged to receive source signal S20 as speech signal S40. FIG. 6B shows a block diagram of a further implementation A120 of apparatus A100 (and of apparatus A110) that includes two instances EN10*a* and EN10*b* of enhancer EN10. In this example, enhancer EN10*a* is arranged to process speech signal S40 (e.g., a far-end signal) to produce processed speech signal S50*a*, and enhancer EN10*b* is arranged to process source signal S20 (e.g., a near-end signal) to produce processed speech signal S50*b*.

In a typical application of apparatus A100, each channel of sensed audio signal S10 is based on a signal from a corresponding one of an array of M microphones, where M is an integer having a value greater than one. Examples of audio sensing devices that may be implemented to include an implementation of apparatus A100 with such an array of microphones include hearing aids, communications devices, recording devices, and audio or audiovisual playback devices. Examples of such communications devices include, without limitation, telephone sets (e.g., corded or cordless telephones, cellular telephone handsets, Universal Serial Bus (USB) handsets), wired and/or wireless headsets (e.g., Bluetooth headsets), and hands-free car kits. Examples of such recording devices include, without limitation, handheld audio and/or video recorders and digital cameras. Examples of such audio or audiovisual playback devices include, without limitation, media players configured to reproduce streaming or prerecorded audio or audiovisual content. Other examples of audio sensing devices that may be implemented to include an implementation of apparatus A100 with such an array of microphones and may be configured to perform communications, recording, and/or audio or audiovisual playback operations include personal digital assistants (PDAs) and other handheld computing devices; netbook computers, notebook computers, laptop computers, and other portable computing devices; and desktop computers and workstations.

The array of M microphones may be implemented to have two microphones (e.g., a stereo array), or more than two microphones, that are configured to receive acoustic signals. Each microphone of the array may have a response that is omnidirectional, bidirectional, or unidirectional (e.g., cardioid). The various types of microphones that may be used include (without limitation) piezoelectric microphones, dynamic microphones, and electret microphones. In a device for portable voice communications, such as a handset or headset, the center-to-center spacing between adjacent microphones of such an array is typically in the range of from about 1.5 cm to about 4.5 cm, although a larger spacing (e.g., up to 10 or 15 cm) is also possible in a device such as a handset. In a hearing aid, the center-to-center spacing between adjacent microphones of such an array may be as little as about 4 or 5 mm. The microphones of such an array may be arranged along a line or, alternatively, such that their centers lie at the vertices of a two-dimensional (e.g., triangular) or three-dimensional shape.

It may be desirable to obtain sensed audio signal S10 by performing one or more preprocessing operations on the signals produced by the microphones of the array. Such preprocessing operations may include sampling, filtering (e.g., for echo cancellation, noise reduction, spectrum shaping, etc.), and possibly even pre-separation (e.g., by another SSP filter or adaptive filter as described herein) to obtain sensed audio signal S10. For acoustic applications such as speech, typical sampling rates range from 8 kHz to 16 kHz. Other typical preprocessing operations include impedance matching, gain control, and filtering in the analog and/or digital domains.

Spatially selective processing (SSP) filter SS10 is configured to perform a spatially selective processing operation on sensed audio signal S10 to produce a source signal S20 and a noise reference S30. Such an operation may be designed to determine the distance between the audio sensing device and a particular sound source, to reduce noise, to enhance signal components that arrive from a particular direction, and/or to separate one or more sound components from other environmental sounds. Examples of such spatial processing operations are described in U.S. patent application Ser. No. 12/197,924, filed Aug. 25, 2008, entitled "SYSTEMS, METHODS, AND APPARATUS FOR SIGNAL SEPARATION," and U.S. patent application Ser. No. 12/277,283, filed Nov. 24, 2008, entitled "SYSTEMS, METHODS, APPARATUS, AND COMPUTER PROGRAM PRODUCTS FOR ENHANCED INTELLIGIBILITY" and include (without limitation) beamforming and blind source separation operations. Examples of noise components include (without limitation) diffuse environmental noise, such as street noise, car noise, and/or babble noise, and directional noise, such as an interfering speaker and/or sound from another point source, such as a television, radio, or public address system.

Figure 7:
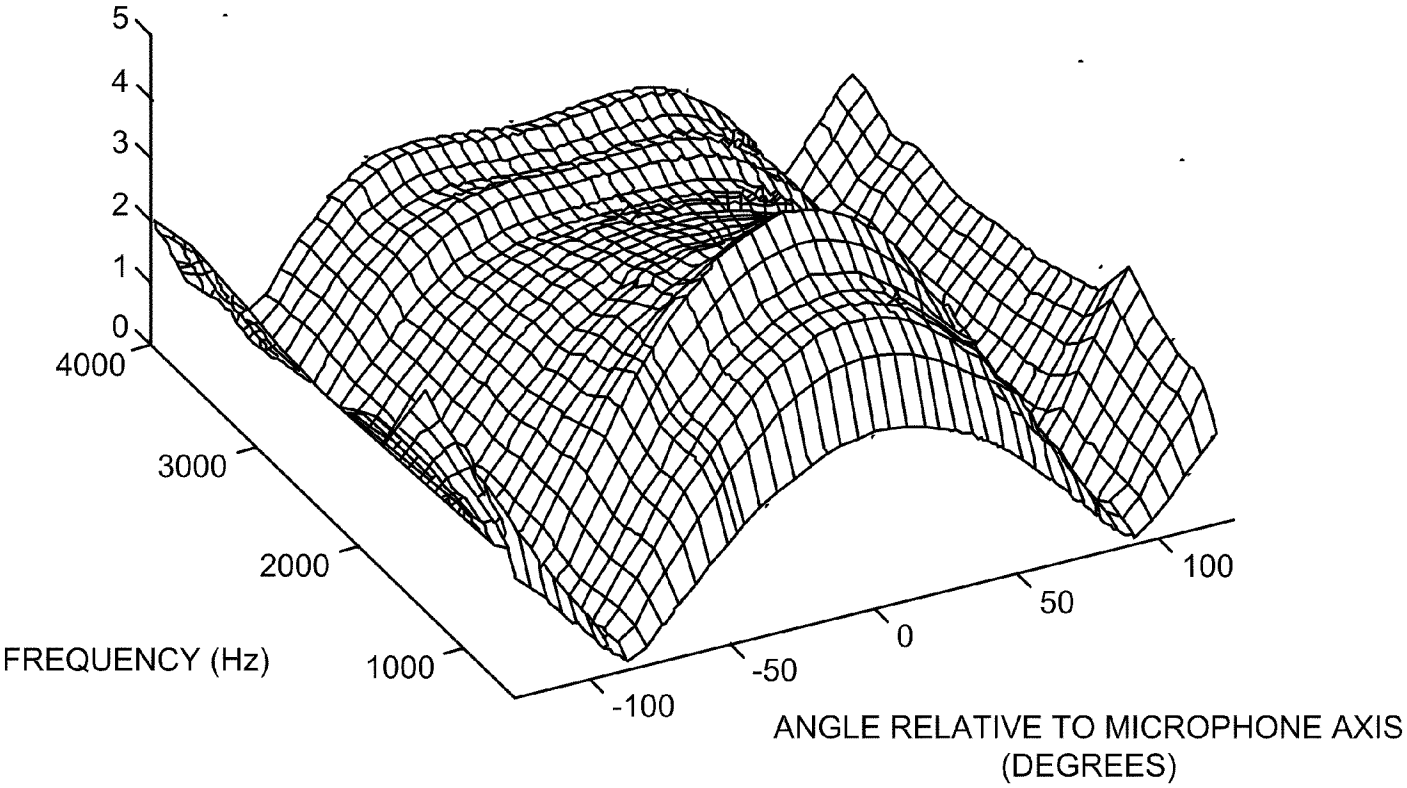
FIG. 7 shows a beam pattern for one example of spatially selective processing (SSP) filter SS10.

Spatially selective processing filter SS10 may be configured to separate a directional desired component of sensed audio signal S10 (e.g., the user's voice) from one or more other components of the signal, such as a directional interfering component and/or a diffuse noise component. In such case, SSP filter SS10 may be configured to concentrate energy of the directional desired component so that source signal S20 includes more of the energy of the directional desired component than each channel of sensed audio channel S10 does (that is to say, so that source signal S20 includes more of the energy of the directional desired component than any individual channel of sensed audio channel S10 does). FIG. 7 shows a beam pattern for such an example of SSP filter SS10 that demonstrates the directionality of the filter response with respect to the axis of the microphone array.

Spatially selective processing filter SS10 may be used to provide a reliable and contemporaneous estimate of the environmental noise. In some noise estimation methods, a noise reference is estimated by averaging inactive frames of the input signal (e.g., frames that contain only background noise or silence). Such methods may be slow to react to changes in the environmental noise and are typically ineffective for modeling nonstationary noise (e.g., impulsive noise). Spatially selective processing filter SS10 may be configured to separate noise components even from active frames of the input signal to provide noise reference S30. The noise separated by SSP filter SS10 into a frame of such a noise reference may be essentially contemporaneous with the information content in the corresponding frame of source signal S20, and such a noise reference is also called an "instantaneous" noise estimate.

Figure 8A:
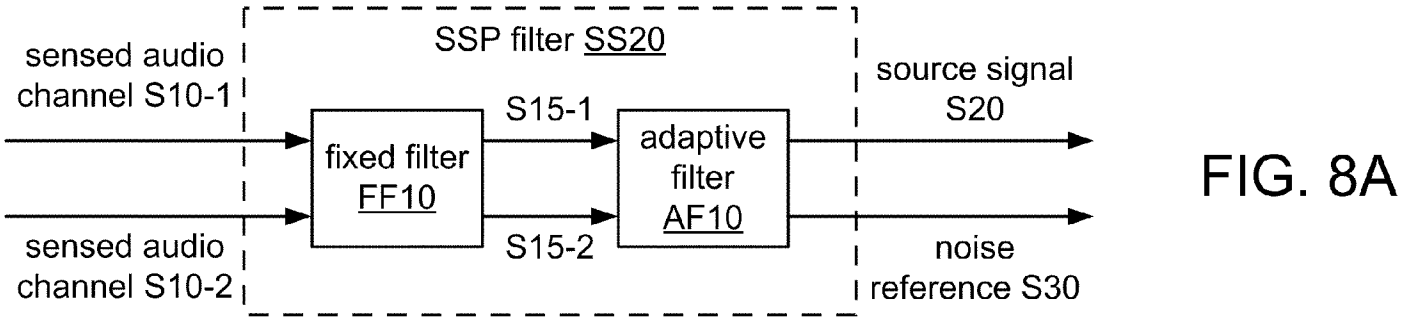
FIG. 8A shows a block diagram of an implementation SS20 of SSP filter SS10.

Spatially selective processing filter SS10 is typically implemented to include a fixed filter FF10 that is characterized by one or more matrices of filter coefficient values. These filter coefficient values may be obtained using a beamforming, blind source separation (BSS), or combined BSS/beamforming method as described in more detail below. Spatially selective processing filter SS10 may also be implemented to include more than one stage. FIG. 8A shows a block diagram of such an implementation SS20 of SSP filter SS10 that includes a fixed filter stage FF10 and an adaptive filter stage AF10. In this example, fixed filter stage FF10 is arranged to filter channels S10-1 and S10-2 of sensed audio signal S10 to produce channels S15-1 and S15-2 of a filtered signal S15, and adaptive filter stage AF10 is arranged to filter the channels S15-1 and S15-2 to produce source signal S20 and noise reference S30. In such case, it may be desirable to use fixed filter stage FF10 to generate initial conditions for adaptive filter stage AF10, as described in more detail below. It may also be desirable to perform adaptive scaling of the inputs to SSP filter SS10 (e.g., to ensure stability of an IIR fixed or adaptive filter bank).

In another implementation of SSP filter SS20, adaptive filter AF10 is arranged to receive filtered channel S15-1 and sensed audio channel S10-2 as inputs. In such a case, it may be desirable for adaptive filter AF10 to receive sensed audio channel S10-2 via a delay element that matches the expected processing delay of fixed filter FF10.

It may be desirable to implement SSP filter SS10 to include multiple fixed filter stages, arranged such that an appropriate one of the fixed filter stages may be selected during operation (e.g., according to the relative separation performance of the various fixed filter stages). Such a structure is disclosed in, for example, U.S. patent application Ser. No. 12/334,246, filed Dec. 12, 2008, entitled "SYSTEMS, METHODS, AND APPARATUS FOR MULTI-MICROPHONE BASED SPEECH ENHANCEMENT."

Spatially selective processing filter SS10 may be configured to process sensed audio signal S10 in the time domain and to produce source signal S20 and noise reference S30 as time-domain signals. Alternatively, SSP filter SS10 may be configured to receive sensed audio signal S10 in the frequency domain (or another transform domain), or to convert sensed audio signal S10 to such a domain, and to process sensed audio signal S10 in that domain.

Figure 8B:
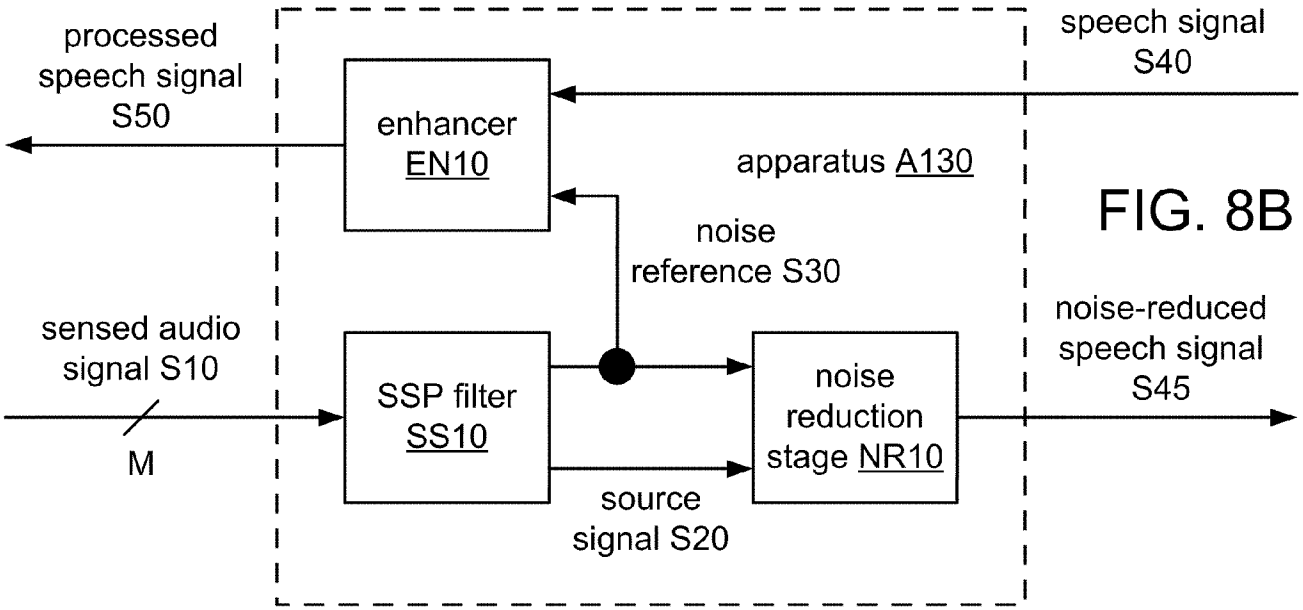
FIG. 8B shows a block diagram of an implementation A130 of apparatus A100.

It may be desirable to follow SSP filter SS10 or SS20 with a noise reduction stage that is configured to apply noise reference S30 to further reduce noise in source signal S20. FIG. 8B shows a block diagram of an implementation A130 of apparatus A100 that includes such a noise reduction stage NR10. Noise reduction stage NR10 may be implemented as a Wiener filter whose filter coefficient values are based on signal and noise power information from source signal S20 and noise reference S30. In such case, noise reduction stage NR10 may be configured to estimate the noise spectrum based on information from noise reference S30. Alternatively, noise reduction stage NR10 may be implemented to perform a spectral subtraction operation on source signal S20, based on a spectrum of noise reference S30. Alternatively, noise reduction stage NR10 may be implemented as a Kalman filter, with noise covariance being based on information from noise reference S30.

Figure 9A:
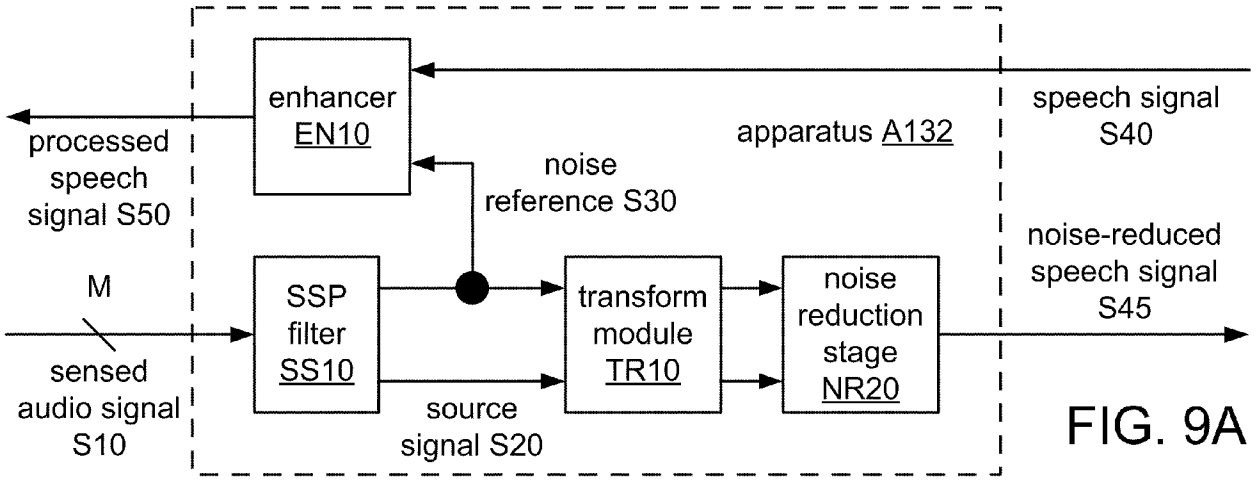
FIG. 9A shows a block diagram of an implementation A132 of apparatus A130.
Figure 9B:
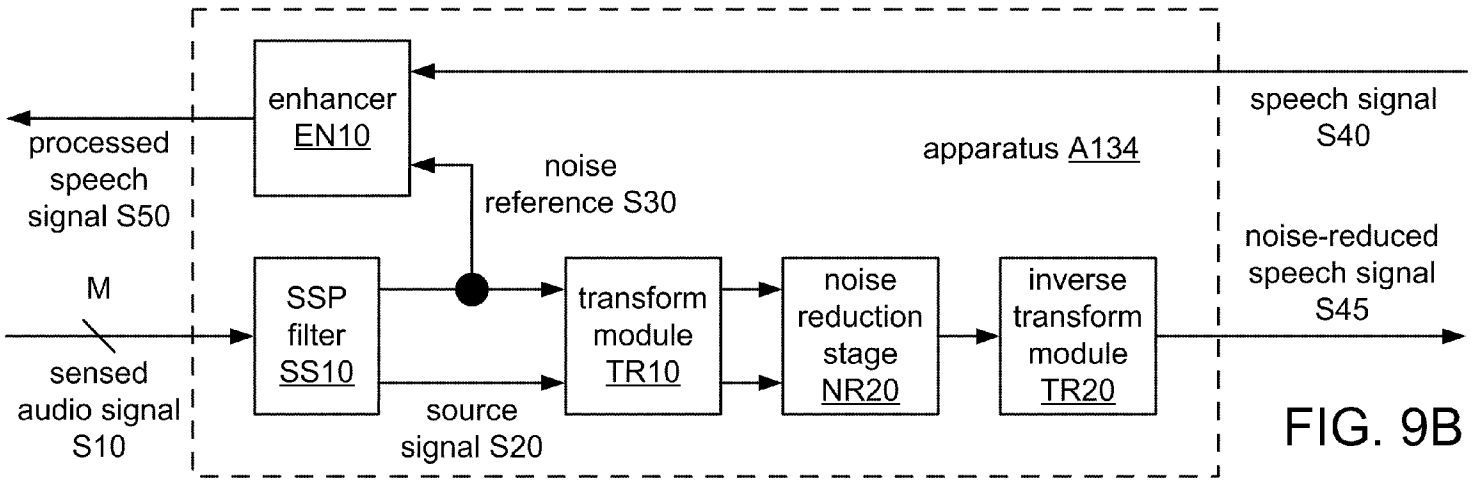
FIG. 9B shows a block diagram of an implementation A134 of apparatus A132.

Noise reduction stage NR10 may be configured to process source signal S20 and noise reference S30 in the frequency domain (or another transform domain). FIG. 9A shows a block diagram of an implementation A132 of apparatus A130 that includes such an implementation NR20 of noise reduction stage NR10. Apparatus A132 also includes a transform module TR10 that is configured to transform source signal S20 and noise reference S30 into the transform domain. In a typical example, transform module TR10 is configured to perform a fast Fourier transform (FFT), such as a 128-point, 256-point, or 512-point FFT, on each of source signal S20 and noise reference S30 to produce the respective frequency-domain signals. FIG. 9B shows a block diagram of an implementation A134 of apparatus A132 that also includes an inverse transform module TR20 arranged to transform the output of noise reduction stage NR20 to the time domain (e.g., by performing an inverse FFT on the output of noise reduction stage NR20).

Noise reduction stage NR20 may be configured to calculate noise-reduced speech signal S45 by weighting frequency-domain bins of source signal S20 according to the values of corresponding bins of noise reference S30. In such case, noise reduction stage NR20 may be configured to produce noise-reduced speech signal S45 according to an expression such as $B_i=w_iA_i$, where $B_i$ indicates the i-th bin of noise-reduced speech signal S45, $A_i$ indicates the i-th bin of source signal S20, and $w_i$ indicates the i-th element of a weight vector for the frame. Each bin may include only one value of the corresponding frequency-domain signal, or noise reduction stage NR20 may be configured to group the values of each frequency-domain signal into bins according to a desired subband division scheme (e.g., as described below with reference to binning module SG30).

Such an implementation of noise reduction stage NR20 may be configured to calculate the weights $w_i$ such that the weights are higher (e.g., closer to one) for bins in which noise reference S30 has a low value and lower (e.g., closer to zero) for bins in which noise reference S30 has a high value. One such example of noise reduction stage NR20 is configured to block or pass bins of source signal S20 by calculating each of the weights $w_i$ according to an expression such as $w_i=1$ when the sum (alternatively, the average) of the values in bin $N_i$ is less than (alternatively, not greater than) a threshold value $T_i$, and $w_i=0$ otherwise. In this example, $N_i$ indicates the i-th bin of noise reference S30. It may be desirable to configure such an implementation of noise reduction stage NR20 such that the threshold values $T_i$ are equal to one another or, alternatively, such that at least two of the threshold values $T_i$ are different from one another. In another example, noise reduction stage NR20 is configured to calculate noise-reduced speech signal S45 by subtracting noise reference S30 from source signal S20 in the frequency domain (i.e., by subtracting the spectrum of noise reference S30 from the spectrum of source signal S20).

Figure 10A:
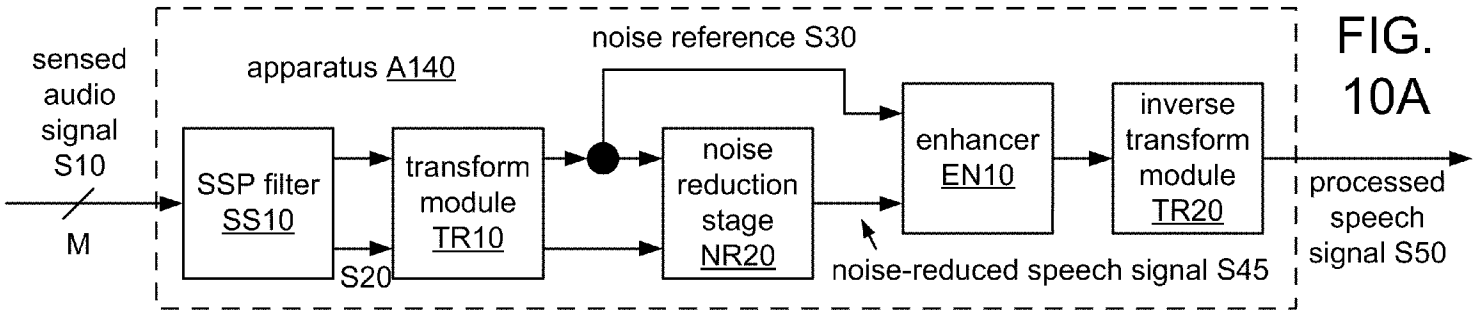
FIG. 10A shows a block diagram of an implementation A140 of apparatus A130 (and of apparatus A110).

As described in more detail below, enhancer EN10 may be configured to perform operations on one or more signals in the frequency domain or another transform domain. FIG. 10A shows a block diagram of an implementation A140 of apparatus A100 that includes an instance of noise reduction stage NR20. In this example, enhancer EN10 is arranged to receive noise-reduced speech signal S45 as speech signal S40, and enhancer EN10 is also arranged to receive noise reference S30 and noise-reduced speech signal S45 as transform-domain signals. Apparatus A140 also includes an instance of inverse transform module TR20 that is arranged to transform processed speech signal S50 from the transform domain to the time domain.

It is expressly noted that for a case in which speech signal S40 has a high sampling rate (e.g., 44.1 kHz, or another sampling rate above ten kilohertz), it may be desirable for enhancer EN10 to produce a corresponding processed speech signal S50 by processing signal S40 in the time domain. For example, it may be desirable to avoid the computational expense of performing a transform operation on such a signal. A signal that is reproduced from a media file or filestream may have such a sampling rate.

Figure 10B:
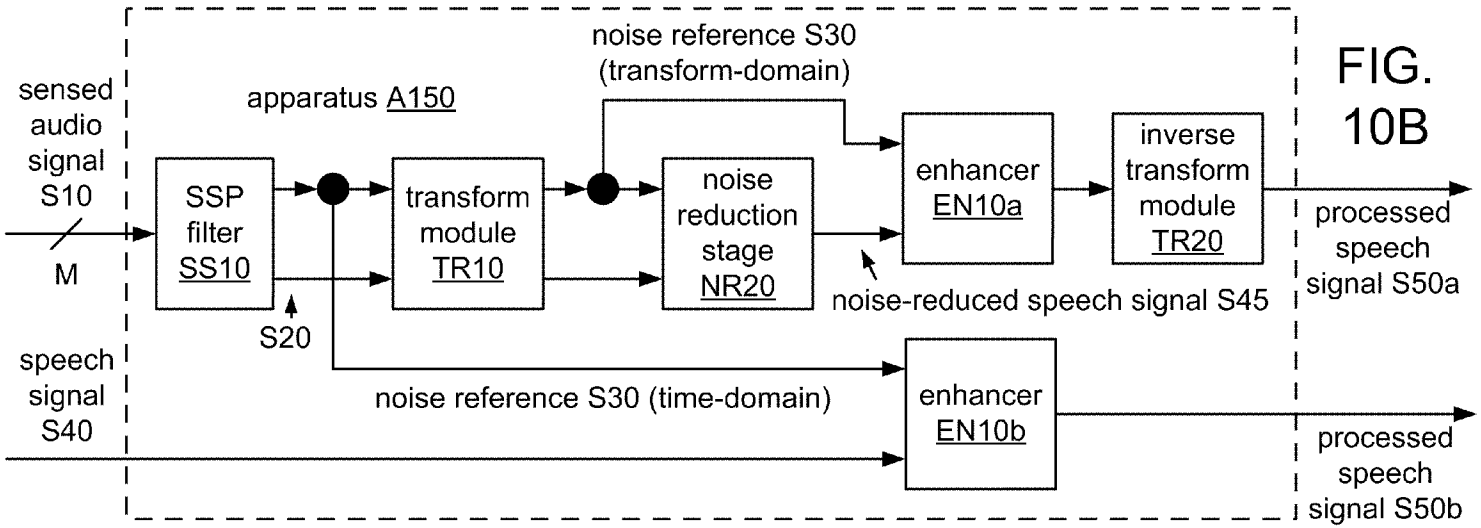
FIG. 10B shows a block diagram of an implementation A150 of apparatus A140 (and of apparatus A120).

FIG. 10B shows a block diagram of an implementation A150 of apparatus A140. Apparatus A150 includes an instance EN10*a* of enhancer EN10 that is configured to process noise reference S30 and noise-reduced speech signal S45 in a transform domain (e.g., as described with reference to apparatus A140 above) to produce a first processed speech signal S50*a*. Apparatus A150 also includes an instance EN10*b* of enhancer EN10 that is configured to process noise reference S30 and speech signal S40 (e.g., a far-end or other reproduced signal) in the time domain to produce a second processed speech signal S50*b*.

Figure 11A:
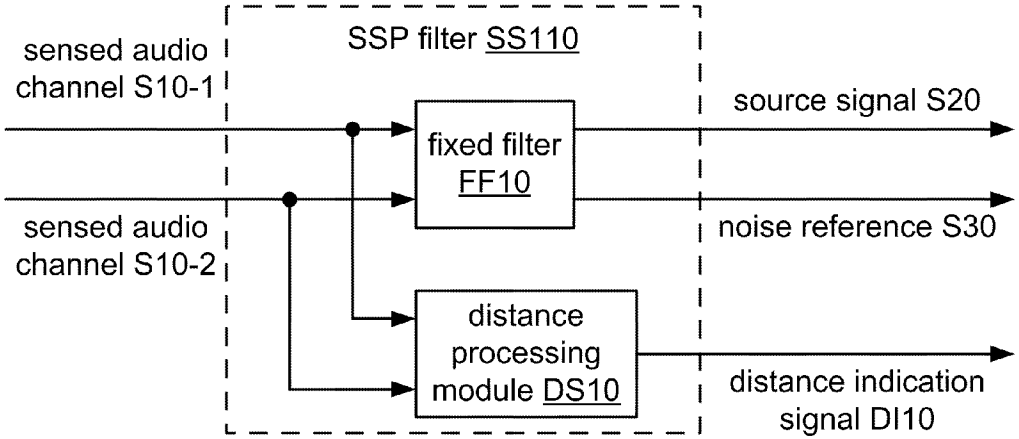
FIG. 11A shows a block diagram of an implementation SS110 of SSP filter SS10.
Figure 11B:
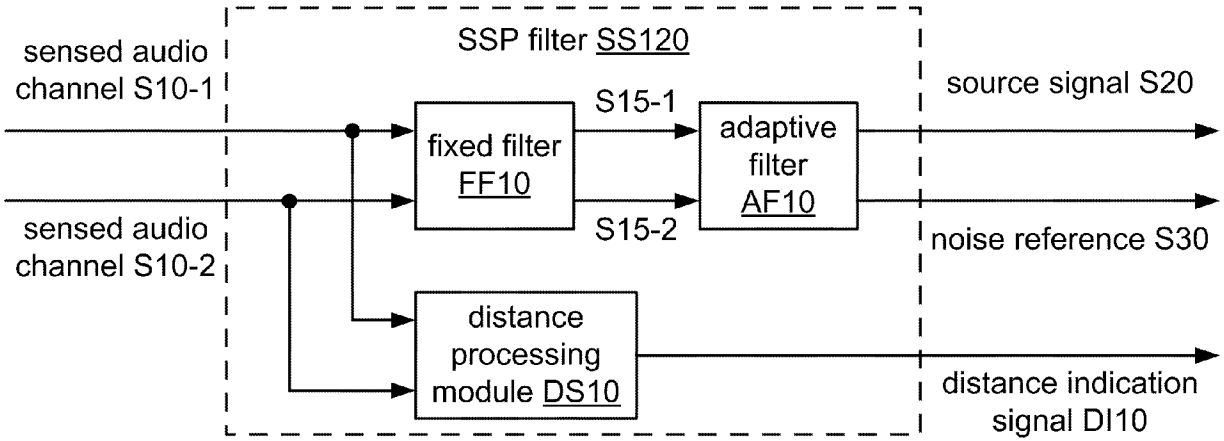
FIG. 11B shows a block diagram of an implementation SS120 of SSP filter SS20 and SS110.

In the alternative to being configured to perform a directional processing operation, or in addition to being configured to perform a directional processing operation, SSP filter SS10 may be configured to perform a distance processing operation. FIGS. 11A and 11B show block diagrams of implementations SS110 and SS120 of SSP filter SS10, respectively, that include a distance processing module DS10 configured to perform such an operation. Distance processing module DS10 is configured to produce, as a result of the distance processing operation, a distance indication signal DI10 that indicates the distance of the source of a component of multichannel sensed audio signal S10 relative to the microphone array. Distance processing module DS10 is typically configured to produce distance indication signal DI10 as a binary-valued indication signal whose two states indicate a near-field source and a far-field source, respectively, but configurations that produce a continuous and/or multi-valued signal are also possible.

In one example, distance processing module DS10 is configured such that the state of distance indication signal DI10 is based on a degree of similarity between the power gradients of the microphone signals. Such an implementation of distance processing module DS10 may be configured to produce distance indication signal DI10 according to a relation between (A) a difference between the power gradients of the microphone signals and (B) a threshold value. One such relation may be expressed as $$\theta = \begin{cases} 0, & \nabla_p - \nabla_s > T_d \\ 1, & \text{otherwise,} \end{cases}$$

where θ denotes the current state of distance indication signal DI10, $\nabla_p$ denotes a current value of a power gradient of a primary channel of sensed audio signal S10 (e.g., a channel that corresponds to a microphone that usually receives sound from a desired source, such as the user's voice, most directly), $\nabla_s$ denotes a current value of a power gradient of a secondary channel of sensed audio signal S10 (e.g., a channel that corresponds to a microphone that usually receives sound from a desired source less directly than the microphone of the primary channel), and $T_d$ denotes a threshold value, which may be fixed or adaptive (e.g., based on a current level of one or more of the microphone signals). In this particular example, state 1 of distance indication signal DI10 indicates a far-field source and state 0 indicates a near-field source, although of course a converse implementation (i.e., such that state 1 indicates a near-field source and state 0 indicates a far-field source) may be used if desired.

It may be desirable to implement distance processing module DS10 to calculate the value of a power gradient as a difference between the energies of the corresponding channel of sensed audio signal S10 over successive frames. In one such example, distance processing module DS10 is configured to calculate the current values for each of the power gradients $\nabla_p$ and $\nabla_s$ as a difference between a sum of the squares of the values of the current frame of the channel and a sum of the squares of the values of the previous frame of the channel. In another such example, distance processing module DS10 is configured to calculate the current values for each of the power gradients $\nabla_p$ and $\nabla_s$ as a difference between a sum of the magnitudes of the values of the current frame of the corresponding channel and a sum of the magnitudes of the values of the previous frame of the channel.

Additionally or in the alternative, distance processing module DS10 may be configured such that the state of distance indication signal DI10 is based on a degree of correlation, over a range of frequencies, between the phase for a primary channel of sensed audio signal S10 and the phase for a secondary channel. Such an implementation of distance processing module DS10 may be configured to produce distance indication signal DI10 according to a relation between (A) a correlation between phase vectors of the channels and (B) a threshold value. One such relation may be expressed as $$\mu = \begin{cases} 0, & \text{corr}(\varphi_p, \varphi_s) > T_c \\ 1, & \text{otherwise,} \end{cases}$$

where μ denotes the current state of distance indication signal DI10, $\phi_p$ denotes a current phase vector for a primary channel of sensed audio signal S10, $\phi_s$ denotes a current phase vector for a secondary channel of sensed audio signal S10, and $T_c$ denotes a threshold value, which may be fixed or adaptive (e.g., based on a current level of one or more of the channels). It may be desirable to implement distance processing module DS10 to calculate the phase vectors such that each element of a phase vector represents a current phase angle of the corresponding channel at a corresponding frequency or over a corresponding frequency subband. In this particular example, state 1 of distance indication signal DI10 indicates a far-field source and state 0 indicates a near-field source, although of course a converse implementation may be used if desired. Distance indication signal DI10 may be applied as a control signal to noise reduction stage NR10, such that the noise reduction performed by noise reduction stage NR10 is maximized when distance indication signal DI10 indicates a far-field source.

It may be desirable to configure distance processing module DS10 such that the state of distance indication signal DI10 is based on both of the power gradient and phase correlation criteria as disclosed above. In such case, distance processing module DS10 may be configured to calculate the state of distance indication signal DI10 as a combination of the current values of θ and μ (e.g., logical OR or logical AND).

Alternatively, distance processing module DS10 may be configured to calculate the state of distance indication signal DI10 according to one of these criteria (i.e., power gradient similarity or phase correlation), such that the value of the corresponding threshold is based on the current value of the other criterion.

An alternate implementation of SSP filter SS10 is configured to perform a phase correlation masking operation on sensed audio signal S10 to produce source signal S20 and noise reference S30. One example of such an implementation of SSP filter SS10 is configured to determine the relative phase angles between different channels of sensed audio signal S10 at different frequencies. If the phase angles at most of the frequencies are substantially equal (e.g., within five, ten, or twenty percent), then the filter passes those frequencies as source signal S20 and separates components at other frequencies (i.e., components having other phase angles) into noise reference S30.

Enhancer EN10 may be arranged to receive noise reference S30 from a time-domain buffer. Alternatively or additionally, enhancer EN10 may be arranged to receive first speech signal S40 from a time-domain buffer. In one example, each time-domain buffer has a length of ten milliseconds (e.g., eighty samples at a sampling rate of eight kHz, or 160 samples at a sampling rate of sixteen kHz).

Enhancer EN10 is configured to perform a spectral contrast enhancement operation on speech signal S40 to produce a processed speech signal S50. Spectral contrast may be defined as a difference (e.g., in decibels) between adjacent peaks and valleys in the signal spectrum, and enhancer EN10 may be configured to produce processed speech signal S50 by increasing a difference between peaks and valleys in the energy spectrum or magnitude spectrum of speech signal S40. Spectral peaks of a speech signal are also called "formants." The spectral contrast enhancement operation includes calculating a plurality of noise subband power estimates based on information from noise reference S30, generating an enhancement vector EV10 based on information from the speech signal, and producing processed speech signal S50 based on the plurality of noise subband power estimates, information from speech signal S40, and information from enhancement vector EV10.

In one example, enhancer EN10 is configured to generate a contrast-enhanced signal SC10 based on speech signal S40 (e.g., according to any of the techniques described herein), to calculate a power estimate for each frame of noise reference S30, and to produce processed speech signal S50 by mixing corresponding frames of speech signal S30 and contrast-enhanced signal SC10 according to the corresponding noise power estimate. For example, such an implementation of enhancer EN10 may be configured to produce a frame of processed speech signal S50 using proportionately more of a corresponding frame of contrast-enhanced signal SC10 when the corresponding noise power estimate is high, and using proportionately more of a corresponding frame of speech signal S40 when the corresponding noise power estimate is low. Such an implementation of enhancer EN10 may be configured to produce a frame PSS(n) of processed speech signal S50 according to an expression such as $PSS(n)=\rho CES(n)+(1-p)SS(n)$, where CES(n) and SS(n) indicate corresponding frames of contrast-enhanced signal SC10 and speech signal S40, respectively, and ρ indicates a noise level indication which has a value in the range of from zero to one that is based on the corresponding noise power estimate.

Figure 12:
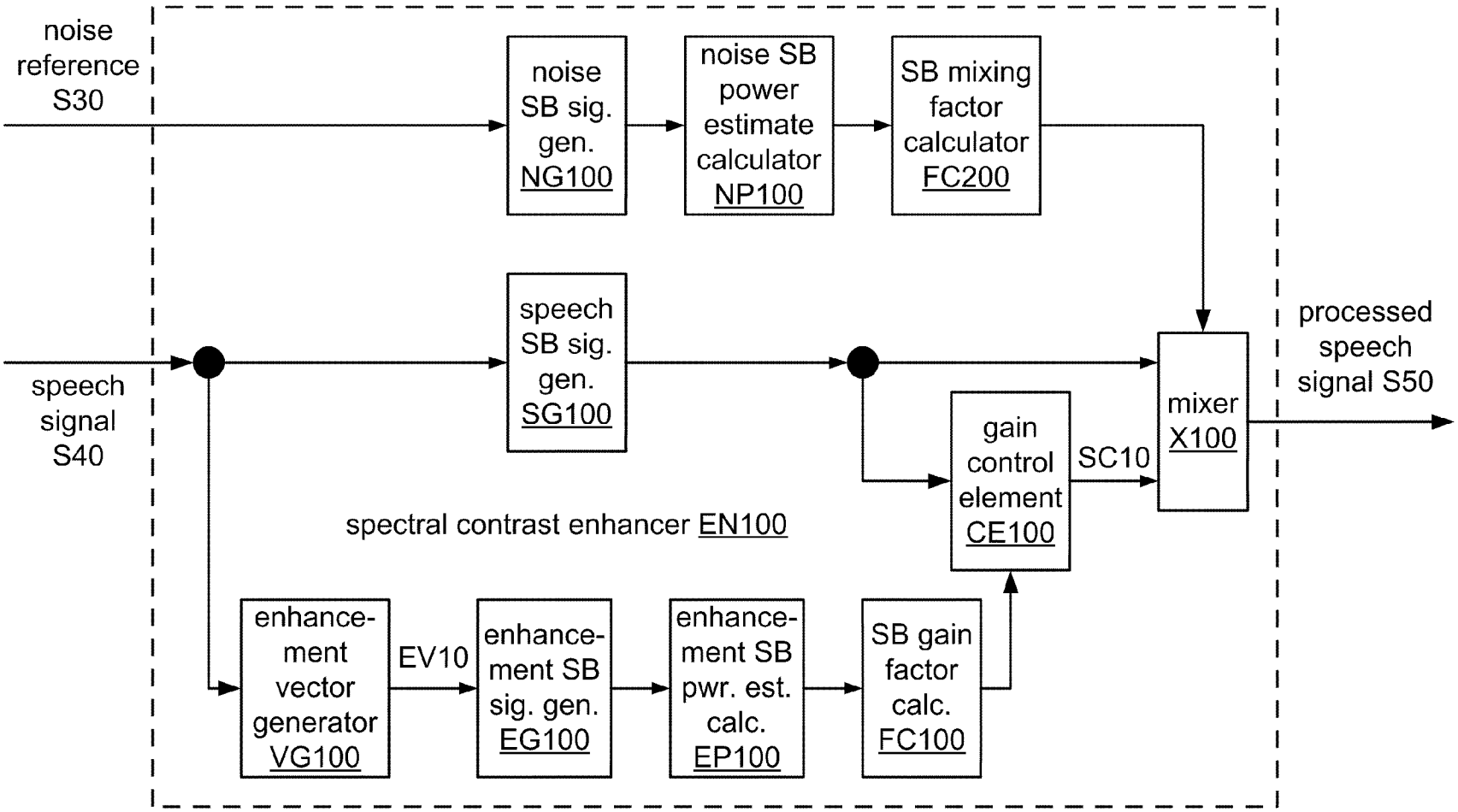
FIG. 12 shows a block diagram of an implementation EN100 of enhancer EN10.

FIG. 12 shows a block diagram of an implementation EN100 of spectral contrast enhancer EN10. Enhancer EN100 is configured to produce a processed speech signal S50 that is based on contrast-enhanced speech signal SC10. Enhancer EN100 is also configured to produce processed speech signal S50 such that each of a plurality of frequency subbands of processed speech signal S50 is based on a corresponding frequency subband of speech signal S40.

Enhancer EN100 includes an enhancement vector generator VG100 configured to generate an enhancement vector EV10 that is based on speech signal S40; an enhancement subband signal generator EG100 that is configured to produce a set of enhancement subband signals based on information from enhancement vector EV10; and an enhancement subband power estimate generator EP100 that is configured to produce a set of enhancement subband power estimates, each based on information from a corresponding one of the enhancement subband signals. Enhancer EN100 also includes a subband gain factor calculator FC100 that is configured to calculate a plurality of gain factor values such that each of the plurality of gain factor values is based on information from a corresponding frequency subband of enhancement vector EV10, a speech subband signal generator SG100 that is configured to produce a set of speech subband signals based on information from speech signal S40, and a gain control element CE100 that is configured to produce contrast-enhanced signal SC10 based on the speech subband signals and information from enhancement vector EV10 (e.g., the plurality of gain factor values).

Enhancer EN100 includes a noise subband signal generator NG100 configured to produce a set of noise subband signals based on information from noise reference S30; and a noise subband power estimate calculator NP100 that is configured to produce a set of noise subband power estimates, each based on information from a corresponding one of the noise subband signals. Enhancer EN100 also includes a subband mixing factor calculator FC200 that is configured to calculate a mixing factor for each of the subbands, based on information from a corresponding noise subband power estimate, and a mixer X100 that is configured to produce processed speech signal S50 based on information from the mixing factors, speech signal S40, and contrast-enhanced signal SC10.

It is explicitly noted that in applying enhancer EN100 (and any of the other implementations of enhancer EN10 as disclosed herein), it may be desirable to obtain noise reference S30 from microphone signals that have undergone an echo cancellation operation (e.g., as described below with reference to audio preprocessor AP20 and echo canceller EC10). Such an operation may be especially desirable for a case in which speech signal S40 is a reproduced audio signal. If acoustic echo remains in noise reference S30 (or in any of the other noise references that may be used by further implementations of enhancer EN10 as disclosed below), then a positive feedback loop may be created between processed speech signal S50 and the subband gain factor computation path. For example, such a loop may have the effect that the louder that processed speech signal S50 drives a far-end loudspeaker, the more that the enhancer will tend to increase the gain factors.

In one example, enhancement vector generator VG100 is configured to generate enhancement vector EV10 by raising the magnitude spectrum or the power spectrum of speech signal S40 to a power M that is greater than one (e.g., a value in the range of from 1.2 to 2.5, such as 1.2, 1.5, 1.7, 1.9, or two). Enhancement vector generator VG100 may be configured to perform such an operation on logarithmic spectral values according to an expression such as $y_i=Mx_i$, where $x_i$ denotes the values of the spectrum of speech signal S40 in decibels, and $y_i$ denotes the corresponding values of enhancement vector EV10 in decibels. Enhancement vector generator VG100 may also be configured to normalize the result of the power-raising operation and/or to produce enhancement vector EV10 as a ratio between a result of the power-raising operation and the original magnitude or power spectrum.

In another example, enhancement vector generator VG100 is configured to generate enhancement vector EV10 by smoothing a second-order derivative of the spectrum of speech signal S40. Such an implementation of enhancement vector generator VG100 may be configured to calculate the second derivative in discrete terms as a second difference according to an expression such as $D2(x_i)=x_{i-1}+x_{i+1}-2x_i$, where the spectral values $x_i$ may be linear or logarithmic (e.g., in decibels). The value of second difference $D2(x_i)$ is less than zero at spectral peaks and greater than zero at spectral valleys, and it may be desirable to configure enhancement vector generator VG100 to calculate the second difference as the negative of this value (or to negate the smoothed second difference) to obtain a result that is greater than zero at spectral peaks and less than zero at spectral valleys.

Figure 13:
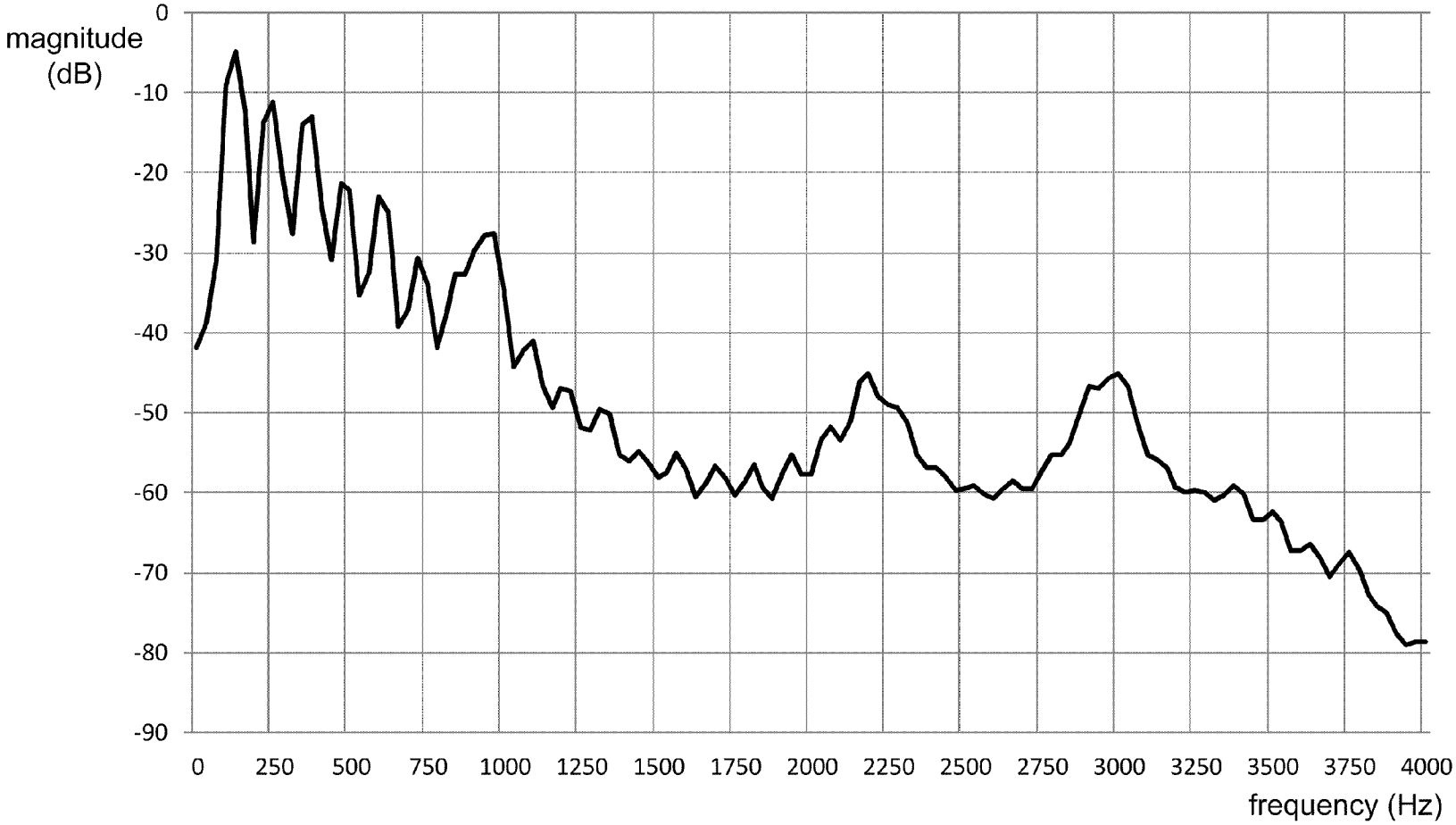
FIG. 13 shows a magnitude spectrum of a frame of a speech signal.
Figure 14:
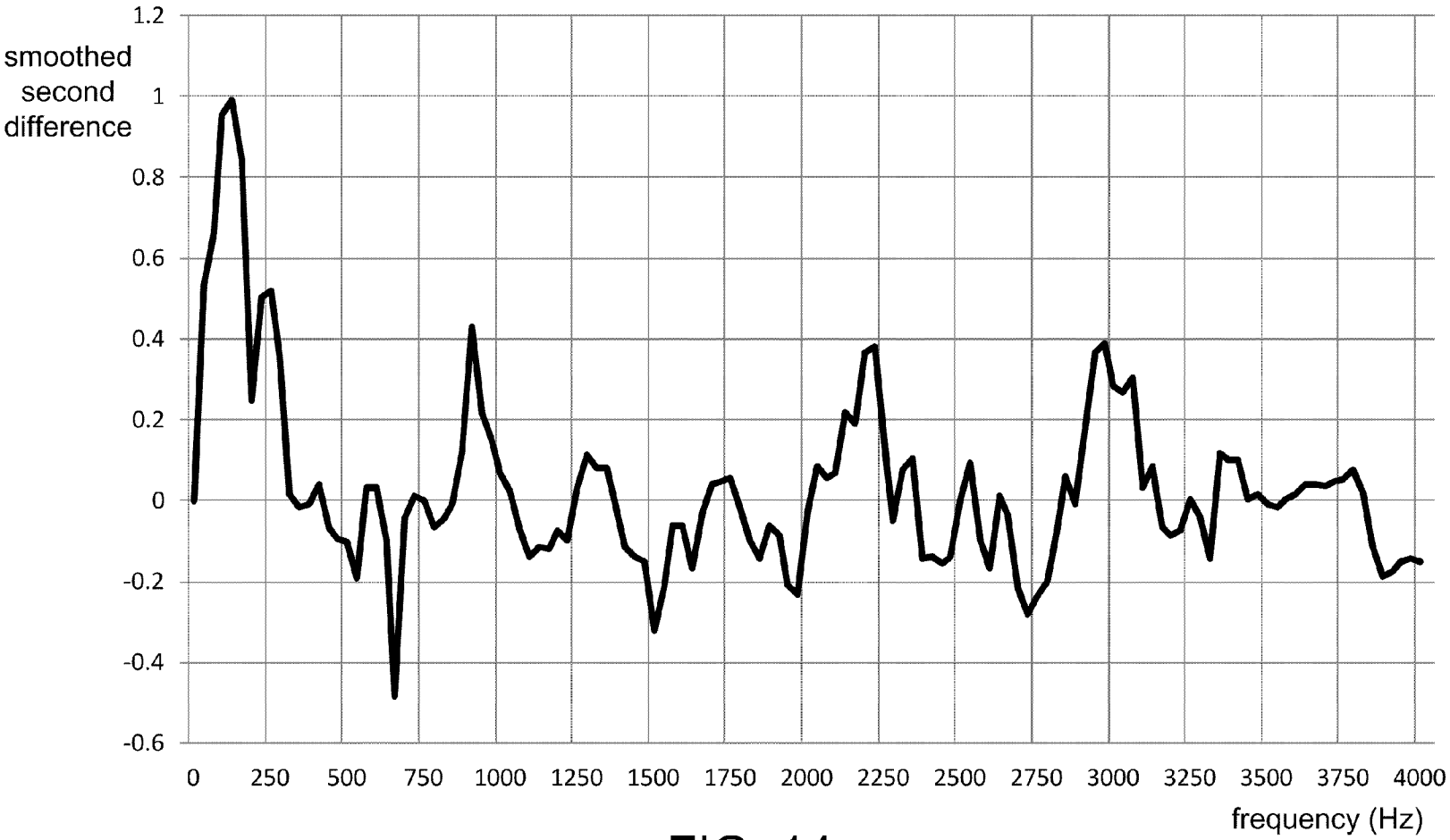
FIG. 14 shows a frame of an enhancement vector EV10 that corresponds to the spectrum of FIG. 13.
Figure 15:
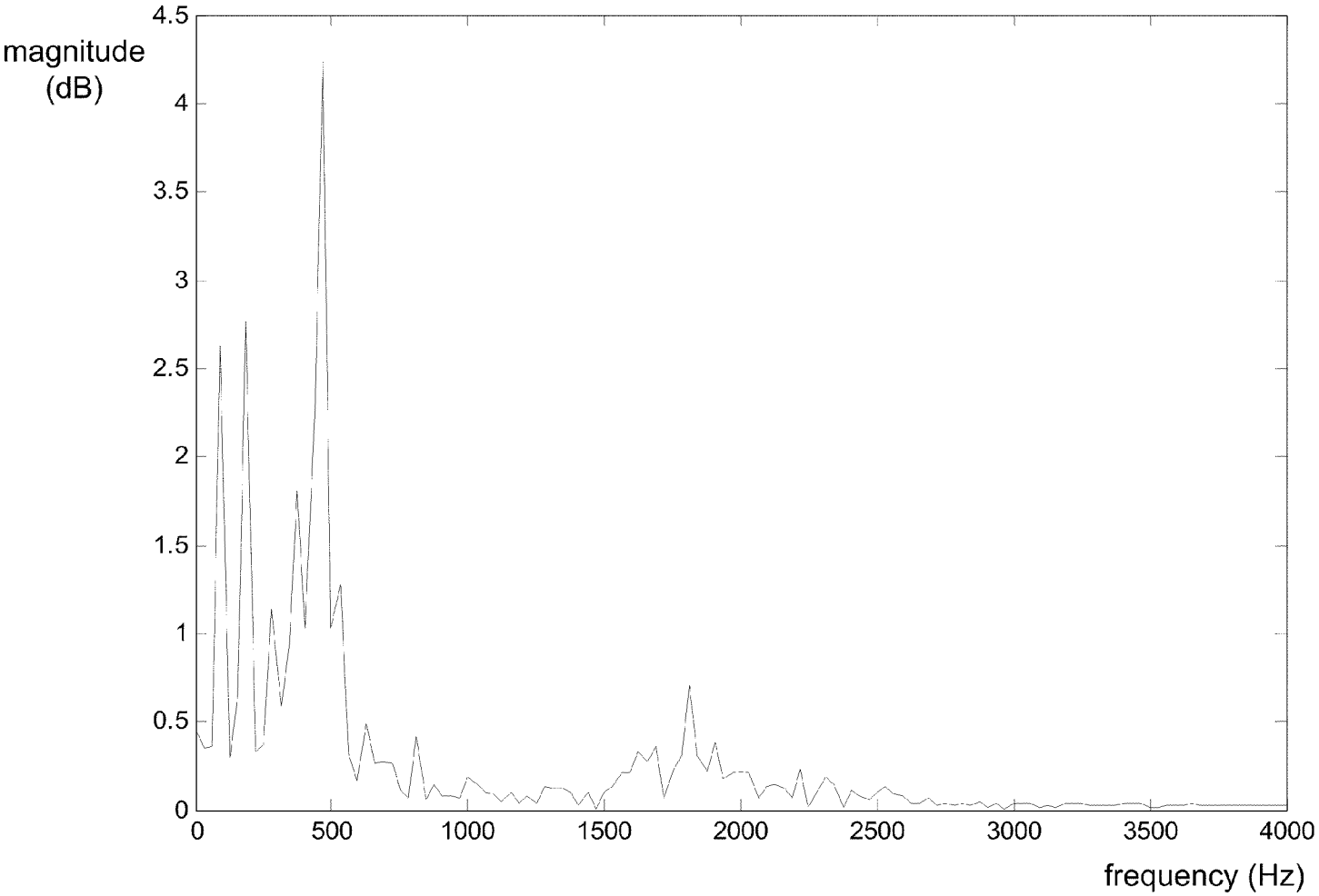
FIGS. 15-18 show examples of a magnitude spectrum of a speech signal, a smoothed version of the magnitude spectrum, a doubly smoothed version of the magnitude spectrum, and a ratio of the smoothed spectrum to the doubly smoothed spectrum, respectively.
Figure 16:
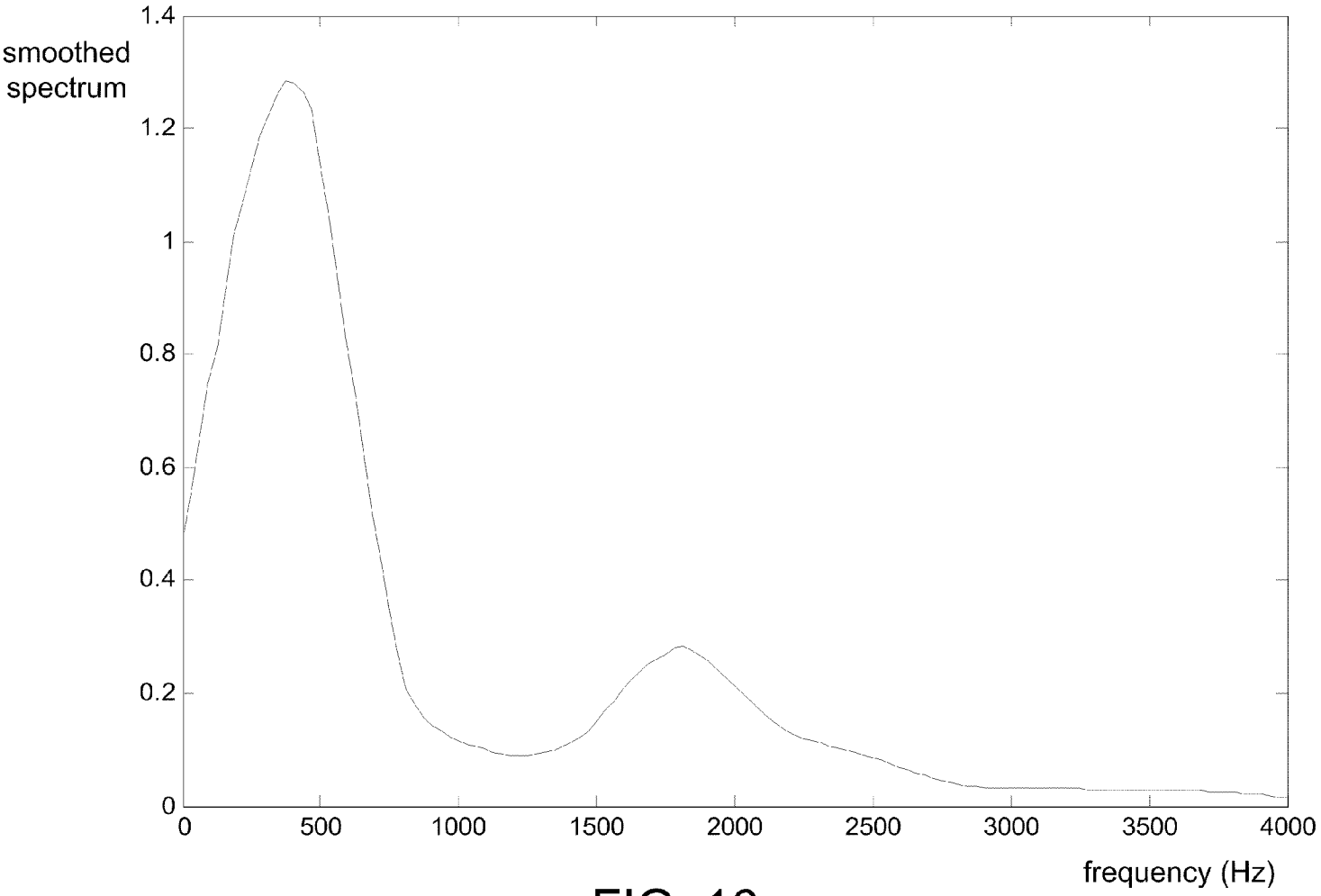
Figure 17:
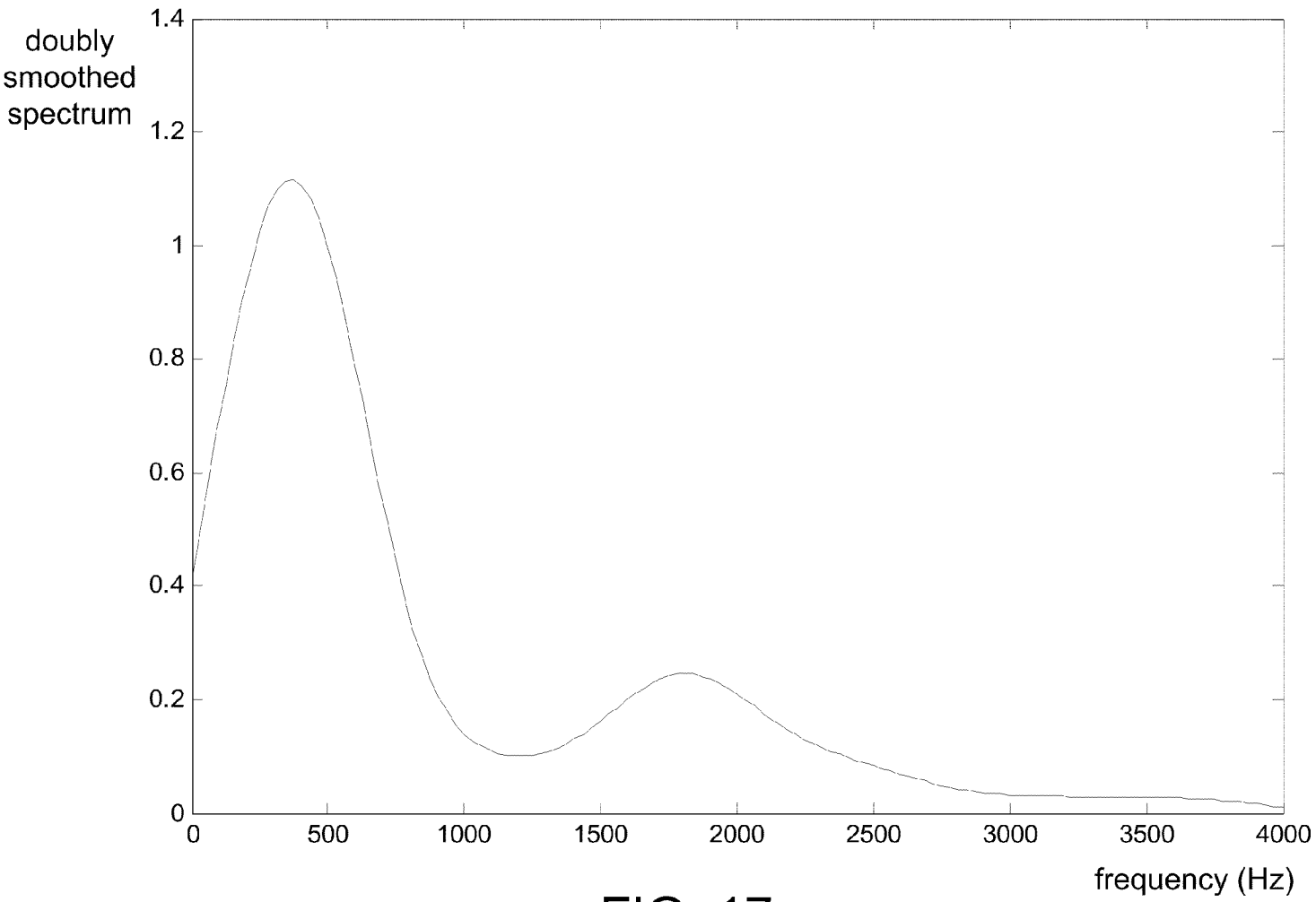
Figure 18:
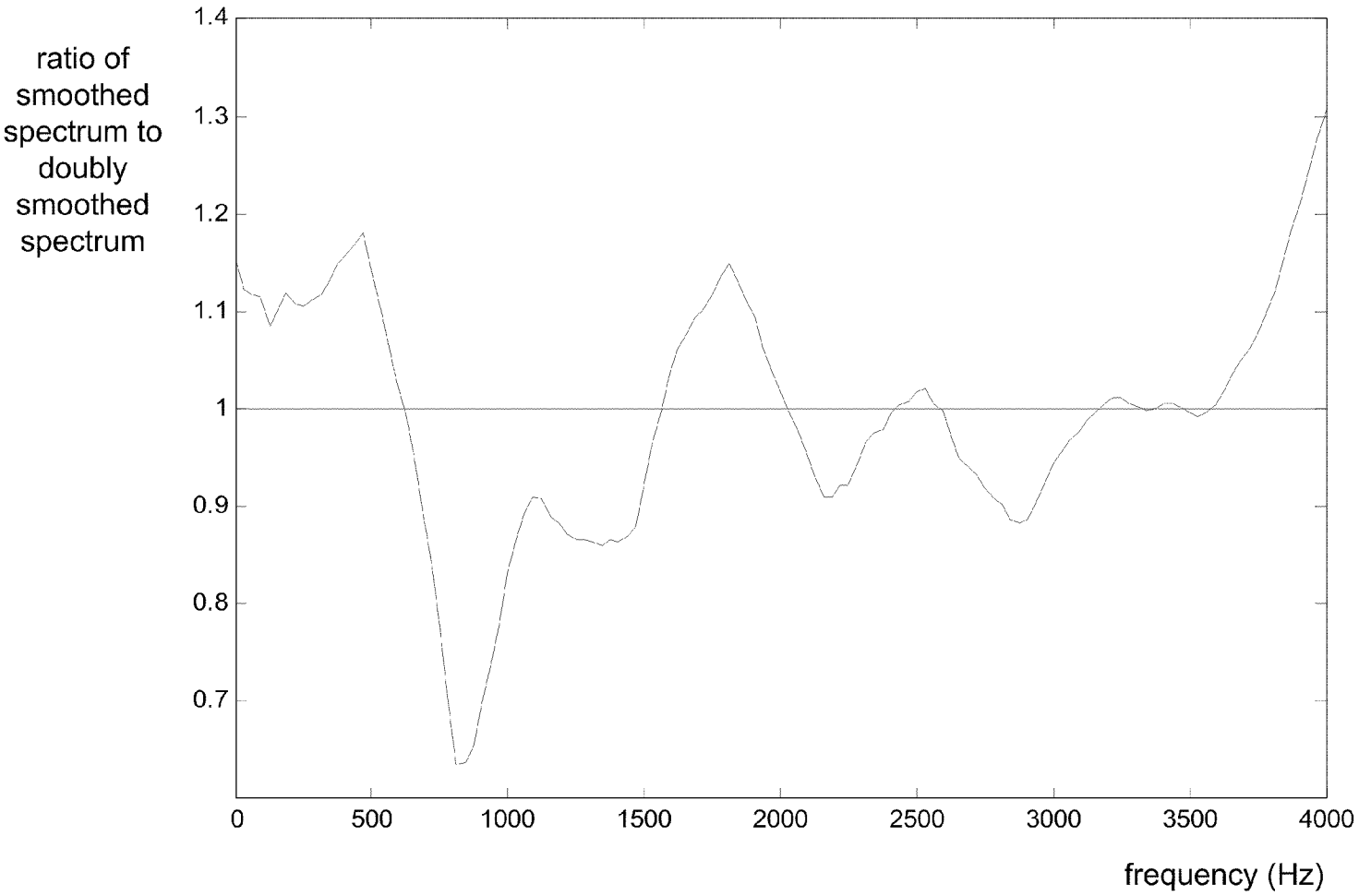

Enhancement vector generator VG100 may be configured to smooth the spectral second difference by applying a smoothing filter, such as a weighted averaging filter (e.g., a triangular filter). The length of the smoothing filter may be based on an estimated bandwidth of the spectral peaks. For example, it may be desirable for the smoothing filter to attenuate frequencies having periods less than twice the estimated peak bandwidth. Typical smoothing filter lengths include three, five, seven, nine, eleven, thirteen, and fifteen taps. Such an implementation of enhancement vector generator VG100 may be configured to perform the difference and smoothing calculations serially or as one operation. FIG. 13 shows an example of a magnitude spectrum of a frame of speech signal S40, and FIG. 14 shows an example of a corresponding frame of enhancement vector EV10 that is calculated as a second spectral difference smoothed by a fifteen-tap triangular filter.

In a similar example, enhancement vector generator VG100 is configured to generate enhancement vector EV10 by convolving the spectrum of speech signal S40 with a difference-of-Gaussians (DoG) filter, which may be implemented according to an expression such as $$y_i = \frac{1}{\sigma_1\sqrt{2\pi}}\exp\left(\frac{x_1-\mu^2}{2\sigma_1^2}\right) - \frac{1}{\sigma_2\sqrt{2\pi}}\exp\left(\frac{x_1-\mu^2}{2\sigma_2^2}\right),$$

where $\sigma_1$ and $\sigma_2$ denote the standard deviations of the respective Gaussian distributions and $\mu$ denotes the spectral mean. Another filter having a similar shape as the DoG filter, such as a "Mexican hat" wavelet filter, may also be used. In another example, enhancement vector generator VG100 is configured to generate enhancement vector EV10 as a second difference of the exponential of the smoothed spectrum of speech signal S40 in decibels.

In a further example, enhancement vector generator VG100 is configured to generate enhancement vector EV10 by calculating a ratio of smoothed spectra of speech signal S40. Such an implementation of enhancement vector generator VG100 may be configured to calculate a first smoothed signal by smoothing the spectrum of speech signal S40, to calculate a second smoothed signal by smoothing the first smoothed signal, and to calculate enhancement vector EV10 as a ratio between the first and second smoothed signals. FIGS. 15-18 show examples of a magnitude spectrum of speech signal S40, a smoothed version of the magnitude spectrum, a doubly smoothed version of the magnitude spectrum, and a ratio of the smoothed spectrum to the doubly smoothed spectrum, respectively.

Figure 19B:
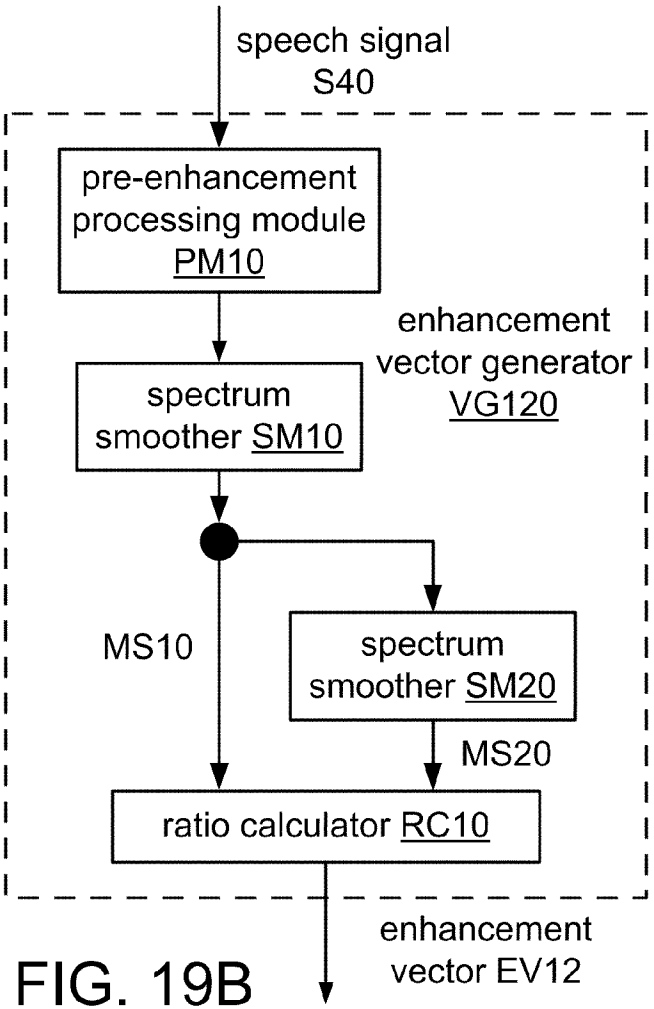
FIG. 19B shows a block diagram of an implementation VG120 of enhancement vector generator VG110.
Figure 19A:
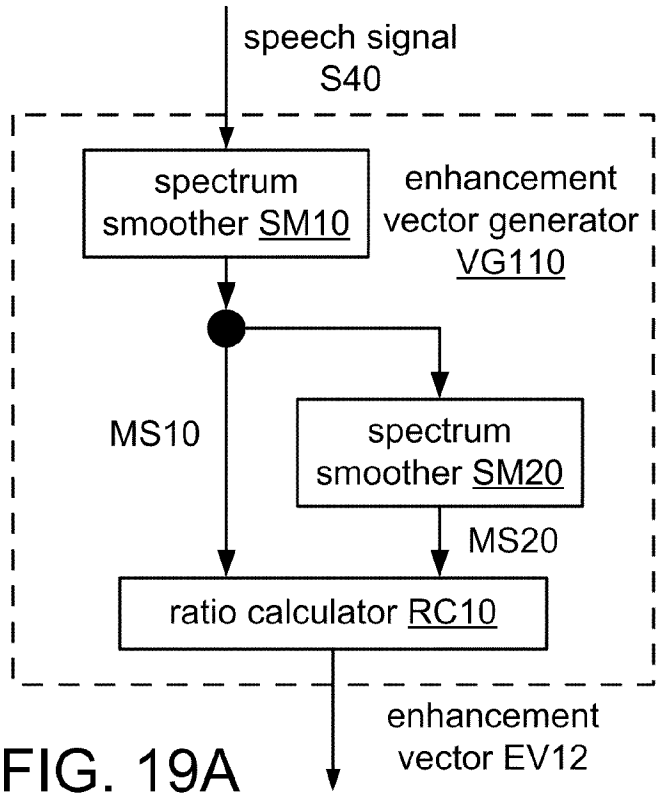
FIG. 19A shows a block diagram of an implementation VG110 of enhancement vector generator VG100.

FIG. 19A shows a block diagram of an implementation VG110 of enhancement vector generator VG100 that includes a first spectrum smoother SM10, a second spectrum smoother SM20, and a ratio calculator RC10. Spectrum smoother SM10 is configured to smooth the spectrum of speech signal S40 to produce a first smoothed signal MS10. Spectrum smoother SM10 may be implemented as a smoothing filter, such as a weighted averaging filter (e.g., a triangular filter). The length of the smoothing filter may be based on an estimated bandwidth of the spectral peaks. For example, it may be desirable for the smoothing filter to attenuate frequencies having periods less than twice the estimated peak bandwidth. Typical smoothing filter lengths include three, five, seven, nine, eleven, thirteen, and fifteen taps.

Spectrum smoother SM20 is configured to smooth first smoothed signal MS10 to produce a second smoothed signal MS20. Spectrum smoother SM20 is typically configured to perform the same smoothing operation as spectrum smoother SM10. However, it is also possible to implement spectrum smoothers SM10 and SM20 to perform different smoothing operations (e.g., to use different filter shapes and/or lengths). Spectrum smoothers SM10 and SM20 may be implemented as different structures (e.g., different circuits or software modules) or as the same structure at different times (e.g., a calculating circuit or processor configured to perform a sequence of different tasks over time). Ratio calculator RC10 is configured to calculate a ratio between signals MS10 and MS20 (i.e., a series of ratios between corresponding values of signals MS10 and MS20) to produce an instance EV12 of enhancement vector EV10. In one example, ratio calculator RC10 is configured to calculate each ratio value as a difference of two logarithmic values.

Figure 20:
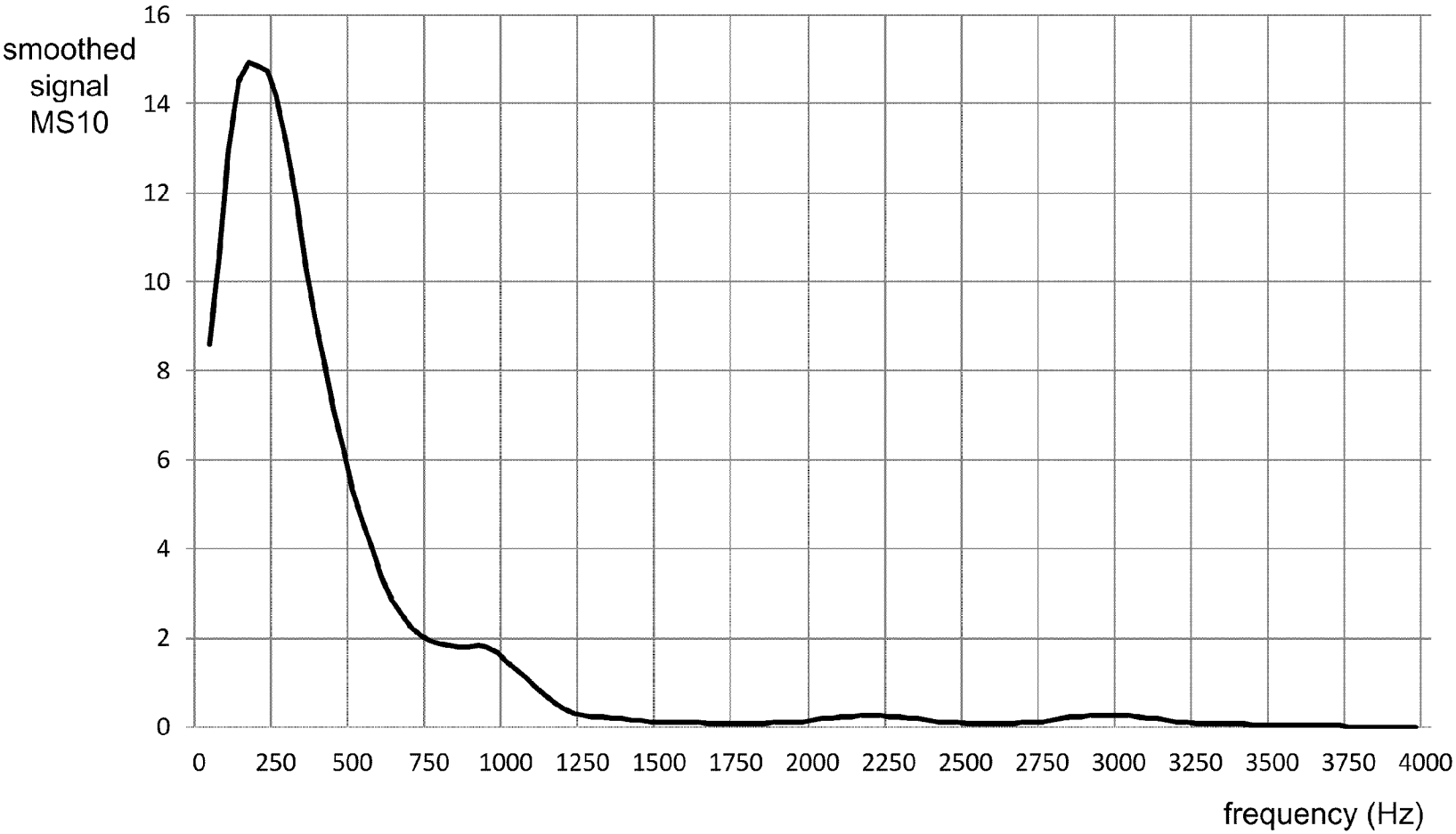
FIG. 20 shows an example of a smoothed signal produced from the magnitude spectrum of FIG. 13.
Figure 21:
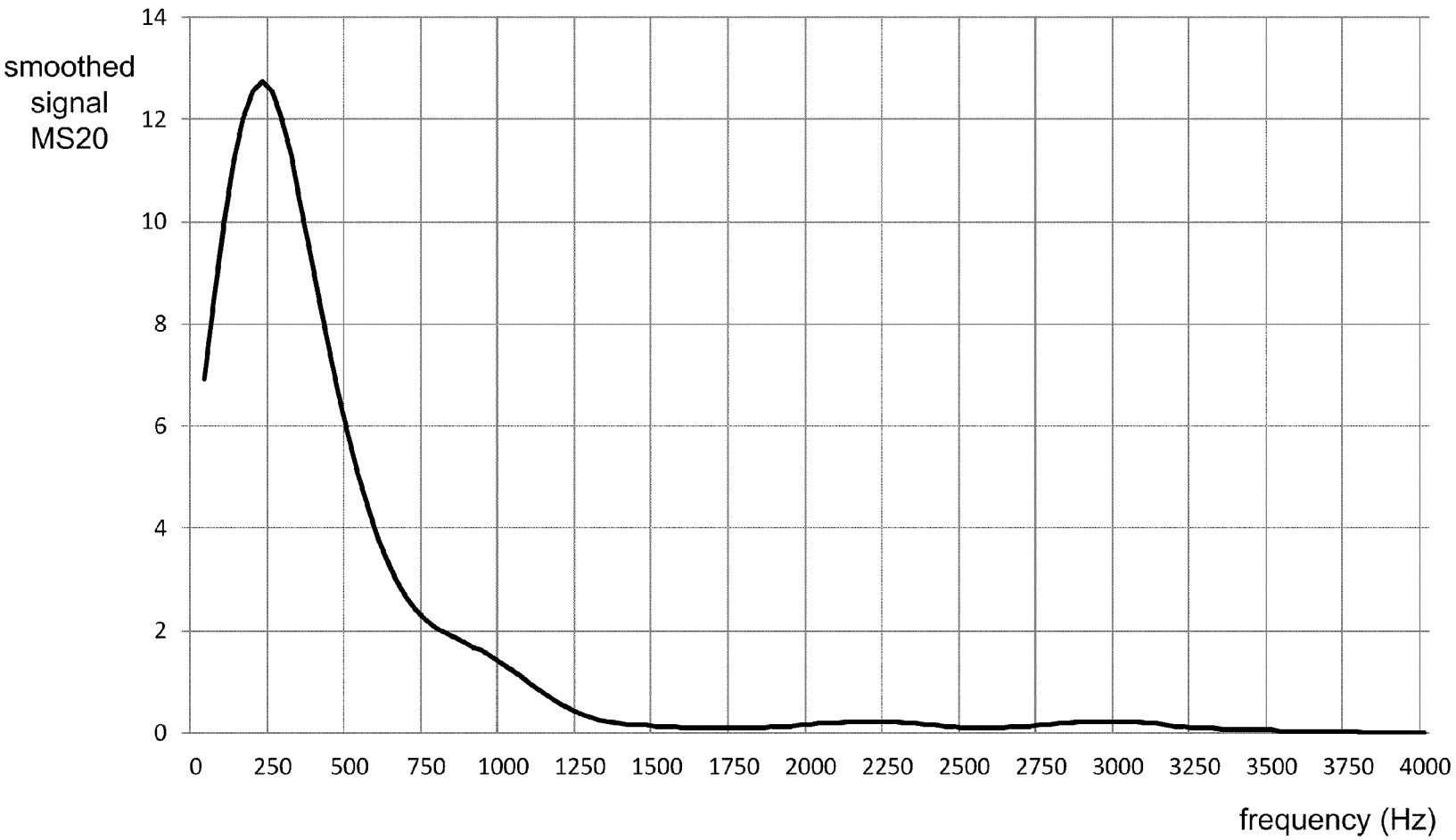
FIG. 21 shows an example of a smoothed signal produced from the smoothed signal of FIG. 20.
Figure 22:
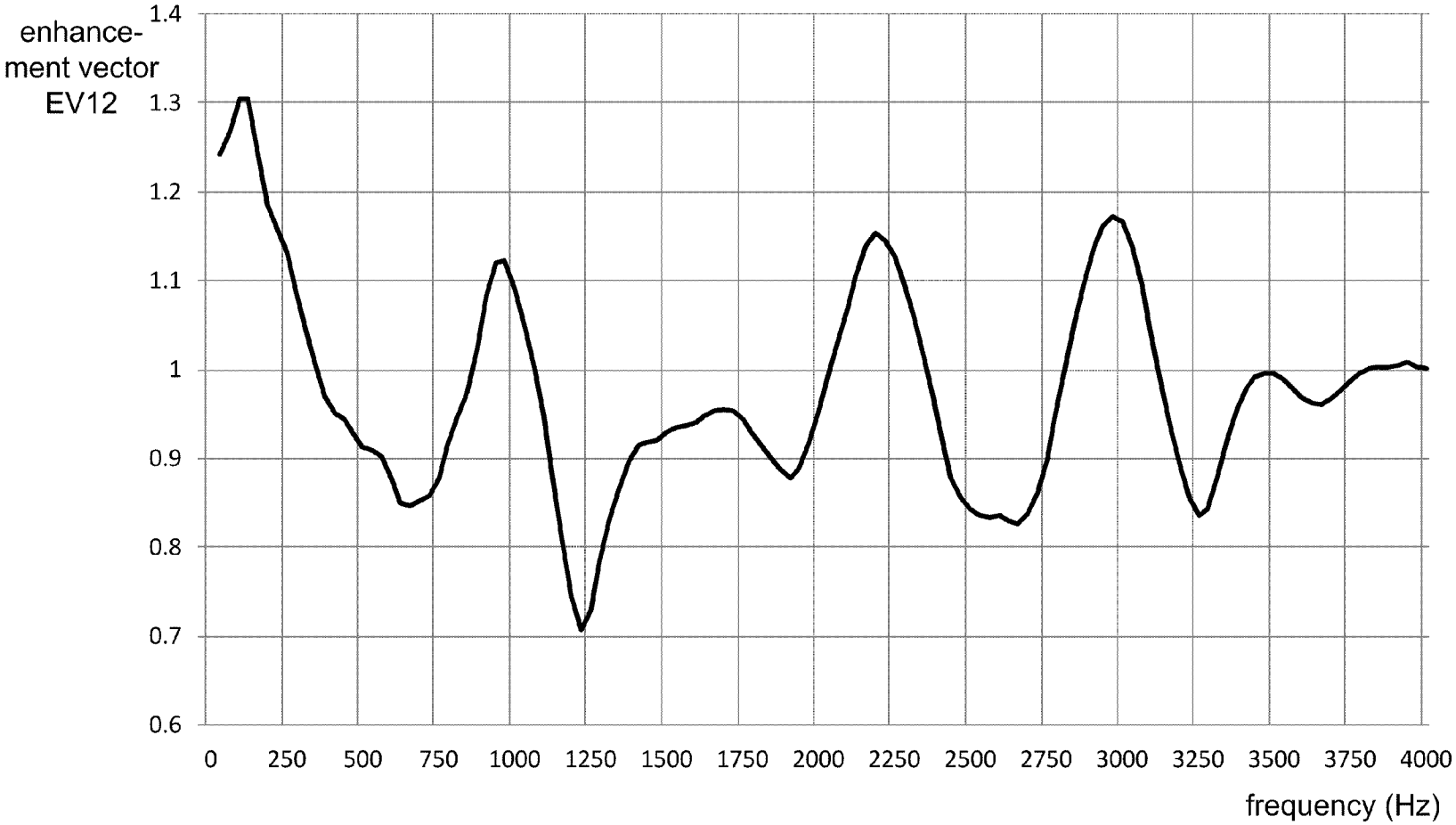
FIG. 22 shows an example of an enhancement vector for a frame of speech signal S40.

FIG. 20 shows an example of smoothed signal MS10 as produced from the magnitude spectrum of FIG. 13 by a fifteen-tap triangular filter implementation of spectrum smoother MS10. FIG. 21 shows an example of smoothed signal MS20 as produced from smoothed signal MS10 of FIG. 20 by a fifteen-tap triangular filter implementation of spectrum smoother MS20, and FIG. 22 shows an example of a frame of enhancement vector EV12 that is a ratio of smoothed signal MS10 of FIG. 20 to smoothed signal MS20 of FIG. 21.

As described above, enhancement vector generator VG100 may be configured to process speech signal S40 as a spectral signal (i.e., in the frequency domain). For an implementation of apparatus A100 in which a frequency-domain instance of speech signal S40 is not otherwise available, such an implementation of enhancement vector generator VG100 may include an instance of transform module TR10 that is arranged to perform a transform operation (e.g., an FFT) on a time-domain instance of speech signal S40. In such a case, enhancement subband signal generator EG100 may be configured to process enhancement vector EV10 in the frequency domain, or enhancement vector generator VG100 may also include an instance of inverse transform module TR20 that is arranged to perform an inverse transform operation (e.g., an inverse FFT) on enhancement vector EV10.

Linear prediction analysis may be used to calculate parameters of an all-pole filter that models the resonances of the speaker's vocal tract during a frame of a speech signal. A further example of enhancement vector generator VG100 is configured to generate enhancement vector EV10 based on the results of a linear prediction analysis of speech signal S40. Such an implementation of enhancement vector generator VG100 may be configured to track one or more (e.g., two, three, four, or five) formants of each voiced frame of speech signal S40 based on poles of the corresponding all-pole filter (e.g., as determined from a set of linear prediction coding (LPC) coefficients, such as filter coefficients or reflection coefficients, for the frame). Such an implementation of enhancement vector generator VG100 may be configured to produce enhancement vector EV10 by applying bandpass filters to speech signal S40 at the center frequencies of the formants or by otherwise boosting the subbands of speech signal S40 (e.g., as defined using a uniform or nonuniform subband division scheme as discussed herein) that contain the center frequencies of the formants.

Figure 23B:
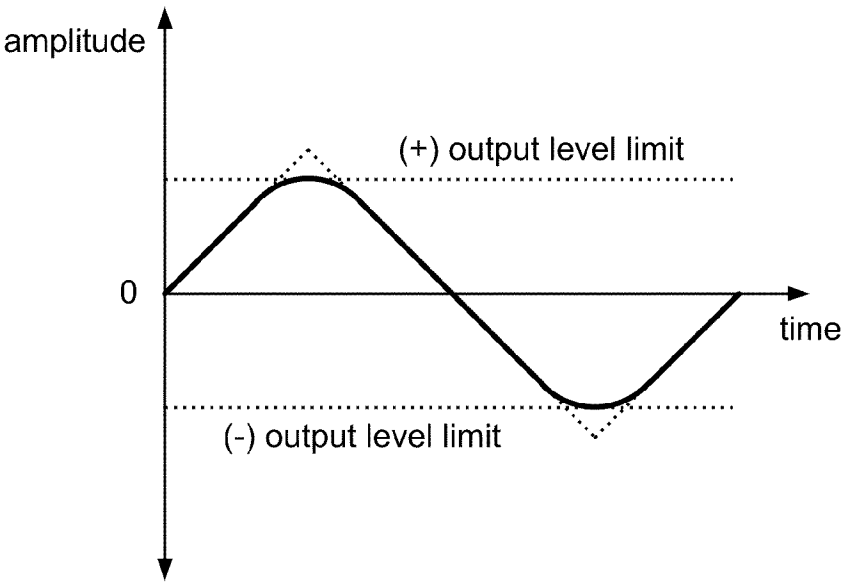
FIG. 23B shows an application of a dynamic range compression operation to a triangular waveform.
Figure 23A:
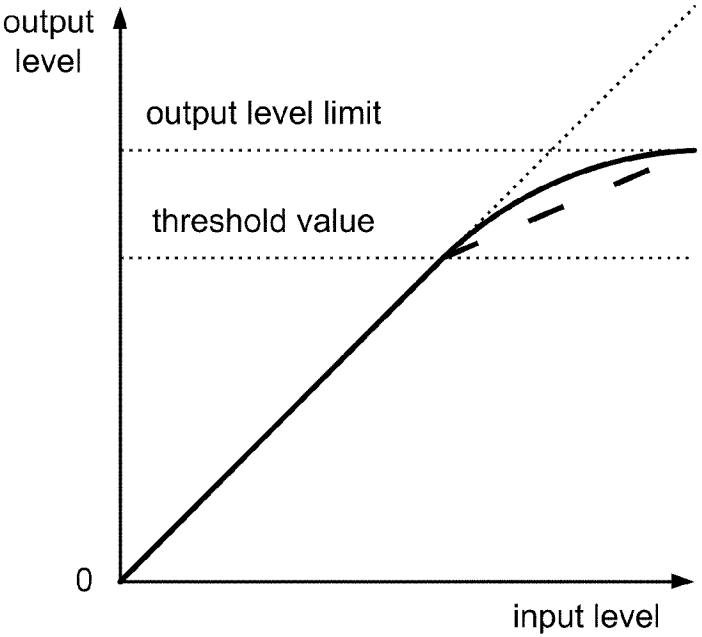
FIG. 23A shows examples of transfer functions for dynamic range control operations.

Enhancement vector generator VG100 may also be implemented to include a pre-enhancement processing module PM10 that is configured to perform one or more preprocessing operations on speech signal S40 upstream of an enhancement vector generation operation as described above. FIG. 19B shows a block diagram of such an implementation VG120 of enhancement vector generator VG110. In one example, pre-enhancement processing module PM10 is configured to perform a dynamic range control operation (e.g., compression and/or expansion) on speech signal S40. A dynamic range compression operation (also called a "soft limiting" operation) maps input levels that exceed a threshold value to output values that exceed the threshold value by a lesser amount according to an input-to-output ratio that is greater than one. The dot-dash line in FIG. 23A shows an example of such a transfer function for a fixed input-to-output ratio, and the solid line in FIG. 23A shows an example of such a transfer function for an input-to-output ratio that increases with input level. FIG. 23B shows an application of a dynamic range compression operation according to the solid line of FIG. 23A to a triangular waveform, where the dotted line indicates the input waveform and the solid line indicates the compressed waveform.

Figure 24B:
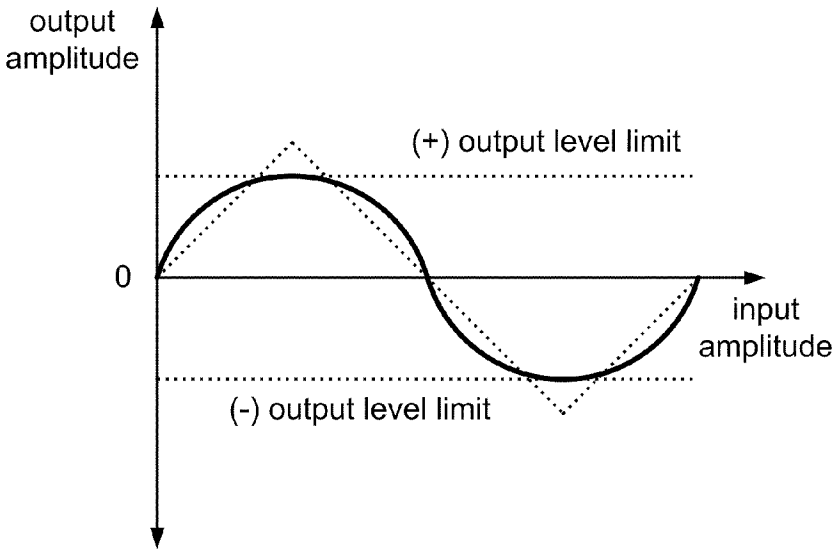
FIG. 24B shows an application of a dynamic range compression operation to a triangular waveform.
Figure 24A:
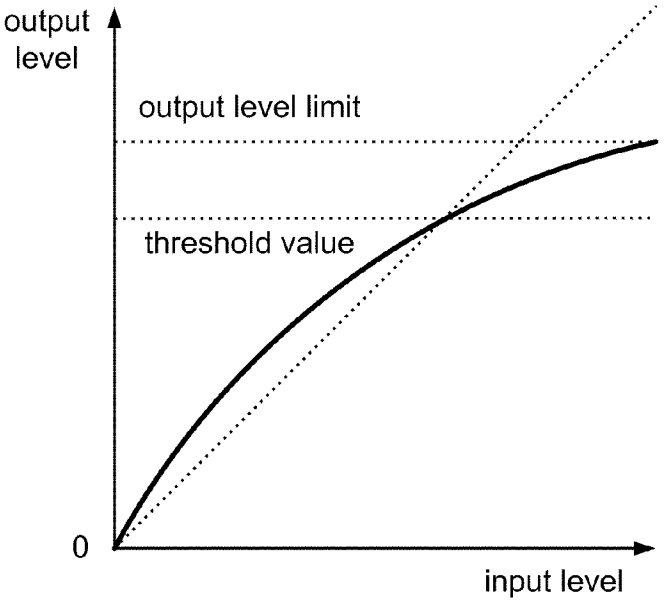
FIG. 24A shows an example of a transfer function for a dynamic range compression operation.

FIG. 24A shows an example of a transfer function for a dynamic range compression operation that maps input levels below the threshold value to higher output levels according to an input-output ratio that is less than one at low frequencies and increases with input level. FIG. 24B shows an application of such an operation to a triangular waveform, where the dotted line indicates the input waveform and the solid line indicates the compressed waveform.

As shown in the examples of FIGS. 23B and 24B, pre-enhancement processing module PM10 may be configured to perform a dynamic range control operation on speech signal S40 in the time domain (e.g., upstream of an FFT operation). Alternatively, pre-enhancement processing module PM10 may be configured to perform a dynamic range control operation on a spectrum of speech signal S40 (i.e., in the frequency domain).

Figure 25:
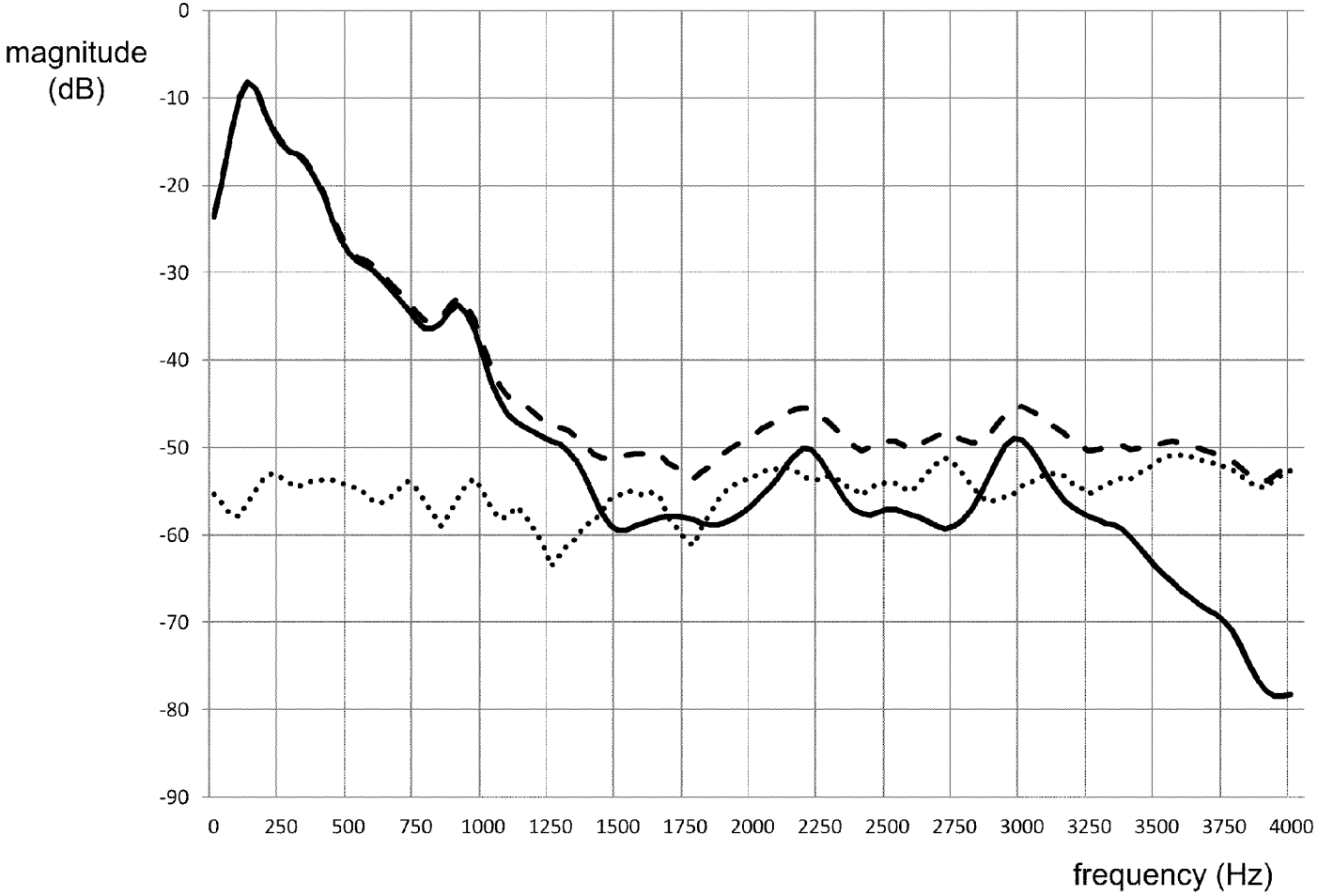
FIG. 25 shows an example of an adaptive equalization operation.

Alternatively or additionally, pre-enhancement processing module PM10 may be configured to perform an adaptive equalization operation on speech signal S40 upstream of the enhancement vector generation operation. In this case, pre-enhancement processing module PM10 is configured to add the spectrum of noise reference S30 to the spectrum of speech signal S40. FIG. 25 shows an example of such an operation in which the solid line indicates the spectrum of a frame of speech signal S40 before equalization, the dotted line indicates the spectrum of a corresponding frame of noise reference S30, and the dashed line indicates the spectrum of speech signal S40 after equalization. In this example, it may be seen that before equalization, the high-frequency components of speech signal S40 are buried by noise, and that the equalization operation adaptively boosts these components, which may be expected to increase intelligibility. Pre-enhancement processing module PM10 may be configured to perform such an adaptive equalization operation at the full FFT resolution or on each of a set of frequency subbands of speech signal S40 as described herein.

It is expressly noted that it may be unnecessary for apparatus A110 to perform an adaptive equalization operation on source signal S20, as SSP filter SS10 already operates to separate noise from the speech signal. However, such an operation may become useful in such an apparatus for frames in which separation between source signal S20 and noise reference S30 is inadequate (e.g., as discussed below with reference to separation evaluator EV10).

As shown in the example of FIG. 25, speech signals tend to have a downward spectral tilt, with the signal power rolling off at higher frequencies. Because the spectrum of noise reference S30 tends to be flatter than the spectrum of speech signal S40, an adaptive equalization operation tends to reduce this downward spectral tilt.

Another example of a tilt-reducing preprocessing operation that may be performed by pre-enhancement processing module PM10 on speech signal S40 to obtain a tilt-reduced signal is pre-emphasis. In a typical implementation, pre-enhancement processing module PM10 is configured to perform a pre-emphasis operation on speech signal S40 by applying a first-order highpass filter of the form $1-\alpha z^{-1}$, where $\alpha$ has a value in the range of from 0.9 to 1.0. Such a filter is typically configured to boost high-frequency components by about six dB per octave. A tilt-reducing operation may also reduce a difference between magnitudes of the spectral peaks. For example, such an operation may equalize the speech signal by increasing the amplitudes of the higher-frequency second and third formants relative to the amplitude of the lower-frequency first formant. Another example of a tilt-reducing operation applies a gain factor to the spectrum of speech signal S40, where the value of the gain factor increases with frequency and does not depend on noise reference S30.

It may be desirable to implement apparatus A120 such that enhancer EN10*a* includes an implementation VG100*a* of enhancement vector generator VG100 that is arranged to generate a first enhancement vector EV10*a* based on information from speech signal S40, and enhancer EN10*b* includes an implementation VG100*b* of enhancement vector generator VG100 that is arranged to generate a second enhancement vector VG10*b* based on information from source signal S20. In such case, generator VG100*a* may be configured to perform a different enhancement vector generation operation than generator VG100*b*. In one example, generator VG100*a* is configured to generate enhancement vector VG10*a* by tracking one or more formants of speech signal S40 from a set of linear prediction coefficients, and generator VG100*b* is configured to generate enhancement vector VG10*b* by calculating a ratio of smoothed spectra of source signal S20.

Figure 26D:
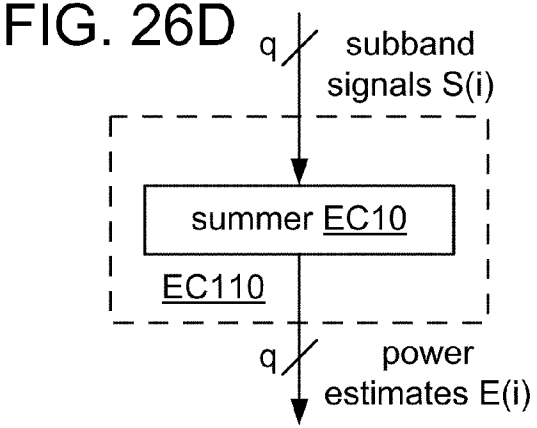
FIG. 26D shows a block diagram of a subband power estimate calculator EC110.
Figure 26E:
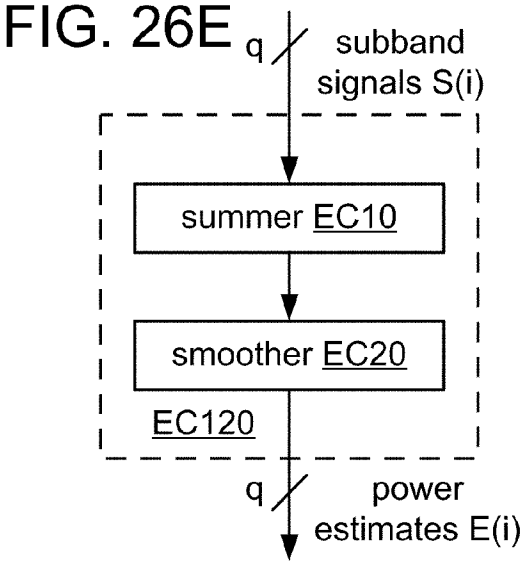
FIG. 26E shows a block diagram of a subband power estimate calculator EC120.
Figure 26A:
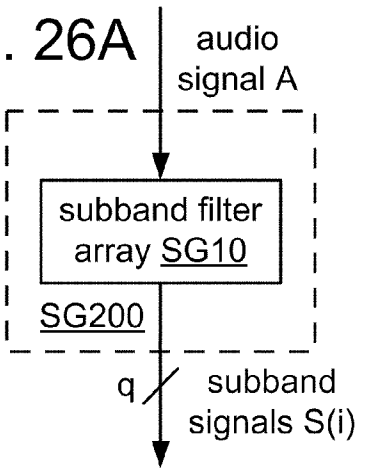
FIG. 26A shows a block diagram of a subband signal generator SG200.

Any or all of noise subband signal generator NG100, speech subband signal generator SG100, and enhancement subband signal generator EG100 may be implemented as respective instances of a subband signal generator SG200 as shown in FIG. 26A. Subband signal generator SG200 is configured to produce a set of q subband signals S(i) based on information from a signal A (i.e., noise reference S30, speech signal S40, or enhancement vector EV10 as appropriate), where $1 \le i \le q$ and q is the desired number of subbands (e.g., four, seven, eight, twelve, sixteen, twenty-four). In this case, subband signal generator SG200 includes a subband filter array SG10 that is configured to produce each of the subband signals S(1) to S(q) by applying a different gain to the corresponding subband of signal A relative to the other subbands of signal A (i.e., by boosting the passband and/or attenuating the stopband).

Figure 28:
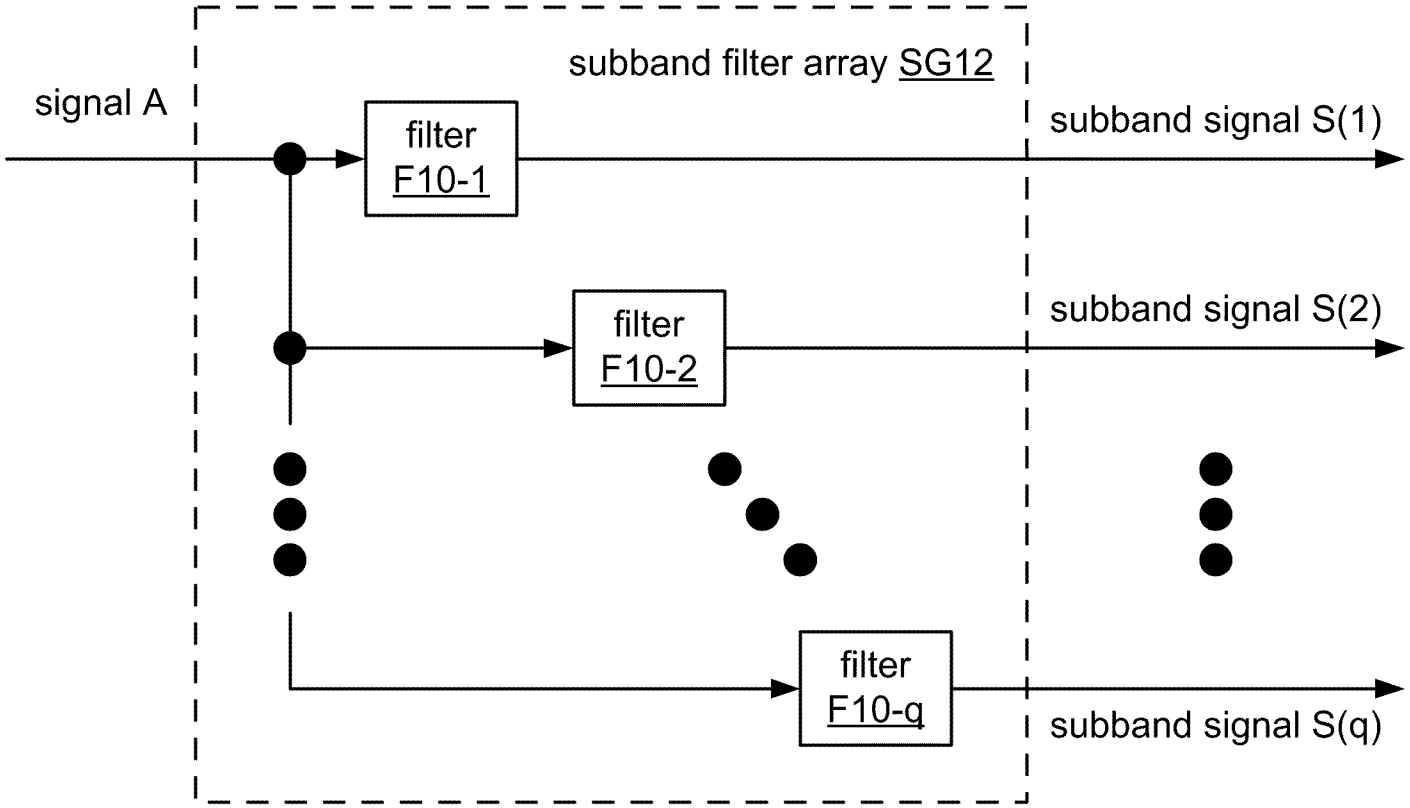
FIG. 28 shows a block diagram of an implementation SG12 of subband filter array SG10.

Subband filter array SG10 may be implemented to include two or more component filters that are configured to produce different subband signals in parallel. FIG. 28 shows a block diagram of such an implementation SG12 of subband filter array SG10 that includes an array of q bandpass filters F10-1 to F10-*q* arranged in parallel to perform a subband decomposition of signal A. Each of the filters F10-1 to F10-*q* is configured to filter signal A to produce a corresponding one of the q subband signals S(1) to S(q).

Each of the filters F10-1 to F10-*q* may be implemented to have a finite impulse response (FIR) or an infinite impulse response (IIR). In one example, subband filter array SG12 is implemented as a wavelet or polyphase analysis filter bank. In another example, each of one or more (possibly all) of filters F10-1 to F10-*q* is implemented as a second-order IIR section or "biquad". The transfer function of a biquad may be expressed as $$H(z) = \frac{b_0 + b_1 z^{-1} + b_2 z^{-2}}{1 + a_1 z^{-1} + a_2 z^{-2}}. \quad (1)$$

Figure 29B:
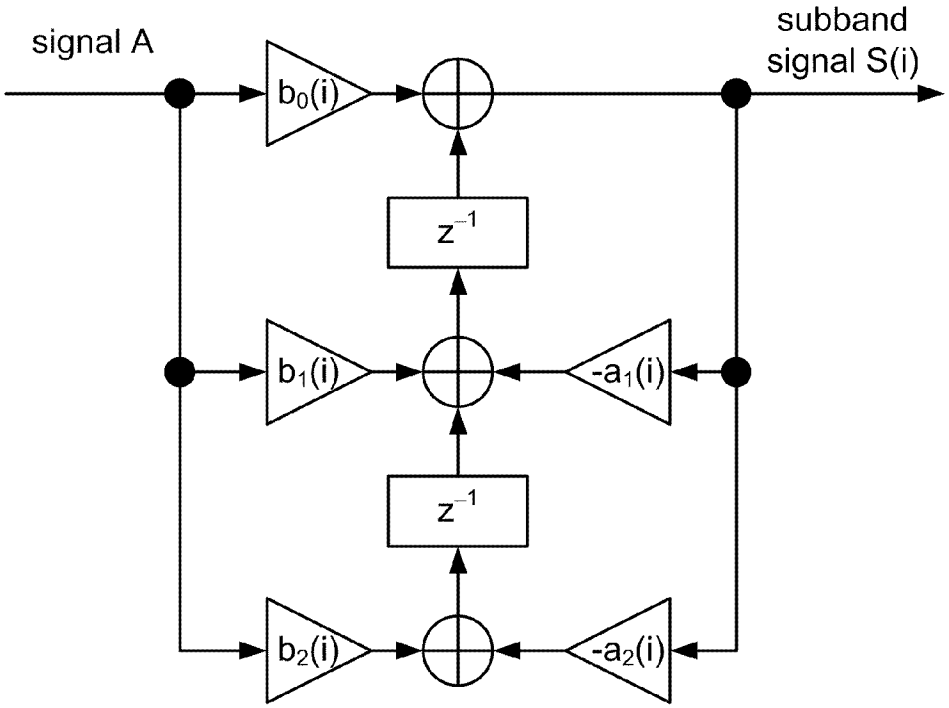
FIG. 29B illustrates a transposed direct form II structure for a biquad implementation of an IIR filter.
Figure 29A:
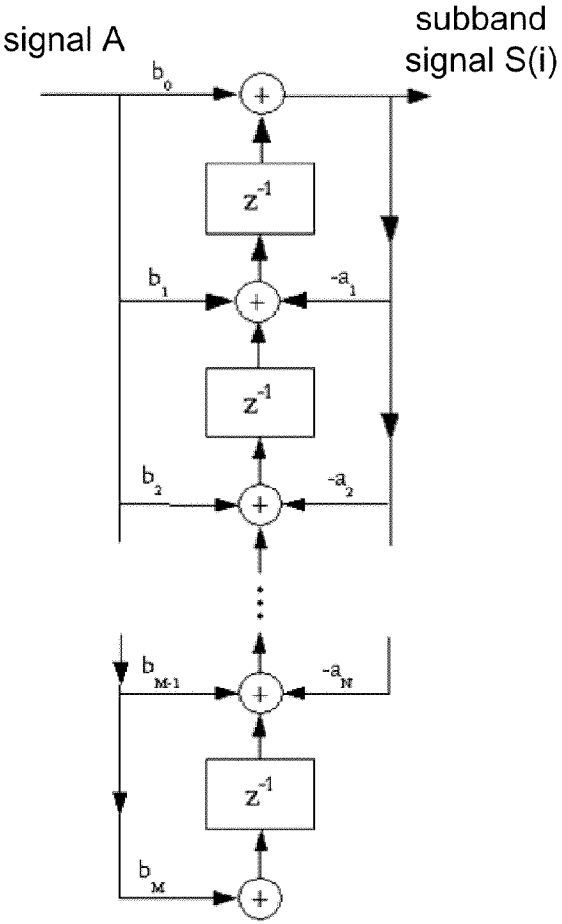
FIG. 29A illustrates a transposed direct form II for a general infinite impulse response (IIR) filter implementation.
Figure 30:
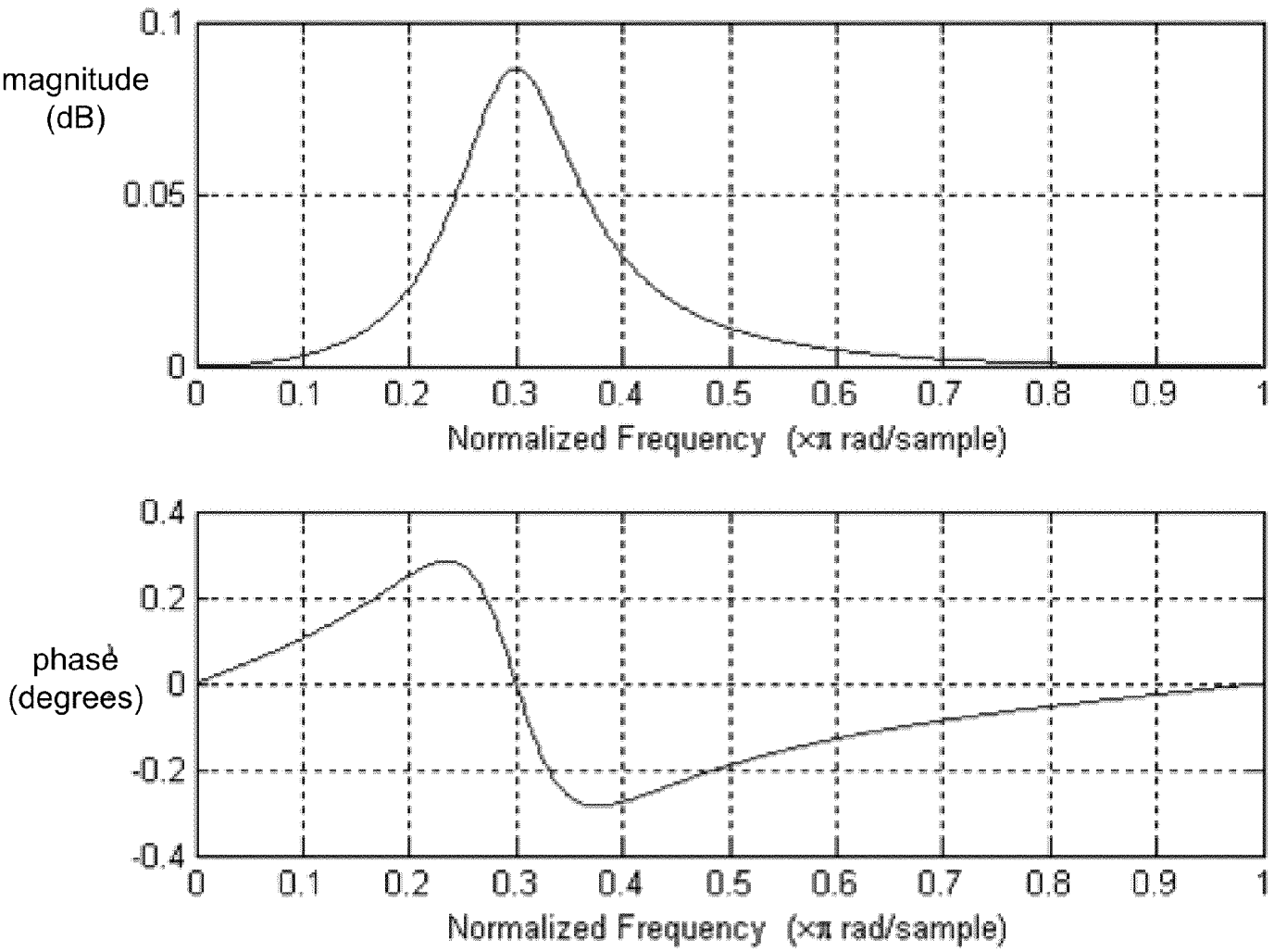
FIG. 30 shows magnitude and phase response plots for one example of a biquad implementation of an IIR filter.

It may be desirable to implement each biquad using the transposed direct form II, especially for floating-point implementations of enhancer EN10. FIG. 29A illustrates a transposed direct form II for a general IIR filter implementation of one of filters F10-1 to F10-*q*, and FIG. 29B illustrates a transposed direct form II structure for a biquad implementation of one F10-*i* of filters F10-1 to F10-*q*. FIG. 30 shows magnitude and phase response plots for one example of a biquad implementation of one of filters F10-1 to F10-*q*.

Figure 27:
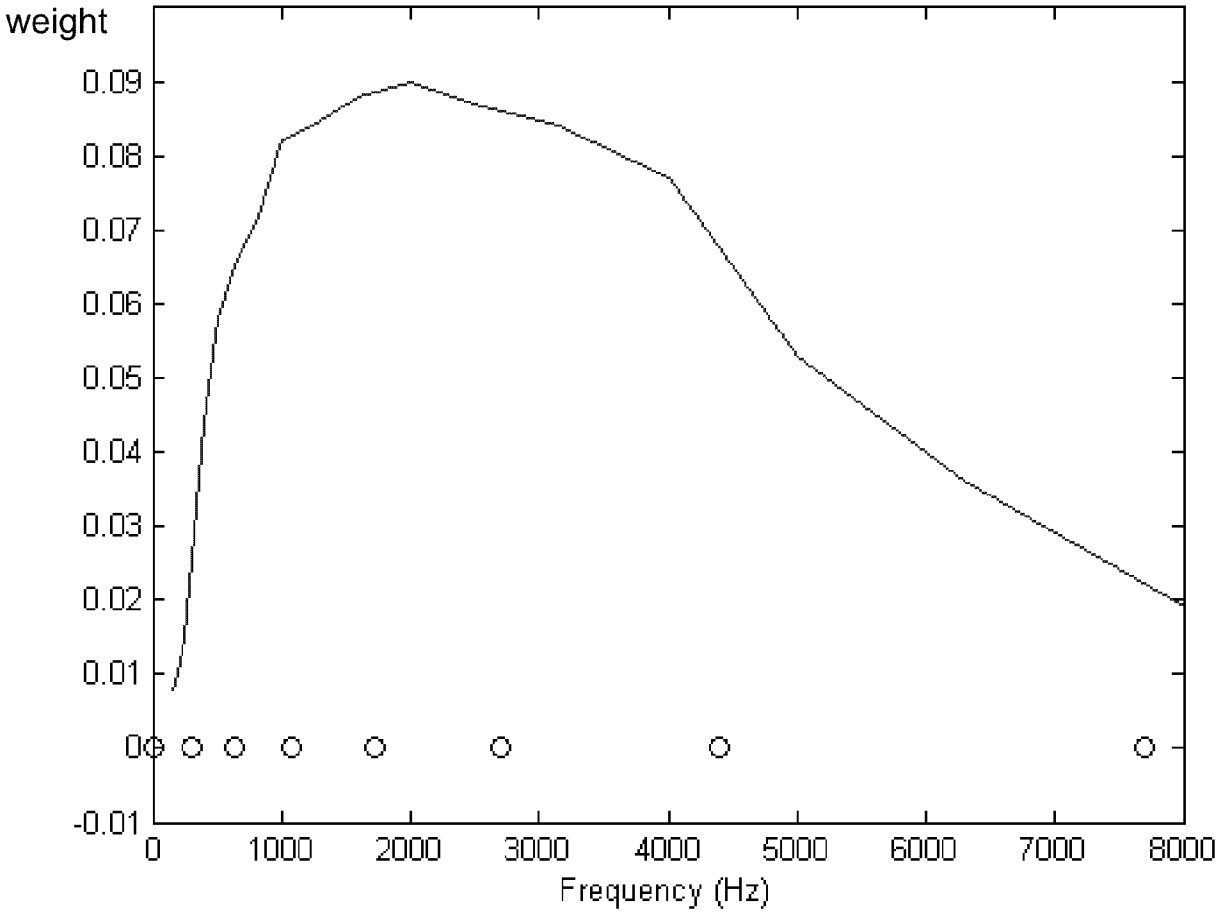
FIG. 27 includes a row of dots that indicate edges of a set of seven Bark scale subbands.

It may be desirable for the filters F10-1 to F10-*q* to perform a nonuniform subband decomposition of signal A (e.g., such that two or more of the filter passbands have different widths) rather than a uniform subband decomposition (e.g., such that the filter passbands have equal widths). As noted above, examples of nonuniform subband division schemes include transcendental schemes, such as a scheme based on the Bark scale, or logarithmic schemes, such as a scheme based on the Mel scale. One such division scheme is illustrated by the dots in FIG. 27, which correspond to the frequencies 20, 300, 630, 1080, 1720, 2700, 4400, and 7700 Hz and indicate the edges of a set of seven Bark scale subbands whose widths increase with frequency. Such an arrangement of subbands may be used in a wideband speech processing system (e.g., a device having a sampling rate of 16 kHz). In other examples of such a division scheme, the lowest subband is omitted to obtain a six-subband scheme and/or the upper limit of the highest subband is increased from 7700 Hz to 8000 Hz.

In a narrowband speech processing system (e.g., a device that has a sampling rate of 8 kHz), it may be desirable to use an arrangement of fewer subbands. One example of such a subband division scheme is the four-band quasi-Bark scheme 300-510 Hz, 510-920 Hz, 920-1480 Hz, and 1480-4000 Hz. Use of a wide high-frequency band (e.g., as in this example) may be desirable because of low subband energy estimation and/or to deal with difficulty in modeling the highest subband with a biquad.

Figure 31:
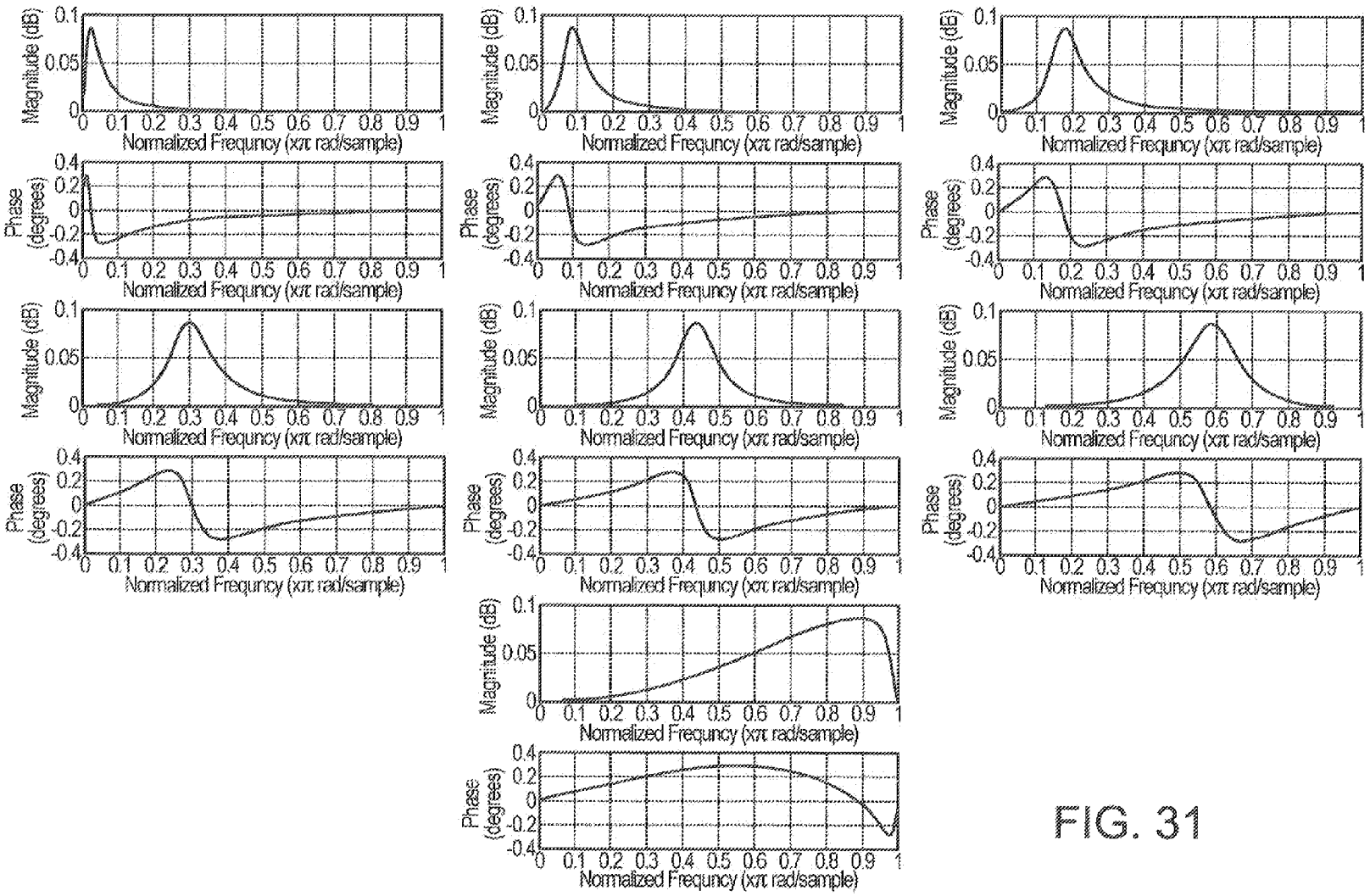
FIG. 31 shows magnitude and phase responses for a series of seven biquads.

Each of the filters F10-1 to F10-*q* is configured to provide a gain boost (i.e., an increase in signal magnitude) over the corresponding subband and/or an attenuation (i.e., a decrease in signal magnitude) over the other subbands. Each of the filters may be configured to boost its respective passband by about the same amount (for example, by three dB, or by six dB). Alternatively, each of the filters may be configured to attenuate its respective stopband by about the same amount (for example, by three dB, or by six dB). FIG. 31 shows magnitude and phase responses for a series of seven biquads that may be used to implement a set of filters F10-1 to F10-*q* where q is equal to seven. In this example, each filter is configured to boost its respective subband by about the same amount. It may be desirable to configure filters F10-1 to F10-*q* such that each filter has the same peak response and the bandwidths of the filters increase with frequency.

Alternatively, it may be desirable to configure one or more of filters F10-1 to F10-*q* to provide a greater boost (or attenuation) than another of the filters. For example, it may be desirable to configure each of the filters F10-1 to F10-*q* of a subband filter array SG10 in one among noise subband signal generator NG100, speech subband signal generator SG100, and enhancement subband signal generator EG100 to provide the same gain boost to its respective subband (or attenuation to other subbands), and to configure at least some of the filters F10-1 to F10-*q* of a subband filter array SG10 in another among noise subband signal generator NG100, speech subband signal generator SG100, and enhancement subband signal generator EG100 to provide different gain boosts (or attenuations) from one another according to, e.g., a desired psychoacoustic weighting function.

FIG. 28 shows an arrangement in which the filters F10-1 to F10-*q* produce the subband signals S(1) to S(q) in parallel. One of ordinary skill in the art will understand that each of one or more of these filters may also be implemented to produce two or more of the subband signals serially. For example, subband filter array SG10 may be implemented to include a filter structure (e.g., a biquad) that is configured at one time with a first set of filter coefficient values to filter signal A to produce one of the subband signals S(1) to S(q), and is configured at a subsequent time with a second set of filter coefficient values to filter signal A to produce a different one of the subband signals S(1) to S(q). In such case, subband filter array SG10 may be implemented using fewer than q bandpass filters. For example, it is possible to implement subband filter array SG10 with a single filter structure that is serially reconfigured in such manner to produce each of the q subband signals S(1) to S(q) according to a respective one of q sets of filter coefficient values.

Figure 26C:
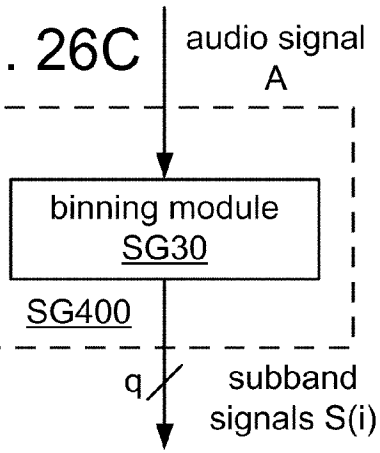
FIG. 26C shows a block diagram of a subband signal generator SG400.
Figure 26B:
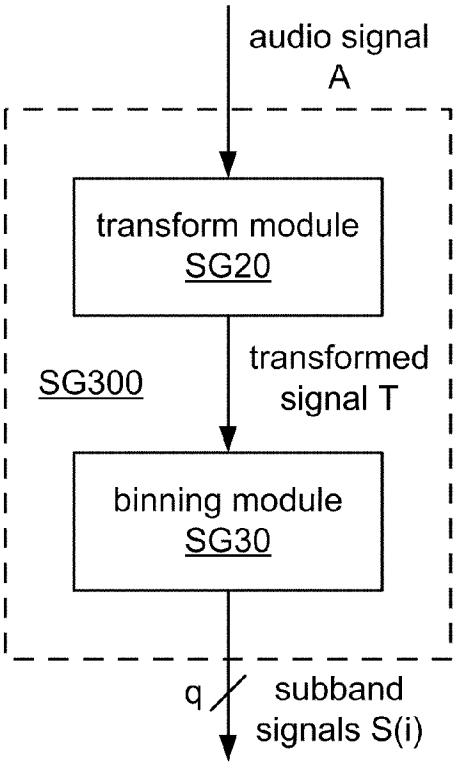
FIG. 26B shows a block diagram of a subband signal generator SG300.

Alternatively or additionally, any or all of noise subband signal generator NG100, speech subband signal generator SG100, and enhancement subband signal generator EG100 may be implemented as an instance of a subband signal generator SG300 as shown in FIG. 26B. Subband signal generator SG300 is configured to produce a set of q subband signals S(i) based on information from signal A (i.e., noise reference S30, speech signal S40, or enhancement vector EV10 as appropriate), where $1 \le i \le q$ and q is the desired number of subbands. Subband signal generator SG300 includes a transform module SG20 that is configured to perform a transform operation on signal A to produce a transformed signal T. Transform module SG20 may be configured to perform a frequency domain transform operation on signal A (e.g., via a fast Fourier transform or FFT) to produce a frequency-domain transformed signal. Other implementations of transform module SG20 may be configured to perform a different transform operation on signal A, such as a wavelet transform operation or a discrete cosine transform (DCT) operation. The transform operation may be performed according to a desired uniform resolution (for example, a 32-, 64-, 128-, 256-, or 512-point FFT operation).

Subband signal generator SG300 also includes a binning module SG30 that is configured to produce the set of subband signals S(i) as a set of q bins by dividing transformed signal T into the set of bins according to a desired subband division scheme. Binning module SG30 may be configured to apply a uniform subband division scheme. In a uniform subband division scheme, each bin has substantially the same width (e.g., within about ten percent). Alternatively, it may be desirable for binning module SG30 to apply a subband division scheme that is nonuniform, as psychoacoustic studies have demonstrated that human hearing operates on a nonuniform resolution in the frequency domain. Examples of nonuniform subband division schemes include transcendental schemes, such as a scheme based on the Bark scale, or logarithmic schemes, such as a scheme based on the Mel scale. The row of dots in FIG. 27 indicates edges of a set of seven Bark scale subbands, corresponding to the frequencies 20, 300, 630, 1080, 1720, 2700, 4400, and 7700 Hz. Such an arrangement of subbands may be used in a wideband speech processing system that has a sampling rate of 16 kHz. In other examples of such a division scheme, the lower subband is omitted to obtain a six-subband arrangement and/or the high-frequency limit is increased from 7700 Hz to 8000 Hz. Binning module SG30 is typically implemented to divide transformed signal T into a set of nonoverlapping bins, although binning module SG30 may also be implemented such that one or more (possibly all) of the bins overlaps at least one neighboring bin.

The discussions of subband signal generators SG200 and SG300 above assume that the signal generator receives signal A as a time-domain signal. Alternatively, any or all of noise subband signal generator NG100, speech subband signal generator SG100, and enhancement subband signal generator EG100 may be implemented as an instance of a subband signal generator SG400 as shown in FIG. 26C. Subband signal generator SG400 is configured to receive signal A (i.e., noise reference S30, speech signal S40, or enhancement vector EV10) as a transform-domain signal and to produce a set of q subband signals S(i) based on information from signal A. For example, subband signal generator SG400 may be configured to receive signal A as a frequency-domain signal or as a signal in a wavelet transform, DCT, or other transform domain. In this example, subband signal generator SG400 is implemented as an instance of binning module SG30 as described above.

Either or both of noise subband power estimate calculator NP100 and enhancement subband power estimate calculator EP100 may be implemented as an instance of a subband power estimate calculator EC110 as shown in FIG. 26D. Subband power estimate calculator EC110 includes a summer EC10 that is configured to receive the set of subband signals S(i) and to produce a corresponding set of q subband power estimates E(i), where $1 \le i \le q$. Summer EC10 is typically configured to calculate a set of q subband power estimates for each block of consecutive samples (also called a "frame") of signal A (i.e., noise reference S30 or enhancement vector EV10 as appropriate). Typical frame lengths range from about five or ten milliseconds to about forty or fifty milliseconds, and the frames may be overlapping or nonoverlapping. A frame as processed by one operation may also be a segment (i.e., a "subframe") of a larger frame as processed by a different operation. In one particular example, signal A is divided into sequences of 10-millisecond nonoverlapping frames, and summer EC10 is configured to calculate a set of q subband power estimates for each frame of signal A.

In one example, summer EC10 is configured to calculate each of the subband power estimates E(i) as a sum of the squares of the values of the corresponding one of the subband signals S(i). Such an implementation of summer EC10 may be configured to calculate a set of q subband power estimates for each frame of signal A according to an expression such as $$E(i,k)=\Sigma_{j\in k}S(i,j)^2, 1 \le i \le q, \tag{2}$$

where E(i,k) denotes the subband power estimate for subband i and frame k and S(i,j) denotes the j-th sample of the i-th subband signal.

In another example, summer EC10 is configured to calculate each of the subband power estimates E(i) as a sum of the magnitudes of the values of the corresponding one of the subband signals S(i). Such an implementation of summer EC10 may be configured to calculate a set of q subband power estimates for each frame of signal A according to an expression such as $$E(i,k)=\Sigma_{j\in k}|S(i,j)|, 1 \le i \le q. \tag{3}$$

It may be desirable to implement summer EC10 to normalize each subband sum by a corresponding sum of signal A. In one such example, summer EC10 is configured to calculate each one of the subband power estimates E(i) as a sum of the squares of the values of the corresponding one of the subband signals S(i), divided by a sum of the squares of the values of signal A. Such an implementation of summer EC10 may be configured to calculate a set of q subband power estimates for each frame of signal A according to an expression such as $$E(i,k)=\frac{\sum_{j\in k} S(i,j)^2}{\sum_{j\in k} A(j)^2}, 1 \le i \le q, \tag{4a}$$

where A(j) denotes the j-th sample of signal A. In another such example, summer EC10 is configured to calculate each subband power estimate as a sum of the magnitudes of the values of the corresponding one of the subband signals S(i), divided by a sum of the magnitudes of the values of signal A. Such an implementation of summer EC10 may be configured to calculate a set of q subband power estimates for each frame of the audio signal according to an expression such as $$E(i,k)=\frac{\sum_{j\in k} |S(i,j)|}{\sum_{j\in k} |A(j)|}, 1 \le i \le q. \tag{4b}$$

Alternatively, for a case in which the set of subband signals S(i) is produced by an implementation of binning module SG30, it may be desirable for summer EC10 to normalize each subband sum by the total number of samples in the corresponding one of the subband signals S(i). For cases in which a division operation is used to normalize each subband sum (e.g., as in expressions (4a) and (4b) above), it may be desirable to add a small nonzero (e.g., positive) value $\zeta$ to the denominator to avoid the possibility of dividing by zero. The value $\zeta$ may be the same for all subbands, or a different value of $\zeta$ may be used for each of two or more (possibly all) of the subbands (e.g., for tuning and/or weighting purposes). The value (or values) of $\zeta$ may be fixed or may be adapted over time (e.g., from one frame to the next).

Alternatively, it may be desirable to implement summer EC10 to normalize each subband sum by subtracting a corresponding sum of signal A. In one such example, summer EC10 is configured to calculate each one of the subband power estimates E(i) as a difference between a sum of the squares of the values of the corresponding one of the subband signals S(i) and a sum of the squares of the values of signal A. Such an implementation of summer EC10 may be configured to calculate a set of q subband power estimates for each frame of signal A according to an expression such as $$E(i,k)=\Sigma_{j\in k}S(i)^2-\Sigma_{j\in k}A(j)^2, 1\leq i\leq q. \quad (5a)$$

In another such example, summer EC10 is configured to calculate each one of the subband power estimates E(i) as a difference between a sum of the magnitudes of the values of the corresponding one of the subband signals S(i) and a sum of the magnitudes of the values of signal A. Such an implementation of summer EC10 may be configured to calculate a set of q subband power estimates for each frame of signal A according to an expression such as $$E(i,k)=\Sigma_{j\in k}|S(i,j)|-\Sigma_{j\in k}|A(j)|, 1\leq i\leq q. \quad (5b).$$

It may be desirable, for example, to implement noise subband signal generator NG100 as a boosting implementation of subband filter array SG10 and to implement noise subband power estimate calculator NP100 as an implementation of summer EC10 that is configured to calculate a set of q subband power estimates according to expression (5b). Alternatively or additionally, it may be desirable to implement enhancement subband signal generator EG100 as a boosting implementation of subband filter array SG10 and to implement enhancement subband power estimate calculator EP100 as an implementation of summer EC10 that is configured to calculate a set of q subband power estimates according to expression (5b).

Either or both of noise subband power estimate calculator NP100 and enhancement subband power estimate calculator EP100 may be configured to perform a temporal smoothing operation on the subband power estimates. For example, either or both of noise subband power estimate calculator NP100 and enhancement subband power estimate calculator EP100 may be implemented as an instance of a subband power estimate calculator EC120 as shown in FIG. 26E. Subband power estimate calculator EC120 includes a smoother EC20 that is configured to smooth the sums calculated by summer EC10 over time to produce the subband power estimates E(i). Smoother EC20 may be configured to compute the subband power estimates E(i) as running averages of the sums. Such an implementation of smoother EC20 may be configured to calculate a set of q subband power estimates E(i) for each frame of signal A according to a linear smoothing expression such as one of the following:

$$E(i,k)\leftarrow\alpha E(i,k-1)+(1-\alpha)E(i,k), \quad (6)$$

$$E(i,k)\leftarrow\alpha E(i,k-1)+(1-\alpha)|E(i,k)|, \quad (7)$$

$$E(i,k)\leftarrow\alpha E(i,k-1)+(1-\alpha)\sqrt{E(i,k)^2}, \quad (8)$$

for $1\leq i\leq q$, where smoothing factor $\alpha$ is a value in the range of from zero (no smoothing) to one (maximum smoothing, no updating) (e.g., 0.3, 0.5, 0.7, 0.9, 0.99, or 0.999). It may be desirable for smoother EC20 to use the same value of smoothing factor $\alpha$ for all of the q subbands. Alternatively, it may be desirable for smoother EC20 to use a different value of smoothing factor $\alpha$ for each of two or more (possibly all) of the q subbands. The value (or values) of smoothing factor $\alpha$ may be fixed or may be adapted over time (e.g., from one frame to the next).

One particular example of subband power estimate calculator EC120 is configured to calculate the q subband sums according to expression (3) above and to calculate the q corresponding subband power estimates according to expression (7) above. Another particular example of subband power estimate calculator EC120 is configured to calculate the q subband sums according to expression (5b) above and to calculate the q corresponding subband power estimates according to expression (7) above. It is noted, however, that all of the eighteen possible combinations of one of expressions (2)-(5b) with one of expressions (6)-(8) are hereby individually expressly disclosed. An alternative implementation of smoother EC20 may be configured to perform a nonlinear smoothing operation on sums calculated by summer EC10.

It is expressly noted that the implementations of subband power estimate calculator EC110 discussed above may be arranged to receive the set of subband signals S(i) as time-domain signals or as signals in a transform domain (e.g., as frequency-domain signals).

Gain control element CE100 is configured to apply each of a plurality of subband gain factors to a corresponding subband of speech signal S40 to produce contrast-enhanced speech signal SC10. Enhancer EN10 may be implemented such that gain control element CE100 is arranged to receive the enhancement subband power estimates as the plurality of gain factors. Alternatively, gain control element CE100 may be configured to receive the plurality of gain factors from a subband gain factor calculator FC100 (e.g., as shown in FIG. 12).

Subband gain factor calculator FC100 is configured to calculate a corresponding one of a set of gain factors G(i) for each of the q subbands, where $1\leq i\leq q$, based on information from the corresponding enhancement subband power estimate. Calculator FC100 may be configured to calculate each of one or more (possibly all) of the subband gain factors by applying an upper limit UL and/or a lower limit LL to the corresponding enhancement subband power estimate E(i) (e.g., according to an expression such as G(i)=max (LL, E(i)) and/or G(i)=min (UL, E(i)). Additionally or in the alternative, calculator FC100 may be configured to calculate each of one or more (possibly all) of the subband gain factors by normalizing the corresponding enhancement subband power estimate. For example, such an implementation of calculator FC100 may be configured to calculate each subband gain factor G(i) according to an expression such as $$G(i)=\frac{E(i)}{\max_{1\leq i\leq q}E(i)}.$$

Additionally or in the alternative, calculator FC100 may be configured to perform a temporal smoothing operation on each subband gain factor.

It may be desirable to configure enhancer EN10 to compensate for excessive boosting that may result from an overlap of subbands. For example, gain factor calculator FC100 may be configured to reduce the value of one or more of the mid-frequency gain factors (e.g., a subband that includes the frequency fs/4, where fs denotes the sampling frequency of speech signal S40). Such an implementation of gain factor calculator FC100 may be configured to perform the reduction by multiplying the current value of the gain factor by a scale factor having a value of less than one. Such an implementation of gain factor calculator FC100 may be configured to use the same scale factor for each gain factor to be scaled down or, alternatively, to use different scale factors for each gain factor to be scaled down (e.g., based on the degree of overlap of the corresponding subband with one or more adjacent subbands).

Additionally or in the alternative, it may be desirable to configure enhancer EN10 to increase a degree of boosting of one or more of the high-frequency subbands. For example, it may be desirable to configure gain factor calculator FC100 to ensure that amplification of one or more high-frequency subbands of speech signal S40 (e.g., the highest subband) is not lower than amplification of a mid-frequency subband (e.g., a subband that includes the frequency fs/4, where fs denotes the sampling frequency of speech signal S40). Gain factor calculator FC100 may be configured to calculate the current value of the gain factor for a high-frequency subband by multiplying the current value of the gain factor for a mid-frequency subband by a scale factor that is greater than one. In another example, gain factor calculator FC100 is configured to calculate the current value of the gain factor for a high-frequency subband as the maximum of (A) a current gain factor value that is calculated based on a noise power estimate for that subband in accordance with any of the techniques disclosed herein and (B) a value obtained by multiplying the current value of the gain factor for a mid-frequency subband by a scale factor that is greater than one. Alternatively or additionally, gain factor calculator FC100 may be configured to use a higher value for upper bound UB in calculating the gain factors for one or more high-frequency subbands.

Gain control element CE100 is configured to apply each of the gain factors to a corresponding subband of speech signal S40 (e.g., to apply the gain factors to speech signal S40 as a vector of gain factors) to produce contrast-enhanced speech signal SC10. Gain control element CE100 may be configured to produce a frequency-domain version of contrast-enhanced speech signal SC10, for example, by multiplying each of the frequency-domain subbands of a frame of speech signal S40 by a corresponding gain factor G(i). Other examples of gain control element CE100 are configured to use an overlap-add or overlap-save method to apply the gain factors to corresponding subbands of speech signal S40 (e.g., by applying the gain factors to respective filters of a synthesis filter bank).

Gain control element CE100 may be configured to produce a time-domain version of contrast-enhanced speech signal SC10. For example, gain control element CE100 may include an array of subband gain control elements G20-1 to G20-*q* (e.g., multipliers or amplifiers) in which each of the subband gain control elements is arranged to apply a respective one of the gain factors G(1) to G(q) to a respective one of the subband signals S(1) to S(q).

Figure 33A:
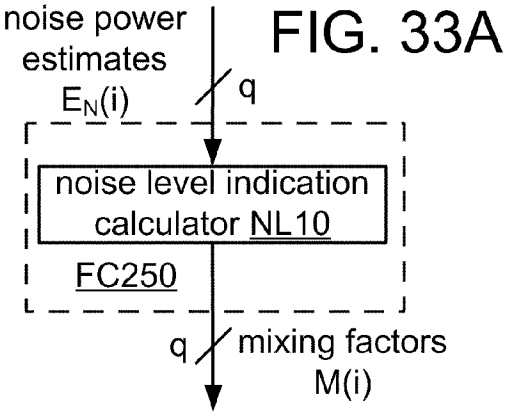
FIG. 33A shows a block diagram of an implementation FC250 of mixing factor calculator FC200.

Subband mixing factor calculator FC200 is configured to calculate a corresponding one of a set of mixing factors M(i) for each of the q subbands, where $1 \le i \le q$, based on information from the corresponding noise subband power estimate. FIG. 33A shows a block diagram of an implementation FC250 of mixing factor calculator FC200 that is configured to calculate each mixing factor M(i) as an indication of a noise level η for the corresponding subband. Mixing factor calculator FC250 includes a noise level indication calculator NL10 that is configured to calculate a set of noise level indications η(i, k) for each frame k of the speech signal, based on the corresponding set of noise subband power estimates, such that each noise level indication indicates a relative noise level in the corresponding subband of noise reference S30. Noise level indication calculator NL10 may be configured to calculate each of the noise level indications to have a value over some range, such as zero to one. For example, noise level indication calculator NL10 may be configured to calculate each of a set of q noise level indications according to an expression such as $$\eta(i,k) = \frac{\max(\min(E_N(i,k), \eta_{max}), \eta_{min}) - \eta_{min}}{\eta_{max} - \eta_{min}}, \tag{9A}$$

where $E_N(i,k)$ denotes the subband power estimate as produced by noise subband power estimate calculator NP100 (i.e., based on noise reference S20) for subband i and frame k; η(i, k) denotes the noise level indication for subband i and frame k; and $\eta_{min}$ and $\eta_{max}$ denote minimum and maximum values, respectively, for η(i, k).

Such an implementation of noise level indication calculator NL10 may be configured to use the same values of $\eta_{min}$ and $\eta_{max}$ for all of the q subbands or, alternatively, may be configured to use a different value of $\eta_{min}$ and/or $\eta_{max}$ for one subband than for another. The values of each of these bounds may be fixed. Alternatively, the values of either or both of these bounds may be adapted according to, for example, a desired headroom for enhancer EN10 and/or a current volume of processed speech signal S50 (e.g., a current value of volume control signal VS10 as described below with reference to audio output stage O10). Alternatively or additionally, the values of either or both of these bounds may be based on information from speech signal S40, such as a current level of speech signal S40. In another example, noise level indication calculator NL10 is configured to calculate each of a set of q noise level indications by normalizing the subband power estimates according to an expression such as $$\eta(i,k) = \frac{E_N(i,k)}{\max_{1 \le x \le q}(E_N(x,k))}. \tag{9B}$$

Figure 33B:
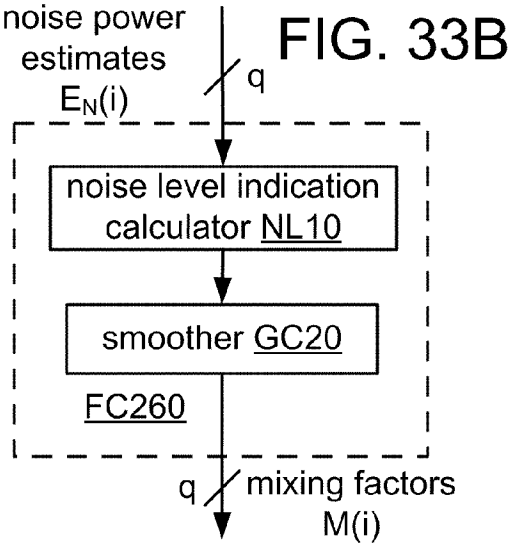
FIG. 33B shows a block diagram of an implementation FC260 of mixing factor calculator FC250.

Mixing factor calculator FC200 may also be configured to perform a smoothing operation on each of one or more (possibly all) of the mixing factors M(i). FIG. 33B shows a block diagram of such an implementation FC260 of mixing factor calculator FC250 that includes a smoother GC20 configured to perform a temporal smoothing operation on each of one or more (possibly all) of the q noise level indications produced by noise level indication calculator NL10. In one example, smoother GC20 is configured to perform a linear smoothing operation on each of the q noise level indications according to an expression such as $$M(i,k) \leftarrow \beta\eta(i,k-1) + (1-\beta)\eta(i,k), 1 \le i \le q, \tag{10}$$

where β is a smoothing factor. In this example, smoothing factor β has a value in the range of from zero (no smoothing) to one (maximum smoothing, no updating) (e.g., 0.3, 0.5, 0.7, 0.9, 0.99, or 0.999).

It may be desirable for smoother GC20 to select one among two or more values of smoothing factor β depending on a relation between the current and previous values of the mixing factor. For example, it may be desirable for smoother GC20 to perform a differential temporal smoothing operation by allowing the mixing factor values to change more quickly when the degree of noise is increasing and/or by inhibiting rapid changes in the mixing factor values when the degree of noise is decreasing. Such a configuration may help to counter a psychoacoustic temporal masking effect in which a loud noise continues to mask a desired sound even after the noise has ended. Accordingly, it may be desirable for the value of smoothing factor β to be larger when the current value of the noise level indication is less than the previous value, as compared to the value of smoothing factor β when the current value of the noise level indication is greater than the previous value. In one such example, smoother GC20 is configured to perform a linear smoothing operation on each of the q noise level indications according to an expression such as $$M(i,k) \leftarrow \begin{cases} \beta_{att}\eta(i,k-1)+(1-\beta_{att})\eta(i,k), & \eta(i,k)>\eta(i,k-1) \\ \beta_{dec}\eta(i,k-1)+(1-\beta_{dec})\eta(i,k), & \text{otherwise,} \end{cases} \quad (11)$$

for $1 \le i \le q$, where $\beta_{att}$ denotes an attack value for smoothing factor $\beta$, $\beta_{dec}$ denotes a decay value for smoothing factor $\beta$, and $\beta_{att}<\beta_{dec}$. Another implementation of smoother EC20 is configured to perform a linear smoothing operation on each of the q noise level indications according to a linear smoothing expression such as one of the following:

$$M(i,k) \leftarrow \begin{cases} \beta_{att}\eta(i,k-1)+(1-\beta_{att})\eta(i,k), & \eta(i,k)>\eta(i,k-1) \\ \beta_{dec}\eta(i,k-1), & \text{otherwise,} \end{cases} \quad (12)$$

$$M(i,k) \leftarrow \begin{cases} \beta_{att}\eta(i,k-1)+(1-\beta_{att})\eta(i,k), & \eta(i,k)>\eta(i,k-1) \\ \max[\beta_{dec}\eta(i,k-1),\eta(i,k)], & \text{otherwise.} \end{cases} \quad (13)$$

A further implementation of smoother GC20 may be configured to delay updates to one or more (possibly all) of the q mixing factors when the degree of noise is decreasing. For example, smoother CG20 may be implemented to include hangover logic that delays updates during a ratio decay profile according to an interval specified by a value hangover_max (i), which may be in the range of, for example, from one or two to five, six, or eight. The same value of hangover_max may be used for each subband, or different values of hangover_max may be used for different subbands.

Mixer X100 is configured to produce processed speech signal S50 based on information from the mixing factors, speech signal S40, and contrast-enhanced signal SC10. For example, enhancer EN100 may include an implementation of mixer X100 that is configured to produce a frequency-domain version of processed speech signal S50 by mixing corresponding frequency-domain subbands of speech signal S40 and contrast-enhanced signal SC10 according to an expression such as $P(i,k)=M(i,k)C(i,k)+(1-M(i,k))S(i,k)$ for $1 \le i \le q$, where P(i,k) indicates subband i of P(k), C(i,k) indicates subband i and frame k of contrast-enhanced signal SC10, and S(i,k) indicates subband i and frame k of speech signal S40. Alternatively, enhancer EN100 may include an implementation of mixer X100 that is configured to produce a time-domain version of processed speech signal S50 by mixing corresponding time-domain subbands of speech signal S40 and contrast-enhanced signal SC10 according to an expression such as $P(k)=\Sigma_{i=1}^{q}P(i,k)$, where $P(i,k)=M(i,k)C(i,k)+(1-M(i,k))S(i,k)$ for $1 \le i \le q$, P(k) indicates frame k of processed speech signal S50, P(i,k) indicates subband i of P(k), C(i,k) indicates subband i and frame k of contrast-enhanced signal SC10, and S(i,k) indicates subband i and frame k of speech signal S40.

It may be desirable to configure mixer X100 to produce processed speech signal S50 based on additional information, such as a fixed or adaptive frequency profile. For example, it may be desirable to apply such a frequency profile to compensate for the frequency response of a microphone or speaker. Alternatively, it may be desirable to apply a frequency profile that describes a user-selected equalization profile. In such cases, mixer X100 may be configured to produce processed speech signal S50 according to an expression such as $P(k)=\Sigma_{i=1}^{q}w_iP(i,k)$, where the values $w_i$ define a desired frequency weighting profile.

Figure 32:
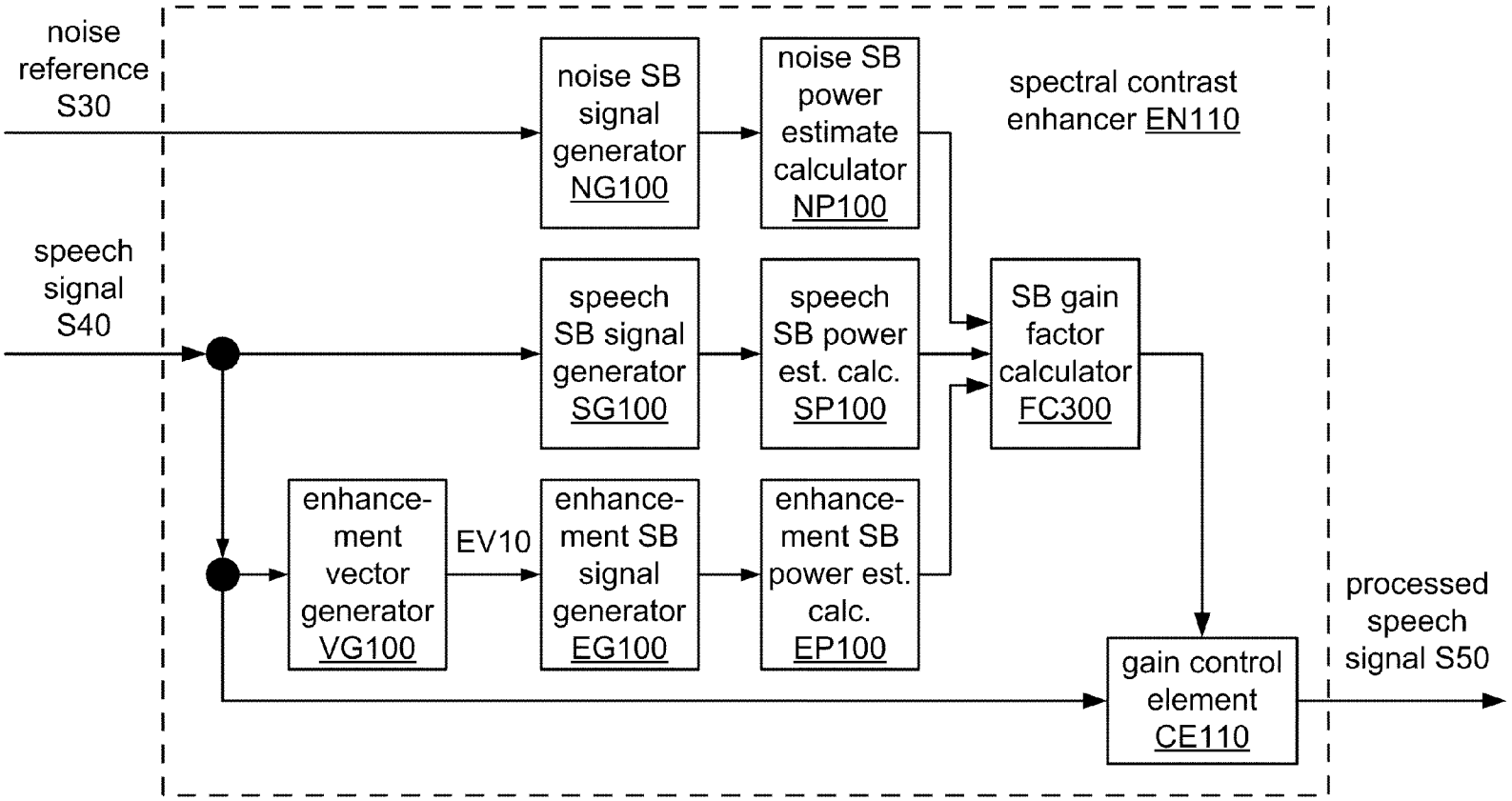
FIG. 32 shows a block diagram of an implementation EN110 of enhancer EN10.

FIG. 32 shows a block diagram of an implementation EN110 of spectral contrast enhancer EN10. Enhancer EN110 includes a speech subband signal generator SG100 that is configured to produce a set of speech subband signals based on information from speech signal S40. As noted above, speech subband signal generator SG100 may be implemented, for example, as an instance of subband signal generator SG200 as shown in FIG. 26A, subband signal generator SG300 as shown in FIG. 26B, or subband signal generator SG400 as shown in FIG. 26C.

Enhancer EN110 also includes a speech subband power estimate calculator SP100 that is configured to produce a set of speech subband power estimates, each based on information from a corresponding one of the speech subband signals. Speech subband power estimate calculator SP100 may be implemented as an instance of a subband power estimate calculator EC110 as shown in FIG. 26D. It may be desirable, for example, to implement speech subband signal generator SG100 as a boosting implementation of subband filter array SG10 and to implement speech subband power estimate calculator SP100 as an implementation of summer EC10 that is configured to calculate a set of q subband power estimates according to expression (5b). Additionally or in the alternative, speech subband power estimate calculator SP100 may be configured to perform a temporal smoothing operation on the subband power estimates. For example, speech subband power estimate calculator SP100 may be implemented as an instance of a subband power estimate calculator EC120 as shown in FIG. 26E.

Enhancer EN110 also includes an implementation FC300 of subband gain factor calculator FC100 (and of subband mixing factor calculator FC200) that is configured to calculate a gain factor for each of the speech subband signals, based on information from a corresponding noise subband power estimate and a corresponding enhancement subband power estimate, and a gain control element CE110 that is configured to apply each of the gain factors to a corresponding subband of speech signal S40 to produce processed speech signal S50. It is expressly noted that processed speech signal S50 may also be referred to as a contrast-enhanced speech signal at least in cases for which spectral contrast enhancement is enabled and enhancement vector EV10 contributes to at least one of the gain factor values.

Figure 33C:
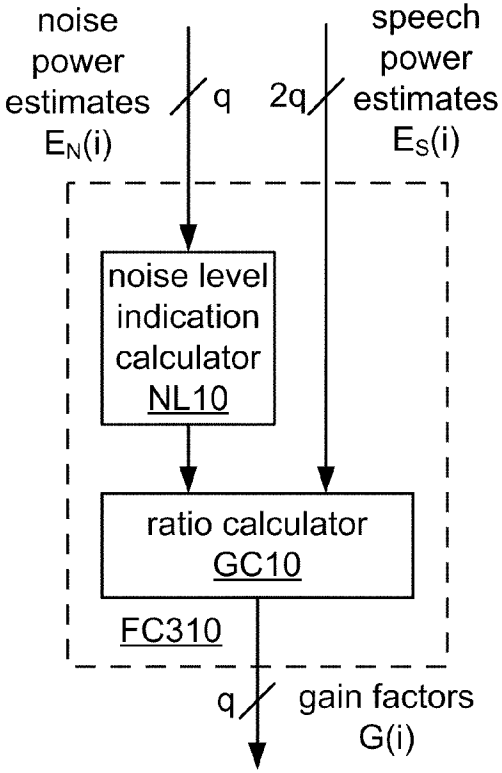
FIG. 33C shows a block diagram of an implementation FC310 of gain factor calculator FC300.

Gain factor calculator FC300 is configured to calculate a corresponding one of a set of gain factors G(i) for each of the q subbands, based on the corresponding noise subband power estimate and the corresponding enhancement subband power estimate, where $1 \le i \le q$. FIG. 33C shows a block diagram of an implementation FC310 of gain factor calculator FC300 that is configured to calculate each gain factor G(i) by using the corresponding noise subband power estimate to weight a contribution of the corresponding enhancement subband power estimate to the gain factor.

Gain factor calculator FC310 includes an instance of noise level indication calculator NL10 as described above with reference to mixing factor calculator FC200. Gain factor calculator FC310 also includes a ratio calculator GC10 that is configured to calculate each of a set of q power ratios for each frame of the speech signal as a ratio between a blended subband power estimate and a corresponding speech subband power estimate $E_S(i,k)$. For example, gain factor calculator FC310 may be configured to calculate each of a set of q power ratios for each frame of the speech signal according to an expression such as $$G(i,k)=\frac{(\eta(i,k))E_E(i,k)+(1-\eta(i,k))E_S(i,k)}{E_S(i,k)},\ 1\le i\le q, \tag{14}$$

where $E_S(i,k)$ denotes the subband power estimate as produced by speech subband power estimate calculator SP100 (i.e., based on speech signal S40) for subband i and frame k, and $E_E(i,k)$ denotes the subband power estimate as produced by enhancement subband power estimate calculator EP100 (i.e., based on enhancement vector EV10) for subband i and frame k. The numerator of expression (14) represents a blended subband power estimate in which the relative contributions of the speech subband power estimate and the corresponding enhancement subband power estimate are weighted according to the corresponding noise level indication.

In a further example, ratio calculator GC10 is configured to calculate at least one (and possibly all) of the set of q ratios of subband power estimates for each frame of speech signal S40 according to an expression such as $$G(i,k)=\frac{(\eta(i,k))E_E(i,k)+(1-\eta(i,k))E_S(i,k)}{E_S(i,k)+\varepsilon},\ 1\le i\le q, \tag{15}$$

where $\epsilon$ is a tuning parameter having a small positive value (i.e., a value less than the expected value of $E_S(i,k)$). It may be desirable for such an implementation of ratio calculator GC10 to use the same value of tuning parameter $\epsilon$ for all of the subbands. Alternatively, it may be desirable for such an implementation of ratio calculator GC10 to use a different value of tuning parameter $\epsilon$ for each of two or more (possibly all) of the subbands. The value (or values) of tuning parameter $\epsilon$ may be fixed or may be adapted over time (e.g., from one frame to the next). Use of tuning parameter $\epsilon$ may help to avoid the possibility of a divide-by-zero error in ratio calculator GC10.

Figure 33D:
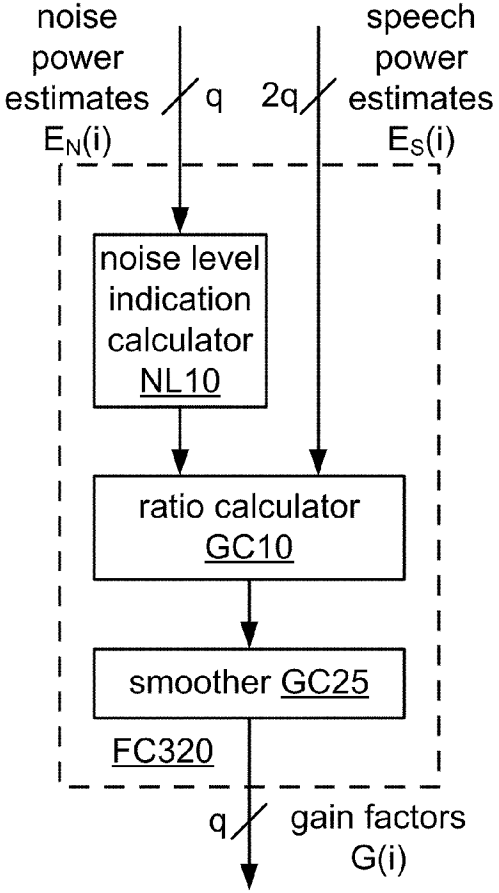
FIG. 33D shows a block diagram of an implementation FC320 of gain factor calculator FC300.

Gain factor calculator FC310 may also be configured to perform a smoothing operation on each of one or more (possibly all) of the q power ratios. FIG. 33D shows a block diagram of such an implementation FC320 of gain factor calculator FC310 that includes an instance GC25 of smoother GC20 that is arranged to perform a temporal smoothing operation on each of one or more (possibly all) of the q power ratios produced by ratio calculator GC10. In one such example, smoother GC25 is configured to perform a linear smoothing operation on each of the q power ratios according to an expression such as $$G(i,k)\leftarrow\beta G(i,k-1)+(1-\beta)G(i,k),1\le i\le q, \tag{16}$$

where $\beta$ is a smoothing factor. In this example, smoothing factor $\beta$ has a value in the range of from zero (no smoothing) to one (maximum smoothing, no updating) (e.g., 0.3, 0.5, 0.7, 0.9, 0.99, or 0.999).

It may be desirable for smoother GC25 to select one among two or more values of smoothing factor $\beta$ depending on a relation between the current and previous values of the gain factor. Accordingly, it may be desirable for the value of smoothing factor $\beta$ to be larger when the current value of the gain factor is less than the previous value, as compared to the value of smoothing factor $\beta$ when the current value of the gain factor is greater than the previous value. In one such example, smoother GC25 is configured to perform a linear smoothing operation on each of the q power ratios according to an expression such as $$G(i,k)\leftarrow\begin{cases}\beta_{att}G(i,k-1)+(1-\beta_{att})G(i,k), & G(i,k)>G(i,k-1)\\ \beta_{dec}G(i,k-1)+(1-\beta_{dec})G(i,k), & \text{otherwise,}\end{cases} \tag{17}$$

for $1\le i\le q$, where $\beta_{att}$ denotes an attack value for smoothing factor $\beta$, $\beta_{dec}$ denotes a decay value for smoothing factor $\beta$, and $\beta_{att}<\beta_{dec}$. Another implementation of smoother EC25 is configured to perform a linear smoothing operation on each of the q power ratios according to a linear smoothing expression such as one of the following:

$$G(i,k)\leftarrow\begin{cases}\beta_{att}G(i,k-1)+(1-\beta_{att})G(i,k), & G(i,k)>G(i,k-1)\\ \beta_{dec}G(i,k-1), & \text{otherwise,}\end{cases} \tag{18}$$

$$G(i,k)\leftarrow\begin{cases}\beta_{att}G(i,k-1)+(1-\beta_{att})G(i,k), & G(i,k)>G(i,k-1)\\ \max[\beta_{dec}G(i,k-1),G(i,k)], & \text{otherwise.}\end{cases} \tag{19}$$

Alternatively or additionally, expressions (17)-(19) may be implemented to select among values of $\beta$ based upon a relation between noise level indications (e.g., according to the value of the expression $\eta(i,k)>\eta(i,k-1)$).

FIG. 34A shows a pseudocode listing that describes one example of such smoothing according to expressions (15) and (18) above, which may be performed for each subband i at frame k. In this listing, the current value of the noise level indication is calculated, and the current value of the gain factor is initialized to a ratio of blended subband power to original speech subband power. If this ratio is less than the previous value of the gain factor, then the current value of the gain factor is calculated by scaling down the previous value by a scale factor beta_dec that has a value less than one. Otherwise, the current value of the gain factor is calculated as an average of the ratio and the previous value of the gain factor, using an averaging factor beta_att that has a value in the range of from zero (no smoothing) to one (maximum smoothing, no updating) (e.g., 0.3, 0.5, 0.7, 0.9, 0.99, or 0.999).

A further implementation of smoother GC25 may be configured to delay updates to one or more (possibly all) of the q gain factors when the degree of noise is decreasing. FIG. 34B shows a modification of the pseudocode listing of FIG. 34A that may be used to implement such a differential temporal smoothing operation. This listing includes hangover logic that delays updates during a ratio decay profile according to an interval specified by the value hangover_max(i), which may be in the range of, for example, from one or two to five, six, or eight. The same value of hangover_max may be used for each subband, or different values of hangover_max may be used for different subbands.

An implementation of gain factor calculator FC100 or FC300 as described herein may be further configured to apply an upper bound and/or a lower bound to one or more (possibly all) of the gain factors. FIGS. 35A and 35B show modifications of the pseudocode listings of FIGS. 34A and 34B, respectively, that may be used to apply such an upper bound UB and lower bound LB to each of the gain factor values. The values of each of these bounds may be fixed. Alternatively, the values of either or both of these bounds may be adapted according to, for example, a desired headroom for enhancer EN10 and/or a current volume of processed speech signal S50 (e.g., a current value of volume control signal VS10). Alternatively or additionally, the values of either or both of these bounds may be based on information from speech signal S40, such as a current level of speech signal S40.

Gain control element CE110 is configured to apply each of the gain factors to a corresponding subband of speech signal S40 (e.g., to apply the gain factors to speech signal S40 as a vector of gain factors) to produce processed speech signal S50. Gain control element CE110 may be configured to produce a frequency-domain version of processed speech signal S50, for example, by multiplying each of the frequency-domain subbands of a frame of speech signal S40 by a corresponding gain factor G(i). Other examples of gain control element CE110 are configured to use an overlap-add or overlap-save method to apply the gain factors to corresponding subbands of speech signal S40 (e.g., by applying the gain factors to respective filters of a synthesis filter bank).

Figure 36A:
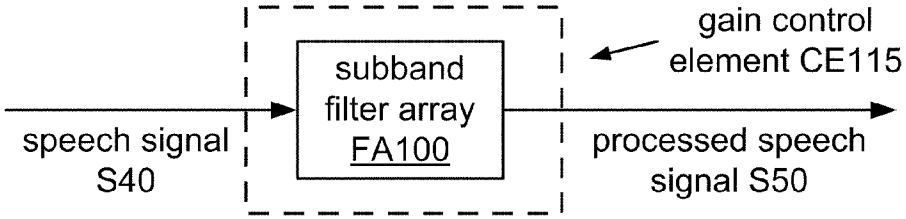
FIG. 36A shows a block diagram of an implementation CE115 of gain control element CE110.

Gain control element CE10 may be configured to produce a time-domain version of processed speech signal S50. FIG. 36A shows a block diagram of such an implementation CE115 of gain control element CE110 that includes a subband filter array FA100 having an array of bandpass filters, each configured to apply a respective one of the gain factors to a corresponding time-domain subband of speech signal S40. The filters of such an array may be arranged in parallel and/or in serial. In one example, array FA100 is implemented as a wavelet or polyphase synthesis filter bank. An implementation of enhancer EN110 that includes a time-domain implementation of gain control element CE110 and is configured to receive speech signal S40 as a frequency-domain signal may also include an instance of inverse transform module TR20 that is arranged to provide a time-domain version of speech signal S40 to gain control element CE110.

Figure 36B:
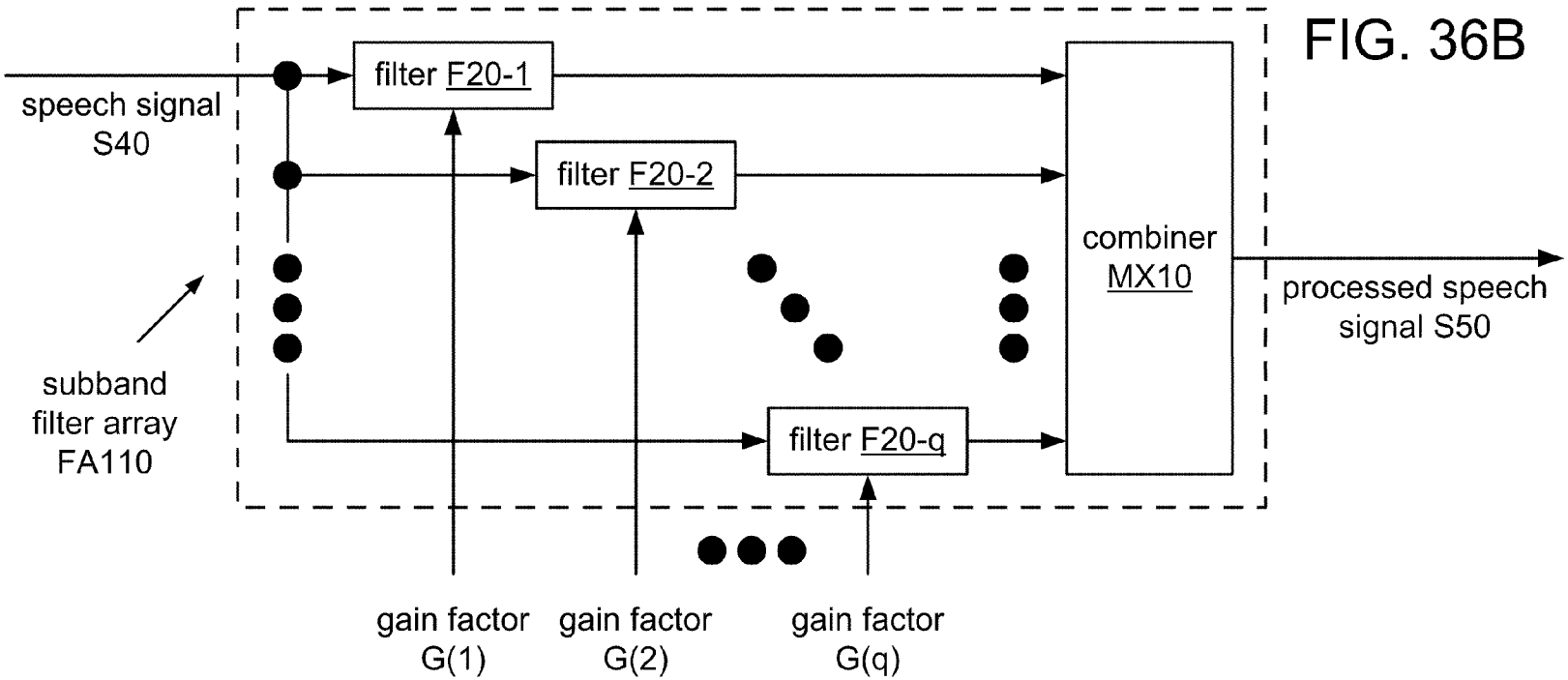
FIG. 36B shows a block diagram of an implementation FA110 of subband filter array FA100 that includes a set of bandpass filters arranged in parallel.

FIG. 36B shows a block diagram of an implementation FA110 of subband filter array FA100 that includes a set of q bandpass filters F20-1 to F20-*q* arranged in parallel. In this case, each of the filters F20-1 to F20-*q* is arranged to apply a corresponding one of q gain factors G(1) to G(q) (e.g., as calculated by gain factor calculator FC300) to a corresponding subband of speech signal S40 by filtering the subband according to the gain factor to produce a corresponding bandpass signal. Subband filter array FA110 also includes a combiner MX10 that is configured to mix the q bandpass signals to produce processed speech signal S50.

Figure 37A:
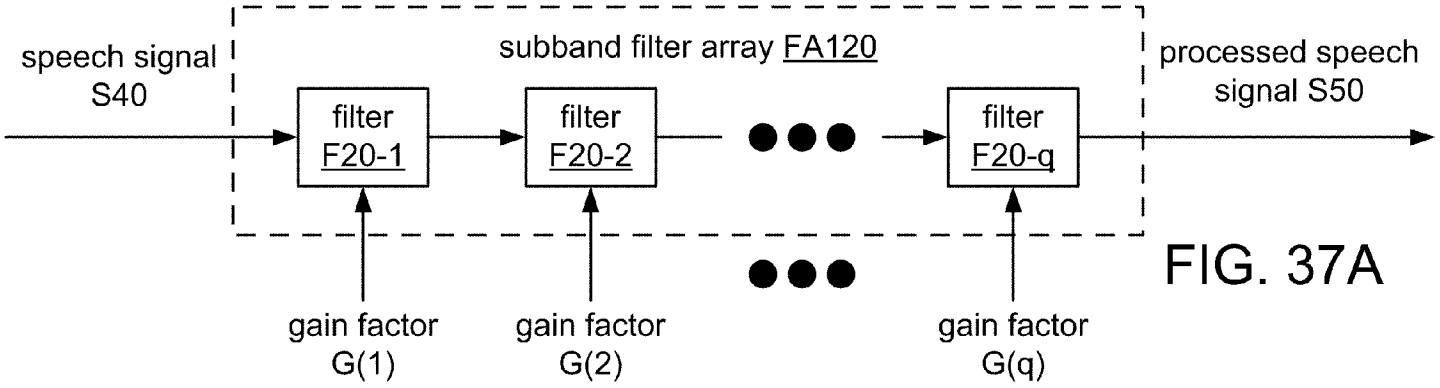
FIG. 37A shows a block diagram of an implementation FA120 of subband filter array FA100 in which the bandpass filters are arranged in serial.

FIG. 37A shows a block diagram of another implementation FA120 of subband filter array FA100 in which the bandpass filters F20-1 to F20-*q* are arranged to apply each of the gain factors G(1) to G(q) to a corresponding subband of speech signal S40 by filtering speech signal S40 according to the gain factors in serial (i.e., in a cascade, such that each filter F20-*k* is arranged to filter the output of filter F20-(*k*-1) for $2 \le k \le q$).

Each of the filters F20-1 to F20-*q* may be implemented to have a finite impulse response (FIR) or an infinite impulse response (IIR). For example, each of one or more (possibly all) of filters F20-1 to F20-*q* may be implemented as a biquad. For example, subband filter array FA120 may be implemented as a cascade of biquads. Such an implementation may also be referred to as a biquad IIR filter cascade, a cascade of second-order IIR sections or filters, or a series of subband IIR biquads in cascade. It may be desirable to implement each biquad using the transposed direct form II, especially for floating-point implementations of enhancer EN10.

It may be desirable for the passbands of filters F20-1 to F20-*q* to represent a division of the bandwidth of speech signal S40 into a set of nonuniform subbands (e.g., such that two or more of the filter passbands have different widths) rather than a set of uniform subbands (e.g., such that the filter passbands have equal widths). As noted above, examples of nonuniform subband division schemes include transcendental schemes, such as a scheme based on the Bark scale, or logarithmic schemes, such as a scheme based on the Mel scale. Filters F20-1 to F20-*q* may be configured in accordance with a Bark scale division scheme as illustrated by the dots in FIG. 27, for example. Such an arrangement of subbands may be used in a wideband speech processing system (e.g., a device having a sampling rate of 16 kHz). In other examples of such a division scheme, the lowest subband is omitted to obtain a six-subband scheme and/or the upper limit of the highest subband is increased from 7700 Hz to 8000 Hz.

In a narrowband speech processing system (e.g., a device that has a sampling rate of 8 kHz), it may be desirable to design the passbands of filters F20-1 to F20-*q* according to a division scheme having fewer than six or seven subbands. One example of such a subband division scheme is the four-band quasi-Bark scheme 300-510 Hz, 510-920 Hz, 920-1480 Hz, and 1480-4000 Hz. Use of a wide high-frequency band (e.g., as in this example) may be desirable because of low subband energy estimation and/or to deal with difficulty in modeling the highest subband with a biquad.

Each of the gain factors G(1) to G(q) may be used to update one or more filter coefficient values of a corresponding one of filters F20-1 to F20-*q*. In such case, it may be desirable to configure each of one or more (possibly all) of the filters F20-1 to F20-*q* such that its frequency characteristics (e.g., the center frequency and width of its passband) are fixed and its gain is variable. Such a technique may be implemented for an FIR or IIR filter by varying only the values of the feedforward coefficients (e.g., the coefficients $b_0$, $b_1$, and $b_2$ in biquad expression (1) above) by a common factor (e.g., the current value of the corresponding one of gain factors G(1) to G(q)). For example, the values of each of the feedforward coefficients in a biquad implementation of one F20-*i* of filters F20-1 to F20-*q* may be varied according to the current value of a corresponding one G(i) of gain factors G(1) to G(q) to obtain the following transfer function:

$$H_i(z) = \frac{G(i)b_0(i) + G(i)b_1(i)z^{-1} + G(i)b_2(i)z^{-2}}{1 + a_1(i)z^{-1} + a_2(i)z^{-2}}. \tag{20}$$

Figure 37B:
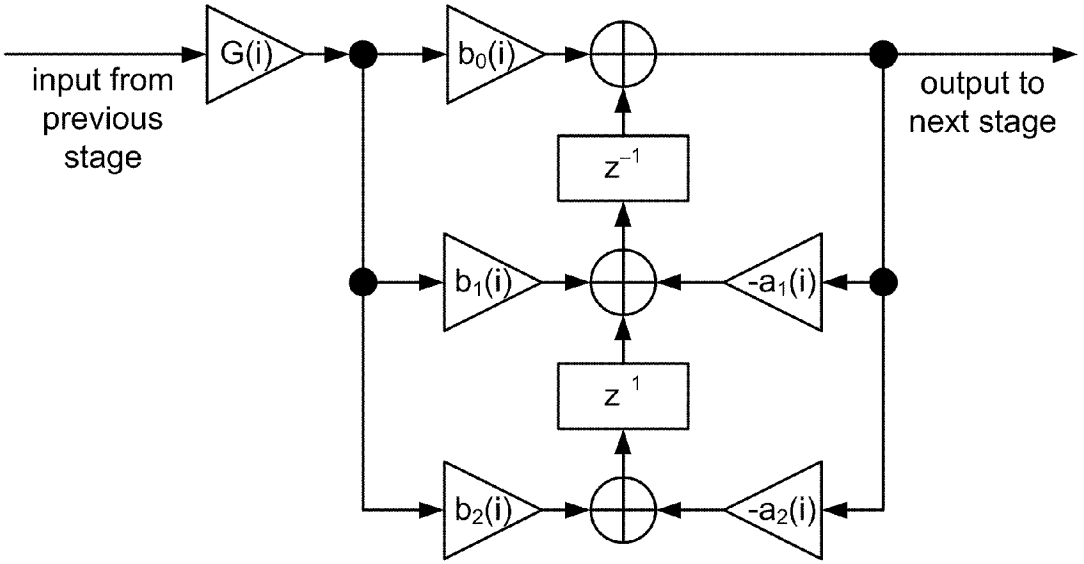
FIG. 37B shows another example of a biquad implementation of an IIR filter.

FIG. 37B shows another example of a biquad implementation of one F20-*i* of filters F20-1 to F20-*q* in which the filter gain is varied according to the current value of the corresponding gain factor G(i).

It may be desirable to implement subband filter array FA100 such that its effective transfer function over a frequency range of interest (e.g., from 50, 100, or 200 Hz to 3000, 3500, 4000, 7000, 7500, or 8000 Hz) is substantially a constant when all of the gain factors G(1) to G(q) are equal to one. For example, it may be desirable for the effective transfer function of subband filter array FA100 to be constant to within five, ten, or twenty percent (e.g., within 0.25, 0.5, or one decibels) over the frequency range when all of the gain factors G(1) to G(q) are equal to one. In one particular example, the effective transfer function of subband filter array FA100 is substantially equal to one when all of the gain factors G(1) to G(q) are equal to one.

It may be desirable for subband filter array FA100 to apply the same subband division scheme as an implementation of subband filter array SG10 of speech subband signal generator SG100 and/or an implementation of a subband filter array SG10 of enhancement subband signal generator EG100. For example, it may be desirable for subband filter array FA100 to use a set of filters having the same design as those of such a filter or filters (e.g., a set of biquads), with fixed values being used for the gain factors of the subband filter array or arrays SG10. Subband filter array FA100 may even be implemented using the same component filters as such a subband filter array or arrays (e.g., at different times, with different gain factor values, and possibly with the component filters being differently arranged, as in the cascade of array FA120).

It may be desirable to design subband filter array FA100 according to stability and/or quantization noise considerations. As noted above, for example, subband filter array FA120 may be implemented as a cascade of second-order sections. Use of a transposed direct form II biquad structure to implement such a section may help to minimize round-off noise and/or to obtain robust coefficient/frequency sensitivities within the section. Enhancer EN10 may be configured to perform scaling of filter input and/or coefficient values, which may help to avoid overflow conditions. Enhancer EN10 may be configured to perform a sanity check operation that resets the history of one or more IIR filters of subband filter array FA100 in case of a large discrepancy between filter input and output. Numerical experiments and online testing have led to the conclusion that enhancer EN10 may be implemented without any modules for quantization noise compensation, but one or more such modules may be included as well (e.g., a module configured to perform a dithering operation on the output of each of one or more filters of subband filter array FA100).

As described above, subband filter array FA100 may be implemented using component filters (e.g., biquads) that are suitable for boosting respective subbands of speech signal S40. However, it may also be desirable in some cases to attenuate one or more subbands of speech signal S40 relative to other subbands of speech signal S40. For example, it may be desirable to amplify one or more spectral peaks and also to attenuate one or more spectral valleys. Such attenuation may be performed by attenuating speech signal S40 upstream of subband filter array FA100 according to the largest desired attenuation for the frame, and increasing the values of the gain factors of the frame for the other subbands accordingly to compensate for the attenuation. For example, attenuation of subband i by two decibels may be accomplished by attenuating speech signal S40 by two decibels upstream of subband filter array FA100, passing subband i through array FA100 without boosting, and increasing the values of the gain factors for the other subbands by two decibels. As an alternative to applying the attenuation to speech signal S40 upstream of subband filter array FA100, such attenuation may be applied to processed speech signal S50 downstream of subband filter array FA100.

Figure 38:
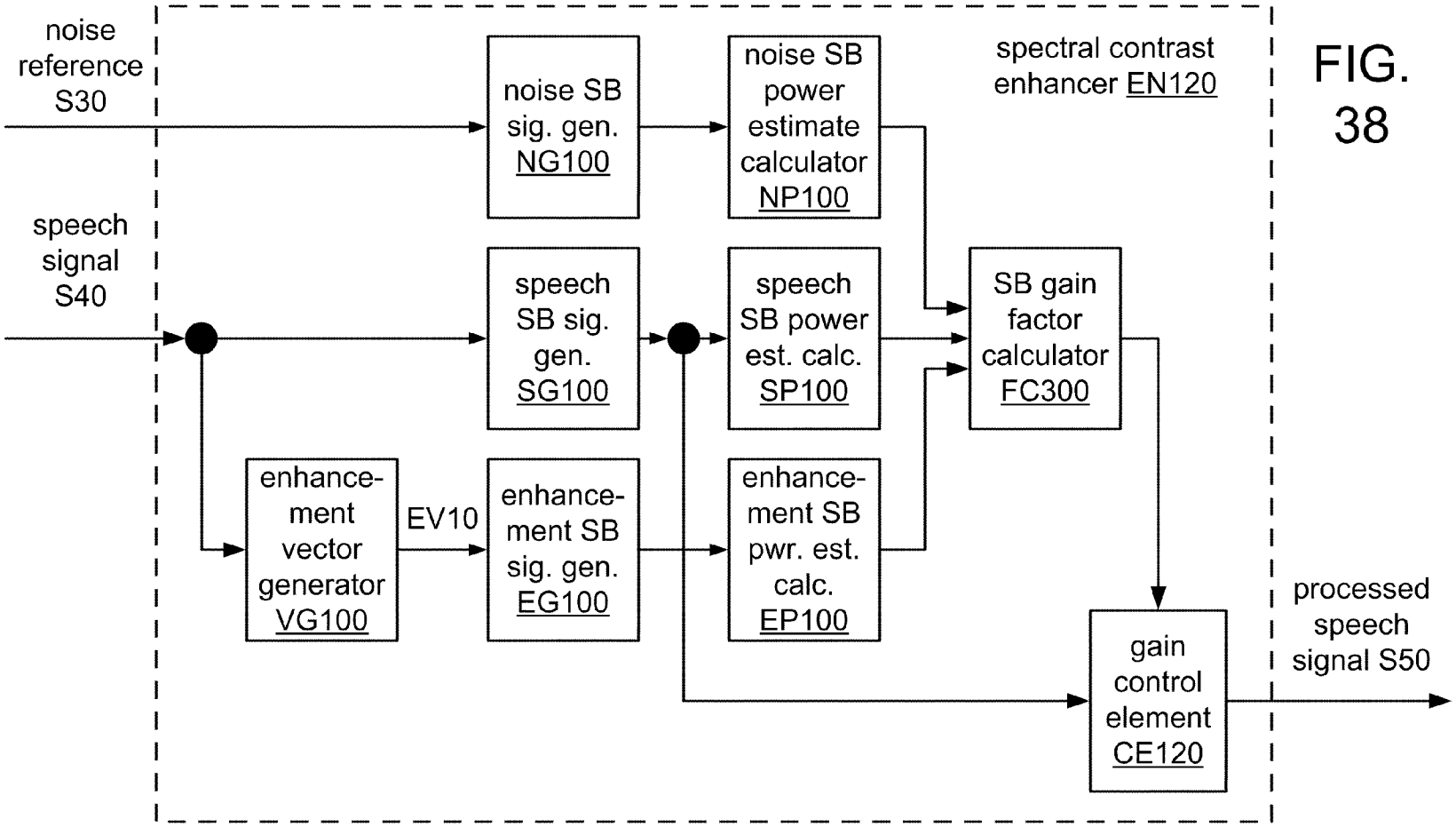
FIG. 38 shows a block diagram of an implementation EN120 of enhancer EN10.
Figure 39:
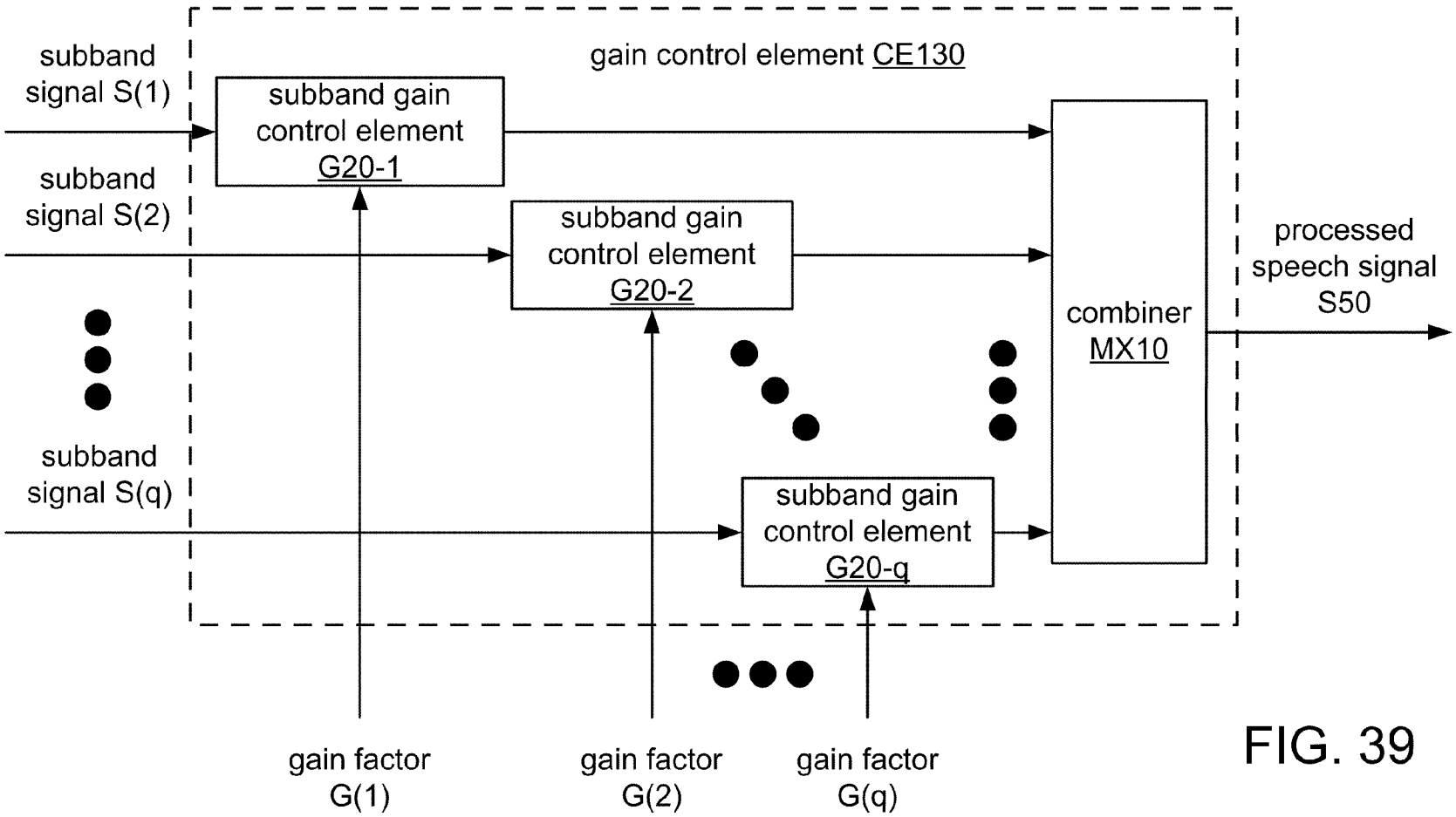
FIG. 39 shows a block diagram of an implementation CE130 of gain control element CE120.

FIG. 38 shows a block diagram of an implementation EN120 of spectral contrast enhancer EN10. As compared to enhancer EN110, enhancer EN120 includes an implementation CE120 of gain control element CE100 that is configured to process the set of q subband signals S(i) produced from speech signal S40 by speech subband signal generator SG100. For example, FIG. 39 shows a block diagram of an implementation CE130 of gain control element CE120 that includes an array of subband gain control elements G20-1 to G20-*q* and an instance of combiner MX10. Each of the q subband gain control elements G20-1 to G20-*q* (which may be implemented as, e.g., multipliers or amplifiers) is arranged to apply a respective one of the gain factors G(1) to G(q) to a respective one of the subband signals S(1) to S(q). Combiner MX10 is arranged to combine (e.g., to mix) the gain-controlled subband signals to produce processed speech signal S50.

For a case in which enhancer EN100, EN110, or EN120 receives speech signal S40 as a transform-domain signal (e.g., as a frequency-domain signal), the corresponding gain control element CE100, CE10, or CE120 may be configured to apply the gain factors to the respective subbands in the transform domain. For example, such an implementation of gain control element CE100, CE110, or CE120 may be configured to multiply each subband by a corresponding one of the gain factors, or to perform an analogous operation using logarithmic values (e.g., adding gain factor and subband values in decibels). An alternate implementation of enhancer EN100, EN110, or EN120 may be configured to convert speech signal S40 from the transform domain to the time domain upstream of the gain control element.

It may be desirable to configure enhancer EN10 to pass one or more subbands of speech signal S40 without boosting. Boosting of a low-frequency subband, for example, may lead to muffling of other subbands, and it may be desirable for enhancer EN10 to pass one or more low-frequency subbands of speech signal S40 (e.g., a subband that includes frequencies less than 300 Hz) without boosting.

Such an implementation of enhancer EN100, EN110, or EN120, for example, may include an implementation of gain control element CE100, CE110, or CE120 that is configured to pass one or more subbands without boosting. In one such case, subband filter array FA110 may be implemented such that one or more of the subband filters F20-1 to F20-*q* applies a gain factor of one (e.g., zero dB). In another such case, subband filter array FA120 may be implemented as a cascade of fewer than all of the filters F20-1 to F20-*q*. In a further such case, gain control element CE100 or CE120 may be implemented such that one or more of the gain control elements G20-1 to G20-*q* applies a gain factor of one (e.g., zero dB) or is otherwise configured to pass the respective subband signal without changing its level.

It may be desirable to avoid enhancing the spectral contrast of portions of speech signal S40 that contain only background noise or silence. For example, it may be desirable to configure apparatus A100 to bypass enhancer EN10, or to otherwise suspend or inhibit spectral contrast enhancement of speech signal S40, during intervals in which speech signal S40 is inactive. Such an implementation of apparatus A100 may include a voice activity detector (VAD) that is configured to classify a frame of speech signal S40 as active (e.g., speech) or inactive (e.g., background noise or silence) based on one or more factors such as frame energy, signal-to-noise ratio, periodicity, autocorrelation of speech and/or residual (e.g., linear prediction coding residual), zero crossing rate, and/or first reflection coefficient. Such classification may include comparing a value or magnitude of such a factor to a threshold value and/or comparing the magnitude of a change in such a factor to a threshold value.

Figure 40A:
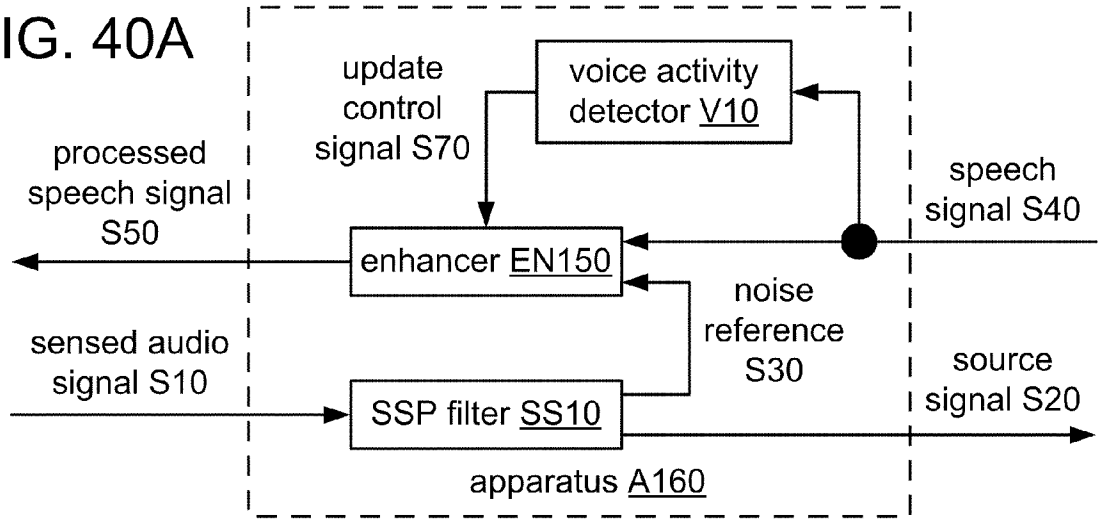
FIG. 40A shows a block diagram of an implementation A160 of apparatus A100.

FIG. 40A shows a block diagram of an implementation A160 of apparatus A100 that includes such a VAD V10. Voice activity detector V10 is configured to produce an update control signal S70 whose state indicates whether speech activity is detected on speech signal S40. Apparatus A160 also includes an implementation EN150 of enhancer EN10 (e.g., of enhancer EN110 or EN120) that is controlled according to the state of update control signal S70. Such an implementation of enhancer EN10 may be configured such that updates of the gain factor values and/or updates of the noise level indications $\eta$ are inhibited during intervals of speech signal S40 when speech is not detected. For example, enhancer EN150 may be configured such that gain factor calculator FC300 outputs the previous values of the gain factor values for frames of speech signal S40 in which speech is not detected.

In another example, enhancer EN150 includes an implementation of gain factor calculator FC300 that is configured to force the values of the gain factors to a neutral value (e.g., indicating no contribution from enhancement vector EV10, or a gain factor of zero decibels), or to force the values of the gain factors to decay to a neutral value over two or more frames, when VAD V10 indicates that the current frame of speech signal S40 is inactive. Alternatively or additionally, enhancer EN150 may include an implementation of gain factor calculator FC300 that is configured to set the values of the noise level indications $\eta$ to zero, or to allow the values of the noise level indications to decay to zero, when VAD V10 indicates that the current frame of speech signal S40 is inactive.

Voice activity detector V10 may be configured to classify a frame of speech signal S40 as active or inactive (e.g., to control a binary state of update control signal S70) based on one or more factors such as frame energy, signal-to-noise ratio (SNR), periodicity, zero-crossing rate, autocorrelation of speech and/or residual, and first reflection coefficient. Such classification may include comparing a value or magnitude of such a factor to a threshold value and/or comparing the magnitude of a change in such a factor to a threshold value. Alternatively or additionally, such classification may include comparing a value or magnitude of such a factor, such as energy, or the magnitude of a change in such a factor, in one frequency band to a like value in another frequency band. It may be desirable to implement VAD V10 to perform voice activity detection based on multiple criteria (e.g., energy, zero-crossing rate, etc.) and/or a memory of recent VAD decisions. One example of a voice activity detection operation that may be performed by VAD V10 includes comparing highband and lowband energies of speech signal S40 to respective thresholds as described, for example, in section 4.7 (pp. 4-49 to 4-57) of the 3GPP2 document C.S0014-C, v1.0, entitled "Enhanced Variable Rate Codec, Speech Service Options 3, 68, and 70 for Wideband Spread Spectrum Digital Systems," January 2007 (available online at www-dot-3gpp-dot-org). Voice activity detector V10 is typically configured to produce update control signal S70 as a binary-valued voice detection indication signal, but configurations that produce a continuous and/or multi-valued signal are also possible.

Figure 40B:
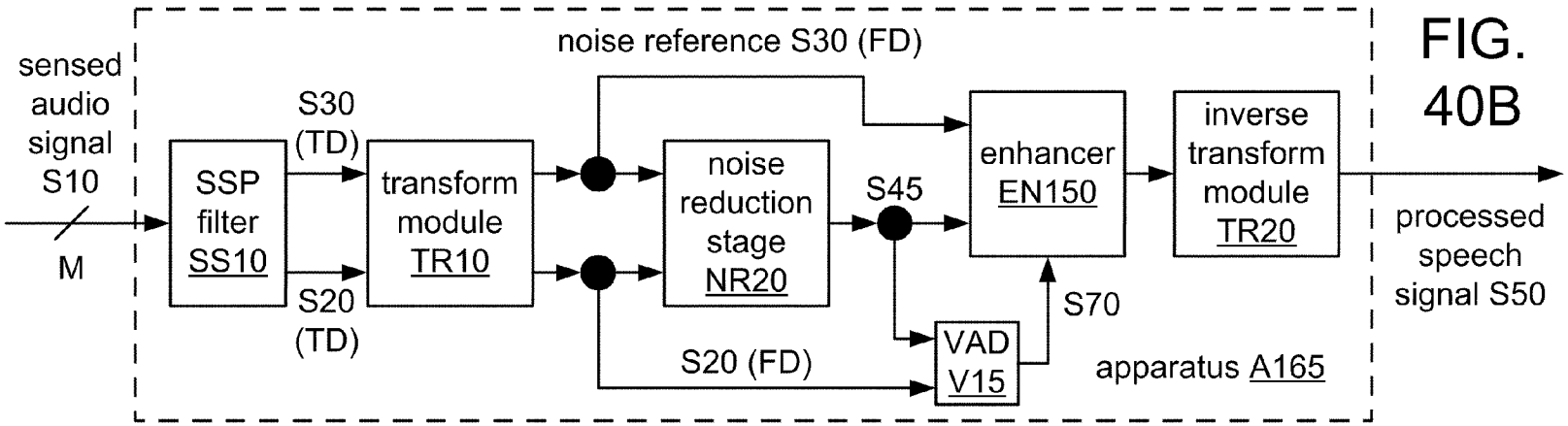
FIG. 40B shows a block diagram of an implementation A165 of apparatus A140 (and of apparatus A165).

Apparatus A110 may be configured to include an implementation V15 of voice activity detector V10 that is configured to classify a frame of source signal S20 as active or inactive based on a relation between the input and output of noise reduction stage NR20 (i.e., based on a relation between source signal S20 and noise-reduced speech signal S45). The value of such a relation may be considered to indicate the gain of noise reduction stage NR20. FIG. 40B shows a block diagram of such an implementation A165 of apparatus A140 (and of apparatus A160).

In one example, VAD V15 is configured to indicate whether a frame is active based on the number of frequency-domain bins that are passed by stage NR20. In this case, update control signal S70 indicates that the frame is active if the number of passed bins exceeds (alternatively, is not less than) a threshold value, and inactive otherwise. In another example, VAD V15 is configured to indicate whether a frame is active based on the number of frequency-domain bins that are blocked by stage NR20. In this case, update control signal S70 indicates that the frame is inactive if the number of blocked bins exceeds (alternatively, is not less than) a threshold value, and active otherwise. In determining whether the frame is active or inactive, it may be desirable for VAD V15 to consider only bins that are more likely to contain speech energy, such as low-frequency bins (e.g., bins containing values for frequencies not above one kilohertz, fifteen hundred hertz, or two kilohertz) or mid-frequency bins (e.g., low-frequency bins containing values for frequencies not less than two hundred hertz, three hundred hertz, or five hundred hertz).

FIG. 41 shows a modification of the pseudocode listing of FIG. 35A in which the state of variable VAD (e.g., update control signal S70) is 1 when the current frame of speech signal S40 is active and 0 otherwise. In this example, which may be performed by a corresponding implementation of gain factor calculator FC300, the current value of the subband gain factor for subband i and frame k is initialized to the most recent value, and the value of the subband gain factor is not updated for inactive frames. FIG. 42 shows another modification of the pseudocode listing of FIG. 35A in which the value of the subband gain factor decays to one during periods when no voice activity is detected (i.e., for inactive frames).

It may be desirable to apply one or more instances of VAD V10 elsewhere in apparatus A100. For example, it may be desirable to arrange an instance of VAD V10 to detect speech activity on one or more of the following signals: at least one channel of sensed audio signal S10 (e.g., a primary channel), at least one channel of filtered signal S15, and source signal S20. The corresponding result may be used to control an operation of adaptive filter AF10 of SSP filter SS20. For example, it may be desirable to configure apparatus A100 to activate training (e.g., adaptation) of adaptive filter AF10, to increase a training rate of adaptive filter AF10, and/or to increase a depth of adaptive filter AF10, when a result of such a voice activity detection operation indicates that the current frame is active, and/or to deactivate training and/or reduce such values otherwise.

It may be desirable to configure apparatus A100 to control the level of speech signal S40. For example, it may be desirable to configure apparatus A100 to control the level of speech signal S40 to provide sufficient headroom to accommodate subband boosting by enhancer EN10. Additionally or in the alternative, it may be desirable to configure apparatus A100 to determine values for either or both of noise level indication bounds $\eta_{min}$ and $\eta_{max}$, and/or for either or both of gain factor value bounds UB and LB, as disclosed above with reference to gain factor calculator FC300, based on information regarding speech signal S40 (e.g., a current level of speech signal S40).

Figure 43A:
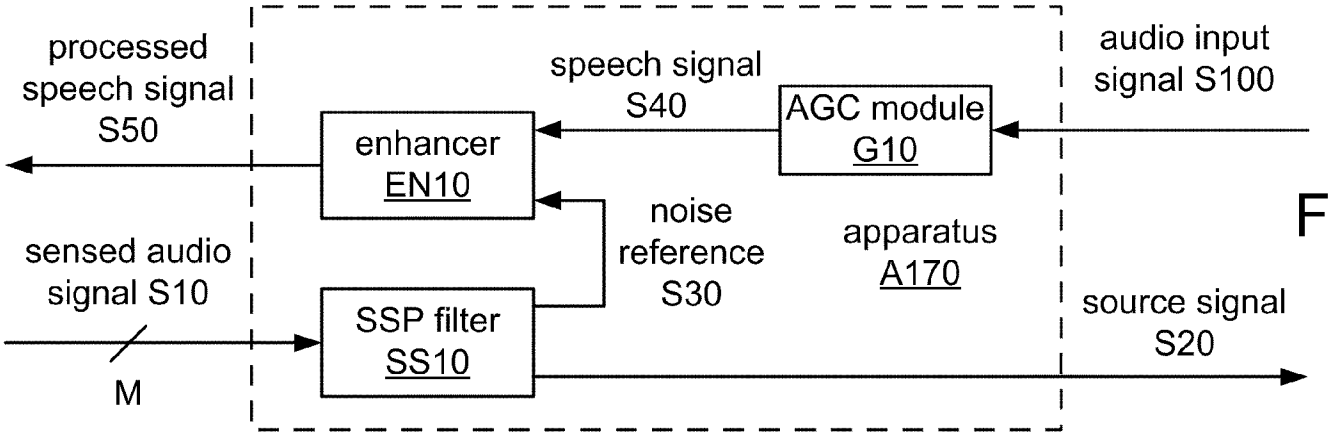
FIG. 43A shows a block diagram of an implementation A170 of apparatus A100.

FIG. 43A shows a block diagram of an implementation A170 of apparatus A100 in which enhancer EN10 is arranged to receive speech signal S40 via an automatic gain control (AGC) module G10. Automatic gain control module G10 may be configured to compress the dynamic range of an audio input signal S100 into a limited amplitude band, according to any AGC technique known or to be developed, to obtain speech signal S40. Automatic gain control module G10 may be configured to perform such dynamic range compression by, for example, boosting segments (e.g., frames) of the input signal that have low power and attenuating segments of the input signal that have high power. For an application in which speech signal S40 is a reproduced audio signal (e.g., a far-end communications signal, a streaming audio signal, or a signal decoded from a stored media file), apparatus A170 may be arranged to receive audio input signal S100 from a decoding stage. A corresponding instance of communications device D100 as described below may be constructed to include an implementation of apparatus A100 that is also an implementation of apparatus A170 (i.e., that includes AGC module G10). For an application in which enhancer EN10 is arranged to receive source signal S20 as speech signal S40 (e.g., as in apparatus A110 as described above), audio input signal S100 may be based on sensed audio signal S10.

Automatic gain control module G10 may be configured to provide a headroom definition and/or a master volume setting. For example, AGC module G10 may be configured to provide values for either or both of upper bound UB and lower bound LB as disclosed above, and/or for either or both of noise level indication bounds $\eta_{min}$ and $\eta_{max}$ as disclosed above, to enhancer EN10. Operating parameters of AGC module G10, such as a compression threshold and/or volume setting, may limit the effective headroom of enhancer EN10. It may be desirable to tune apparatus A100 (e.g., to tune enhancer EN10 and/or AGC module G10 if present) such that in the absence of noise on sensed audio signal S10, the net effect of apparatus A100 is substantially no gain amplification (e.g., with a difference in levels between speech signal S40 and processed speech signal S50 being less than about plus or minus five, ten, or twenty percent).

Time-domain dynamic range compression may increase signal intelligibility by, for example, increasing the perceptibility of a change in the signal over time. One particular example of such a signal change involves the presence of clearly defined formant trajectories over time, which may contribute significantly to the intelligibility of the signal. The start and end points of formant trajectories are typically marked by consonants, especially stop consonants (e.g., [k], [t], [p], etc.). These marking consonants typically have low energies as compared to the vowel content and other voiced parts of speech. Boosting the energy of a marking consonant may increase intelligibility by allowing a listener to more clearly follow speech onset and offsets. Such an increase in intelligibility differs from that which may be gained through frequency subband power adjustment (e.g., as described herein with reference to enhancer EN10). Therefore, exploiting synergies between these two effects (e.g., in an implementation of apparatus A170, and/or in an implementation EG120 of contrast-enhanced signal generator EG10 as described above) may allow a considerable increase in the overall speech intelligibility.

Figure 43B:
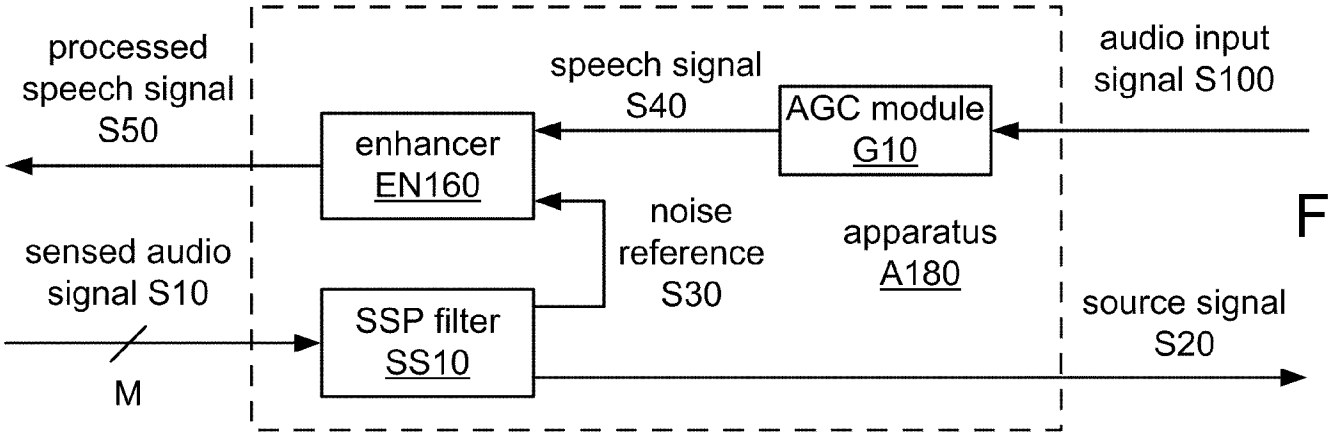
FIG. 43B shows a block diagram of an implementation A180 of apparatus A170.
Figure 44:
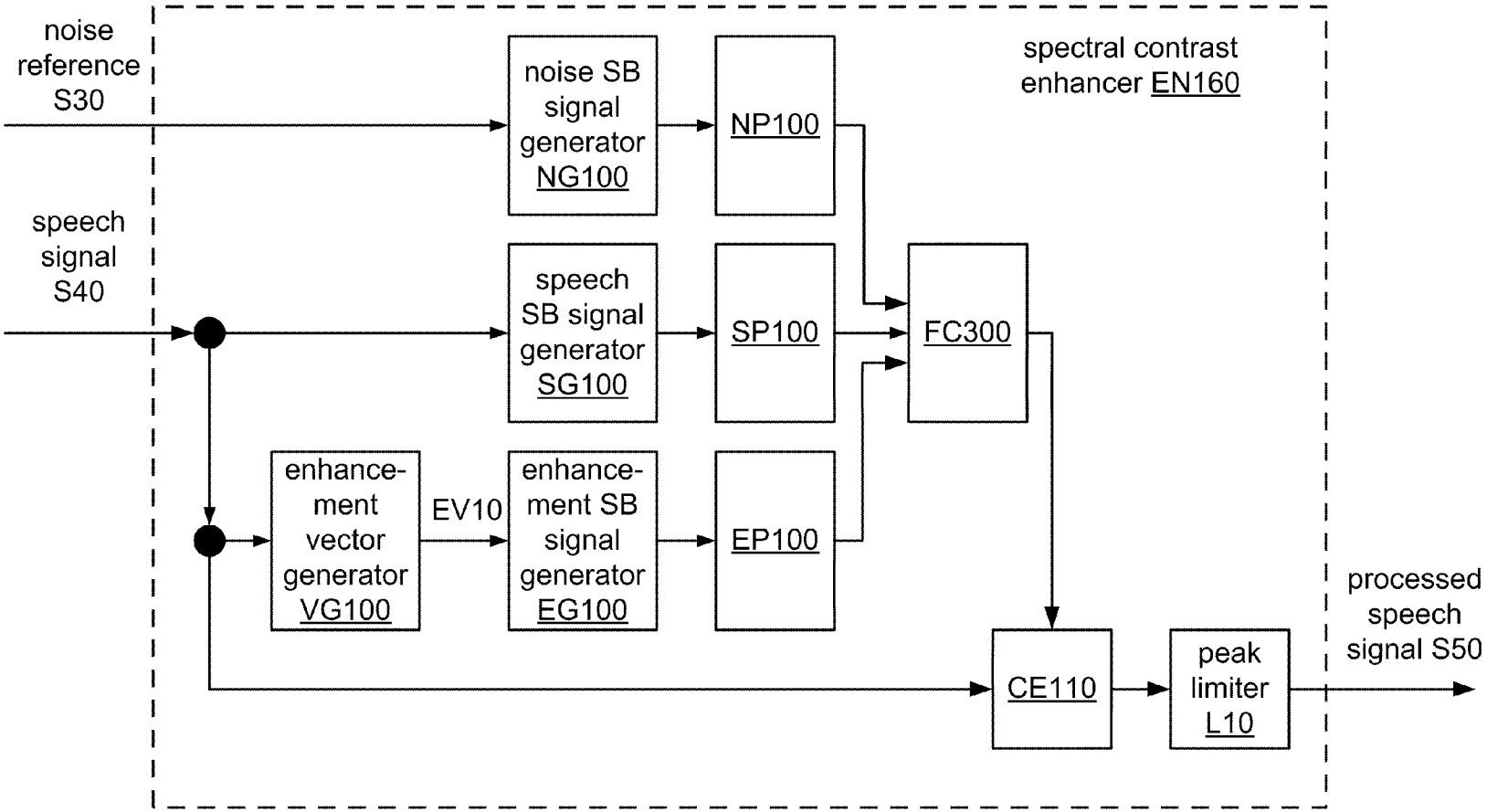
FIG. 44 shows a block diagram of an implementation EN160 of enhancer EN110 that includes a peak limiter L10.

It may be desirable to configure apparatus A100 to further control the level of processed speech signal S50. For example, apparatus A100 may be configured to include an AGC module (in addition to, or in the alternative to, AGC module G10) that is arranged to control the level of processed speech signal S50. FIG. 44 shows a block diagram of an implementation EN160 of enhancer EN20 that includes a peak limiter L10 arranged to limit the acoustic output level of the spectral contrast enhancer. Peak limiter L10 may be implemented as a variable-gain audio level compressor. For example, peak limiter L10 may be configured to compress high peak values to threshold values such that enhancer EN160 achieves a combined spectral-contrast-enhancement/compression effect. FIG. 43B shows a block diagram of an implementation A180 of apparatus A100 that includes enhancer EN160 as well as AGC module G10.

The pseudocode listing of FIG. 45A describes one example of a peak limiting operation that may be performed by peak limiter L10. For each sample k of an input signal sig (e.g., for each sample k of processed speech signal S50), this operation calculates a difference pkdiff between the sample magnitude and a soft peak limit peak_lim. The value of peak_lim may be fixed or may be adapted over time. For example, the value of peak_lim may be based on information from AGC module G10. Such information may include, for example, any of the following: the value of upper bound UB and/or lower bound LB, the value of noise level indication bound $\eta_{min}$ and/or $\eta_{max}$, information relating to a current level of speech signal S40.

If the value of pkdiff is at least zero, then the sample magnitude does not exceed the peak limit peak_lim. In this case, a differential gain value diffgain is set to one. Otherwise, the sample magnitude is greater than the peak limit peak_lim, and diffgain is set to a value that is less than one in proportion to the excess magnitude.

The peak limiting operation may also include smoothing of the differential gain value. Such smoothing may differ according to whether the gain is increasing or decreasing over time. As shown in FIG. 45A, for example, if the value of diffgain exceeds the previous value of peak gain parameter g_pk, then the value of g_pk is updated using the previous value of g_pk, the current value of diffgain, and an attack gain smoothing parameter gamma_att. Otherwise, the value of g_pk is updated using the previous value of g_pk, the current value of diffgain, and a decay gain smoothing parameter gamma_dec. The values gamma_att and gamma_dec are selected from a range of about zero (no smoothing) to about 0.999 (maximum smoothing). The corresponding sample k of input signal sig is then multiplied by the smoothed value of g_pk to obtain a peak-limited sample.

FIG. 45B shows a modification of the pseudocode listing of FIG. 45A that uses a different expression to calculate differential gain value diffgain. As an alternative to these examples, peak limiter L10 may be configured to perform a further example of a peak limiting operation as described in FIG. 45A or 45B in which the value of pkdiff is updated less frequently (e.g., in which the value of pkdiff is calculated as a difference between peak_lim and an average of the absolute values of several samples of signal sig).

As noted herein, a communications device may be constructed to include an implementation of apparatus A100. At some times during the operation of such a device, it may be desirable for apparatus A100 to enhance the spectral contrast of speech signal S40 according to information from a reference other than noise reference S30. In some environments or orientations, for example, a directional processing operation of SSP filter SS10 may produce an unreliable result. In some operating modes of the device, such as a push-to-talk (PTT) mode or a speakerphone mode, spatially selective processing of the sensed audio channels may be unnecessary or undesirable. In such cases, it may be desirable for apparatus A100 to operate in a non-spatial (or "single-channel") mode rather than a spatially selective (or "multichannel") mode.

An implementation of apparatus A100 may be configured to operate in a single-channel mode or a multichannel mode according to the current state of a mode select signal. Such an implementation of apparatus A100 may include a separation evaluator that is configured to produce the mode select signal (e.g., a binary flag) based on a quality of at least one among sensed audio signal S10, source signal S20, and noise reference S30. The criteria used by such a separation evaluator to determine the state of the mode select signal may include a relation between a current value of one or more of the following parameters to a corresponding threshold value: a difference or ratio between energy of source signal S20 and energy of noise reference S30; a difference or ratio between energy of noise reference S20 and energy of one or more channels of sensed audio signal S10; a correlation between source signal S20 and noise reference S30; a likelihood that source signal S20 is carrying speech, as indicated by one or more statistical metrics of source signal S20 (e.g., kurtosis, autocorrelation). In such cases, a current value of the energy of a signal may be calculated as a sum of squared sample values of a block of consecutive samples (e.g., the current frame) of the signal.

Such an implementation A200 of apparatus A100 may include a separation evaluator EV10 that is configured to produce a mode select signal S80 based on information from source signal S20 and noise reference S30 (e.g., based on a difference or ratio between energy of source signal S20 and energy of noise reference S30). Such a separation evaluator may be configured to produce mode select signal S80 to have a first state when it determines that SSP filter SS10 has sufficiently separated a desired sound component (e.g., the user's voice) into source signal S20 and to have a second state otherwise. In one such example, separation evaluator EV10 is configured to indicate sufficient separation when it determines that a difference between a current energy of source signal S20 and a current energy of noise reference S30 exceeds (alternatively, is not less than) a corresponding threshold value. In another such example, separation evaluator EV10 is configured to indicate sufficient separation when it determines that a correlation between a current frame of source signal S20 and a current frame of noise reference S30 is less than (alternatively, does not exceed) a corresponding threshold value.

An implementation of apparatus A100 that includes an instance of separation evaluator EV10 may be configured to bypass enhancer EN10 when mode select signal S80 has the second state. Such an arrangement may be desirable, for example, for an implementation of apparatus A10 in which enhancer EN10 is configured to receive source signal S20 as the speech signal. In one example, bypassing enhancer EN10 is performed by forcing the gain factors for that frame to a neutral value (e.g., indicating no contribution from enhancement vector EV10, or a gain factor of zero decibels) such that gain control element CE100, CE10, or CE120 passes speech signal S40 without change. Such forcing may be implemented suddenly or gradually (e.g., as a decay over two or more frames).

Figure 46:
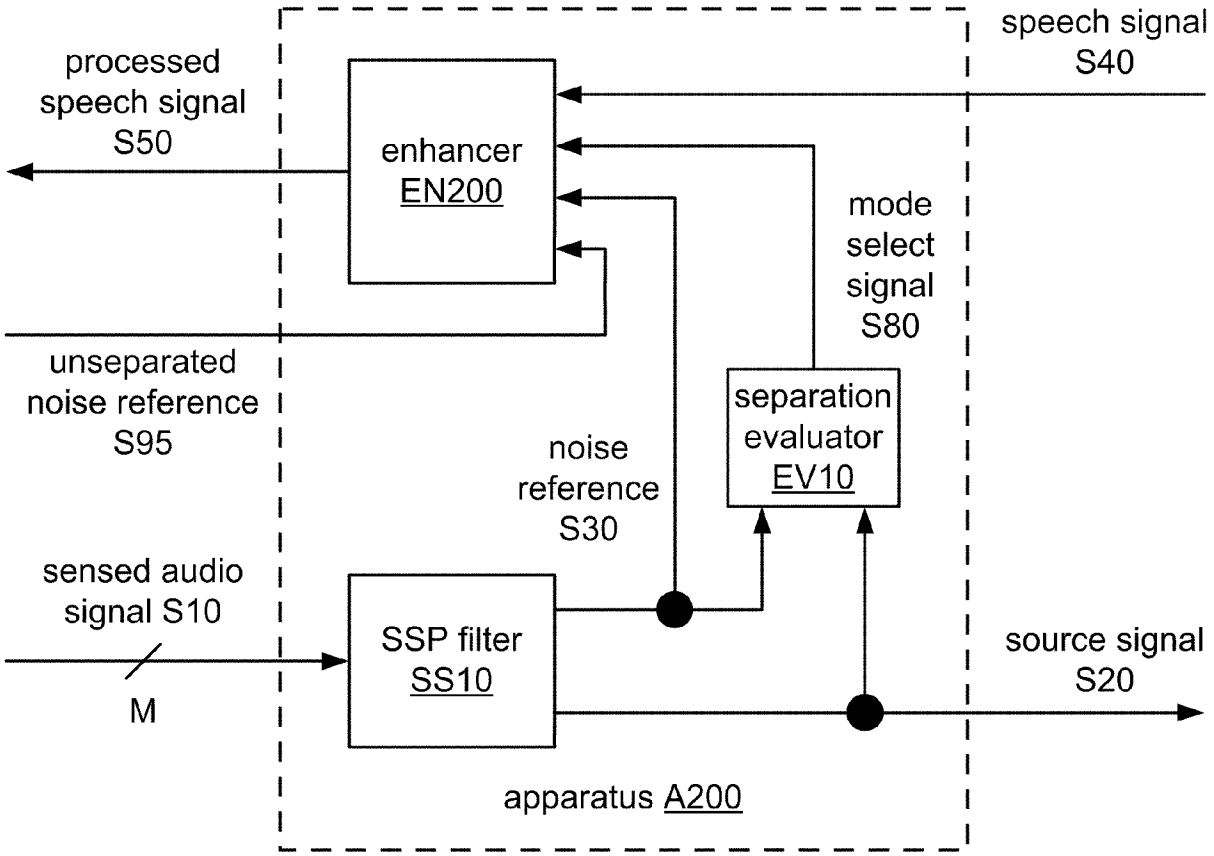
FIG. 46 shows a block diagram of an implementation A200 of apparatus A100 that includes a separation evaluator EV10.

FIG. 46 shows a block diagram of an alternate implementation A200 of apparatus A100 that includes an implementation EN200 of enhancer EN10. Enhancer EN200 is configured to operate in a multichannel mode (e.g., according to any of the implementations of enhancer EN10 disclosed above) when mode select signal S80 has the first state and to operate in a single-channel mode when mode select signal S80 has the second state. In the single-channel mode, enhancer EN200 is configured to calculate the gain factor values G(1) to G(q) based on a set of subband power estimates from an unseparated noise reference S95. Unseparated noise reference S95 is based on an unseparated sensed audio signal (for example, on one or more channels of sensed audio signal S10).

Figure 47:
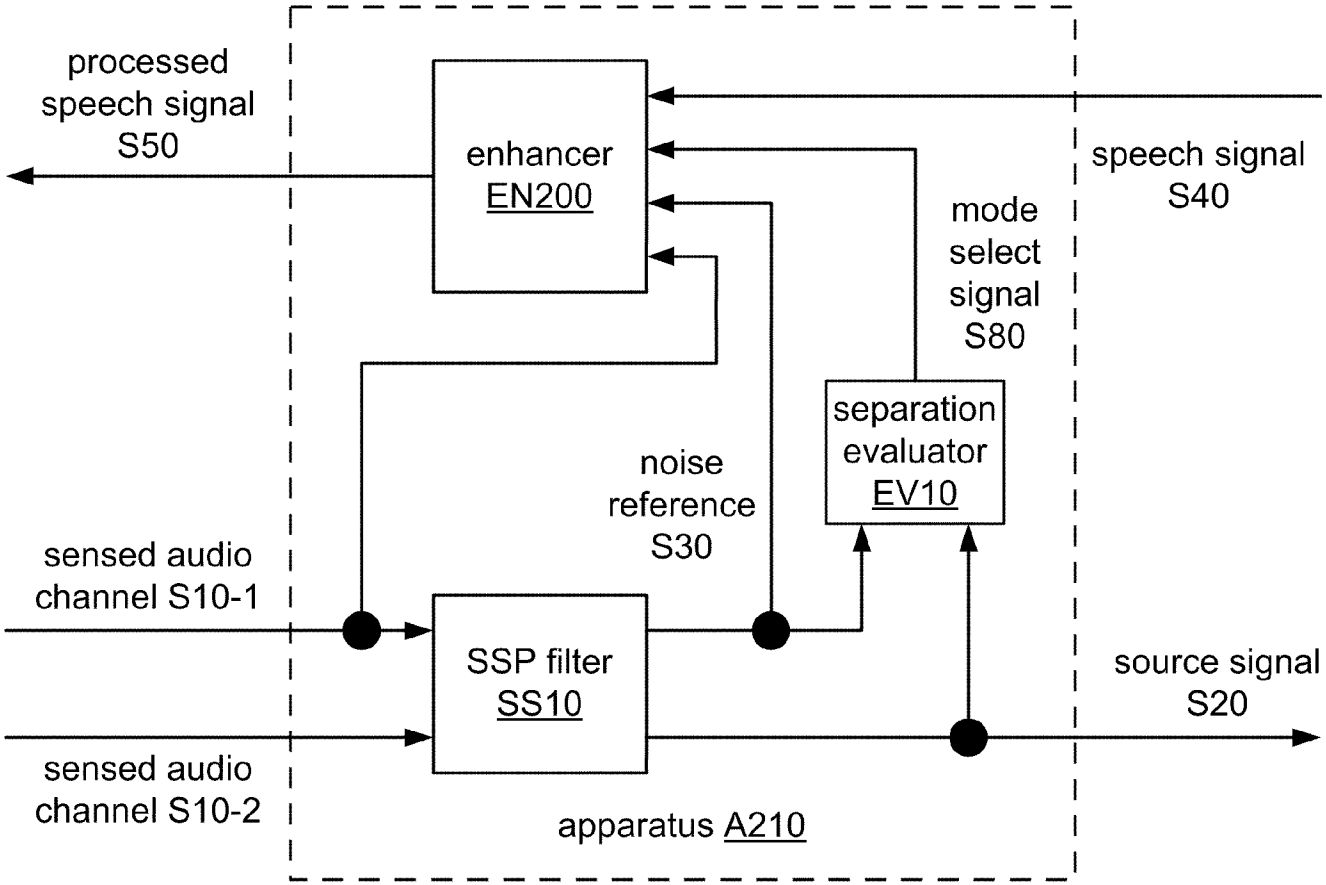
FIG. 47 shows a block diagram of an implementation A210 of apparatus A200.

Apparatus A200 may be implemented such that unseparated noise reference S95 is one of sensed audio channels S10-1 and S10-2. FIG. 47 shows a block diagram of such an implementation A210 of apparatus A200 in which unseparated noise reference S95 is sensed audio channel S10-1. It may be desirable for apparatus A200 to receive sensed audio channel S10 via an echo canceller or other audio preprocessing stage that is configured to perform an echo cancellation operation on the microphone signals (e.g., an instance of audio preprocessor AP20 as described below), especially for a case in which speech signal S40 is a reproduced audio signal. In a more general implementation of apparatus A200, unseparated noise reference S95 is an unseparated microphone signal (e.g., either of analog microphone signals SM10-1 and SM10-2 as described below, or either of digitized microphone signals DM10-1 and DM10-2 as described below).

Apparatus A200 may be implemented such that unseparated noise reference S95 is the particular one of sensed audio channels S10-1 and S10-2 that corresponds to a primary microphone of the communications device (e.g., a microphone that usually receives the user's voice most directly). Such an arrangement may be desirable, for example, for an application in which speech signal S40 is a reproduced audio signal (e.g., a far-end communications signal, a streaming audio signal, or a signal decoded from a stored media file). Alternatively, apparatus A200 may be implemented such that unseparated noise reference S95 is the particular one of sensed audio channels S10-1 and S10-2 that corresponds to a secondary microphone of the communications device (e.g., a microphone that usually receives the user's voice only indirectly). Such an arrangement may be desirable, for example, for an application in which enhancer EN10 is arranged to receive source signal S20 as speech signal S40.

In another arrangement, apparatus A200 may be configured to obtain unseparated noise reference S95 by mixing sensed audio channels S10-1 and S10-2 down to a single channel. Alternatively, apparatus A200 may be configured to select unseparated noise reference S95 from among sensed audio channels S10-1 and S10-2 according to one or more criteria such as highest signal-to-noise ratio, greatest speech likelihood (e.g., as indicated by one or more statistical metrics), the current operating configuration of the communications device, and/or the direction from which the desired source signal is determined to originate.

More generally, apparatus A200 may be configured to obtain unseparated noise reference S95 from a set of two or more microphone signals, such as microphone signals SM10-1 and SM10-2 as described below, or microphone signals DM10-1 and DM10-2 as described below. It may be desirable for apparatus A200 to obtain unseparated noise reference S95 from one or more microphone signals that have undergone an echo cancellation operation (e.g., as described below with reference to audio preprocessor AP20 and echo canceller EC10).

Apparatus A200 may be arranged to receive unseparated noise reference S95 from a time-domain buffer. In one such example, the time-domain buffer has a length of ten milliseconds (e.g., eighty samples at a sampling rate of eight kHz, or 160 samples at a sampling rate of sixteen kHz).

Figure 48:
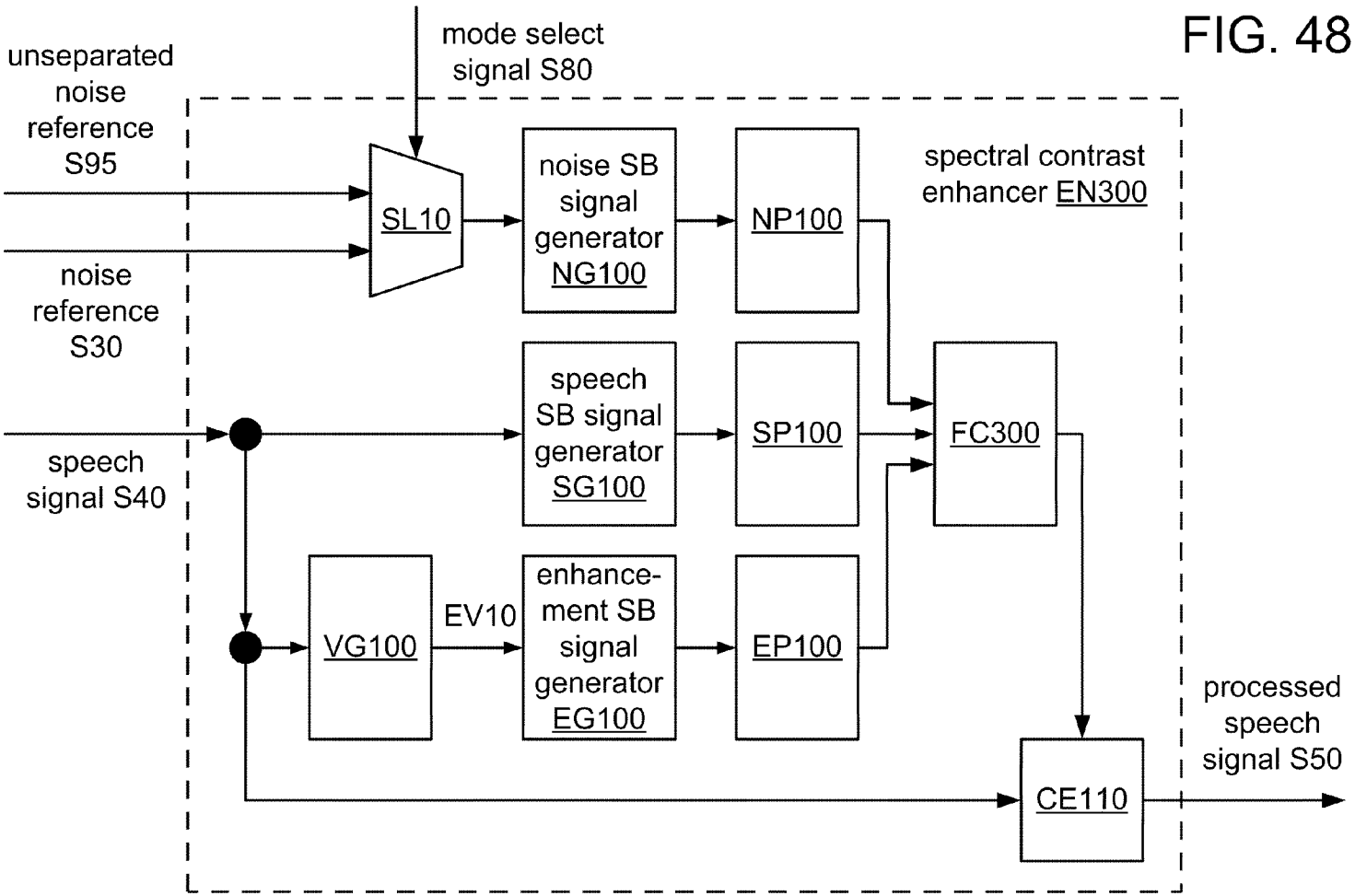
FIG. 48 shows a block diagram of an implementation EN300 of enhancer EN200 (and of enhancer EN110).

Enhancer EN200 may be configured to generate the set of second subband signals based on one among noise reference S30 and unseparated noise reference S95, according to the state of mode select signal S80. FIG. 48 shows a block diagram of such an implementation EN300 of enhancer EN200 (and of enhancer EN110) that includes a selector SL10 (e.g., a demultiplexer) configured to select one among noise reference S30 and unseparated noise reference S95 according to the current state of mode select signal S80. Enhancer EN300 may also include an implementation of gain factor calculator FC300 that is configured to select among different values for either or both of the bounds $\eta_{min}$ and $\eta_{max}$, and/or for either or both of the bounds UB and LB, according to the state of mode select signal S80.

Figure 49:
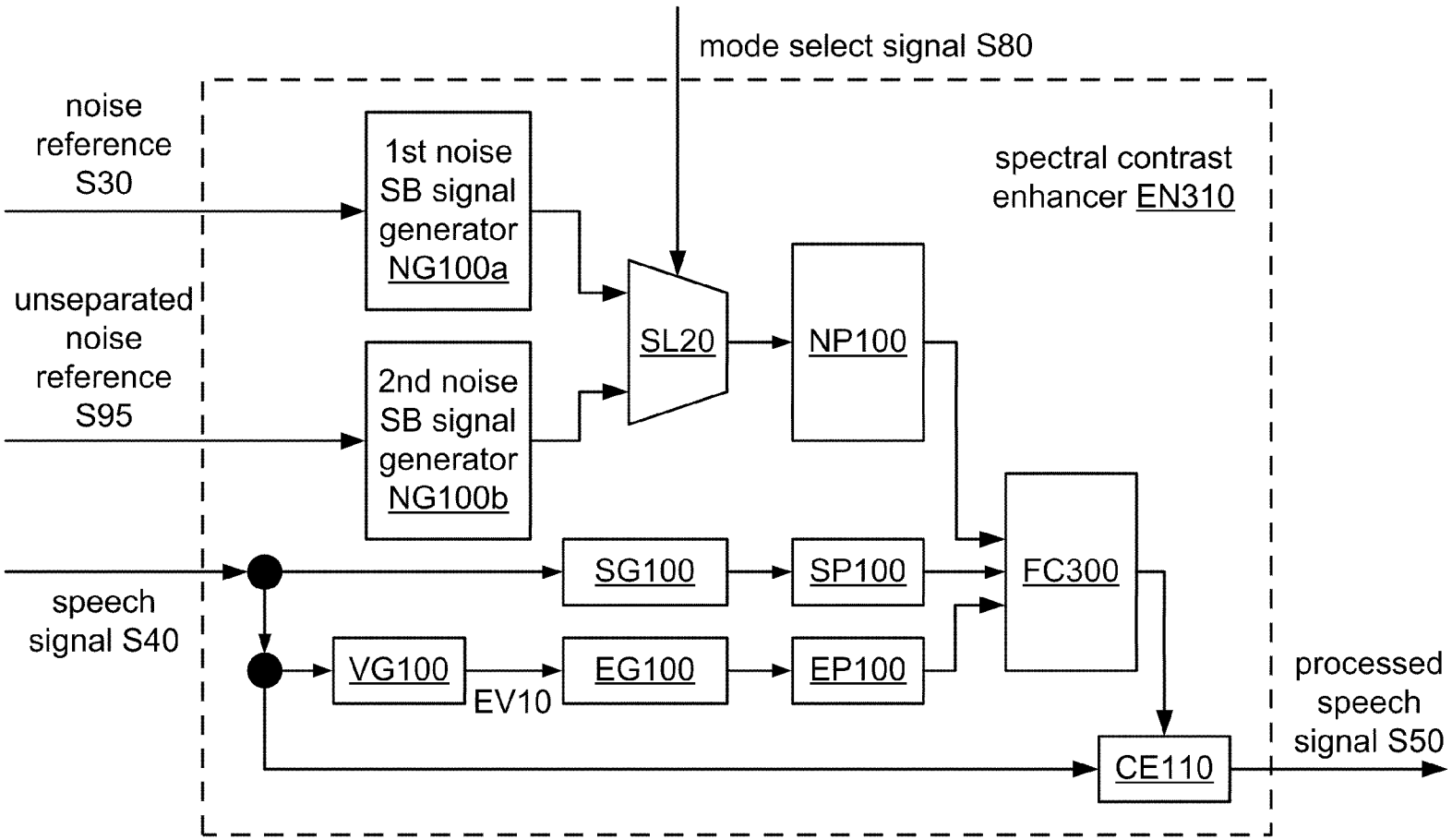
FIG. 49 shows a block diagram of an implementation EN310 of enhancer EN300.

Enhancer EN200 may be configured to select among different sets of subband signals, according to the state of mode select signal S80, to generate the set of second subband power estimates. FIG. 49 shows a block diagram of such an implementation EN310 of enhancer EN300 that includes a first instance NG100*a* of subband signal generator NG100, a second instance NG100*b* of subband signal generator NG100, and a selector SL20. Second subband signal generator NG100*b*, which may be implemented as an instance of subband signal generator SG200 or as an instance of subband signal generator SG300, is configured to generate a set of subband signals that is based on unseparated noise reference S95. Selector SL20 (e.g., a demultiplexer) is configured to select, according to the current state of mode select signal S80, one among the sets of subband signals generated by first subband signal generator NG100*a* and second subband signal generator NG100*b*, and to provide the selected set of subband signals to noise subband power estimate calculator NP100 as the set of noise subband signals.

Figure 50:
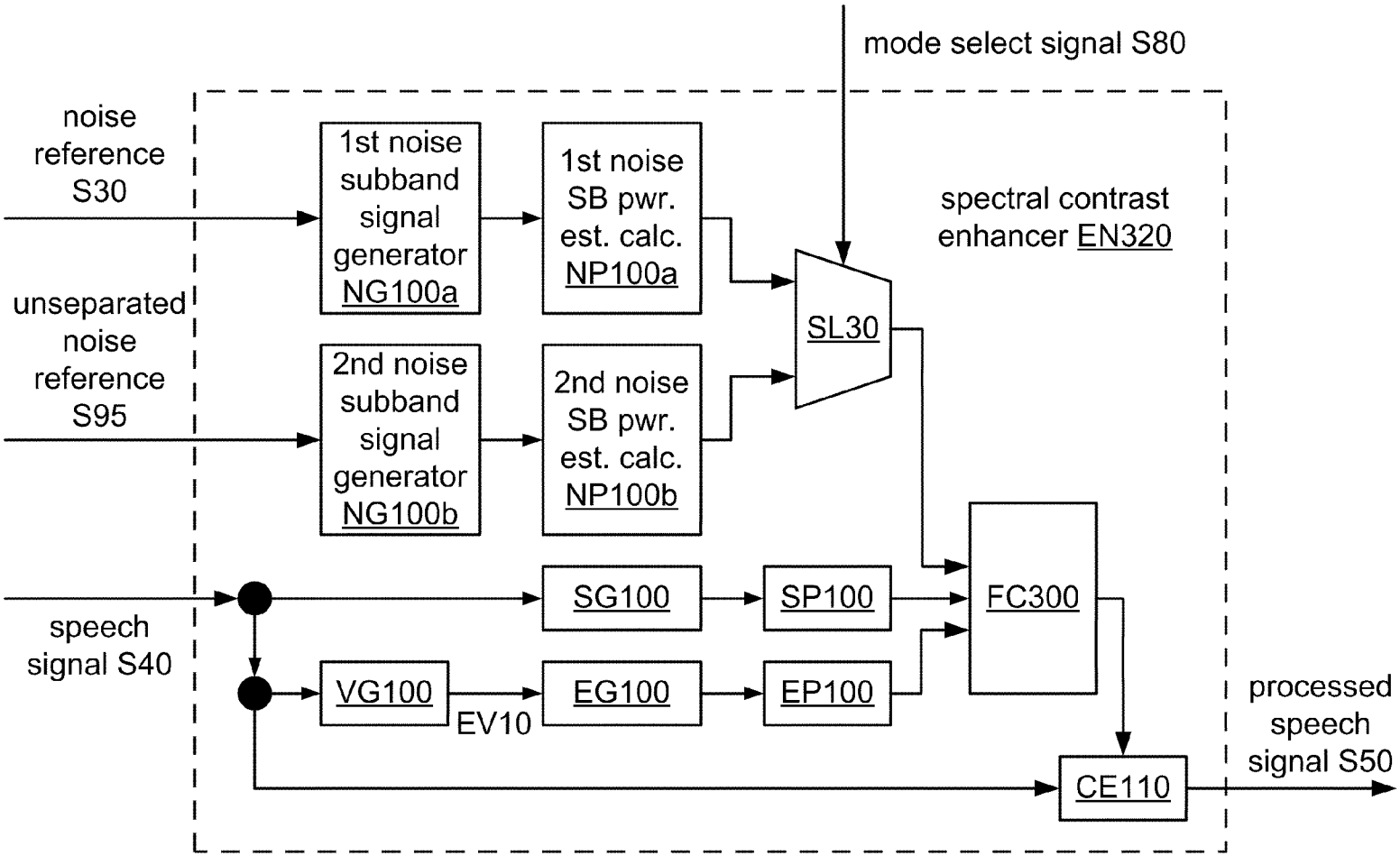
FIG. 50 shows a block diagram of an implementation EN320 of enhancer EN300 (and of enhancer EN310).

In a further alternative, enhancer EN200 is configured to select among different sets of noise subband power estimates, according to the state of mode select signal S80, to generate the set of subband gain factors. FIG. 50 shows a block diagram of such an implementation EN320 of enhancer EN300 (and of enhancer EN310) that includes a first instance NP100*a* of noise subband power estimate calculator NP100, a second instance NP100*b* of noise subband power estimate calculator NP100, and a selector SL30. First noise subband power estimate calculator NP100*a* is configured to generate a first set of noise subband power estimates that is based on the set of subband signals produced by first noise subband signal generator NG100*a* as described above. Second noise subband power estimate calculator NP100*b* is configured to generate a second set of noise subband power estimates that is based on the set of subband signals produced by second noise subband signal generator NG100*b* as described above. For example, enhancer EN320 may be configured to evaluate subband power estimates for each of the noise references in parallel. Selector SL30 (e.g., a demultiplexer) is configured to select, according to the current state of mode select signal S80, one among the sets of noise subband power estimates generated by first noise subband power estimate calculator NP100*a* and second noise subband power estimate calculator NP100*b*, and to provide the selected set of noise subband power estimates to gain factor calculator FC300.

Figure 51B:
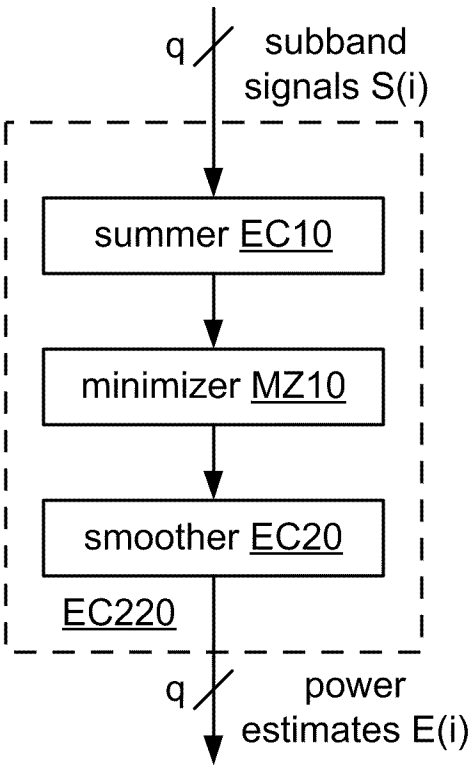
FIG. 51B shows a block diagram of an implementation EC220 of subband signal generator EC210.
Figure 51A:
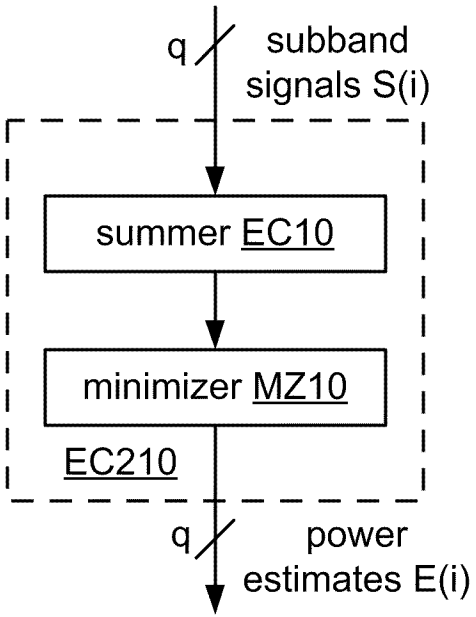
FIG. 51A shows a block diagram of subband signal generator EC210.

First noise subband power estimate calculator NP100*a* may be implemented as an instance of subband power estimate calculator EC110 or as an instance of subband power estimate calculator EC120. Second noise subband power estimate calculator NP100*b* may also be implemented as an instance of subband power estimate calculator EC110 or as an instance of subband power estimate calculator EC120. Second noise subband power estimate calculator NP100*b* may also be further configured to identify the minimum of the current subband power estimates for unseparated noise reference S95 and to replace the other current subband power estimates for unseparated noise reference S95 with this minimum. For example, second noise subband power estimate calculator NP100*b* may be implemented as an instance of subband signal generator EC210 as shown in FIG. 51A. Subband signal generator EC210 is an implementation of subband signal generator EC110 as described above that includes a minimizer MZ10 configured to identify and apply the minimum subband power estimate according to an expression such as $$E(i,k) \leftarrow \min_{1 \le i \le q} E(i,k) \tag{21}$$

for $1 \le i \le q$. Alternatively, second noise subband power estimate calculator NP100*b* may be implemented as an instance of subband signal generator EC220 as shown in FIG. 51B. Subband signal generator EC220 is an implementation of subband signal generator EC120 as described above that includes an instance of minimizer MZ10.

Figure 52:
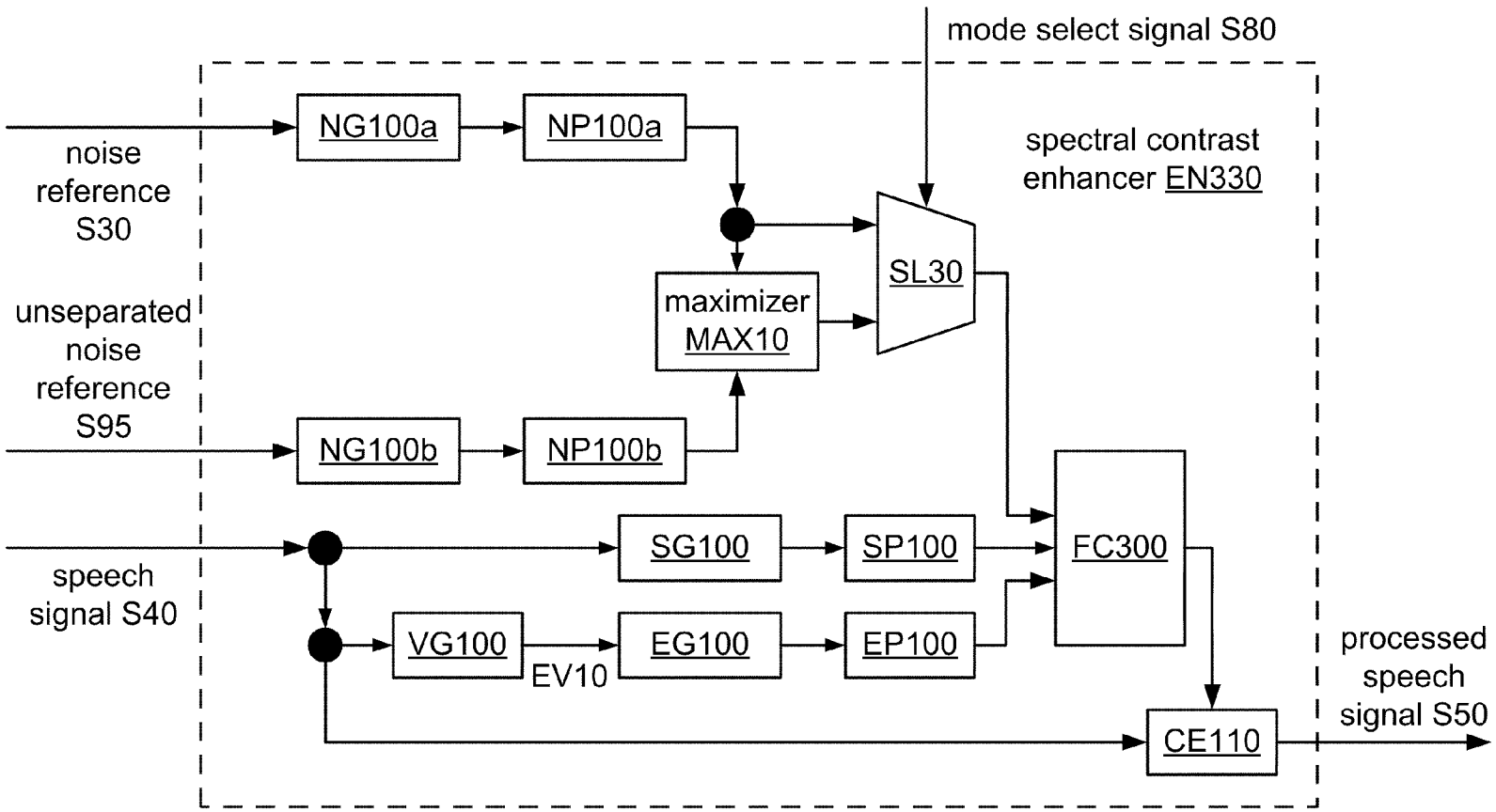
FIG. 52 shows a block diagram of an implementation EN330 of enhancer EN320.

It may be desirable to configure enhancer EN320 to calculate subband gain factor values, when operating in the multichannel mode, that are based on subband power estimates from unseparated noise reference S95 as well as on subband power estimates from noise reference S30. FIG. 52 shows a block diagram of such an implementation EN330 of enhancer EN320. Enhancer EN330 includes a maximizer MAX10 that is configured to calculate a set of subband power estimates according to an expression such as $$E(i,k) \leftarrow \max(E_b(i,k), E_c(i,k)) \tag{22}$$

for $1 \le i \le q$, where $E_b(i,k)$ denotes the subband power estimate calculated by first noise subband power estimate calculator NP100*a* for subband i and frame k, and $E_c(i,k)$ denotes the subband power estimate calculated by second noise subband power estimate calculator NP100*b* for subband i and frame k.

Figure 53:
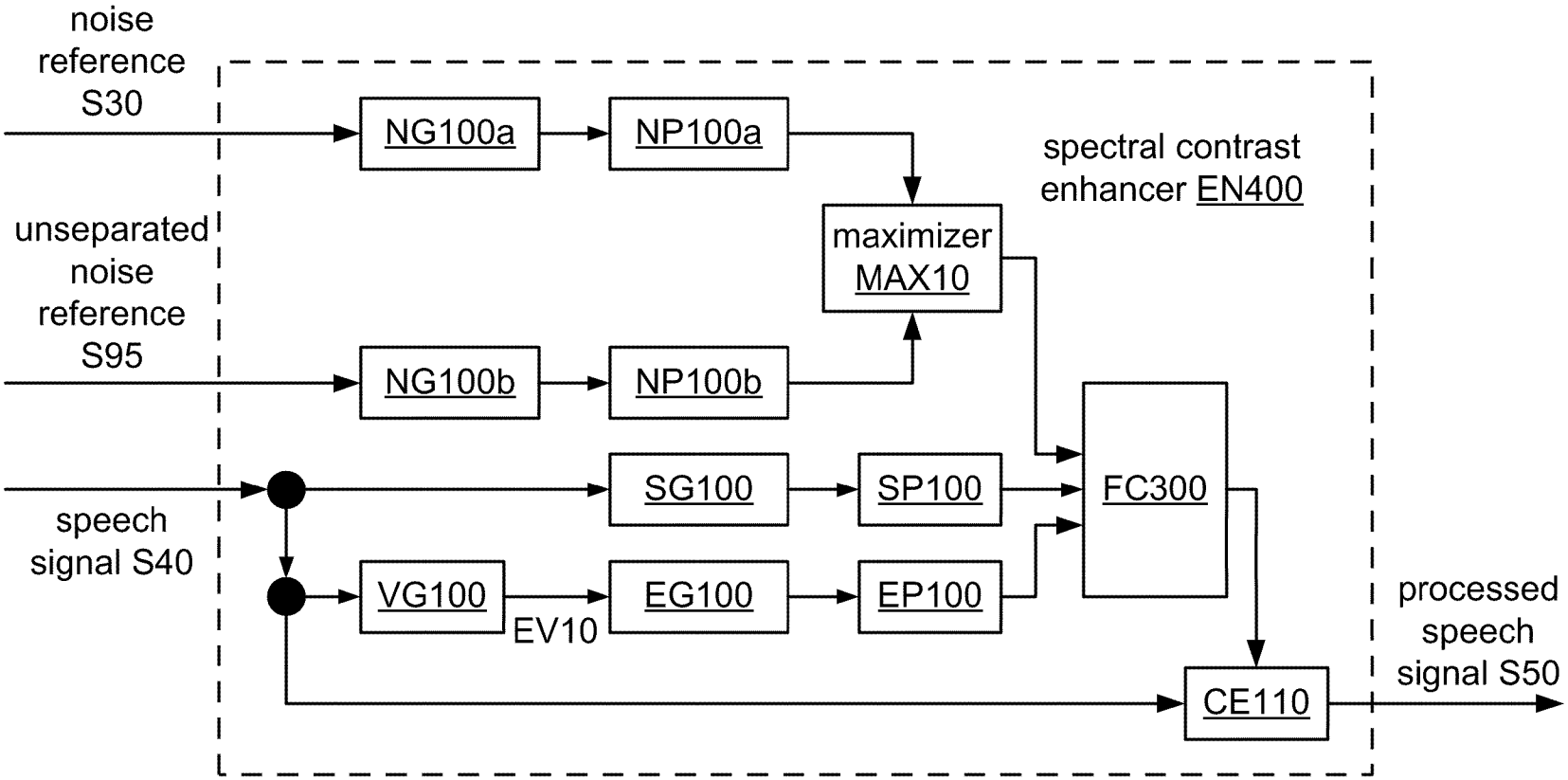
FIG. 53 shows a block diagram of an implementation EN400 of enhancer EN110.

It may be desirable for an implementation of apparatus A100 to operate in a mode that combines noise subband power information from single-channel and multichannel noise references. While a multichannel noise reference may support a dynamic response to nonstationary noise, the resulting operation of the apparatus may be overly reactive to changes, for example, in the user's position. A single-channel noise reference may provide a response that is more stable but lacks the ability to compensate for nonstationary noise. FIG. 53 shows a block diagram of an implementation EN400 of enhancer EN110 that is configured to enhance the spectral contrast of speech signal S40 based on information from noise reference S30 and on information from unseparated noise reference S95. Enhancer EN400 includes an instance of maximizer MAX10 configured as disclosed above.

Maximizer MAX10 may also be implemented to allow independent manipulation of the gains of the single-channel and multichannel noise subband power estimates. For example, it may be desirable to implement maximizer MAX10 to apply a gain factor (or a corresponding one of a set of gain factors) to scale each of one or more (possibly all) of the noise subband power estimates produced by first subband power estimate calculator NP100*a* and/or second subband power estimate calculator NP100*b* such that the scaling occurs upstream of the maximization operation.

At some times during the operation of a device that includes an implementation of apparatus A100, it may be desirable for the apparatus to enhance the spectral contrast of speech signal S40 according to information from a reference other than noise reference S30. For a situation in which a desired sound component (e.g., the user's voice) and a directional noise component (e.g., from an interfering speaker, a public address system, a television or radio) arrive at the microphone array from the same direction, for example, a directional processing operation may provide inadequate separation of these components. In such case, the directional processing operation may separate the directional noise component into source signal S20, such that the resulting noise reference S30 may be inadequate to support the desired enhancement of the speech signal.

It may be desirable to implement apparatus A100 to apply results of both a directional processing operation and a distance processing operation as disclosed herein. For example, such an implementation may provide improved spectral contrast enhancement performance for a case in which a near-field desired sound component (e.g., the user's voice) and a far-field directional noise component (e.g., from an interfering speaker, a public address system, a television or radio) arrive at the microphone array from the same direction.

In one example, an implementation of apparatus A100 that includes an instance of SSP filter SS110 is configured to bypass enhancer EN10 (e.g., as described above) when the current state of distance indication signal DI10 indicates a far-field signal. Such an arrangement may be desirable, for example, for an implementation of apparatus A110 in which enhancer EN10 is configured to receive source signal S20 as the speech signal.

Figure 54:
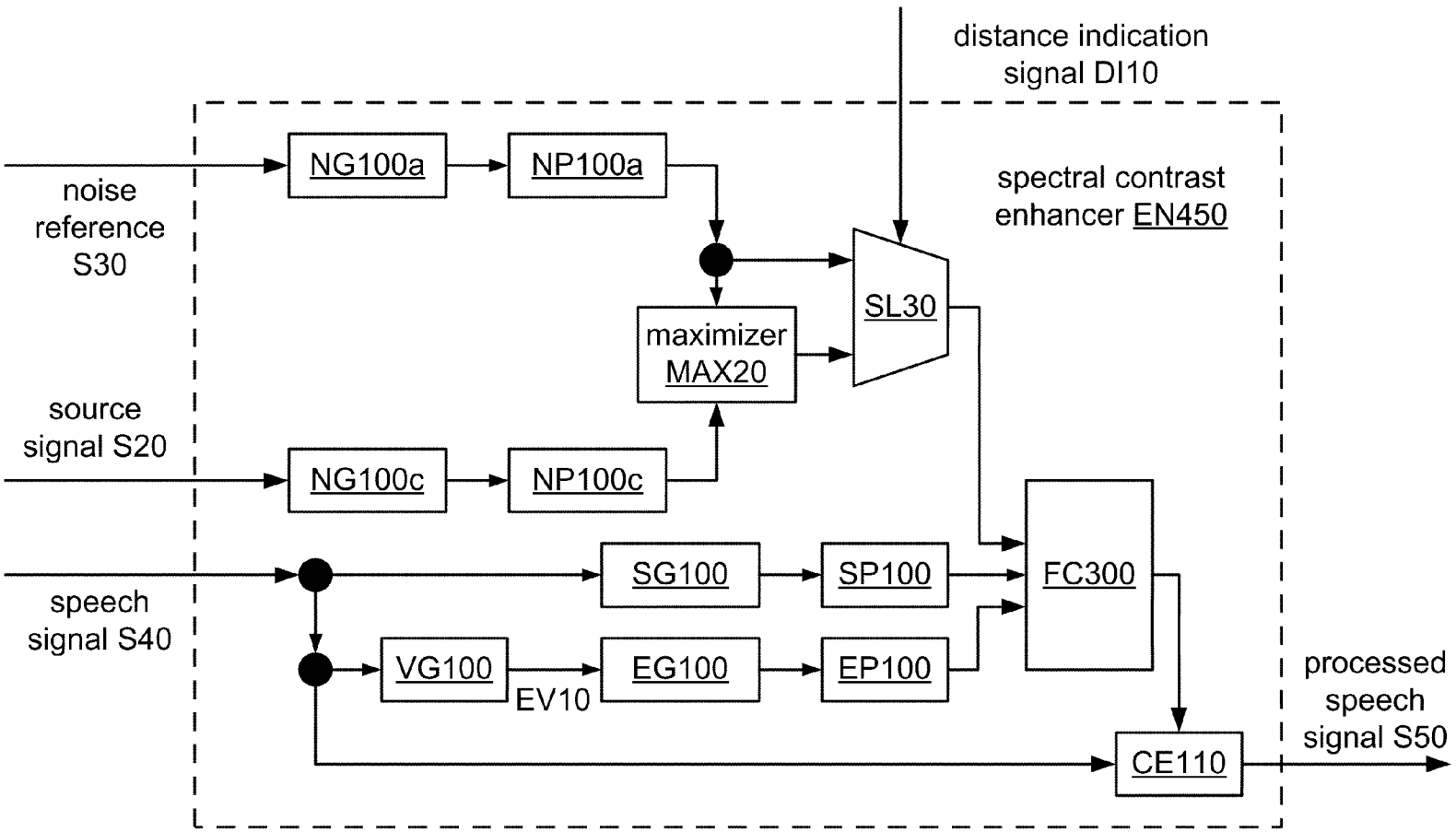
FIG. 54 shows a block diagram of an implementation EN450 of enhancer EN110.

Alternatively, it may be desirable to implement apparatus A100 to boost and/or attenuate at least one subband of speech signal S40 relative to another subband of speech signal S40 according to noise subband power estimates that are based on information from noise reference S30 and on information from source signal S20. FIG. 54 shows a block diagram of such an implementation EN450 of enhancer EN20 that is configured to process source signal S20 as an additional noise reference. Enhancer EN450 includes a third instance NG100*c* of noise subband signal generator NG100, a third instance NP100*c* of subband power estimate calculator NP100, and an instance MAX20 of maximizer MAX10. Third noise subband power estimate calculator NP100*c* is arranged to generate a third set of noise subband power estimates that is based on the set of subband signals produced by third noise subband signal generator NG100*c* from source signal S20, and maximizer MAX20 is arranged to select maximum values from among the first and third noise subband power estimates. In this implementation, selector SL40 is arranged to receive distance indication signal DI10 as produced by an implementation of SSP filter SS110 as disclosed herein. Selector SL30 is arranged to select the output of maximizer MAX20 when the current state of distance indication signal DI10 indicates a far-field signal, and to select the output of first noise subband power estimate calculator NP100*a* otherwise.

It is expressly disclosed that apparatus A100 may also be implemented to include an instance of an implementation of enhancer EN200 as disclosed herein that is configured to receive source signal S20 as a second noise reference instead of unseparated noise reference S95. It is also expressly noted that implementations of enhancer EN200 that receive source signal S20 as a noise reference may be more useful for enhancing reproduced speech signals (e.g., far-end signals) than for enhancing sensed speech signals (e.g., near-end signals).

Figure 55:
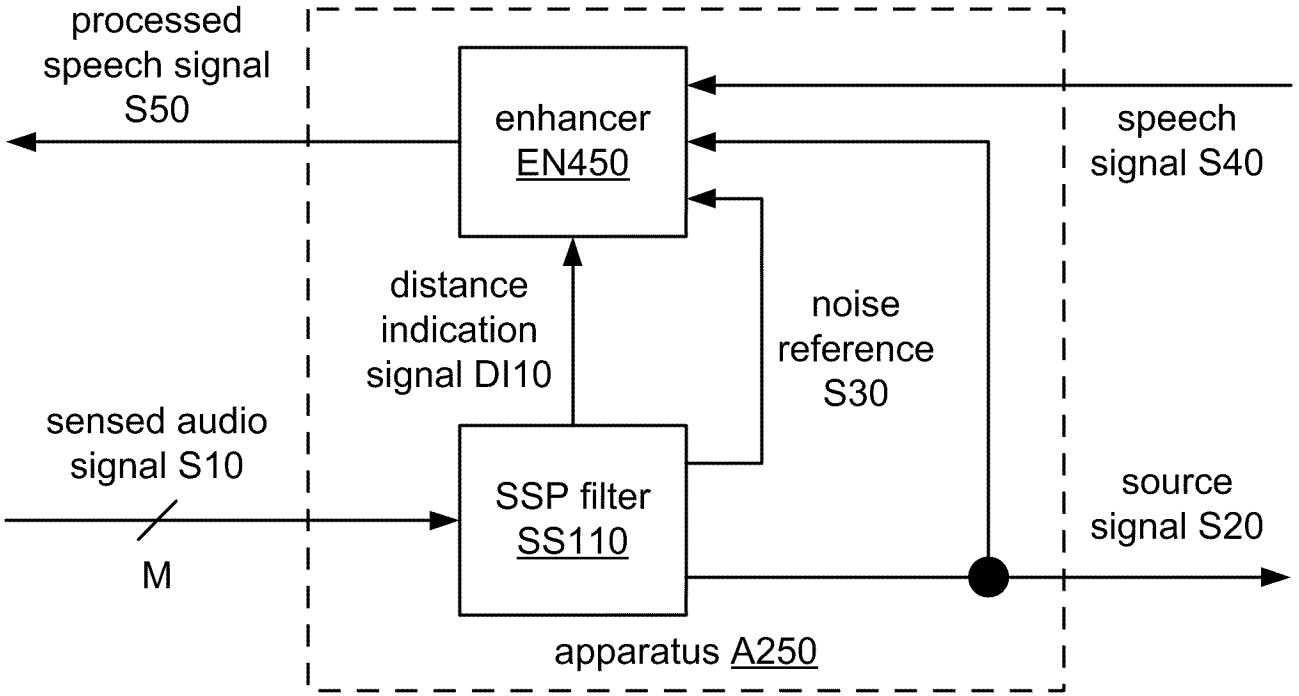
FIG. 55 shows a block diagram of an implementation A250 of apparatus A100.
Figure 56:
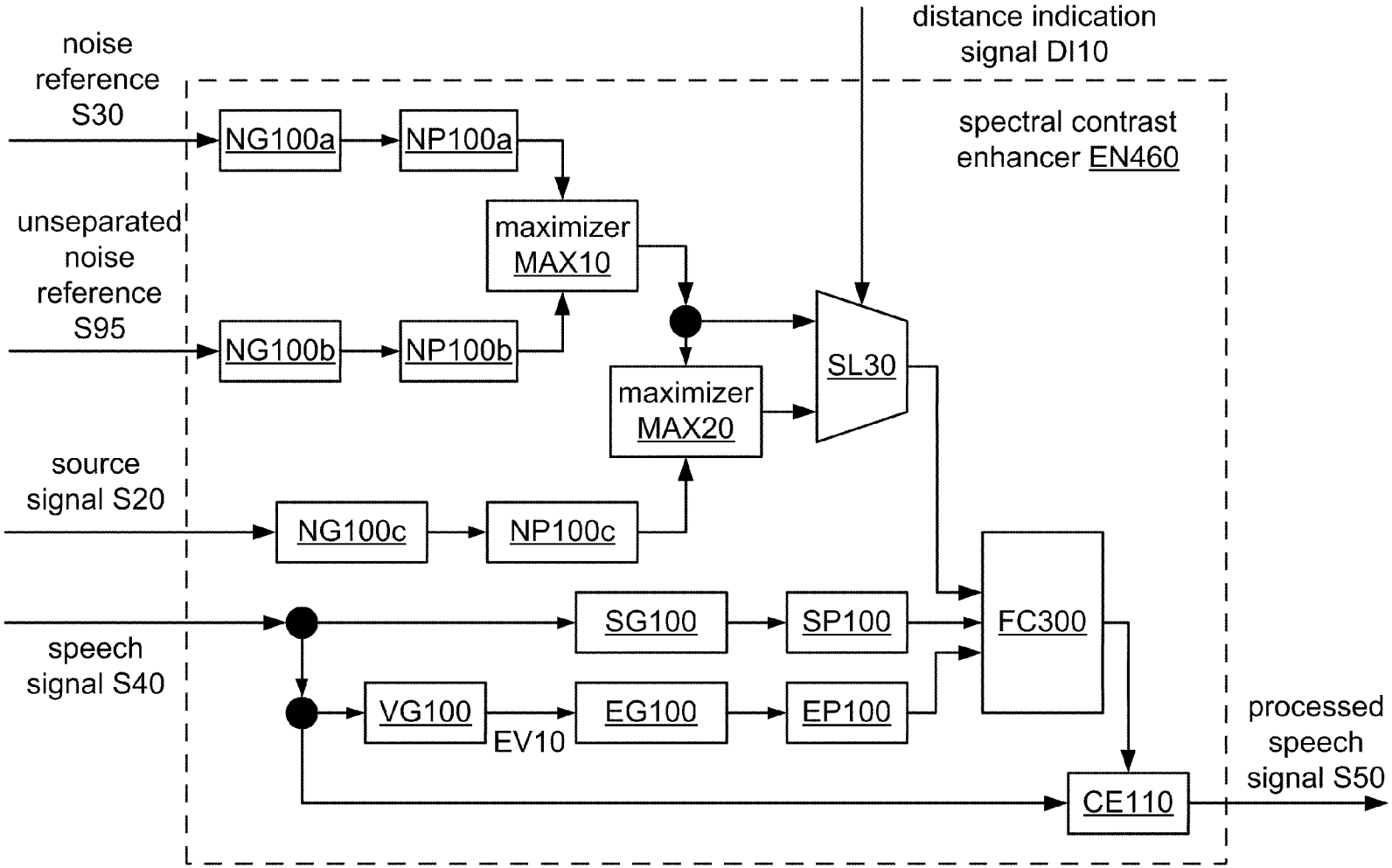
FIG. 56 shows a block diagram of an implementation EN460 of enhancer EN450 (and of enhancer EN400).

FIG. 55 shows a block diagram of an implementation A250 of apparatus A100 that includes SSP filter SS110 and enhancer EN450 as disclosed herein. FIG. 56 shows a block diagram of an implementation EN460 of enhancer EN450 (and enhancer EN400) that combines support for compensation of far-field nonstationary noise (e.g., as disclosed herein with reference to enhancer EN450) with noise subband power information from both single-channel and multichannel noise references (e.g., as disclosed herein with reference to enhancer EN400). In this example, gain factor calculator FC300 receives noise subband power estimates that are based on information from three different noise estimates: unseparated noise reference S95 (which may be heavily smoothed and/or smoothed over a long term, such as more than five frames), an estimate of far-field nonstationary noise from source signal S20 (which may be unsmoothed or only minimally smoothed), and noise reference S30 which may be direction-based. It is reiterated that any implementation of enhancer EN200 that is disclosed herein as applying unseparated noise reference S95 (e.g., as illustrated in FIG. 56) may also be implemented to apply a smoothed noise estimate from source signal S20 instead (e.g., a heavily smoothed estimate and/or a long-term estimate that is smoothed over several frames).

It may be desirable to configure enhancer EN200 (or enhancer EN400 or enhancer EN450) to update noise subband power estimates that are based on unseparated noise reference S95 only during intervals in which unseparated noise reference S95 (or the corresponding unseparated sensed audio signal) is inactive. Such an implementation of apparatus A100 may include a voice activity detector (VAD) that is configured to classify a frame of unseparated noise reference S95, or a frame of the unseparated sensed audio signal, as active (e.g., speech) or inactive (e.g., background noise or silence) based on one or more factors such as frame energy, signal-to-noise ratio, periodicity, autocorrelation of speech and/or residual (e.g., linear prediction coding residual), zero crossing rate, and/or first reflection coefficient. Such classification may include comparing a value or magnitude of such a factor to a threshold value and/or comparing the magnitude of a change in such a factor to a threshold value. It may be desirable to implement this VAD to perform voice activity detection based on multiple criteria (e.g., energy, zero-crossing rate, etc.) and/or a memory of recent VAD decisions.

Figure 57:
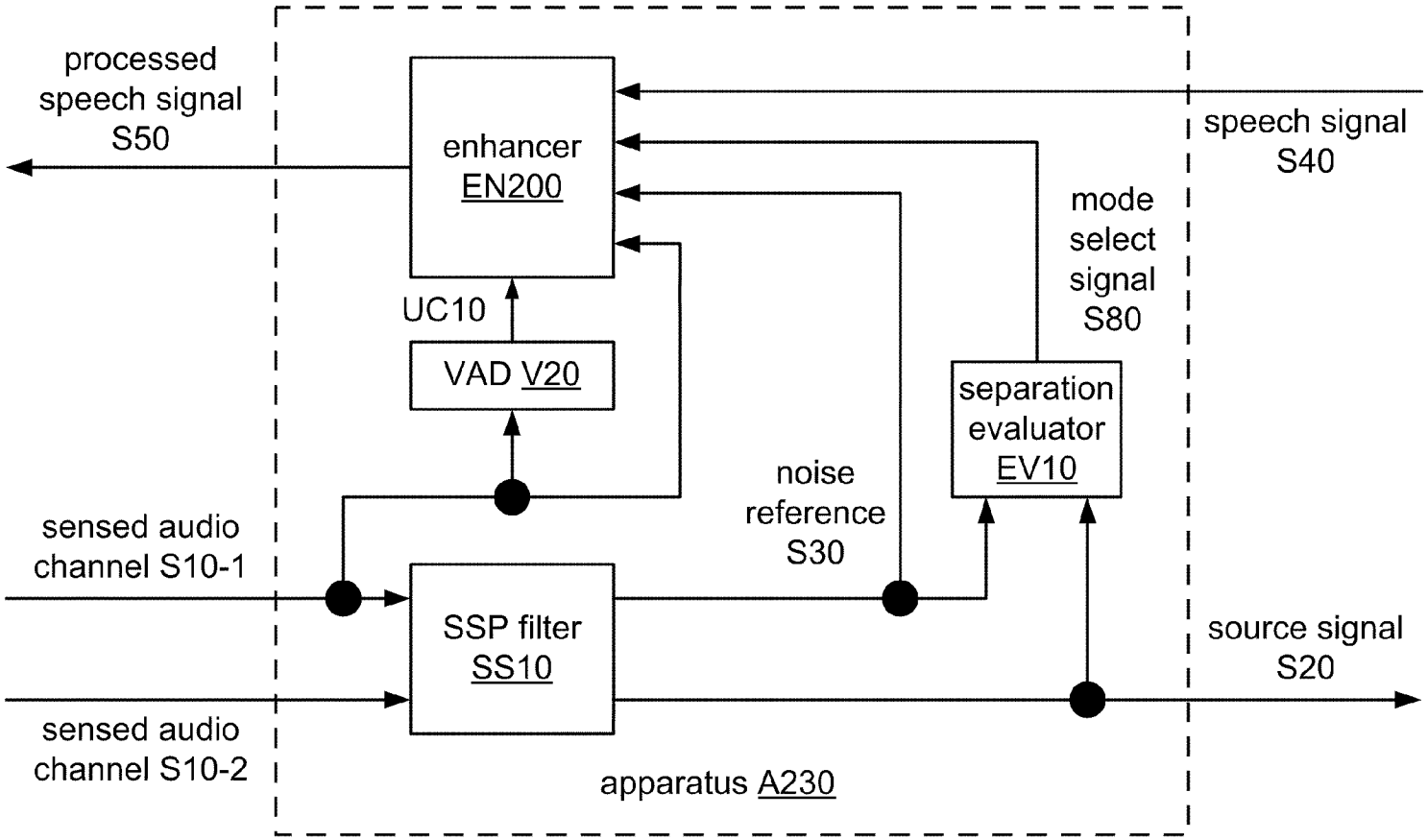
FIG. 57 shows an implementation A230 of apparatus A210 that includes a voice activity detector V20.

FIG. 57 shows such an implementation A230 of apparatus A200 that includes such a voice activity detector (or "VAD") V20. Voice activity detector V20, which may be implemented as an instance of VAD V10 as described above, is configured to produce an update control signal UC10 whose state indicates whether speech activity is detected on sensed audio channel S10-1. For a case in which apparatus A230 includes an implementation EN300 of enhancer EN200 as shown in FIG. 48, update control signal UC10 may be applied to prevent noise subband signal generator NG100 from accepting input and/or updating its output during intervals (e.g., frames) when speech is detected on sensed audio channel S10-1 and a single-channel mode is selected. For a case in which apparatus A230 includes an implementation EN300 of enhancer EN200 as shown in FIG. 48 or an implementation EN310 of enhancer EN200 as shown in FIG. 49, update control signal UC10 may be applied to prevent noise subband power estimate generator NP100 from accepting input and/or updating its output during intervals (e.g., frames) when speech is detected on sensed audio channel S10-1 and a single-channel mode is selected.

For a case in which apparatus A230 includes an implementation EN310 of enhancer EN200 as shown in FIG. 49, update control signal UC10 may be applied to prevent second noise subband signal generator NG100*b* from accepting input and/or updating its output during intervals (e.g., frames) when speech is detected on sensed audio channel S10-1. For a case in which apparatus A230 includes an implementation EN320 of enhancer EN200 or an implementation EN330 of enhancer EN200, or for a case in which apparatus A100 includes an implementation EN400 of enhancer EN200, update control signal UC10 may be applied to prevent second noise subband signal generator NG100*b* from accepting input and/or updating its output, and/or to prevent second noise subband power estimate generator NP100*b* from accepting input and/or updating its output, during intervals (e.g., frames) when speech is detected on sensed audio channel S10-1.

Figure 58A:
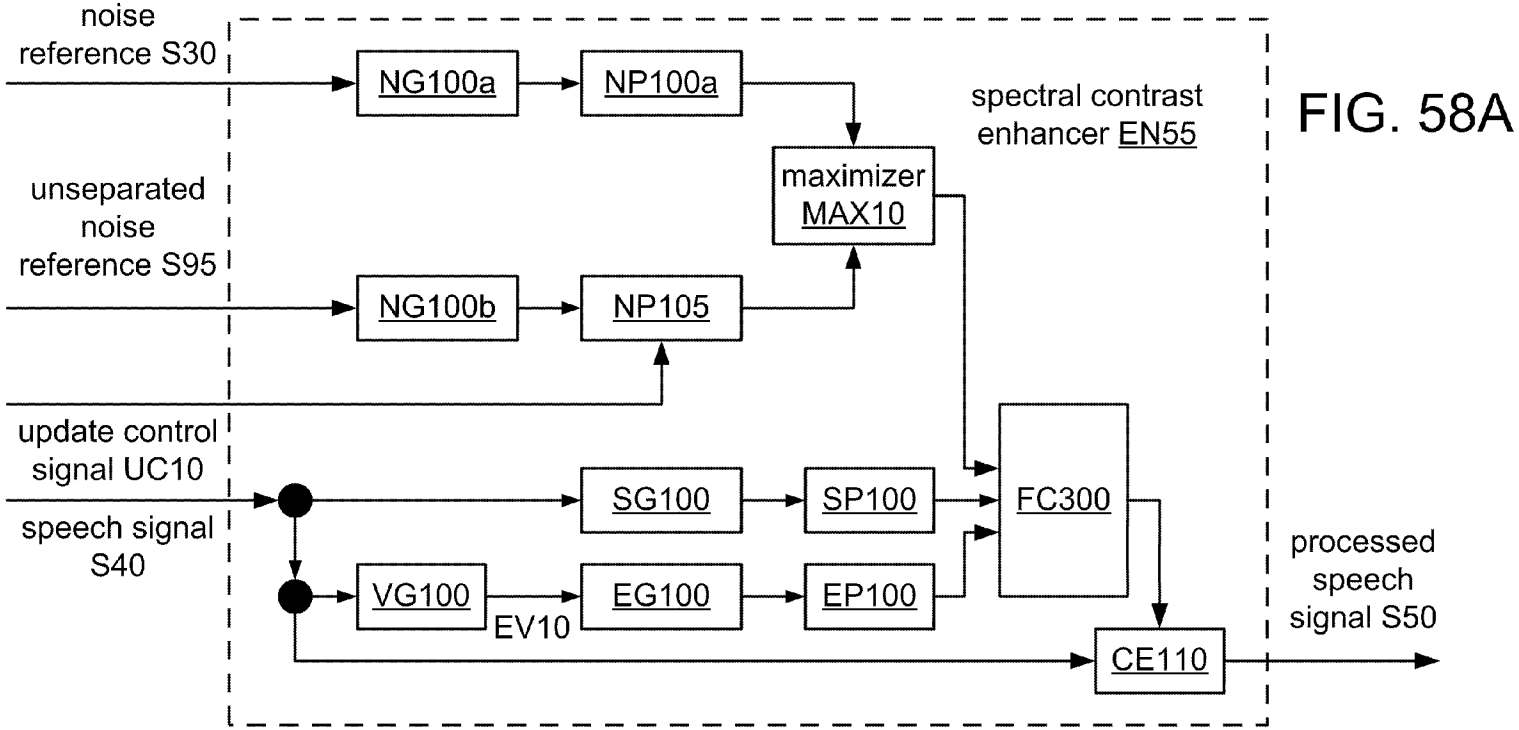
FIG. 58A shows a block diagram of an implementation EN55 of enhancer EN400.
Figure 58B:
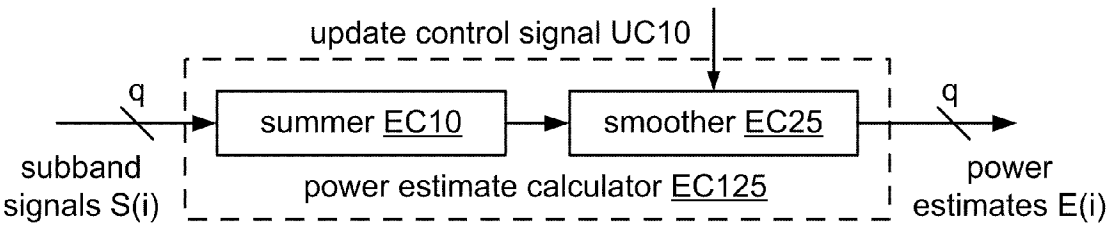
FIG. 58B shows a block diagram of an implementation EC125 of power estimate calculator EC120.

FIG. 58A shows a block diagram of such an implementation EN55 of enhancer EN400. Enhancer EN55 includes an implementation NP105 of noise subband power estimate calculator NP100*b* that produces a set of second noise subband power estimates according to the state of update control signal UC10. For example, noise subband power estimate calculator NP105 may be implemented as an instance of an implementation EC125 of power estimate calculator EC120 as shown in the block diagram of FIG. 58B. Power estimate calculator EC125 includes an implementation EC25 of smoother EC20 that is configured to perform a temporal smoothing operation (e.g., an average over two or more inactive frames) on each of the q sums calculated by summer EC10 according to a linear smoothing expression such as $$E(i,k) \leftarrow \begin{cases} \gamma E(i,k-1) + (1-\gamma)E(i,k), & UC10 \text{ indicates inactive frame} \\ E(i,k-1), & \text{otherwise,} \end{cases} \quad (18)$$

where γ is a smoothing factor. In this example, smoothing factor γ has a value in the range of from zero (no smoothing) to one (maximum smoothing, no updating) (e.g., 0.3, 0.5, 0.7, 0.9, 0.99, or 0.999). It may be desirable for smoother EC25 to use the same value of smoothing factor γ for all of the q subbands. Alternatively, it may be desirable for smoother EC25 to use a different value of smoothing factor γ for each of two or more (possibly all) of the q subbands. The value (or values) of smoothing factor γ may be fixed or may be adapted over time (e.g., from one frame to the next). Similarly, it may be desirable to use an instance of noise subband power estimate calculator NP105 to implement second noise subband power estimate calculator NP100*b* in enhancer EN320 (as shown in FIG. 50), EN330 (as shown in FIG. 52), EN450 (as shown in FIG. 54), or EN460 (as shown in FIG. 56).

Figure 59:
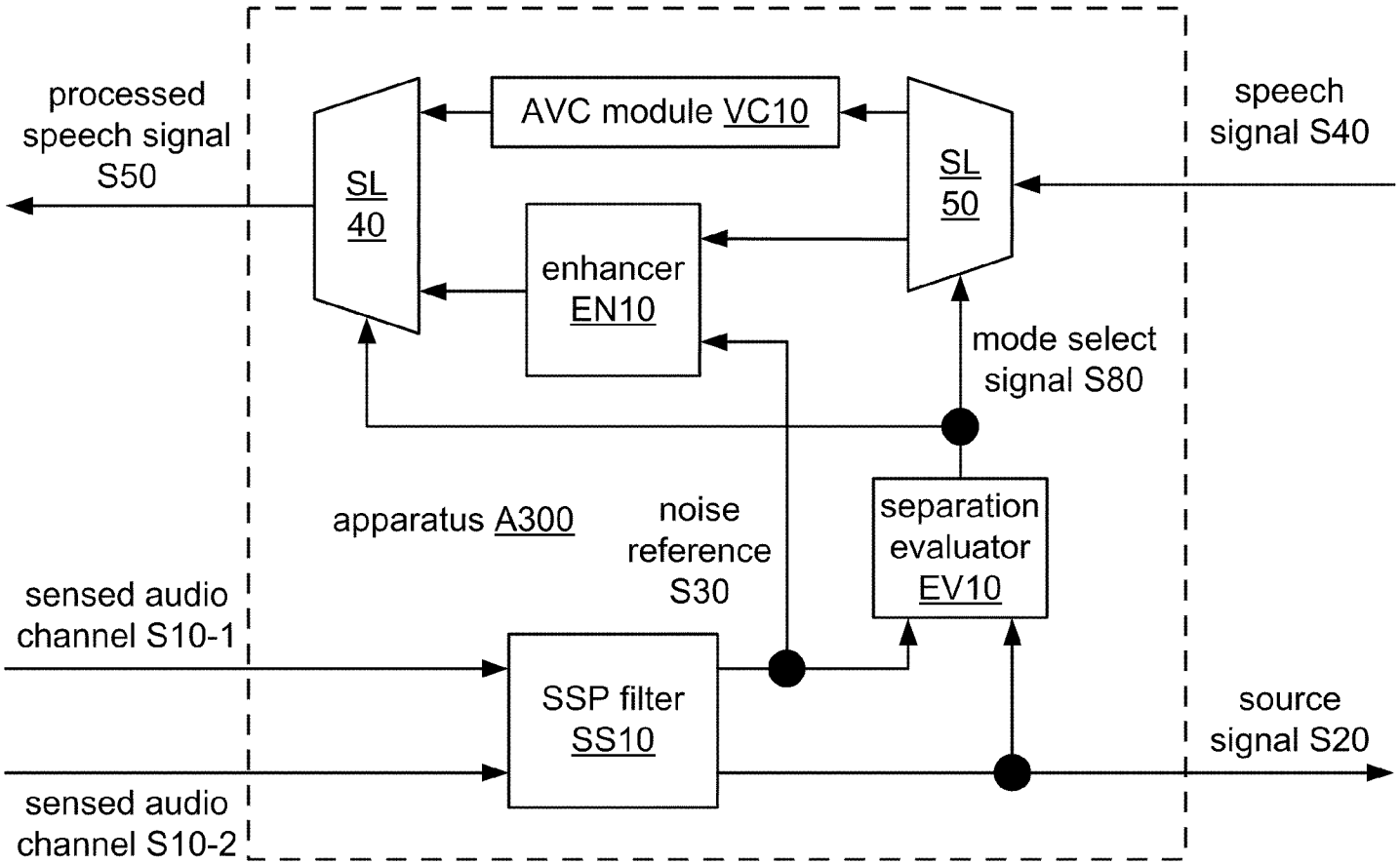
FIG. 59 shows a block diagram of an implementation A300 of apparatus A100.
Figure 60:
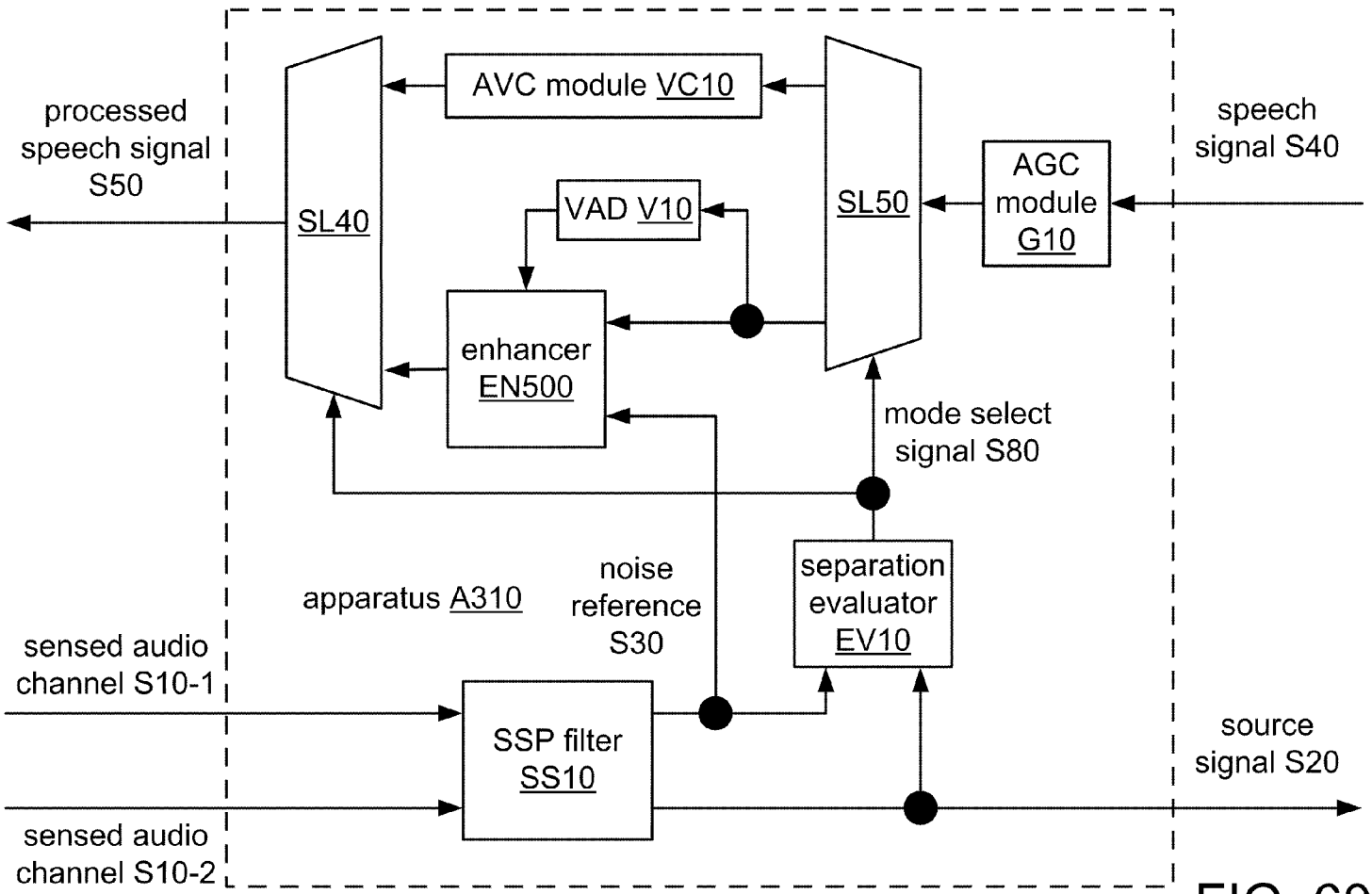
FIG. 60 shows a block diagram of an implementation A310 of apparatus A300.

FIG. 59 shows a block diagram of an alternative implementation A300 of apparatus A100 that is configured to operate in a single-channel mode or a multichannel mode according to the current state of a mode select signal. Like apparatus A200, apparatus A300 of apparatus A100 includes a separation evaluator (e.g., separation evaluator EV10) that is configured to generate a mode select signal S80. In this case, apparatus A300 also includes an automatic volume control (AVC) module VC10 that is configured to perform an AGC or AVC operation on speech signal S40, and mode select signal S80 is applied to control selectors SL40 (e.g., a multiplexer) and SL50 (e.g., a demultiplexer) to select one among AVC module VC10 and enhancer EN10 for each frame according to a corresponding state of mode select signal S80. FIG. 60 shows a block diagram of an implementation A310 of apparatus A300 that also includes an implementation EN500 of enhancer EN150 and instances of AGC module G10 and VAD V10 as described herein. In this example, enhancer EN500 is also an implementation of enhancer EN160 as described above that includes an instance of peak limiter L10 arranged to limit the acoustic output level of the equalizer. (One of ordinary skill will understand that this and the other disclosed configurations of apparatus A300 may also be implemented using alternate implementations of enhancer EN10 as disclosed herein, such as enhancer EN400 or EN450.)

Figure 61:
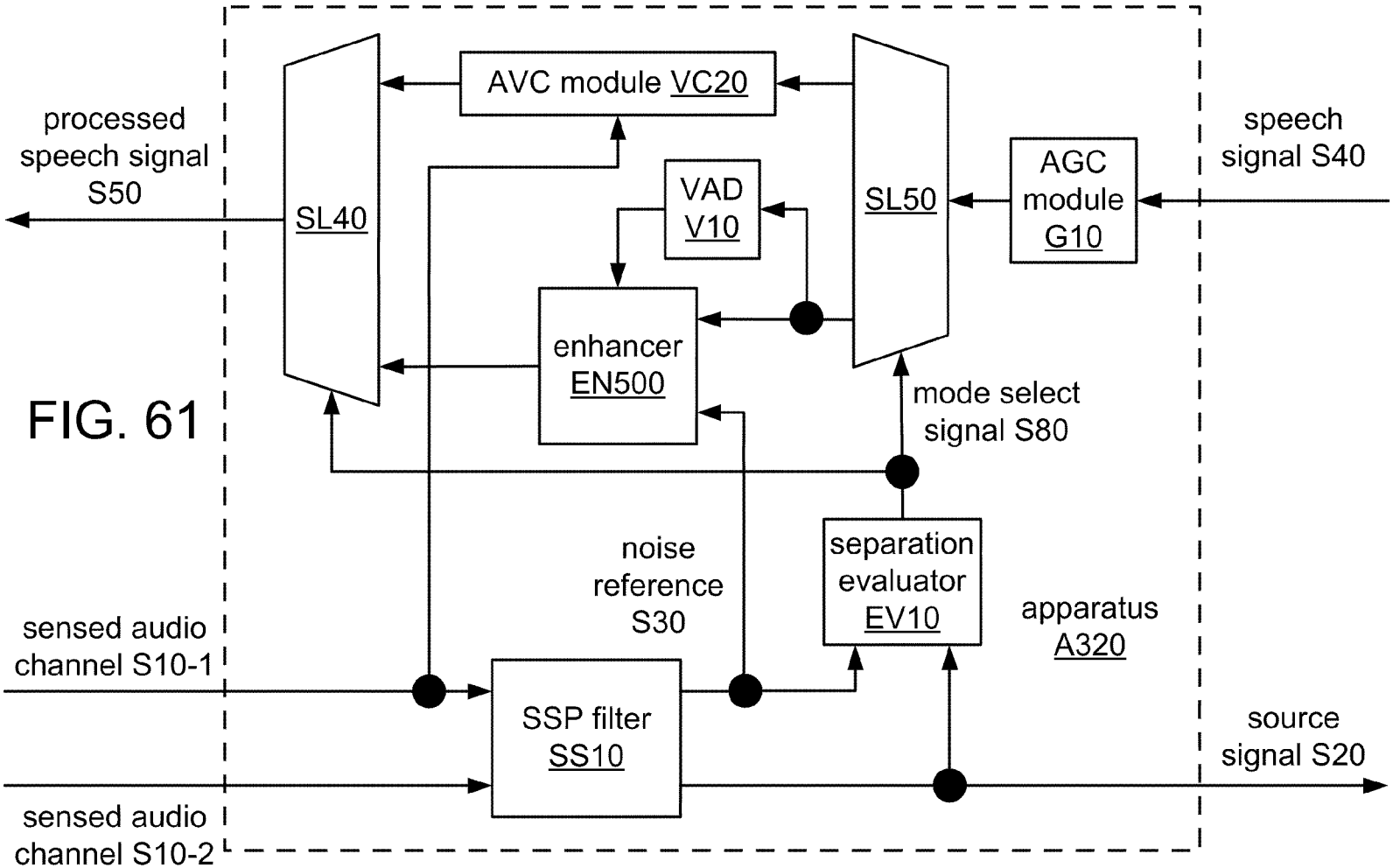
FIG. 61 shows a block diagram of an implementation A320 of apparatus A310.

An AGC or AVC operation controls a level of an audio signal based on a stationary noise estimate, which is typically obtained from a single microphone. Such an estimate may be calculated from an instance of unseparated noise reference S95 as described herein (alternatively, from sensed audio signal S10). For example, it may be desirable to configure AVC module VC10 to control a level of speech signal S40 according to the value of a parameter such as a power estimate of unseparated noise reference S95 (e.g., energy, or sum of absolute values, of the current frame). As described above with reference to other power estimates, it may be desirable to configure AVC module VC10 to perform a temporal smoothing operation on such a parameter value and/or to update the parameter value only when the unseparated sensed audio signal does not currently contain voice activity. FIG. 61 shows a block diagram of an implementation A320 of apparatus A310 in which an implementation VC20 of AVC module VC10 is configured to control the volume of speech signal S40 according to information from sensed audio channel S10-1 (e.g., a current power estimate of signal S10-1).

Figure 62:
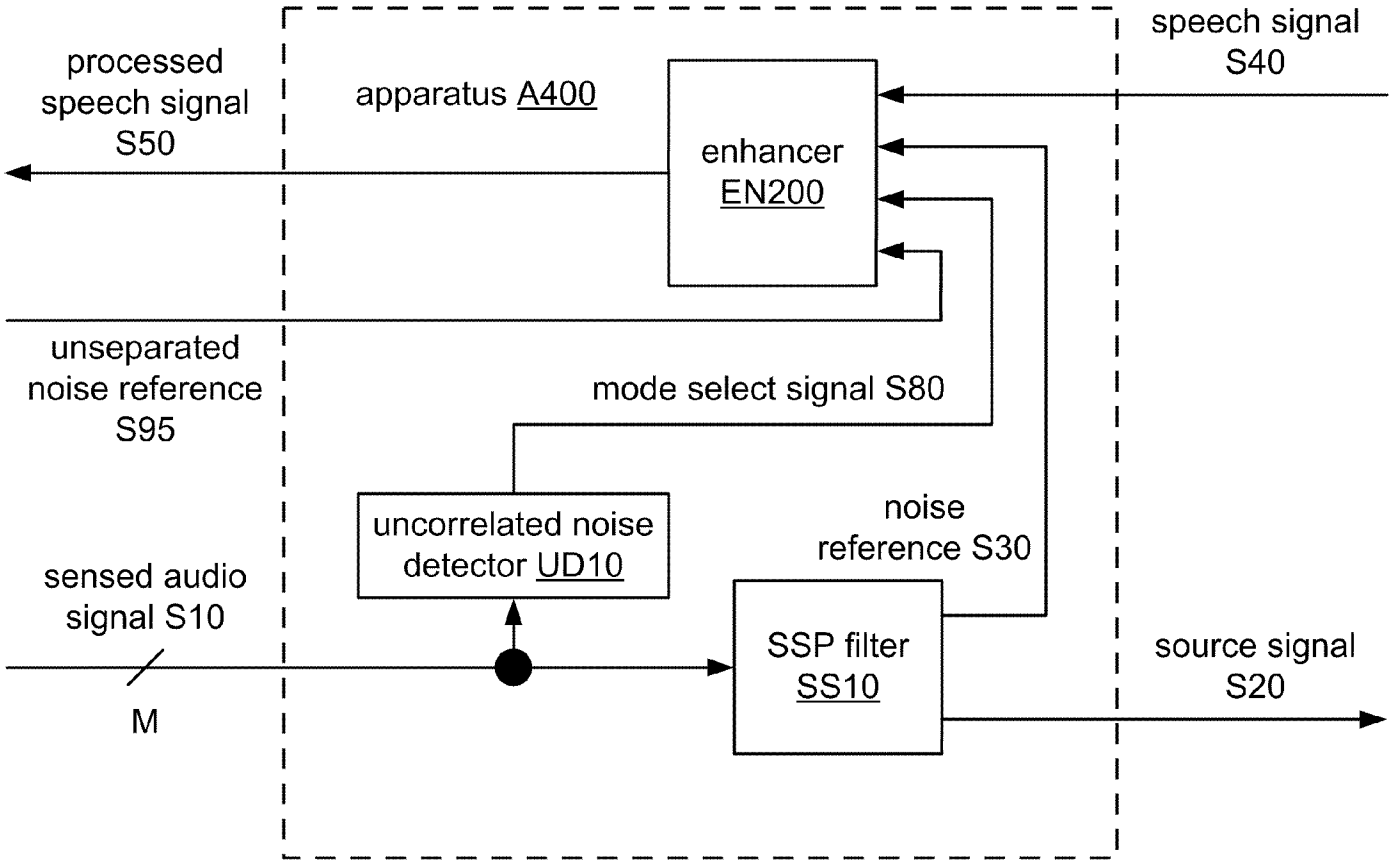
FIG. 62 shows a block diagram of an implementation A400 of apparatus A100.

FIG. 62 shows a block diagram of another implementation A400 of apparatus A100. Apparatus A400 includes an implementation of enhancer EN200 as described herein and is similar to apparatus A200. In this case, however, mode select signal S80 is generated by an uncorrelated noise detector UD10. Uncorrelated noise, which is noise that affects one microphone of an array and not another, may include wind noise, breath sounds, scratching, and the like. Uncorrelated noise may cause an undesirable result in a multi-microphone signal separation system such as SSP filter SS10, as the system may actually amplify such noise if permitted. Techniques for detecting uncorrelated noise include estimating a cross-correlation of the microphone signals (or portions thereof, such as a band in each microphone signal from about 200 Hz to about 800 or 1000 Hz). Such cross-correlation estimation may include gain-adjusting the passband of a secondary microphone signal to equalize far-field response between the microphones, subtracting the gain-adjusted signal from the passband of the primary microphone signal, and comparing the energy of the difference signal to a threshold value (which may be adaptive based on the energy over time of the difference signal and/or of the primary microphone passband). Uncorrelated noise detector UD10 may be implemented according to such a technique and/or any other suitable technique. Detection of uncorrelated noise in a multiple-microphone device is also discussed in U.S. patent application Ser. No. 12/201,528, filed Aug. 29, 2008, entitled "SYSTEMS, METHODS, AND APPARATUS FOR DETECTION OF UNCORRELATED COMPONENT," which document is hereby incorporated by reference for purposes limited to disclosure of the design and implementation of uncorrelated noise detector UD10 and the integration of such a detector into a speech processing apparatus. It is expressly noted that apparatus A400 may be implemented as an implementation of apparatus A110 (i.e., such that enhancer EN200 is arranged to receive source signal S20 as speech signal S40).

In another example, an implementation of apparatus A100 that includes an instance of uncorrelated noise detector UD10 is configured to bypass enhancer EN10 (e.g., as described above) when mode select signal S80 has the second state (i.e., when mode select signal S80 indicates that uncorrelated noise is detected). Such an arrangement may be desirable, for example, for an implementation of apparatus A110 in which enhancer EN10 is configured to receive source signal S20 as the speech signal.

Figure 63:
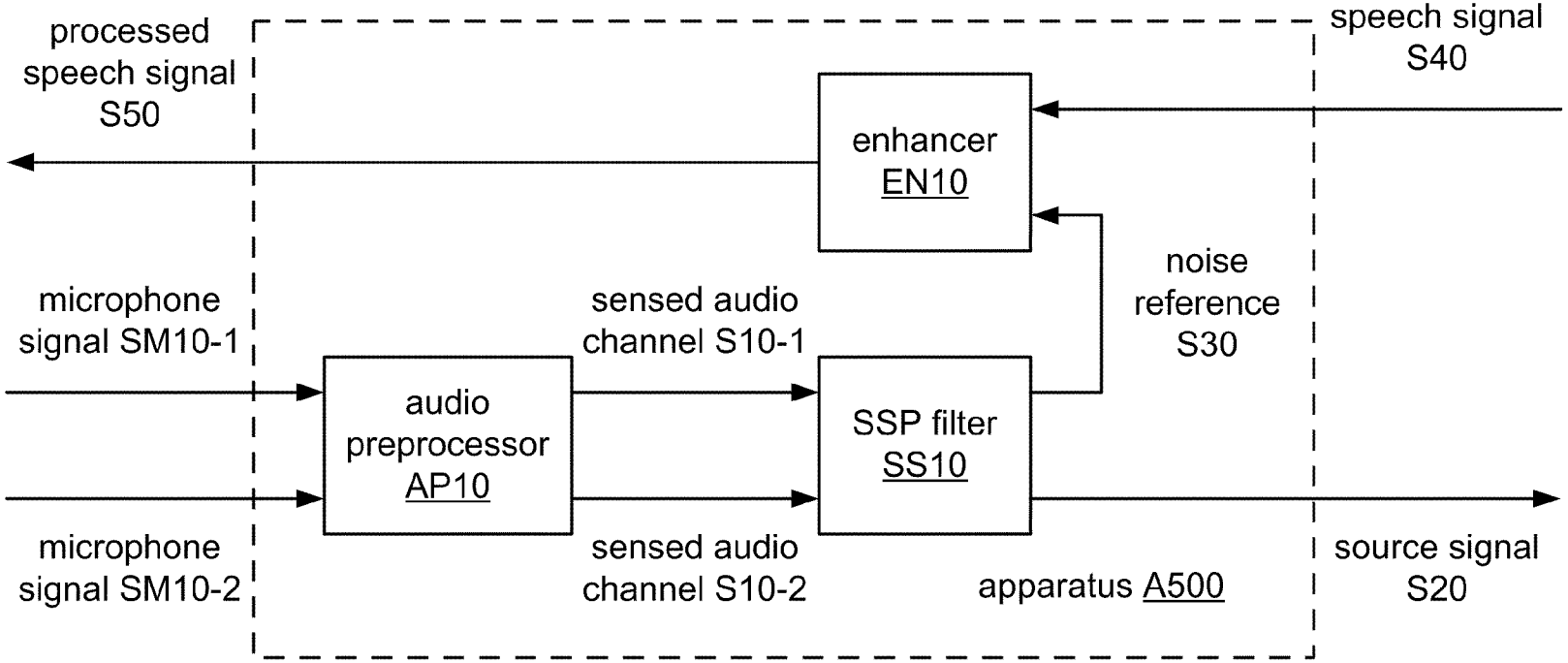
FIG. 63 shows a block diagram of an implementation A500 of apparatus A100.

As noted above, it may be desirable to obtain sensed audio signal S10 by performing one or more preprocessing operations on two or more microphone signals. FIG. 63 shows a block diagram of an implementation A500 of apparatus A100 (possibly an implementation of apparatus A110 and/or A120) that includes an audio preprocessor AP10 configured to preprocess M analog microphone signals SM10-1 to SM10-M to produce M channels S10-1 to S10-M of sensed audio signal S10. For example, audio preprocessor AP10 may be configured to digitize a pair of analog microphone signals SM10-1, SM10-2 to produce a pair of channels S10-1, S10-2 of sensed audio signal S10. It is expressly noted that apparatus A500 may be implemented as an implementation of apparatus A110 (i.e., such that enhancer EN10 is arranged to receive source signal S20 as speech signal S40).

Audio preprocessor AP10 may also be configured to perform other preprocessing operations on the microphone signals in the analog and/or digital domains, such as spectral shaping and/or echo cancellation. For example, audio preprocessor AP10 may be configured to apply one or more gain factors to each of one or more of the microphone signals, in either of the analog and digital domains. The values of these gain factors may be selected or otherwise calculated such that the microphones are matched to one another in terms of frequency response and/or gain. Calibration procedures that may be performed to evaluate these gain factors are described in more detail below.

Figure 64A:
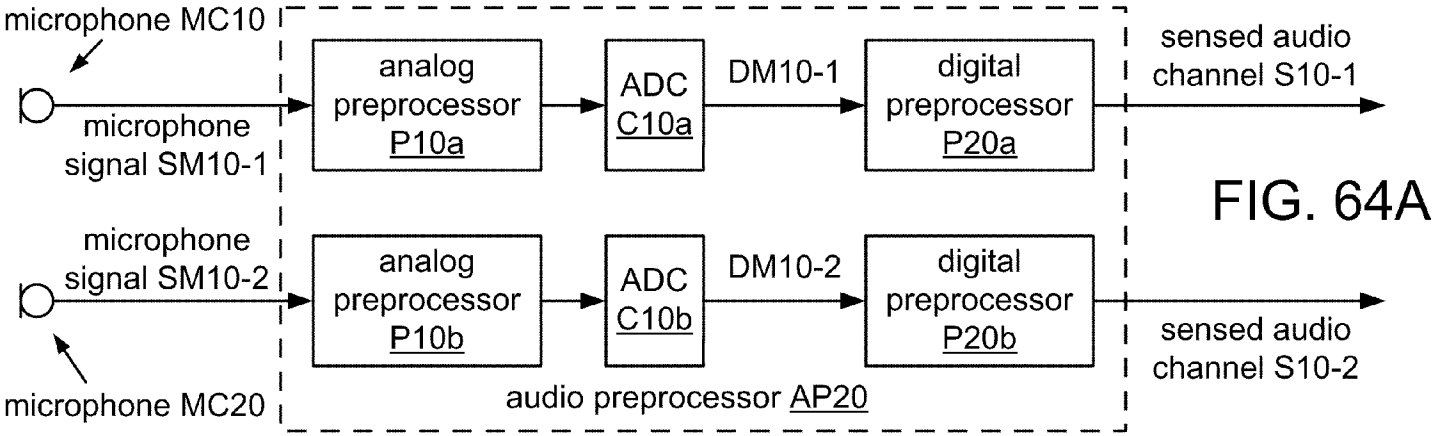
FIG. 64A shows a block diagram of an implementation AP20 of audio preprocessor AP10.

FIG. 64A shows a block diagram of an implementation AP20 of audio preprocessor AP10 that includes first and second analog-to-digital converters (ADCs) C10*a* and C10*b*. First ADC C10*a* is configured to digitize signal SM10-1 from microphone MC10 to obtain a digitized microphone signal DM10-1, and second ADC C10*b* is configured to digitize signal SM10-2 from microphone MC20 to obtain a digitized microphone signal DM10-2. Typical sampling rates that may be applied by ADCs C10*a* and C10*b* include 8 kHz, 12 kHz, 16 kHz, and other frequencies in the range of from about 8 kHz to about 16 kHz, although sampling rates as high as about 44 kHz may also be used. In this example, audio preprocessor AP20 also includes a pair of analog preprocessors P10*a* and P10*b* that are configured to perform one or more analog preprocessing operations on microphone signals SM10-1 and SM10-2, respectively, before sampling and a pair of digital preprocessors P20*a* and P20*b* that are configured to perform one or more digital preprocessing operations (e.g., echo cancellation, noise reduction, and/or spectral shaping) on microphone signals DM10-1 and DM10-2, respectively, after sampling.

Figure 65:
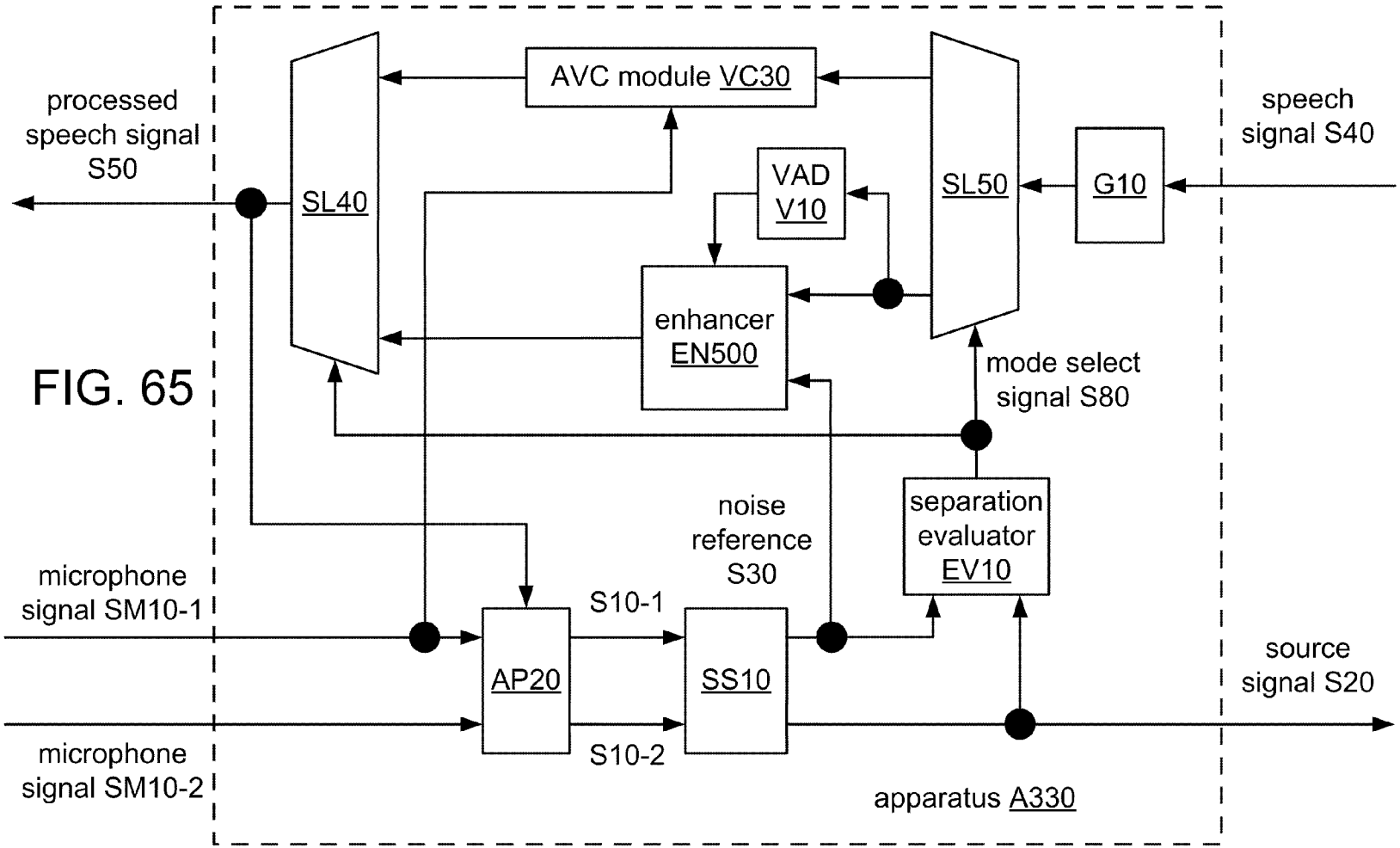
FIG. 65 shows a block diagram of an implementation A330 of apparatus A310.

FIG. 65 shows a block diagram of an implementation A330 of apparatus A310 that includes an instance of audio preprocessor AP20. Apparatus A330 also includes an implementation VC30 of AVC module VC10 that is configured to control the volume of speech signal S40 according to information from microphone signal SM10-1 (e.g., a current power estimate of signal SM10-1).

Figure 64B:
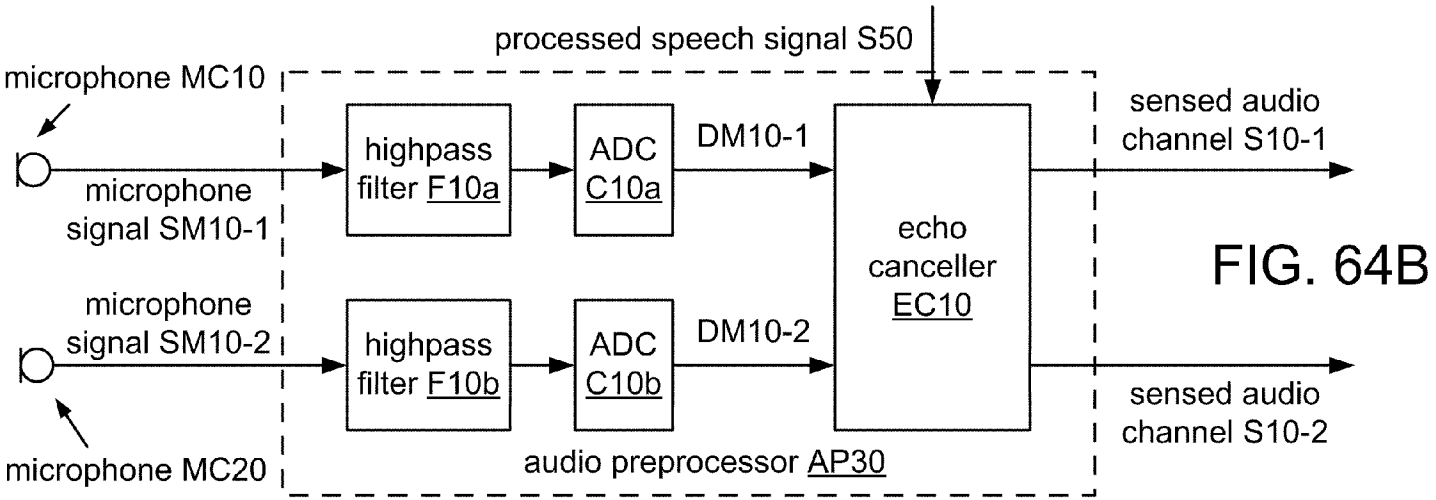
FIG. 64B shows a block diagram of an implementation AP30 of audio preprocessor AP20.

FIG. 64B shows a block diagram of an implementation AP30 of audio preprocessor AP20. In this example, each of analog preprocessors P10*a* and P10*b* is implemented as a respective one of highpass filters F10*a* and F10*b* that are configured to perform analog spectral shaping operations on microphone signals SM10-1 and SM10-2, respectively, before sampling. Each filter F10*a* and F10*b* may be configured to perform a highpass filtering operation with a cutoff frequency of, for example, 50, 100, or 200 Hz.

For a case in which speech signal S40 is a reproduced speech signal (e.g., a far-end signal), the corresponding processed speech signal S50 may be used to train an echo canceller that is configured to cancel echoes from sensed audio signal S10 (i.e., to remove echoes from the microphone signals). In the example of audio preprocessor AP30, digital preprocessors P20*a* and P20*b* are implemented as an echo canceller EC10 that is configured to cancel echoes from sensed audio signal S10, based on information from processed speech signal S50. Echo canceller EC10 may be arranged to receive processed speech signal S50 from a time-domain buffer. In one such example, the time-domain buffer has a length of ten milliseconds (e.g., eighty samples at a sampling rate of eight kHz, or 160 samples at a sampling rate of sixteen kHz). During certain modes of operation of a communications device that includes apparatus A10, such as a speakerphone mode and/or a push-to-talk (PTT) mode, it may be desirable to suspend the echo cancellation operation (e.g., to configure echo canceller EC10 to pass the microphone signals unchanged).

It is possible that using processed speech signal S50 to train the echo canceller may give rise to a feedback problem (e.g., due to the degree of processing that occurs between the echo canceller and the output of the enhancement control element). In such case, it may be desirable to control the training rate of the echo canceller according to the current activity of enhancer EN10. For example, it may be desirable to control the training rate of the echo canceller in inverse proportion to a measure (e.g., an average) of current values of the gain factors and/or to control the training rate of the echo canceller in inverse proportion to a measure (e.g., an average) of differences between successive values of the gain factors.

Figure 66A:
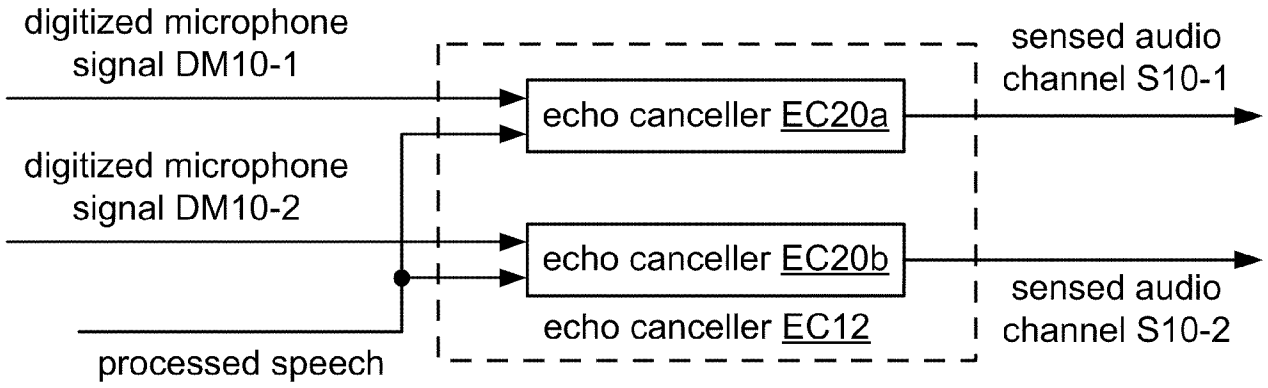
FIG. 66A shows a block diagram of an implementation EC12 of echo canceller EC10.

FIG. 66A shows a block diagram of an implementation EC12 of echo canceller EC10 that includes two instances EC20*a* and EC20*b* of a single-channel echo canceller. In this example, each instance of the single-channel echo canceller is configured to process a corresponding one of microphone signals DM10-1, DM10-2 to produce a corresponding channel S10-1, S10-2 of sensed audio signal S10. The various instances of the single-channel echo canceller may each be configured according to any technique of echo cancellation (for example, a least mean squares technique and/or an adaptive correlation technique) that is currently known or is yet to be developed. For example, echo cancellation is discussed at paragraphs [00139]-[00141] of U.S. patent application Ser. No. 12/197,924 referenced above (beginning with "An apparatus" and ending with "B500"), which paragraphs are hereby incorporated by reference for purposes limited to disclosure of echo cancellation issues, including but not limited to design and/or implementation of an echo canceller and/or integration of an echo canceller with other elements of a speech processing apparatus.

Figure 66B:
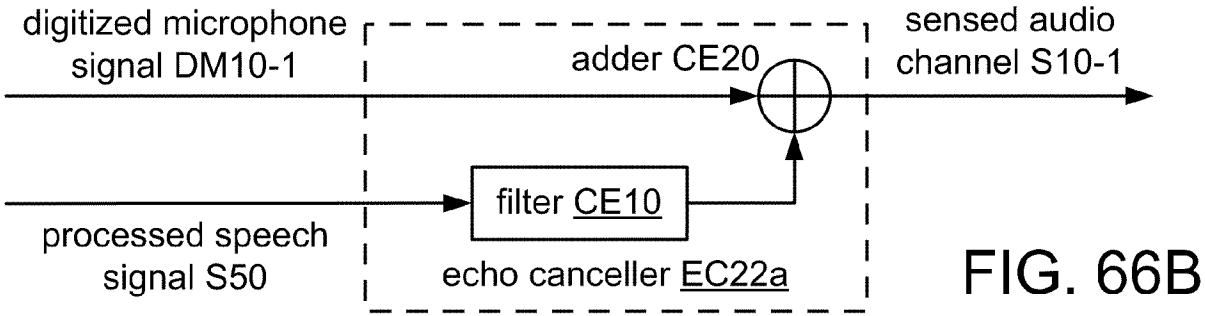
FIG. 66B shows a block diagram of an implementation EC22*a* of echo canceller EC20*a*.

FIG. 66B shows a block diagram of an implementation EC22*a* of echo canceller EC20*a* that includes a filter CE10 arranged to filter processed speech signal S50 and an adder CE20 arranged to combine the filtered signal with the microphone signal being processed. The filter coefficient values of filter CE10 may be fixed. Alternatively, at least one (and possibly all) of the filter coefficient values of filter CE10 may be adapted during operation of apparatus A110 (e.g., based on processed speech signal S50). As described in more detail below, it may be desirable to train a reference instance of filter CE10 to an initial state, using a set of multichannel signals that are recorded by a reference instance of a communications device as it reproduces an audio signal, and to copy the initial state into production instances of filter CE10.

Echo canceller EC20*b* may be implemented as another instance of echo canceller EC22*a* that is configured to process microphone signal DM10-2 to produce sensed audio channel S40-2. Alternatively, echo cancellers EC20*a* and EC20*b* may be implemented as the same instance of a single-channel echo canceller (e.g., echo canceller EC22*a*) that is configured to process each of the respective microphone signals at different times.

An implementation of apparatus A110 that includes an instance of echo canceller EC10 may also be configured to include an instance of VAD V10 that is arranged to perform a voice activity detection operation on processed speech signal S50. In such case, apparatus A110 may be configured to control an operation of echo canceller EC10 based on a result of the voice activity operation. For example, it may be desirable to configure apparatus A110 to activate training (e.g., adaptation) of echo canceller EC10, to increase a training rate of echo canceller EC10, and/or to increase a depth of one or more filters of echo canceller EC10 (e.g., filter CE10), when a result of such a voice activity detection operation indicates that the current frame is active.

Figure 66C:
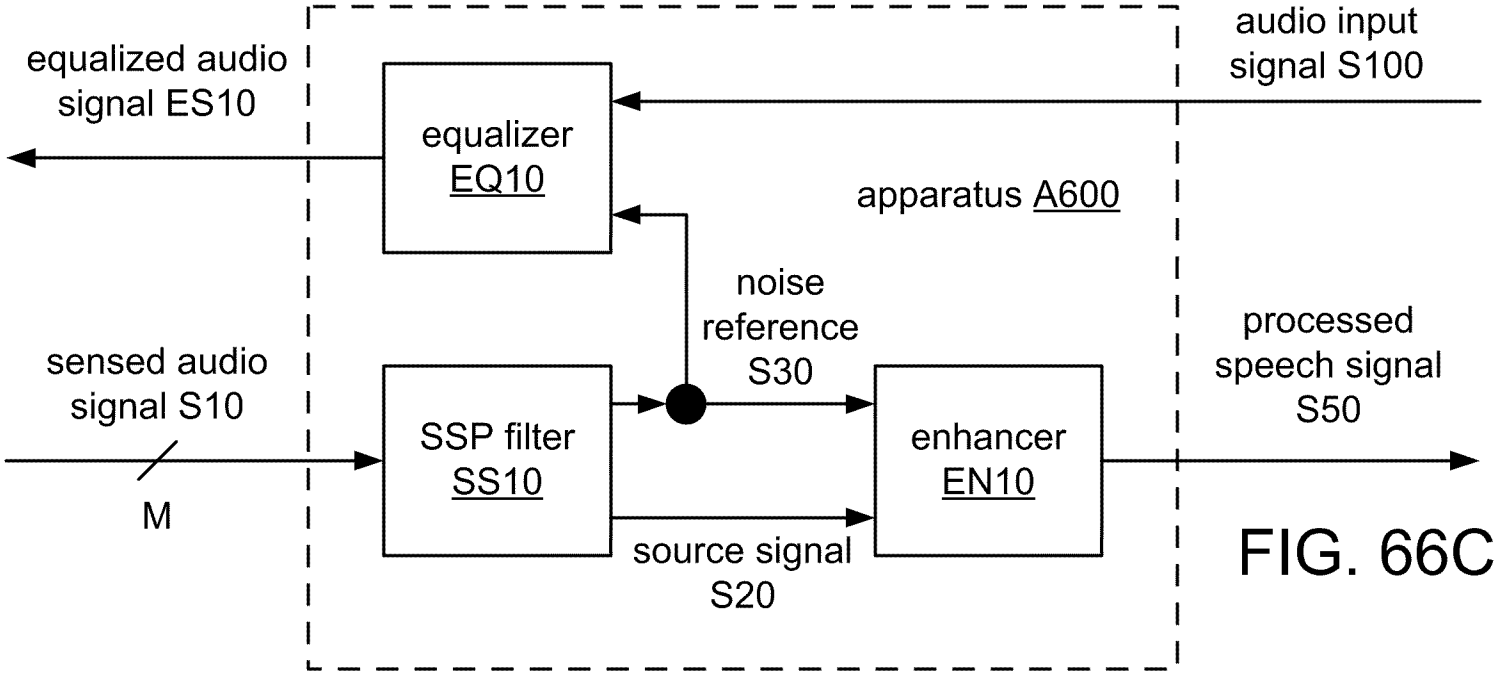
FIG. 66C shows a block diagram of an implementation A600 of apparatus A110.

FIG. 66C shows a block diagram of an implementation A600 of apparatus A110. Apparatus A600 includes an equalizer EQ10 that is arranged to process audio input signal 5100 (e.g., a far-end signal) to produce an equalized audio signal ES10. Equalizer EQ10 may be configured to dynamically alter the spectral characteristics of audio input signal S100 based on information from noise reference S30 to produce equalized audio signal ES10. For example, equalizer EQ10 may be configured to use information from noise reference S30 to boost at least one frequency subband of audio input signal S100 relative to at least one other frequency subband of audio input signal S100 to produce equalized audio signal ES10. Examples of equalizer EQ10 and related equalization methods are disclosed, for example, in U.S. patent application Ser. No. 12/277,283 referenced above. Communications device D100 as disclosed herein may be implemented to include an instance of apparatus A600 instead of apparatus A550.

Figure 67A:
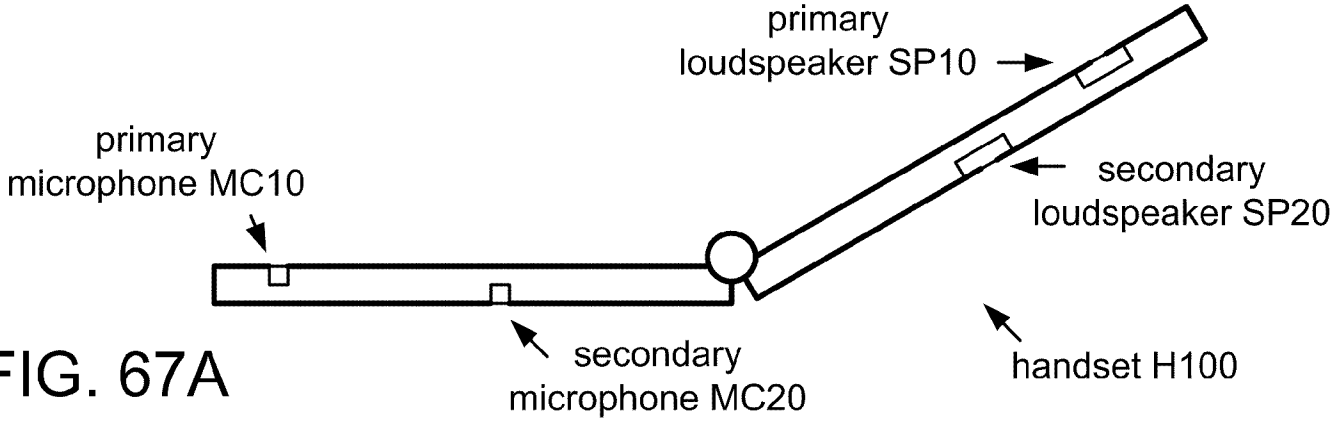
FIG. 67A shows a diagram of a two-microphone handset H100 in a first operating configuration.

Some examples of an audio sensing device that may be constructed to include an implementation of apparatus A100 (for example, an implementation of apparatus A110) are illustrated in FIGS. 67A-72C. FIG. 67A shows a cross-sectional view along a central axis of a two-microphone handset H100 in a first operating configuration. Handset H100 includes an array having a primary microphone MC10 and a secondary microphone MC20. In this example, handset H100 also includes a primary loudspeaker SP10 and a secondary loudspeaker SP20. When handset H100 is in the first operating configuration, primary loudspeaker SP10 is active and secondary loudspeaker SP20 may be disabled or otherwise muted. It may be desirable for primary microphone MC10 and secondary microphone MC20 to both remain active in this configuration to support spatially selective processing techniques for speech enhancement and/or noise reduction.

Handset H100 may be configured to transmit and receive voice communications data wirelessly via one or more codecs. Examples of codecs that may be used with, or adapted for use with, transmitters and/or receivers of communications devices as described herein include the Enhanced Variable Rate Codec (EVRC), as described in the Third Generation Partnership Project 2 (3GPP2) document C.S0014-C, v1.0, entitled "Enhanced Variable Rate Codec, Speech Service Options 3, 68, and 70 for Wideband Spread Spectrum Digital Systems," February 2007 (available online at www-dot-3gpp-dot-org); the Selectable Mode Vocoder speech codec, as described in the 3GPP2 document C.S0030-0, v3.0, entitled "Selectable Mode Vocoder (SMV) Service Option for Wideband Spread Spectrum Communication Systems," January 2004 (available online at www-dot-3gpp-dot-org); the Adaptive Multi Rate (AMR) speech codec, as described in the document ETSI TS 126 092 V6.0.0 (European Telecommunications Standards Institute (ETSI), Sophia Antipolis Cedex, FR, December 2004); and the AMR Wideband speech codec, as described in the document ETSI TS 126 192 V6.0.0 (ETSI, December 2004).

Figure 67B:
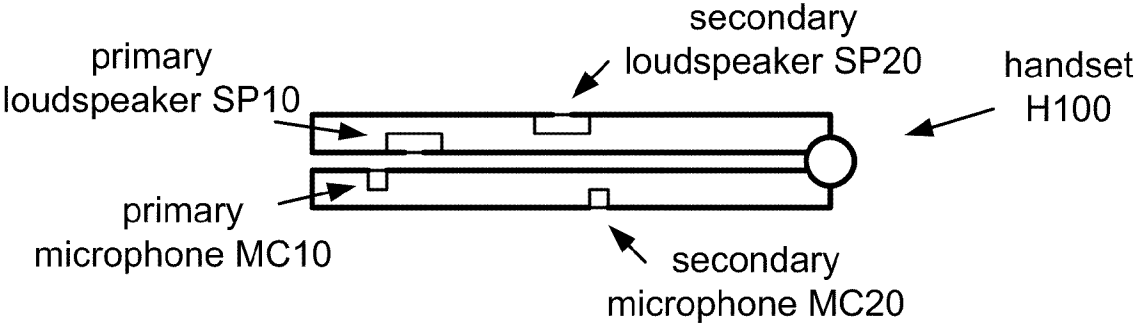
FIG. 67B shows a second operating configuration for handset H100.

FIG. 67B shows a second operating configuration for handset H100. In this configuration, primary microphone MC10 is occluded, secondary loudspeaker SP20 is active, and primary loudspeaker SP10 may be disabled or otherwise muted. Again, it may be desirable for both of primary microphone MC10 and secondary microphone MC20 to remain active in this configuration (e.g., to support spatially selective processing techniques). Handset H100 may include one or more switches or similar actuators whose state (or states) indicate the current operating configuration of the device.

Figure 68A:
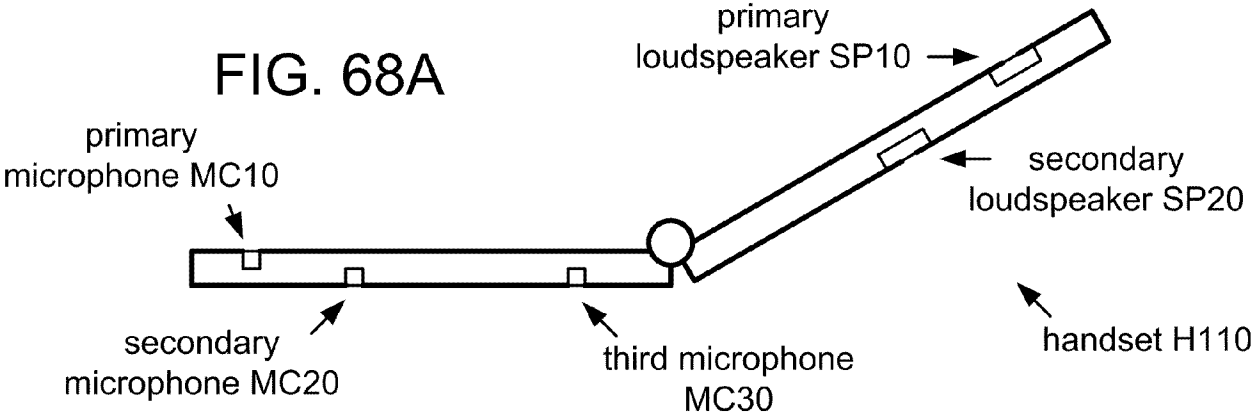
FIG. 68A shows a diagram of an implementation H10 of handset H100 that includes three microphones.
Figure 68B:
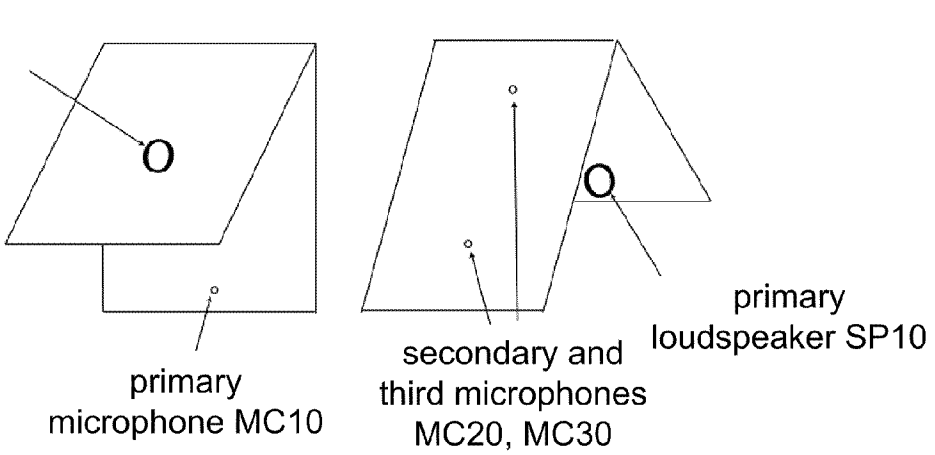
FIG. 68B shows two other views of handset H110.

Apparatus A100 may be configured to receive an instance of sensed audio signal S10 that has more than two channels. For example, FIG. 68A shows a cross-sectional view of an implementation H110 of handset H100 in which the array includes a third microphone MC30. FIG. 68B shows two other views of handset H110 that show a placement of the various transducers along an axis of the device. FIGS. 67A to 68B show examples of clamshell-type cellular telephone handsets. Other configurations of a cellular telephone handset having an implementation of apparatus A100 include bar-type and slider-type telephone handsets, as well as handsets in which one or more of the transducers are disposed away from the axis.

Figure 69A:
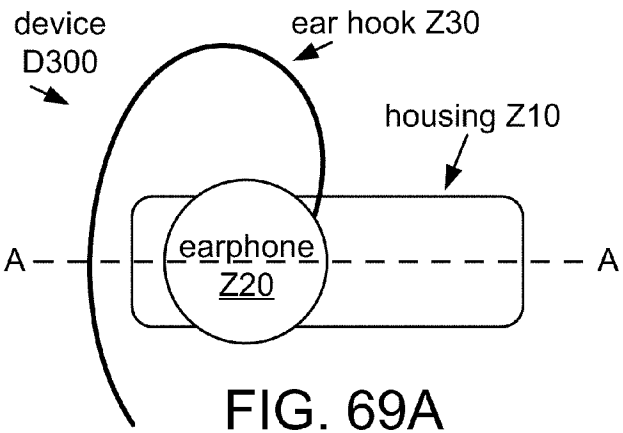
FIGS. 69A to 69D show a bottom view, a top view, a front view, and a side view, respectively, of a multi-microphone audio sensing device D300.
Figure 69B:
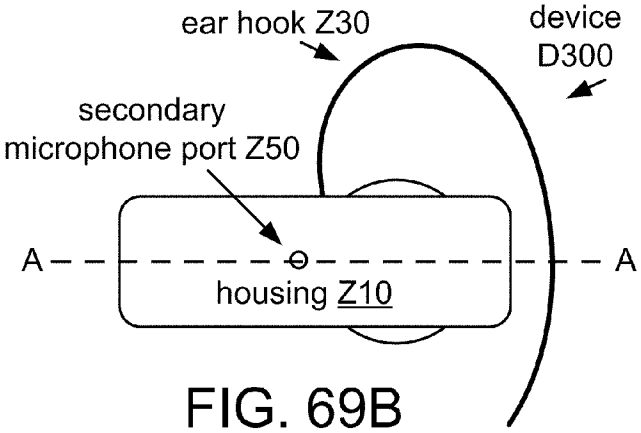
Figure 69C:
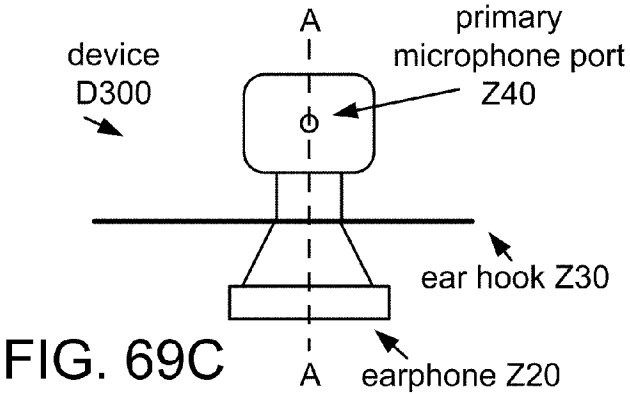
Figure 69D:
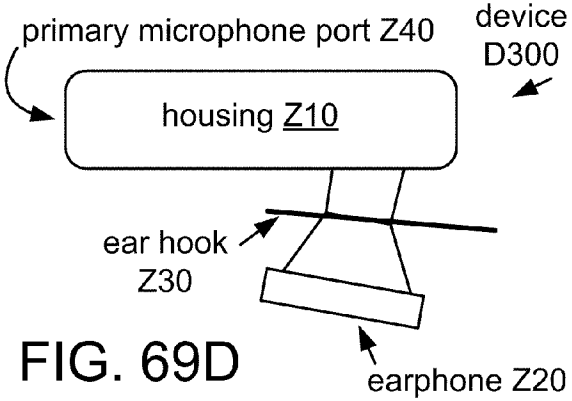

An earpiece or other headset having M microphones is another kind of portable communications device that may include an implementation of apparatus A100. Such a headset may be wired or wireless. FIGS. 69A to 69D show various views of one example of such a wireless headset D300 that includes a housing Z10 which carries a two-microphone array and an earphone Z20 (e.g., a loudspeaker) for reproducing a far-end signal that extends from the housing. Such a device may be configured to support half- or full-duplex telephony via communication with a telephone device such as a cellular telephone handset (e.g., using a version of the Bluetooth™ protocol as promulgated by the Bluetooth Special Interest Group, Inc., Bellevue, Wash.). In general, the housing of a headset may be rectangular or otherwise elongated as shown in FIGS. 69A, 69B, and 69D (e.g., shaped like a miniboom) or may be more rounded or even circular. The housing may enclose a battery and a processor and/or other processing circuitry (e.g., a printed circuit board and components mounted thereon) configured to execute an implementation of apparatus A100. The housing may also include an electrical port (e.g., a mini-Universal Serial Bus (USB) or other port for battery charging) and user interface features such as one or more button switches and/or LEDs. Typically the length of the housing along its major axis is in the range of from one to three inches.

Typically each microphone of the array is mounted within the device behind one or more small holes in the housing that serve as an acoustic port. FIGS. 69B to 69D show the locations of the acoustic port Z40 for the primary microphone of the array and the acoustic port Z50 for the secondary microphone of the array. A headset may also include a securing device, such as ear hook Z30, which is typically detachable from the headset. An external ear hook may be reversible, for example, to allow the user to configure the headset for use on either ear. Alternatively, the earphone of a headset may be designed as an internal securing device (e.g., an earplug) which may include a removable earpiece to allow different users to use an earpiece of different size (e.g., diameter) for better fit to the outer portion of the particular user's ear canal.

Figure 70A:
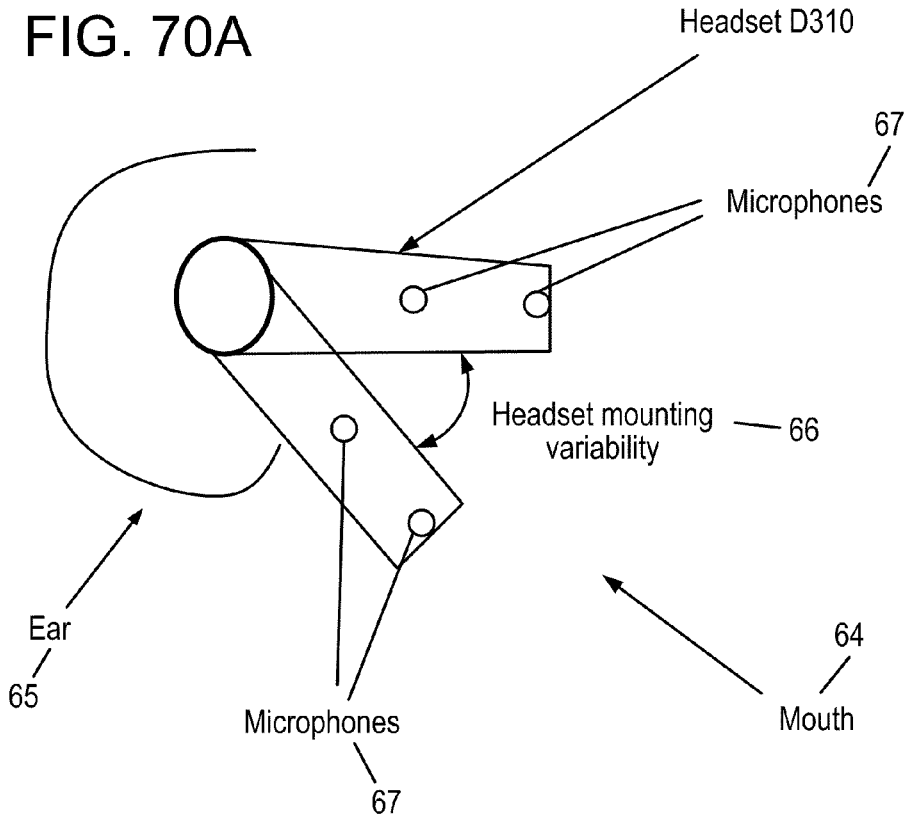
FIG. 70A shows a diagram of a range of different operating configurations of a headset.

FIG. 70A shows a diagram of a range 66 of different operating configurations of an implementation D310 of headset D300 as mounted for use on a user's ear 65. Headset D310 includes an array 67 of primary and secondary microphones arranged in an endfire configuration which may be oriented differently during use with respect to the user's mouth 64. In a further example, a handset that includes an implementation of apparatus A100 is configured to receive sensed audio signal S10 from a headset having M microphones, and to output a far-end processed speech signal S50 to the headset, over a wired and/or wireless communications link (e.g., using a version of the Bluetooth™ protocol).

FIGS. 71A to 71D show various views of a multi-microphone portable audio sensing device D350 that is another example of a wireless headset. Headset D350 includes a rounded, elliptical housing Z12 and an earphone Z22 that may be configured as an earplug. FIGS. 71A to 71D also show the locations of the acoustic port Z42 for the primary microphone and the acoustic port Z52 for the secondary microphone of the array of device D350. It is possible that secondary microphone port Z52 may be at least partially occluded (e.g., by a user interface button).

Figure 70B:
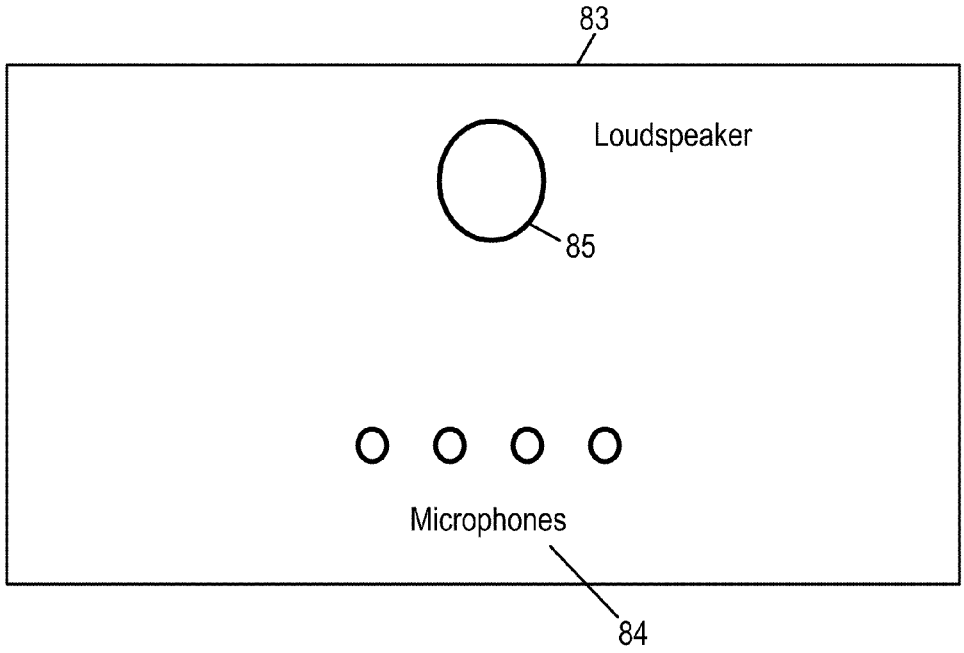
FIG. 70B shows a diagram of a hands-free car kit.
Figure 71A:
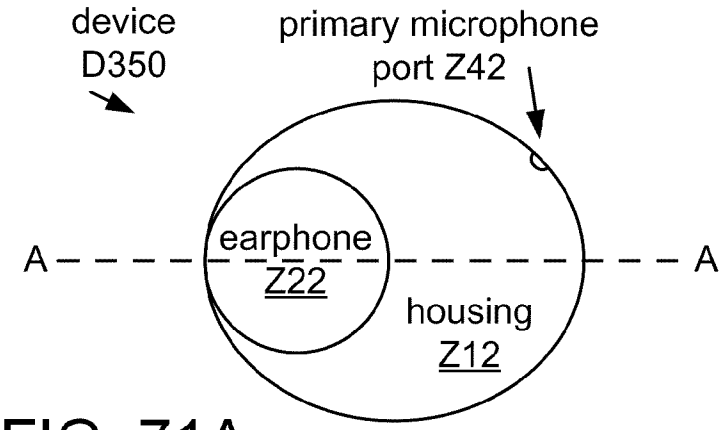
FIGS. 71A to 71D show a bottom view, a top view, a front view, and a side view, respectively, of a multi-microphone audio sensing device D350.
Figure 71B:
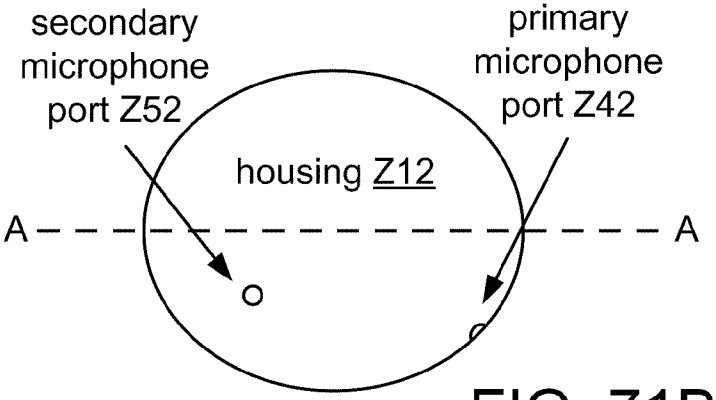
Figure 71C:
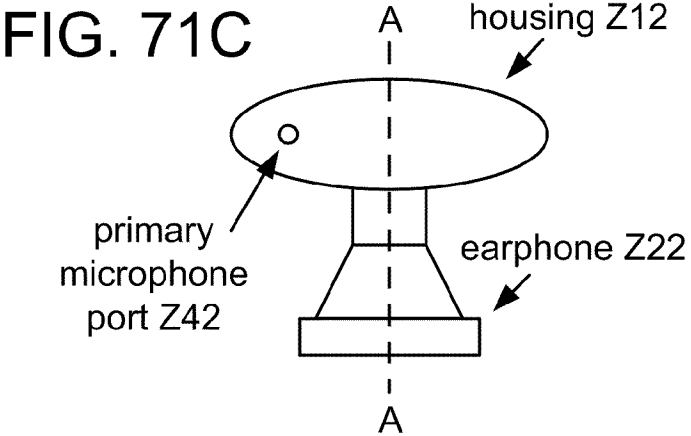
Figure 71D:
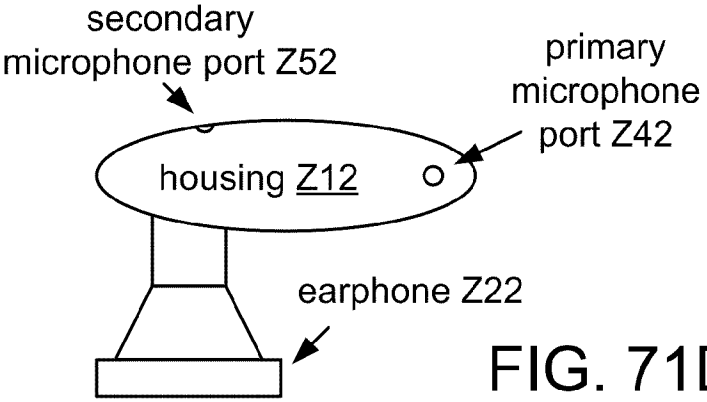

A hands-free car kit having M microphones is another kind of mobile communications device that may include an implementation of apparatus A100. The acoustic environment of such a device may include wind noise, rolling noise, and/or engine noise. Such a device may be configured to be installed in the dashboard of a vehicle or to be removably fixed to the windshield, a visor, or another interior surface. FIG. 70B shows a diagram of an example of such a car kit 83 that includes a loudspeaker 85 and an M-microphone array 84. In this particular example, M is equal to four, and the M microphones are arranged in a linear array. Such a device may be configured to transmit and receive voice communications data wirelessly via one or more codecs, such as the examples listed above. Alternatively or additionally, such a device may be configured to support half- or full-duplex telephony via communication with a telephone device such as a cellular telephone handset (e.g., using a version of the Bluetooth™ protocol as described above).

Other examples of communications devices that may include an implementation of apparatus A100 include communications devices for audio or audiovisual conferencing. A typical use of such a conferencing device may involve multiple desired speech sources (e.g., the mouths of the various participants). In such case, it may be desirable for the array of microphones to include more than two microphones.

Figure 72C:
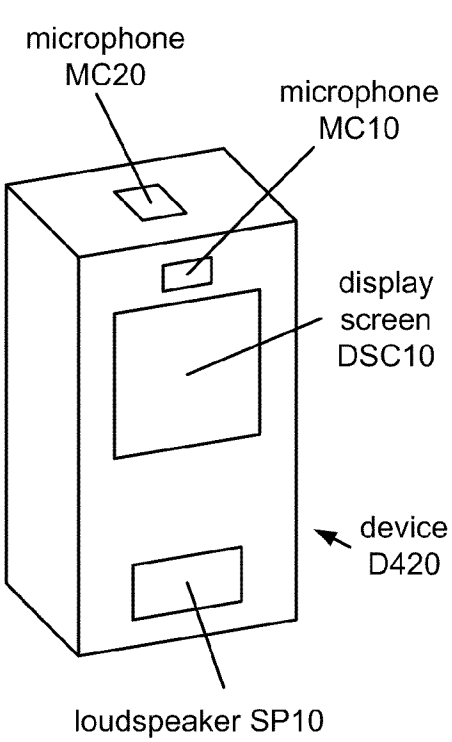
FIGS. 72A-C show examples of media playback devices.
Figure 72B:
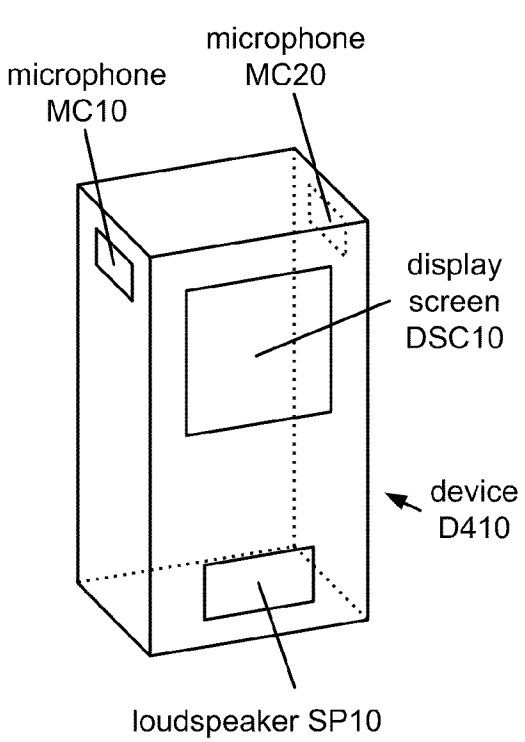
Figure 72A:
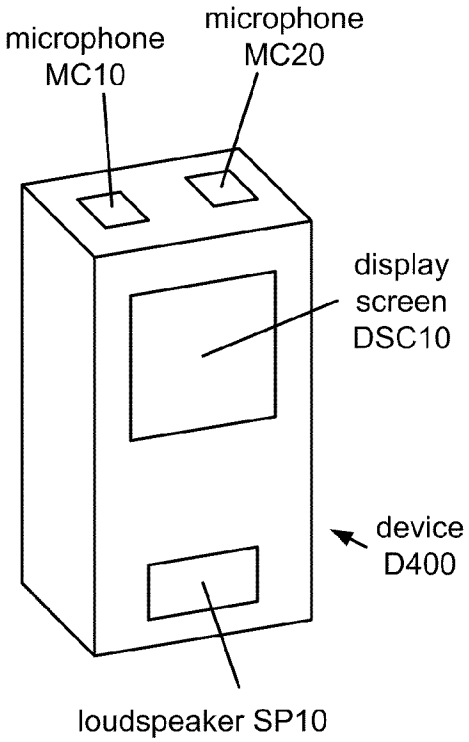

A media playback device having M microphones is a kind of audio or audiovisual playback device that may include an implementation of apparatus A100. FIG. 72A shows a diagram of such a device D400, which may be configured for playback (and possibly for recording) of compressed audio or audiovisual information, such as a file or stream encoded according to a standard codec (e.g., Moving Pictures Experts Group (MPEG)-1 Audio Layer 3 (MP3), MPEG-4 Part 14 (MP4), a version of Windows Media Audio/Video (WMA/WMV) (Microsoft Corp., Redmond, Wash.), Advanced Audio Coding (AAC), International Telecommunication Union (ITU)-T H.264, or the like). Device D400 includes a display screen DSC10 and a loudspeaker SP10 disposed at the front face of the device, and microphones MC10 and MC20 of the microphone array are disposed at the same face of the device (e.g., on opposite sides of the top face as in this example, or on opposite sides of the front face). FIG. 72B shows another implementation D410 of device D400 in which microphones MC10 and MC20 are disposed at opposite faces of the device, and FIG. 72C shows a further implementation D420 of device D400 in which microphones MC10 and MC20 are disposed at adjacent faces of the device. A media playback device as shown in FIGS. 72A-C may also be designed such that the longer axis is horizontal during an intended use.

Figure 73A:
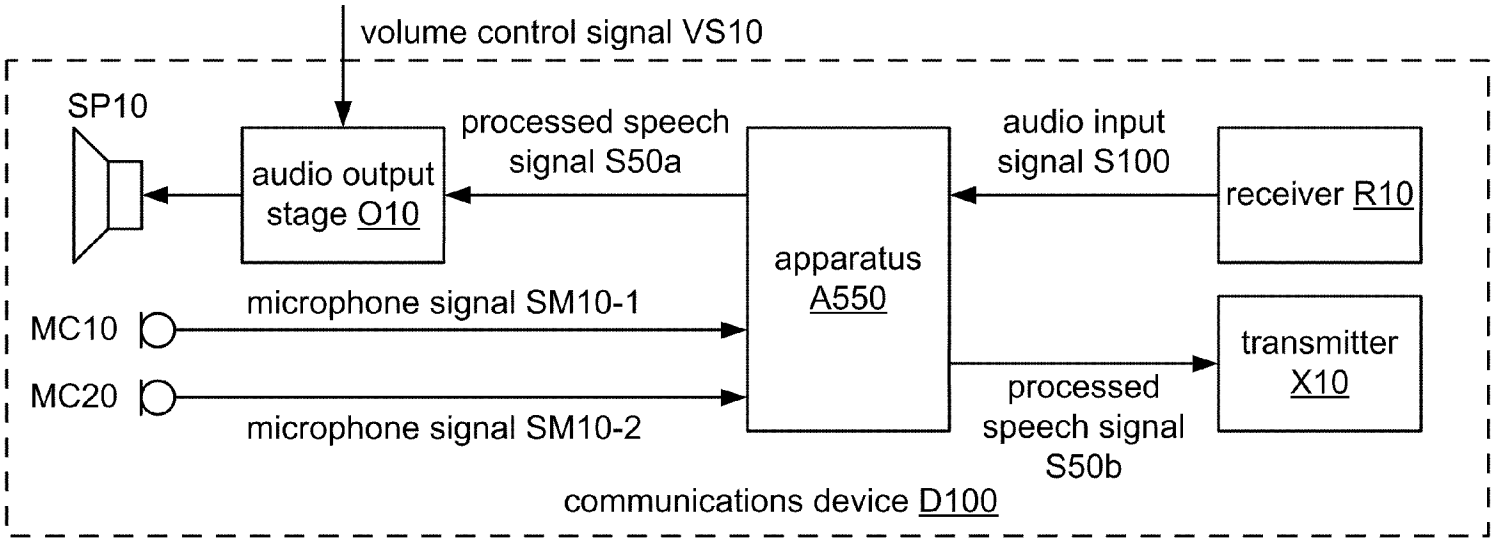
FIG. 73A shows a block diagram of a communications device D100.

An implementation of apparatus A100 may be included within a transceiver (for example, a cellular telephone or wireless headset as described above). FIG. 73A shows a block diagram of such a communications device D100 that includes an implementation A550 of apparatus A500 and of apparatus A120. Device D100 includes a receiver R10 coupled to apparatus A550 that is configured to receive a radio-frequency (RF) communications signal and to decode and reproduce an audio signal encoded within the RF signal as far-end audio input signal S100, which is received by apparatus A550 in this example as speech signal S40. Device D100 also includes a transmitter X10 coupled to apparatus A550 that is configured to encode near-end processed speech signal S50*b* and to transmit an RF communications signal that describes the encoded audio signal. The near-end path of apparatus A550 (i.e., from signals SM10-1 and SM10-2 to processed speech signal S50*b*) may be referred to as an "audio front end" of device D100. Device D100 also includes an audio output stage O10 that is configured to process far-end processed speech signal S50*a* (e.g., to convert processed speech signal S50*a* to an analog signal) and to output the processed audio signal to loudspeaker SP10. In this example, audio output stage O10 is configured to control the volume of the processed audio signal according to a level of volume control signal VS10, which level may vary under user control.

It may be desirable for an implementation of apparatus A100 (e.g., A110 or A120) to reside within a communications device such that other elements of the device (e.g., a baseband portion of a mobile station modem (MSM) chip or chipset) are arranged to perform further audio processing operations on sensed audio signal S10. In designing an echo canceller to be included in an implementation of apparatus A110 (e.g., echo canceller EC10), it may be desirable to take into account possible synergistic effects between this echo canceller and any other echo canceller of the communications device (e.g., an echo cancellation module of the MSM chip or chipset).

Figure 73B:
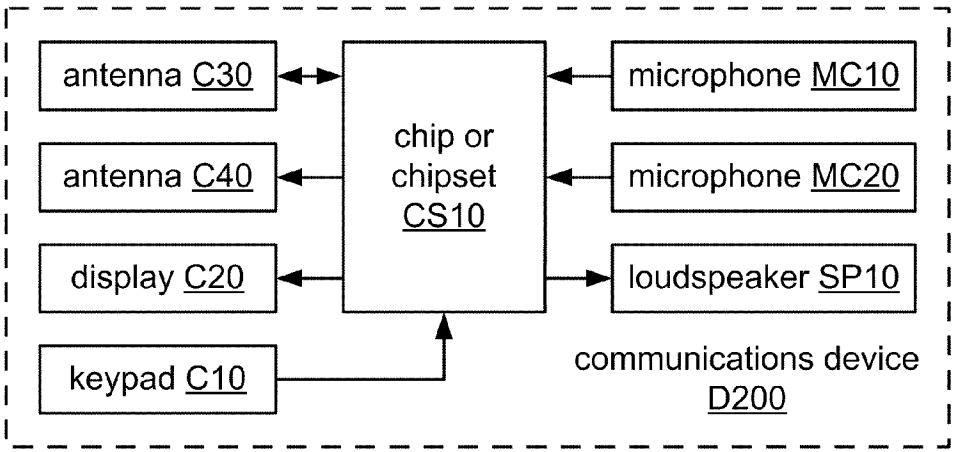
FIG. 73B shows a block diagram of an implementation D200 of communications device D100.

FIG. 73B shows a block diagram of an implementation D200 of communications device D100. Device D200 includes a chip or chipset CS10 (e.g., an MSM chipset) that includes one or more processors configured to execute an instance of apparatus A550. Chip or chipset CS10 also includes elements of receiver R10 and transmitter X10, and the one or more processors of CS10 may be configured to execute one or more of such elements (e.g., a vocoder VC10 that is configured to decode an encoded signal received wirelessly to produce audio input signal S100 and to encode processed speech signal S50*b*). Device D200 is configured to receive and transmit the RF communications signals via an antenna C30. Device D200 may also include a diplexer and one or more power amplifiers in the path to antenna C30. Chip/chipset CS10 is also configured to receive user input via keypad C10 and to display information via display C20. In this example, device D200 also includes one or more antennas C40 to support Global Positioning System (GPS) location services and/or short-range communications with an external device such as a wireless (e.g., Bluetooth™) headset. In another example, such a communications device is itself a Bluetooth headset and lacks keypad C10, display C20, and antenna C30.

Figure 74A:
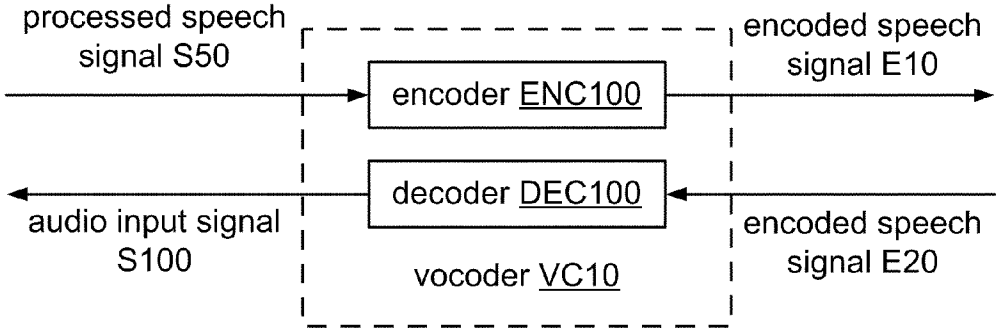
FIG. 74A shows a block diagram of a vocoder VC10.

FIG. 74A shows a block diagram of vocoder VC10. Vocoder VC10 includes an encoder ENC100 that is configured to encode processed speech signal S50 (e.g., according to one or more codecs, such as those identified herein) to produce a corresponding near-end encoded speech signal E10. Vocoder VC10 also includes a decoder DEC100 that is configured to decode a far-end encoded speech signal E20 (e.g., according to one or more codecs, such as those identified herein) to produce audio input signal S100. Vocoder VC10 may also include a packetizer (not shown) that is configured to assemble encoded frames of signal E10 into outgoing packets and a depacketizer (not shown) that is configured to extract encoded frames of signal E20 from incoming packets.

Figure 74B:
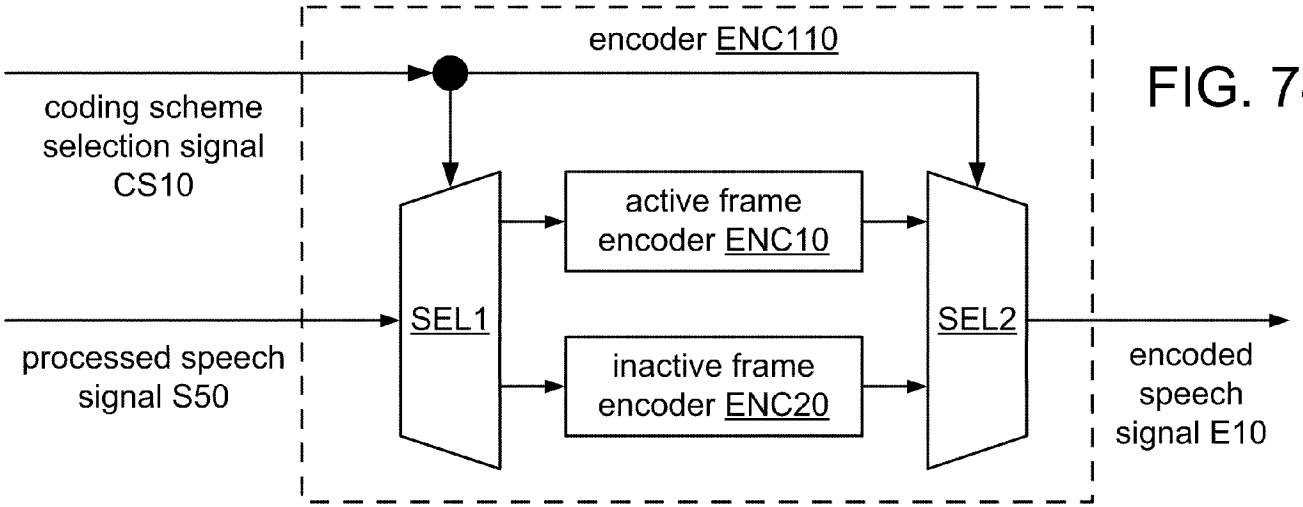
FIG. 74B shows a block diagram of an implementation ENC10 of encoder ENC100.

A codec may use different coding schemes to encode different types of frames. FIG. 74B shows a block diagram of an implementation ENC110 of encoder ENC100 that includes an active frame encoder ENC10 and an inactive frame encoder ENC20. Active frame encoder ENC10 may be configured to encode frames according to a coding scheme for voiced frames, such as a code-excited linear prediction (CELP), prototype waveform interpolation (PWI), or prototype pitch period (PPP) coding scheme. Inactive frame encoder ENC20 may be configured to encode frames according to a coding scheme for unvoiced frames, such as a noiseexcited linear prediction (NELP) coding scheme, or a coding scheme for non-voiced frames, such as a modified discrete cosine transform (MDCT) coding scheme. Frame encoders ENC10 and ENC20 may share common structure, such as a calculator of LPC coefficient values (possibly configured to produce a result having a different order for different coding schemes, such as a higher order for speech and non-speech frames than for inactive frames) and/or an LPC residual generator. Encoder ENC110 receives a coding scheme selection signal CS10 that selects an appropriate one of the frame encoders for each frame (e.g., via selectors SEL1 and SEL2). Decoder DEC100 may be similarly configured to decode encoded frames according to one of two or more of such coding schemes as indicated by information within encoded speech signal E20 and/or other information within the corresponding incoming RF signal.

It may be desirable for coding scheme selection signal CS10 to be based on the result of a voice activity detection operation, such as an output of VAD V10 (e.g., of apparatus A160) or V15 (e.g., of apparatus A165) as described herein. It is also noted that a software or firmware implementation of encoder ENC110 may use coding scheme selection signal CS10 to direct the flow of execution to one or another of the frame encoders, and that such an implementation may not include an analog for selector SEL1 and/or for selector SEL2.

Alternatively, it may be desirable to implement vocoder VC10 to include an instance of enhancer EN10 that is configured to operate in the linear prediction domain. For example, such an implementation of enhancer EN10 may include an implementation of enhancement vector generator VG100 that is configured to generate enhancement vector EV10 based on the results of a linear prediction analysis of speech signal S40 as described above, where the analysis is performed by another element of the vocoder (e.g., a calculator of LPC coefficient values). In such case, other elements of an implementation of apparatus A100 as described herein (e.g., from audio preprocessor AP10 to noise reduction stage NR10) may be located upstream of the vocoder.

Figure 75A:
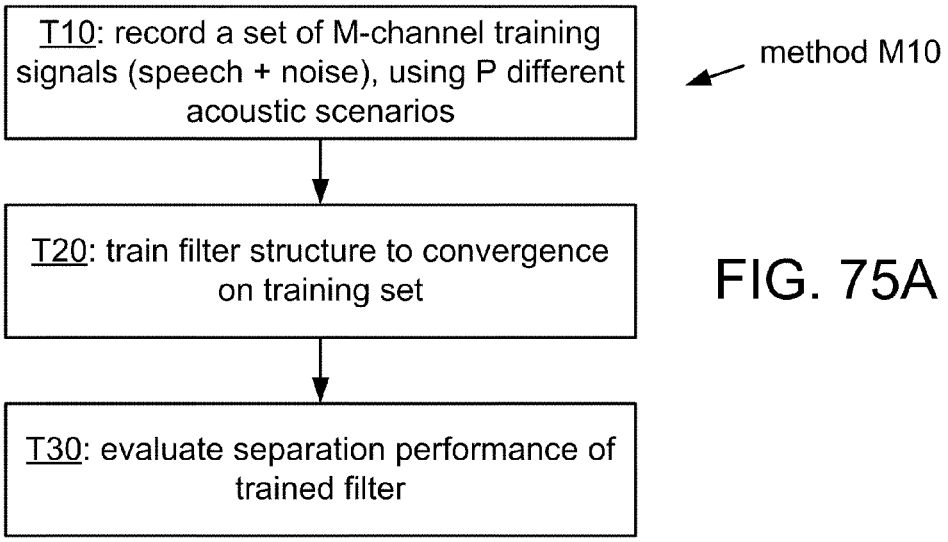
FIG. 75A shows a flowchart of a design method M10.

FIG. 75A shows a flowchart of a design method M10 that may be used to obtain the coefficient values that characterize one or more directional processing stages of SSP filter SS10. Method M10 includes a task T10 that records a set of multichannel training signals, a task T20 that trains a structure of SSP filter SS10 to convergence, and a task T30 that evaluates the separation performance of the trained filter. Tasks T20 and T30 are typically performed outside the audio sensing device, using a personal computer or workstation. One or more of the tasks of method M10 may be iterated until an acceptable result is obtained in task T30. The various tasks of method M10 are discussed in more detail below, and additional description of these tasks is found in U.S. patent application Ser. No. 12/197,924, filed Aug. 25, 2008, entitled "SYSTEMS, METHODS, AND APPARATUS FOR SIGNAL SEPARATION," which document is hereby incorporated by reference for purposes limited to the design, implementation, training, and/or evaluation of one or more directional processing stages of SSP filter SS10.

Task T10 uses an array of at least M microphones to record a set of M-channel training signals such that each of the M channels is based on the output of a corresponding one of the M microphones. Each of the training signals is based on signals produced by this array in response to at least one information source and at least one interference source, such that each training signal includes both speech and noise components. It may be desirable, for example, for each of the training signals to be a recording of speech in a noisy environment. The microphone signals are typically sampled, may be pre-processed (e.g., filtered for echo cancellation, noise reduction, spectrum shaping, etc.), and may even be pre-separated (e.g., by another spatial separation filter or adaptive filter as described herein). For acoustic applications such as speech, typical sampling rates range from 8 kHz to 16 kHz.

Each of the set of M-channel training signals is recorded under one of P scenarios, where P may be equal to two but is generally any integer greater than one. Each of the P scenarios may comprise a different spatial feature (e.g., a different handset or headset orientation) and/or a different spectral feature (e.g., the capturing of sound sources which may have different properties). The set of training signals includes at least P training signals that are each recorded under a different one of the P scenarios, although such a set would typically include multiple training signals for each scenario.

It is possible to perform task T10 using the same audio sensing device that contains the other elements of apparatus A100 as described herein. More typically, however, task T10 would be performed using a reference instance of an audio sensing device (e.g., a handset or headset). The resulting set of converged filter solutions produced by method M10 would then be copied into other instances of the same or a similar audio sensing device during production (e.g., loaded into flash memory of each such production instance).

Figure 75B:
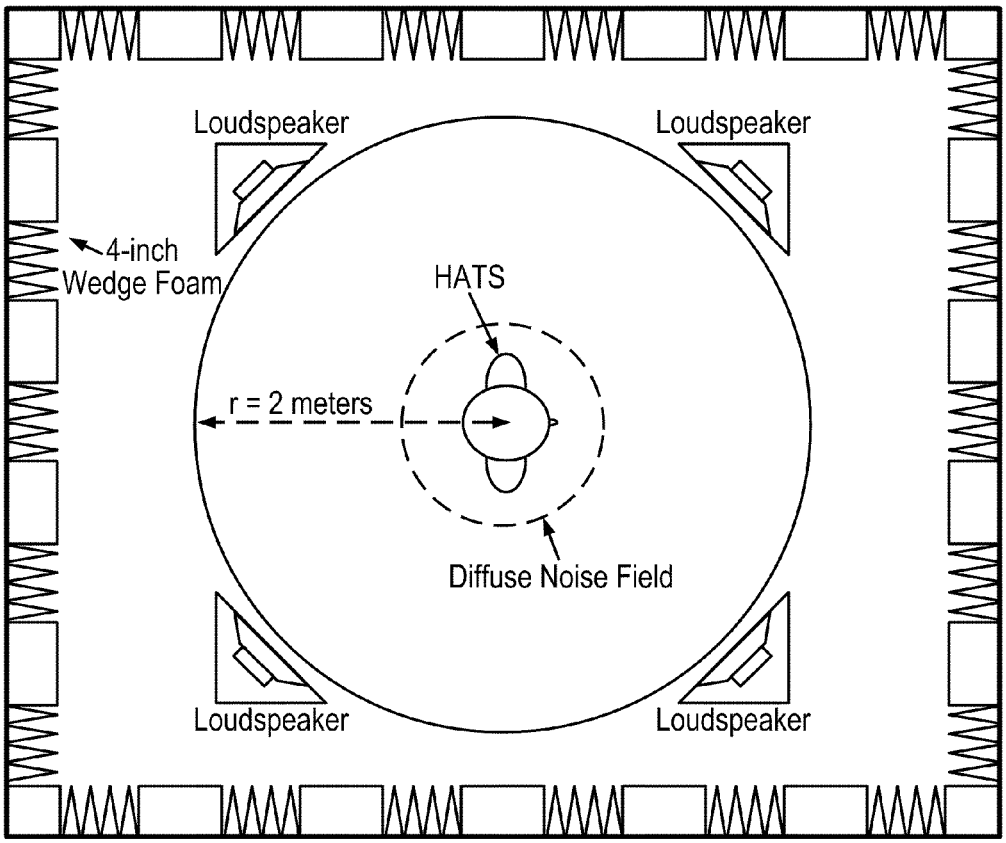
FIG. 75B shows an example of an acoustic anechoic chamber configured for recording of training data.

An acoustic anechoic chamber may be used for recording the set of M-channel training signals. FIG. 75B shows an example of an acoustic anechoic chamber configured for recording of training data. In this example, a Head and Torso Simulator (HATS, as manufactured by Bruel & Kjaer, Naerum, Denmark) is positioned within an inward-focused array of interference sources (i.e., the four loudspeakers). The HATS head is acoustically similar to a representative human head and includes a loudspeaker in the mouth for reproducing a speech signal. The array of interference sources may be driven to create a diffuse noise field that encloses the HATS as shown. In one such example, the array of loudspeakers is configured to play back noise signals at a sound pressure level of 75 to 78 dB at the HATS ear reference point or mouth reference point. In other cases, one or more such interference sources may be driven to create a noise field having a different spatial distribution (e.g., a directional noise field).

Types of noise signals that may be used include white noise, pink noise, grey noise, and Hoth noise (e.g., as described in IEEE Standard 269-2001, "Draft Standard Methods for Measuring Transmission Performance of Analog and Digital Telephone Sets, Handsets and Headsets," as promulgated by the Institute of Electrical and Electronics Engineers (IEEE), Piscataway, N.J.). Other types of noise signals that may be used include brown noise, blue noise, and purple noise.

Variations may arise during manufacture of the microphones of an array, such that even among a batch of mass-produced and apparently identical microphones, sensitivity may vary significantly from one microphone to another. Microphones for use in portable mass-market devices may be manufactured at a sensitivity tolerance of plus or minus three decibels, for example, such that the sensitivity of two such microphones in an array may differ by as much as six decibels.

Moreover, changes may occur in the effective response characteristics of a microphone once it has been mounted into or onto the device. A microphone is typically mounted within a device housing behind an acoustic port and may be fixed in place by pressure and/or by friction or adhesion. Many factors may affect the effective response characteristics of a microphone mounted in such a manner, such as resonances and/or other acoustic characteristics of the cavity within which the microphone is mounted, the amount and/or uniformity of pressure between the microphone and a mounting gasket, the size and shape of the acoustic port, etc.

The spatial separation characteristics of the converged filter solution produced by method M10 (e.g., the shape and orientation of the corresponding beam pattern) are likely to be sensitive to the relative characteristics of the microphones used in task T10 to acquire the training signals. It may be desirable to calibrate at least the gains of the M microphones of the reference device relative to one another before using the device to record the set of training signals. Such calibration may include calculating or selecting a weighting factor to be applied to the output of one or more of the microphones such that the resulting ratio of the gains of the microphones is within a desired range.

Task T20 uses the set of training signals to train a structure of SSP filter SS10 (i.e., to calculate a corresponding converged filter solution) according to a source separation algorithm. Task T20 may be performed within the reference device but is typically performed outside the audio sensing device, using a personal computer or workstation. It may be desirable for task T20 to produce a converged filter structure that is configured to filter a multichannel input signal having a directional component (e.g., sensed audio signal S10) such that in the resulting output signal, the energy of the directional component is concentrated into one of the output channels (e.g., source signal S20). This output channel may have an increased signal-to-noise ratio (SNR) as compared to any of the channels of the multichannel input signal.

The term "source separation algorithm" includes blind source separation (BSS) algorithms, which are methods of separating individual source signals (which may include signals from one or more information sources and one or more interference sources) based only on mixtures of the source signals. Blind source separation algorithms may be used to separate mixed signals that come from multiple independent sources. Because these techniques do not require information on the source of each signal, they are known as "blind source separation" methods. The term "blind" refers to the fact that the reference signal or signal of interest is not available, and such methods commonly include assumptions regarding the statistics of one or more of the information and/or interference signals. In speech applications, for example, the speech signal of interest is commonly assumed to have a supergaussian distribution (e.g., a high kurtosis). The class of BSS algorithms also includes multivariate blind deconvolution algorithms.

BSS method may include an implementation of independent component analysis. Independent component analysis (ICA) is a technique for separating mixed source signals (components) which are presumably independent from each other. In its simplified form, independent component analysis applies an "un-mixing" matrix of weights to the mixed signals (for example, by multiplying the matrix with the mixed signals) to produce separated signals. The weights may be assigned initial values that are then adjusted to maximize joint entropy of the signals in order to minimize information redundancy. This weight-adjusting and entropy-increasing process is repeated until the information redundancy of the signals is reduced to a minimum. Methods such as ICA provide relatively accurate and flexible means for the separation of speech signals from noise sources. Independent vector analysis ("IVA") is a related BSS technique in which the source signal is a vector source signal instead of a single variable source signal.

The class of source separation algorithms also includes variants of BSS algorithms, such as constrained ICA and constrained IVA, which are constrained according to other a priori information, such as a known direction of each of one or more of the acoustic sources with respect to, for example, an axis of the microphone array. Such algorithms may be distinguished from beamformers that apply fixed, non-adaptive solutions based only on directional information and not on observed signals.

As discussed above with reference to FIG. 8A, SSP filter SS10 may include one or more stages (e.g., fixed filter stage FF10, adaptive filter stage AF10). Each of these stages may be based on a corresponding adaptive filter structure, whose coefficient values are calculated by task T20 using a learning rule derived from a source separation algorithm. The filter structure may include feedforward and/or feedback coefficients and may be a finite-impulse-response (FIR) or infinite-impulse-response (IIR) design. Examples of such filter structures are described in U.S. patent application Ser. No. 12/197,924 as incorporated above.

Figure 76A:
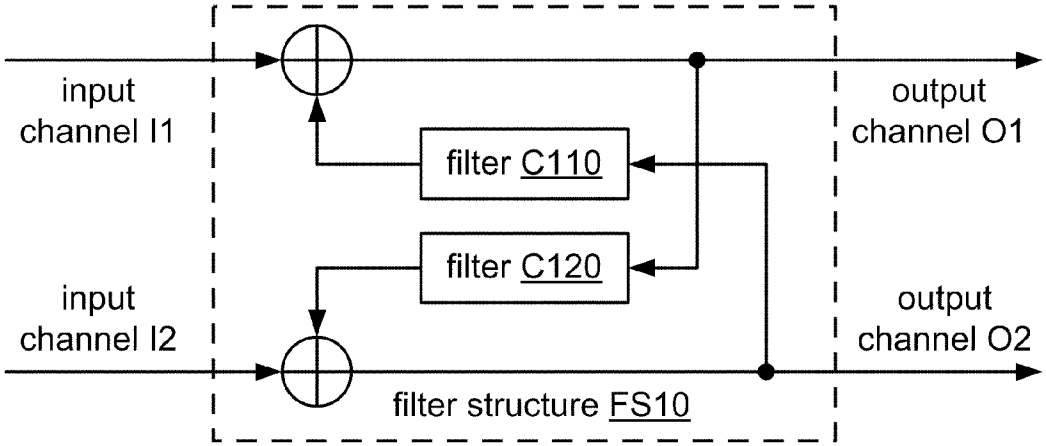
FIG. 76A shows a block diagram of a two-channel example of an adaptive filter structure FS10.
Figure 76B:
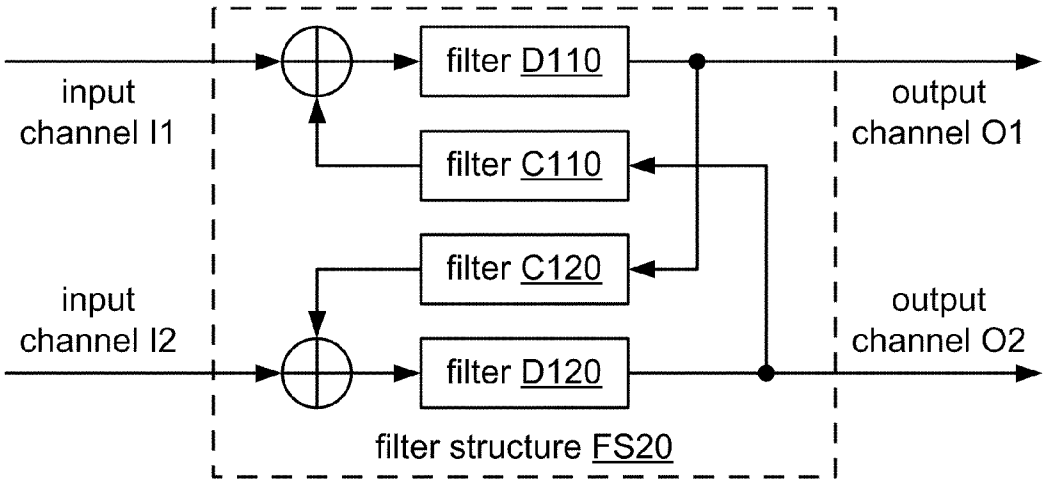
FIG. 76B shows a block diagram of an implementation FS20 of filter structure FS10.

FIG. 76A shows a block diagram of a two-channel example of an adaptive filter structure FS10 that includes two feedback filters C110 and C120, and FIG. 76B shows a block diagram of an implementation FS20 of filter structure FS10 that also includes two direct filters D10 and D120. Spatially selective processing filter SS10 may be implemented to include such a structure such that, for example, input channels I1, I2 correspond to sensed audio channels S10-1, S10-2, respectively, and output channels O1, O2 correspond to source signal S20 and noise reference S30, respectively. The learning rule used by task T20 to train such a structure may be designed to maximize information between the filter's output channels (e.g., to maximize the amount of information contained by at least one of the filter's output channels). Such a criterion may also be restated as maximizing the statistical independence of the output channels, or minimizing mutual information among the output channels, or maximizing entropy at the output. Particular examples of the different learning rules that may be used include maximum information (also known as infomax), maximum likelihood, and maximum nongaussianity (e.g., maximum kurtosis).

Further examples of such adaptive structures, and learning rules that are based on ICA or IVA adaptive feedback and feedforward schemes, are described in U.S. Publ. Pat. Appl. No. 2006/0053002 A1, entitled "System and Method for Speech Processing using Independent Component Analysis under Stability Constraints", published Mar. 9, 2006; U.S. Prov. App. No. 60/777,920, entitled "System and Method for Improved Signal Separation using a Blind Signal Source Process," filed Mar. 1, 2006; U.S. Prov. App. No. 60/777,900, entitled "System and Method for Generating a Separated Signal," filed Mar. 1, 2006; and Int'l Pat. Publ. WO 2007/100330 A1 (Kim et al.), entitled "Systems and Methods for Blind Source Signal Separation." Additional description of adaptive filter structures, and learning rules that may be used in task T20 to train such filter structures, may be found in U.S. patent application Ser. No. 12/197,924 as incorporated by reference above. For example, each of the filter structures FS10 and FS20 may be implemented using two feedforward filters in place of the two feedback filters.

One example of a learning rule that may be used in task T20 to train a feedback structure FS10 as shown in FIG. 76A may be expressed as follows:

$$y_i(t)=x_1(t)+(h_{12}(t)\otimes y_2(t)) \quad \text{(A)}$$

$$y_2(t)=x_2(t)+(h_{21}(t)\otimes y_1(t)) \quad \text{(B)}$$

$$\Delta h_{12k}=-f(y_1(t))\times y_2(t-k) \quad \text{(C)}$$

$$\Delta h_{21k} = -f(y_2(t)) \times y_1(t-k) \quad \text{(D)}$$

where t denotes a time sample index, $h_{12}(t)$ denotes the coefficient values of filter C110 at time t, $h_{21}(t)$ denotes the coefficient values of filter C120 at time t, the symbol $\otimes$ denotes the time-domain convolution operation, $\Delta h_{12k}$ denotes a change in the k-th coefficient value of filter C110 subsequent to the calculation of output values $y_1(t)$ and $y_2(t)$, and $\Delta h_{21k}$ denotes a change in the k-th coefficient value of filter C120 subsequent to the calculation of output values $y_1(t)$ and $y_2(t)$. It may be desirable to implement the activation functions as a nonlinear bounded function that approximates the cumulative density function of the desired signal. Examples of nonlinear bounded functions that may be used for activation signal f for speech applications include the hyperbolic tangent function, the sigmoid function, and the sign function.

Another class of techniques that may be used for directional processing of signals received from a linear microphone array is often referred to as "beamforming". Beamforming techniques use the time difference between channels that results from the spatial diversity of the microphones to enhance a component of the signal that arrives from a particular direction. More particularly, it is likely that one of the microphones will be oriented more directly at the desired source (e.g., the user's mouth), whereas the other microphone may generate a signal from this source that is relatively attenuated. These beamforming techniques are methods for spatial filtering that steer a beam towards a sound source, putting a null at the other directions. Beamforming techniques make no assumption on the sound source but assume that the geometry between source and sensors, or the sound signal itself, is known for the purpose of dereverberating the signal or localizing the sound source. The filter coefficient values of a structure of SSP filter SS10 may be calculated according to a data-dependent or data-independent beamformer design (e.g., a superdirective beamformer, least-squares beamformer, or statistically optimal beamformer design). In the case of a data-independent beamformer design, it may be desirable to shape the beam pattern to cover a desired spatial area (e.g., by tuning the noise correlation matrix).

Task T30 evaluates the trained filter produced in task T20 by evaluating its separation performance. For example, task T30 may be configured to evaluate the response of the trained filter to a set of evaluation signals. This set of evaluation signals may be the same as the training set used in task T20. Alternatively, the set of evaluation signals may be a set of M-channel signals that are different from but similar to the signals of the training set (e.g., are recorded using at least part of the same array of microphones and at least some of the same P scenarios). Such evaluation may be performed automatically and/or by human supervision. Task T30 is typically performed outside the audio sensing device, using a personal computer or workstation.

Task T30 may be configured to evaluate the filter response according to the values of one or more metrics. For example, task T30 may be configured to calculate values for each of one or more metrics and to compare the calculated values to respective threshold values. One example of a metric that may be used to evaluate a filter response is a correlation between (A) the original information component of an evaluation signal (e.g., the speech signal that was reproduced from the mouth loudspeaker of the HATS during the recording of the evaluation signal) and (B) at least one channel of the response of the filter to that evaluation signal. Such a metric may indicate how well the converged filter structure separates information from interference. In this case, separation is indicated when the information component is substantially correlated with one of the M channels of the filter response and has little correlation with the other channels.

Other examples of metrics that may be used to evaluate a filter response (e.g., to indicate how well the filter separates information from interference) include statistical properties such as variance, Gaussianity, and/or higher-order statistical moments such as kurtosis. Additional examples of metrics that may be used for speech signals include zero crossing rate and burstiness over time (also known as time sparsity). In general, speech signals exhibit a lower zero crossing rate and a lower time sparsity than noise signals. A further example of a metric that may be used to evaluate a filter response is the degree to which the actual location of an information or interference source with respect to the array of microphones during recording of an evaluation signal agrees with a beam pattern (or null beam pattern) as indicated by the response of the filter to that evaluation signal. It may be desirable for the metrics used in task T30 to include, or to be limited to, the separation measures used in a corresponding implementation of apparatus A200 (e.g., as discussed above with reference to a separation evaluator, such as separation evaluator EV10).

Once a desired evaluation result has been obtained in task T30 for a fixed filter stage of SSP filter SS10 (e.g., fixed filter stage FF10), the corresponding filter state may be loaded into the production devices as a fixed state of SSP filter SS10 (i.e., a fixed set of filter coefficient values). As described below, it may also be desirable to perform a procedure to calibrate the gain and/or frequency responses of the microphones in each production device, such as a laboratory, factory, or automatic (e.g., automatic gain matching) calibration procedure.

A trained fixed filter produced in one instance of method M10 may be used in another instance of method M10 to filter another set of training signals, also recorded using the reference device, in order to calculate initial conditions for an adaptive filter stage (e.g., for adaptive filter stage AF10 of SSP filter SS10). Examples of such calculation of initial conditions for an adaptive filter are described in U.S. patent application Ser. No. 12/197,924, filed Aug. 25, 2008, entitled "SYSTEMS, METHODS, AND APPARATUS FOR SIGNAL SEPARATION," for example, at paragraphs [00129]-[00135] (beginning with "It may be desirable" and ending with "cancellation in parallel"), which paragraphs are hereby incorporated by reference for purposes limited to description of design, training, and/or implementation of adaptive filter stages. Such initial conditions may also be loaded into other instances of the same or a similar device during production (e.g., as for the trained fixed filter stages).

Alternatively or additionally, an instance of method M10 may be performed to obtain one or more converged filter sets for an echo canceller EC10 as described above. The trained filters of the echo canceller may then be used to perform echo cancellation on the microphone signals during recording of the training signals for SSP filter SS10.

In a production device, the performance of an operation on a multichannel signal produced by a microphone array (e.g., a spatially selective processing operation as discussed above with reference to SSP filter SS10) may depend on how well the response characteristics of the array channels are matched to one another. It is possible for the levels of the channels to differ due to factors that may include a difference in the response characteristics of the respective microphones, a difference in the gain levels of respective preprocessing stages, and/or a difference in circuit noise levels. In such case, the resulting multichannel signal may not provide an accurate representation of the acoustic environment unless the difference between the microphone response characteristics may be compensated. Without such compensation, a spatial processing operation based on such a signal may provide an erroneous result. Amplitude response deviations between the channels as small as one or two decibels at low frequencies (i.e., approximately 100 Hz to 1 kHz), for example, may significantly reduce low-frequency directionality. Effects of an imbalance among the channels of a microphone array may be especially detrimental for applications processing a multichannel signal from an array that has more than two microphones.

Consequently, it may be desirable during and/or after production to calibrate at least the gains of the microphones of each production device relative to one another. For example, it may be desirable to perform a pre-delivery calibration operation on an assembled multi-microphone audio sensing device (that is to say, before delivery to the user) in order to quantify a difference between the effective response characteristics of the channels of the array, such as a difference between the effective gain characteristics of the channels of the array.

While a laboratory procedure as discussed above may also be performed on a production device, performing such a procedure on each production device is likely to be impractical. Examples of portable chambers and other calibration enclosures and procedures that may be used to perform factory calibration of production devices (e.g., handsets) are described in U.S. Pat. Appl. No. 61/077,144, filed Jun. 30, 2008, entitled "SYSTEMS, METHODS, AND APPARATUS FOR CALIBRATION OF MULTI-MICROPHONE DEVICES." A calibration procedure may be configured to produce a compensation factor (e.g., a gain factor) to be applied to a respective microphone channel. For example, an element of audio preprocessor AP10 (e.g., digital preprocessor D20*a* or D20*b*) may be configured to apply such a compensation factor to the respective channel of sensed audio signal S10.

A pre-delivery calibration procedure may be too time-consuming or otherwise impractical to perform for most manufactured devices. For example, it may be economically infeasible to perform such an operation for each instance of a mass-market device. Moreover, a pre-delivery operation alone may be insufficient to ensure good performance over the lifetime of the device. Microphone sensitivity may drift or otherwise change over time, due to factors that may include aging, temperature, radiation, and contamination. Without adequate compensation for an imbalance among the responses of the various channels of the array, however, a desired level of performance for a multichannel operation, such as a spatially selective processing operation, may be difficult or impossible to achieve.

Consequently, it may be desirable to include a calibration routine within the audio sensing device that is configured to match one or more microphone frequency properties and/or sensitivities (e.g., a ratio between the microphone gains) during service on a periodic basis or upon some other event (e.g., at power-up, upon a user selection, etc.). Examples of such an automatic gain matching procedure are described in U.S. patent application Ser. No. 12/473,930, filed May 28, 2009, entitled "SYSTEMS, METHODS, AND APPARATUS FOR MULTICHANNEL SIGNAL BALANCING," which document is hereby incorporated by reference for purposes limited to disclosure of calibration methods, routines, operations, devices, chambers, and procedures.

Figure 77:
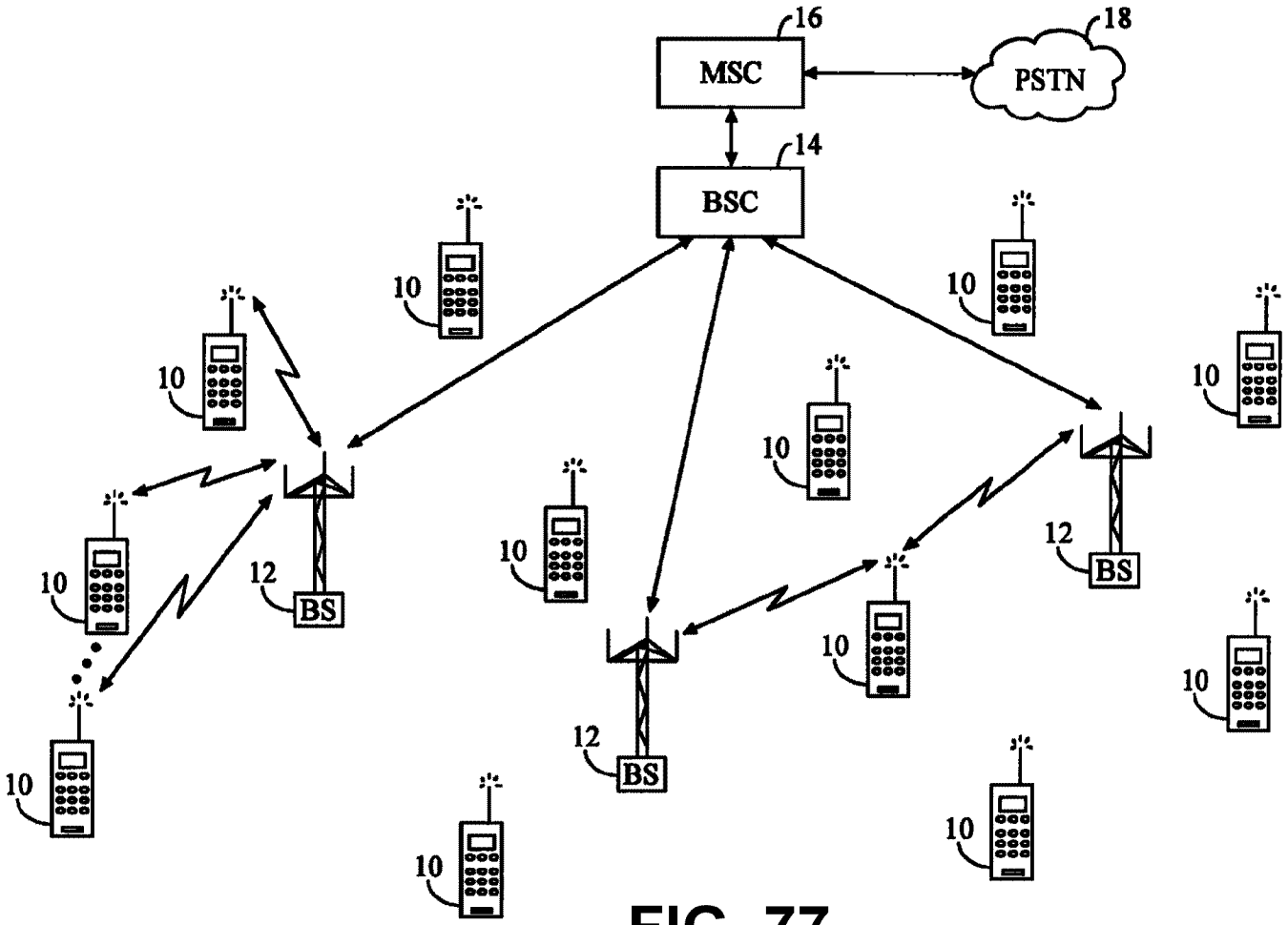
FIG. 77 illustrates a wireless telephone system.

As illustrated in FIG. 77, a wireless telephone system (e.g., a CDMA, TDMA, FDMA, and/or TD-SCDMA system) generally includes a plurality of mobile subscriber units 10 configured to communicate wirelessly with a radio access network that includes a plurality of base stations 12 and one or more base station controllers (BSCs) 14. Such a system also generally includes a mobile switching center (MSC) 16, coupled to the BSCs 14, that is configured to interface the radio access network with a conventional public switched telephone network (PSTN) 18. To support this interface, the MSC may include or otherwise communicate with a media gateway, which acts as a translation unit between the networks. A media gateway is configured to convert between different formats, such as different transmission and/or coding techniques (e.g., to convert between time-division-multiplexed (TDM) voice and VoIP), and may also be configured to perform media streaming functions such as echo cancellation, dual-time multifrequency (DTMF), and tone sending. The BSCs 14 are coupled to the base stations 12 via backhaul lines. The backhaul lines may be configured to support any of several known interfaces including, e.g., E1/T1, ATM, IP, PPP, Frame Relay, HDSL, ADSL, or xDSL. The collection of base stations 12, BSCs 14, MSC 16, and media gateways if any, is also referred to as "infrastructure."

Each base station 12 advantageously includes at least one sector (not shown), each sector comprising an omnidirectional antenna or an antenna pointed in a particular direction radially away from the base station 12. Alternatively, each sector may comprise two or more antennas for diversity reception. Each base station 12 may advantageously be designed to support a plurality of frequency assignments. The intersection of a sector and a frequency assignment may be referred to as a CDMA channel. The base stations 12 may also be known as base station transceiver subsystems (BTSs) 12. Alternatively, "base station" may be used in the industry to refer collectively to a BSC 14 and one or more BTSs 12. The BTSs 12 may also be denoted "cell sites" 12. Alternatively, individual sectors of a given BTS 12 may be referred to as cell sites. The class of mobile subscriber units 10 typically includes communications devices as described herein, such as cellular and/or PCS (Personal Communications Service) telephones, personal digital assistants (PDAs), and/or other communications devices that have mobile telephonic capability. Such a unit 10 may include an internal speaker and an array of microphones, a tethered handset or headset that includes a speaker and an array of microphones (e.g., a USB handset), or a wireless headset that includes a speaker and an array of microphones (e.g., a headset that communicates audio information to the unit using a version of the Bluetooth protocol as promulgated by the Bluetooth Special Interest Group, Bellevue, Wash.). Such a system may be configured for use in accordance with one or more versions of the IS-95 standard (e.g., IS-95, IS-95A, IS-95B, cdma2000; as published by the Telecommunications Industry Alliance, Arlington, Va.).

A typical operation of the cellular telephone system is now described. The base stations 12 receive sets of reverse link signals from sets of mobile subscriber units 10. The mobile subscriber units 10 are conducting telephone calls or other communications. Each reverse link signal received by a given base station 12 is processed within that base station 12, and the resulting data is forwarded to a BSC 14. The BSC 14 provides call resource allocation and mobility management functionality, including the orchestration of soft handoffs between base stations 12. The BSC 14 also routes the received data to the MSC 16, which provides additional routing services for interface with the PSTN 18. Similarly, the PSTN 18 interfaces with the MSC 16, and the MSC 16 interfaces with the BSCs 14, which in turn control the base stations 12 to transmit sets of forward link signals to sets of mobile subscriber units 10.

Figure 78:
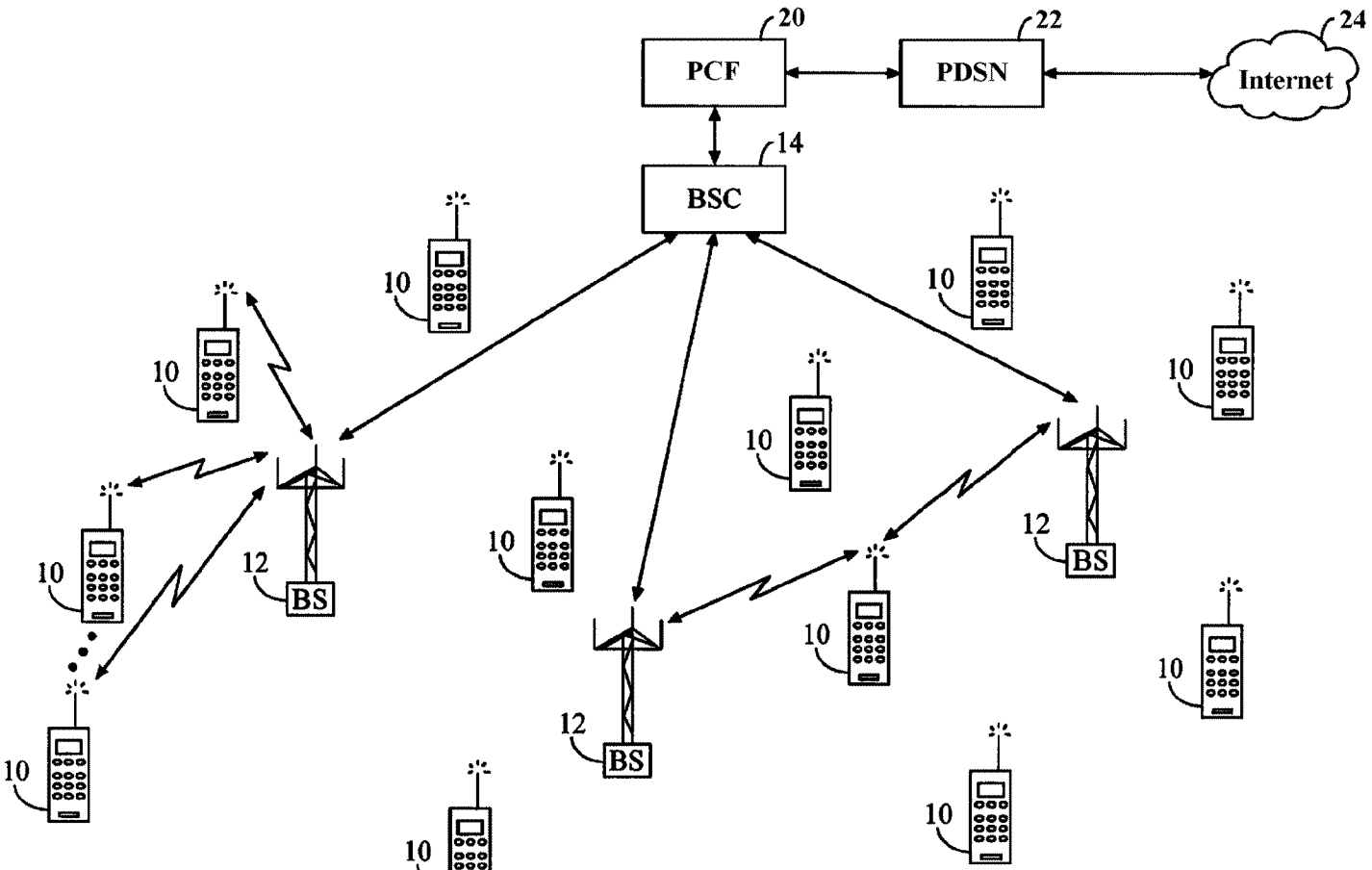
FIG. 78 illustrates a wireless telephone system configured to support packet-switched data communications.

Elements of a cellular telephony system as shown in FIG. 77 may also be configured to support packet-switched data communications. As shown in FIG. 78, packet data traffic is generally routed between mobile subscriber units 10 and an external packet data network 24 (e.g., a public network such as the Internet) using a packet data serving node (PDSN) 22 that is coupled to a gateway router connected to the packet data network. The PDSN 22 in turn routes data to one or more packet control functions (PCFs) 20, which each serve one or more BSCs 14 and act as a link between the packet data network and the radio access network. Packet data network 24 may also be implemented to include a local area network (LAN), a campus area network (CAN), a metropolitan area network (MAN), a wide area network (WAN), a ring network, a star network, a token ring network, etc. A user terminal connected to network 24 may be a device within the class of audio sensing devices as described herein, such as a PDA, a laptop computer, a personal computer, a gaming device (examples of such a device include the XBOX and XBOX 360 (Microsoft Corp., Redmond, Wash.), the Playstation 3 and Playstation Portable (Sony Corp., Tokyo, JP), and the Wii and DS (Nintendo, Kyoto, JP)), and/or any device that has audio processing capability and may be configured to support a telephone call or other communication using one or more protocols such as VoIP. Such a terminal may include an internal speaker and an array of microphones, a tethered handset that includes a speaker and an array of microphones (e.g., a USB handset), or a wireless headset that includes a speaker and an array of microphones (e.g., a headset that communicates audio information to the terminal using a version of the Bluetooth protocol as promulgated by the Bluetooth Special Interest Group, Bellevue, Wash.). Such a system may be configured to carry a telephone call or other communication as packet data traffic between mobile subscriber units on different radio access networks (e.g., via one or more protocols such as VoIP), between a mobile subscriber unit and a non-mobile user terminal, or between two non-mobile user terminals, without ever entering the PSTN. A mobile subscriber unit 10 or other user terminal may also be referred to as an "access terminal."

Figure 79B:
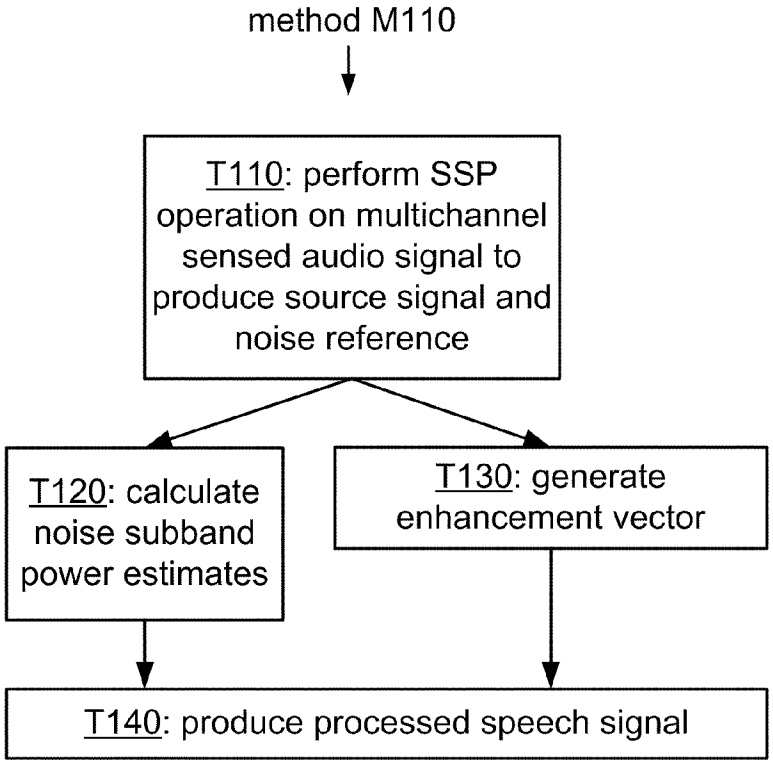
FIG. 79B shows a flowchart of an implementation M110 of method M100.
Figure 79A:
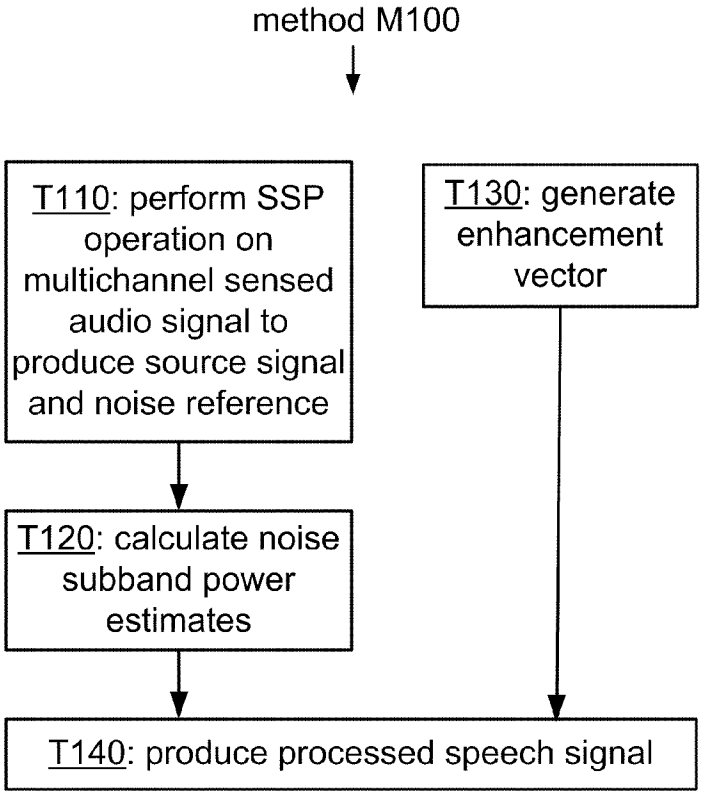
FIG. 79A shows a flowchart of a method M100 according to a general configuration.

FIG. 79A shows a flowchart of a method M100 of processing a speech signal that may be performed within a device that is configured to process audio signals (e.g., any of the audio sensing devices identified herein, such as a communications device). Method M100 includes a task T110 that performs a spatially selective processing operation on a multichannel sensed audio signal (e.g., as described herein with reference to SSP filter SS10) to produce a source signal and a noise reference. For example, task T110 may include concentrating energy of a directional component of the multichannel sensed audio signal into the source signal.

Method M100 also includes a task that performs a spectral contrast enhancement operation on the speech signal to produce the processed speech signal. This task includes subtasks T120, T130, and T140. Task T120 calculates a plurality of noise subband power estimates based on information from the noise reference (e.g., as described herein with reference to noise subband power estimate calculator NP100). Task T130 generates an enhancement vector based on information from the speech signal (e.g., as described herein with reference to enhancement vector generator VG100). Task T140 produces a processed speech signal based on the plurality of noise subband power estimates, information from the speech signal, and information from the enhancement vector (e.g., as described herein with reference to gain control element CE100 and mixer X100, or gain factor calculator FC300 and gain control element CE110 or CE120), such that each of a plurality of frequency subbands of the processed speech signal is based on a corresponding frequency subband of the speech signal. Numerous implementations of method M100 and tasks T110, T120, T130, and T140 are expressly disclosed herein (e.g., by virtue of the variety of apparatus, elements, and operations disclosed herein).

It may be desirable to implement method M100 such that the speech signal is based on the multichannel sensed audio signal. FIG. 79B shows a flowchart of such an implementation M110 of method M100 in which task T130 is arranged to receive the source signal as the speech signal. In this case, task T140 is also arranged such that each of a plurality of frequency subbands of the processed speech signal is based on a corresponding frequency subband of the source signal (e.g., as described herein with reference to apparatus A110).

Alternatively, it may be desirable to implement method M100 such that the speech signal is based on information from a decoded speech signal. Such a decoded speech signal may be obtained, for example, by decoding a signal that is received wirelessly by the device. FIG. 80A shows a flowchart of such an implementation M120 of method M100 that includes a task T150. Task T150 decodes an encoded speech signal that is received wirelessly by the device to produce the speech signal. For example, task T150 may be configured to decode the encoded speech signal according to one or more of the codecs identified herein (e.g., EVRC, SMV, AMR).

Figure 80B:
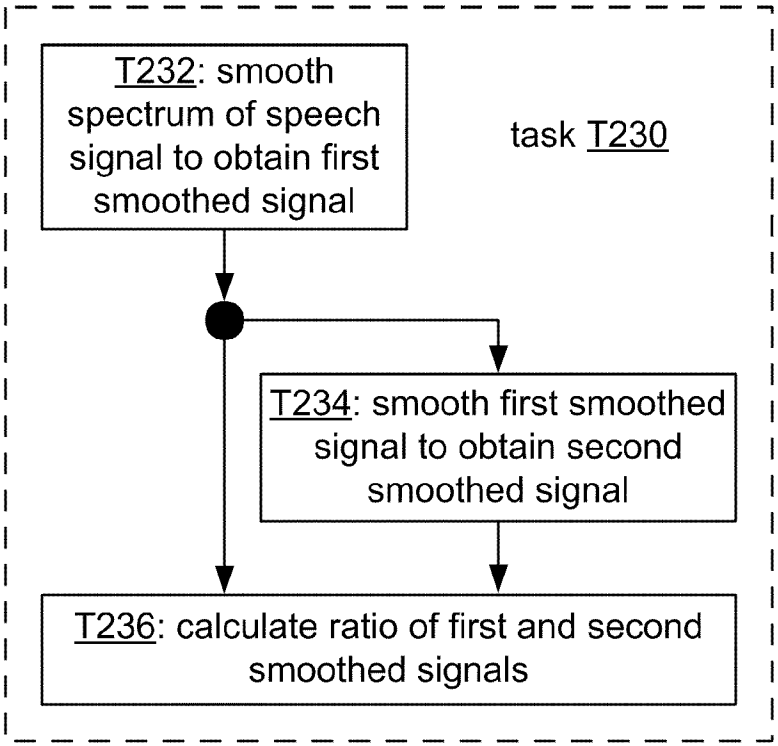
FIG. 80B shows a flowchart of an implementation T230 of task T130.
Figure 80A:
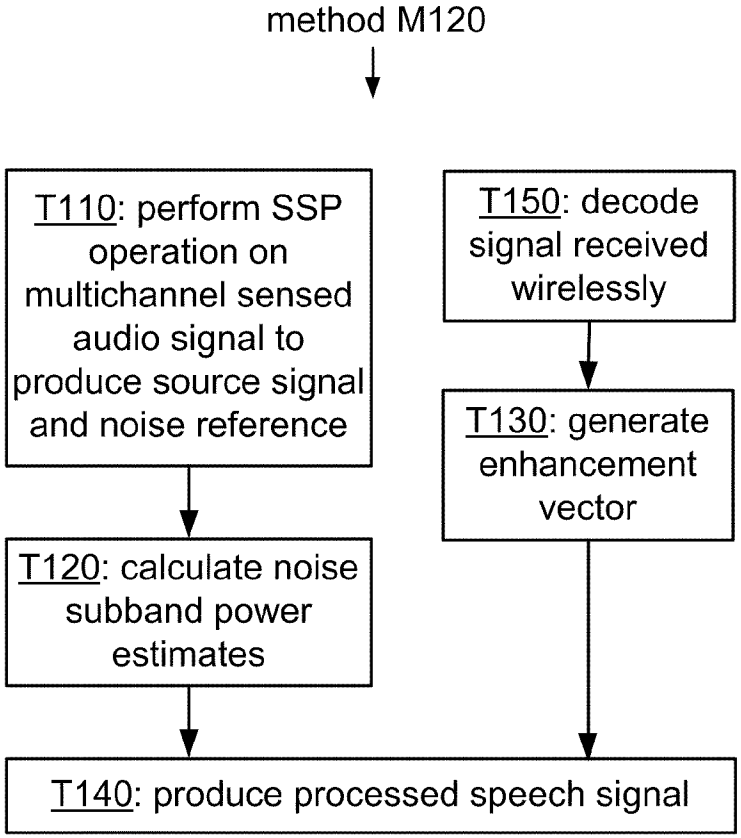
FIG. 80A shows a flowchart of an implementation M120 of method M100.

FIG. 80B shows a flowchart of an implementation T230 of enhancement vector generation task T130 that includes subtasks T232, T234, and T236. Task T232 smoothes a spectrum of the speech signal to obtain a first smoothed signal (e.g., as described herein with reference to spectrum smoother SM10). Task T234 smoothes the first smoothed signal to obtain a second smoothed signal (e.g., as described herein with reference to spectrum smoother SM20). Task T236 calculates a ratio of the first and second smoothed signals (e.g., as described herein with reference to ratio calculator RC10). Task T130 or task T230 may also be configured to include a subtask that reduces a difference between magnitudes of spectral peaks of the speech signal (e.g., as described herein with reference to pre-enhancement processing module PM10), such that the enhancement vector is based on a result of this subtask.

Figure 81A:
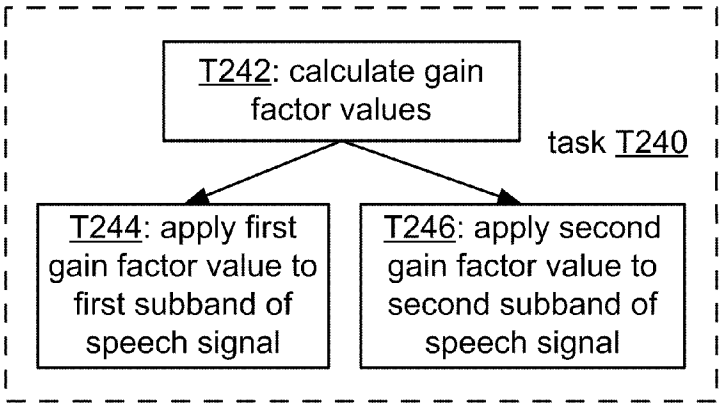
FIG. 81A shows a flowchart of an implementation T240 of task T140.

FIG. 81A shows a flowchart of an implementation T240 of production task T140 that includes subtasks T242, T244, and T246. Task T242 calculates a plurality of gain factor values, based on the plurality of noise subband power estimates and on the information from the enhancement vector, such that a first of the plurality of gain factor values differs from a second of the plurality of gain factor values (e.g., as described herein with reference to gain factor calculator FC300). Task T244 applies the first gain factor value to a first frequency subband of the speech signal to obtain a first subband of the processed speech signal, and task T246 applies the second gain factor value to a second frequency subband of the speech signal to obtain a second subband of the processed speech signal (e.g., as described herein with reference to gain control element CE110 and/or CE120).

Figure 81B:
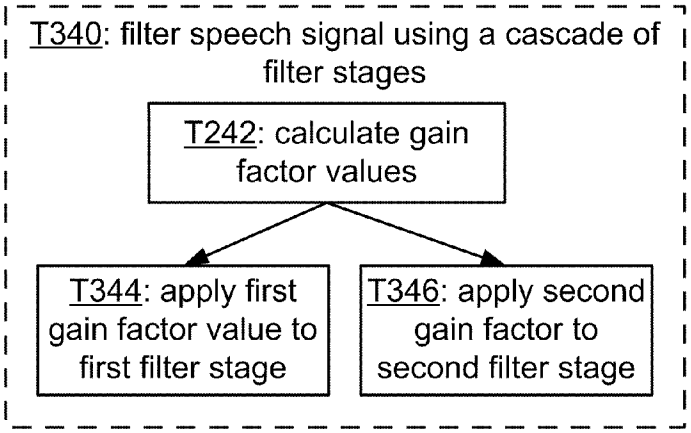
FIG. 81B shows a flowchart of an implementation T340 of task T240.

FIG. 81B shows a flowchart of an implementation T340 of production task T240 that includes implementations T344 and T346 of tasks T244 and T246, respectively. Task T340 produces the processed speech signal by using a cascade of filter stages to filter the speech signal (e.g., as described herein with reference to subband filter array FA120). Task T344 applies the first gain factor value to a first filter stage of the cascade, and task T346 applies the second gain factor value to a second filter stage of the cascade.

Figure 81C:
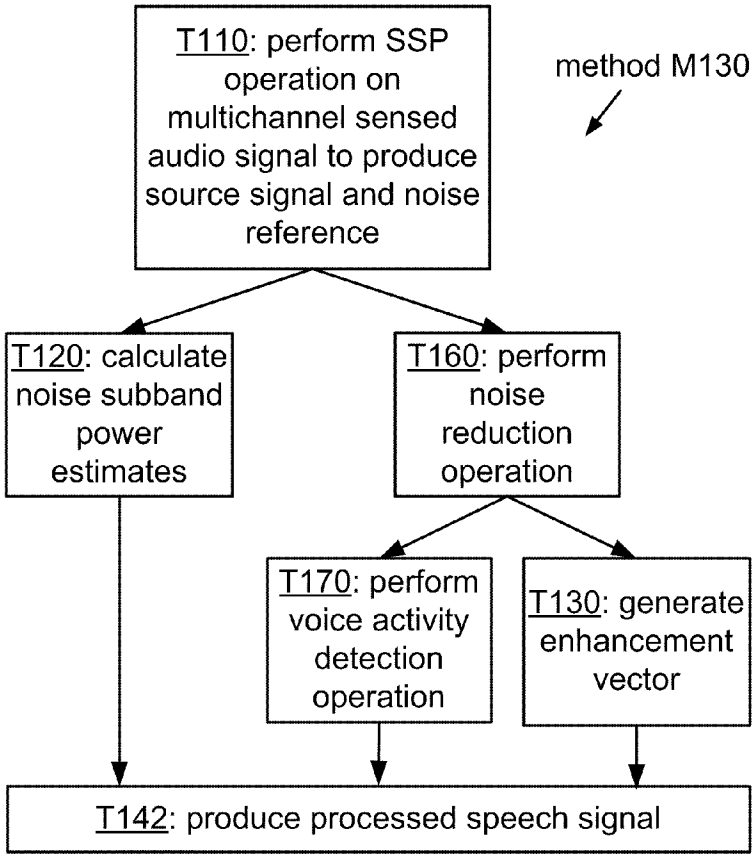
FIG. 81C shows a flowchart of an implementation M130 of method M110.

FIG. 81C shows a flowchart of an implementation M130 of method M110 that includes tasks T160 and T170. Based on information from the noise reference, task T160 performs a noise reduction operation on the source signal to obtain the speech signal (e.g., as described herein with reference to noise reduction stage NR10). In one example, task T160 is configured to perform a spectral subtraction operation on the source signal (e.g., as described herein with reference to noise reduction stage NR20). Task T170 performs a voice activity detection operation based on a relation between the source signal and the speech signal (e.g., as described herein with reference to VAD V15). Method M130 also includes an implementation T142 of task T140 that produces the processed speech signal based on a result of voice activity detection task T170 (e.g., as described herein with reference to enhancer EN150).

Figure 82B:
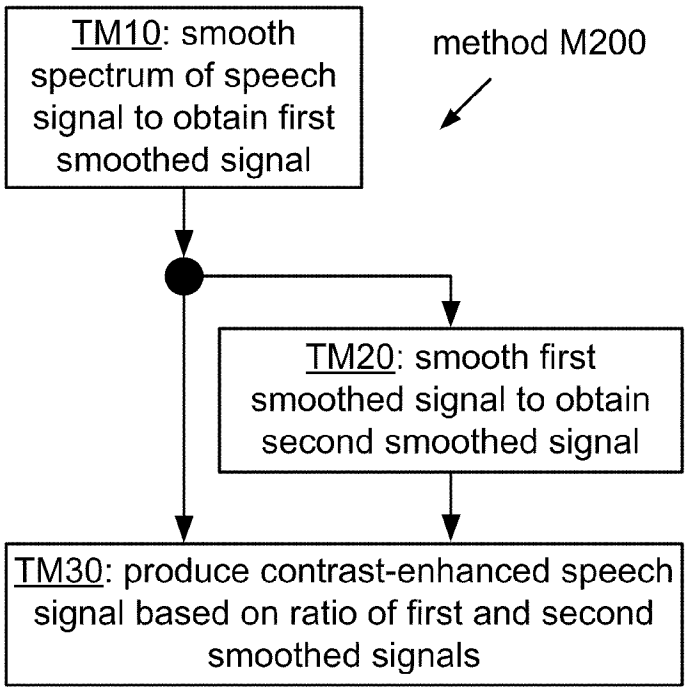
FIG. 82B shows a flowchart of a method M200 according to a general configuration.
Figure 82A:
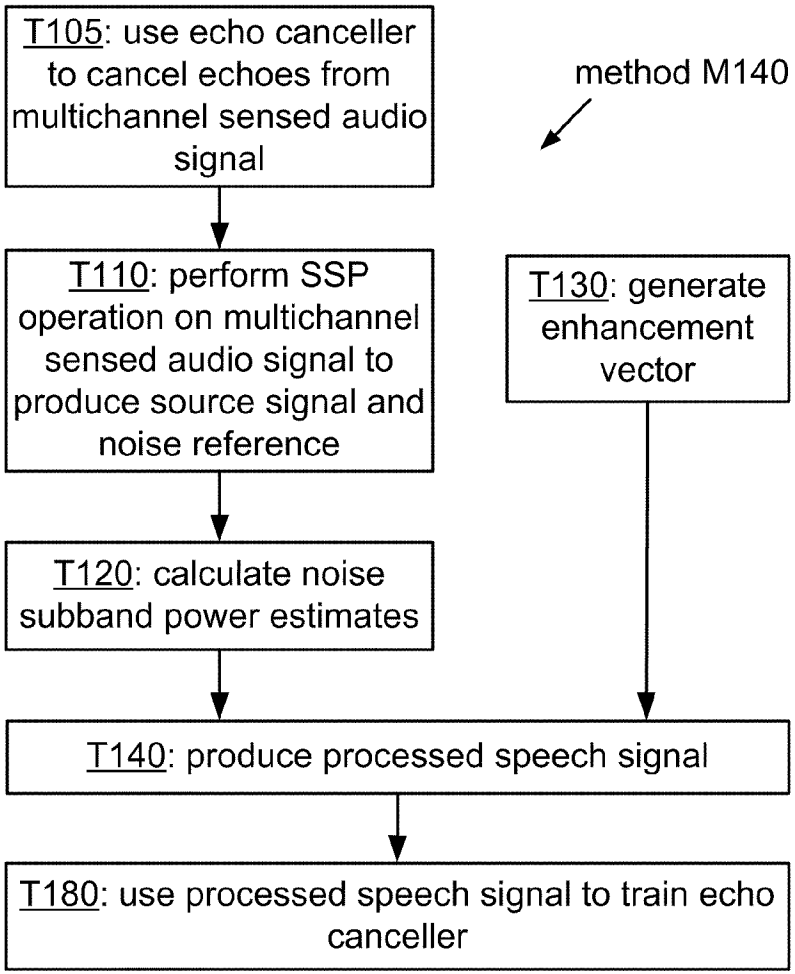
FIG. 82A shows a flowchart of an implementation M140 of method M100.

FIG. 82A shows a flowchart of an implementation M140 of method M100 that includes tasks T105 and T180. Task T105 uses an echo canceller to cancel echoes from the multichannel sensed audio signal (e.g., as described herein with reference to echo canceller EC10). Task T180 uses the processed speech signal to train the echo canceller (e.g., as described herein with reference to audio preprocessor AP30).

FIG. 82B shows a flowchart of a method M200 of processing a speech signal that may be performed within a device that is configured to process audio signals (e.g., any of the audio sensing devices identified herein, such as a communications device). Method M200 includes tasks TM10, TM20, and TM30. Task TM10 smoothes a spectrum of the speech signal to obtain a first smoothed signal (e.g., as described herein with reference to spectrum smoother SM10 and task T232). Task TM20 smoothes the first smoothed signal to obtain a second smoothed signal (e.g., as described herein with reference to spectrum smoother SM20 and task T234). Task TM30 produces a contrast-enhanced speech signal that is based on a ratio of the first and second smoothed signals (e.g., as described herein with reference to enhancement vector generator VG110 and implementations of enhancer EN100, EN110, and EN120 that include such a generator). For example, task TM30 may be configured to produce the contrast-enhanced speech signal by controlling the gains of a plurality of subbands of the speech signal such that the gain for each subband is based on information from a corresponding subband of the ratio of the first and second smoothed signals.

Method M200 may also be implemented to include a task that performs an adaptive equalization operation, and/or a task that reduces a difference between magnitudes of spectral peaks of the speech signal, to obtain an equalized spectrum of the speech signal (e.g., as described herein with reference to pre-enhancement processing module PM10). In such cases, task TM10 may be arranged to smooth the equalized spectrum to obtain the first smoothed signal.

Figure 83B:
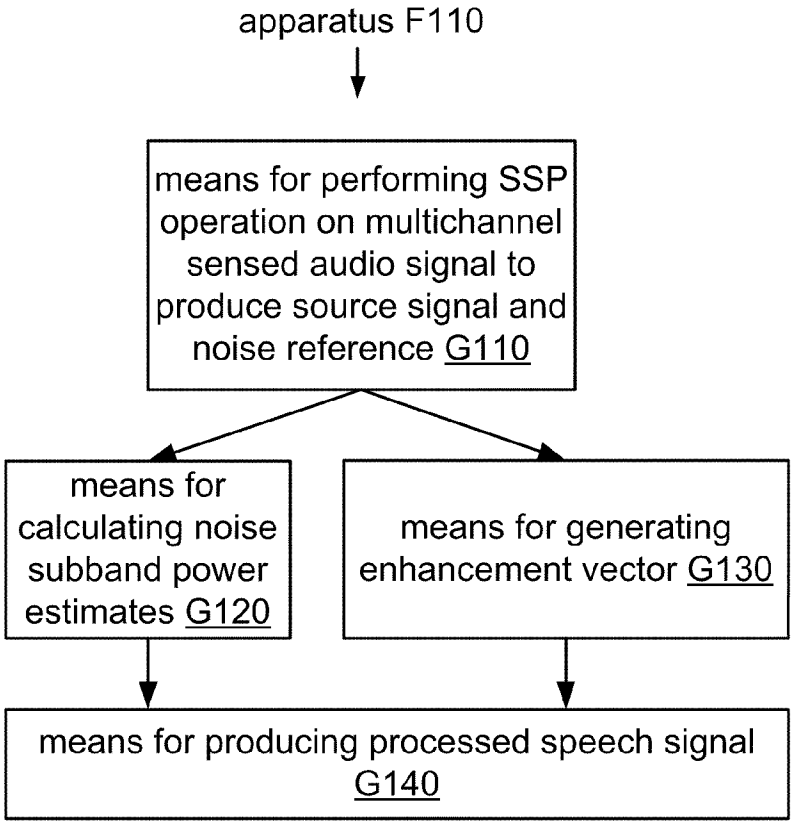
Figure 83A:
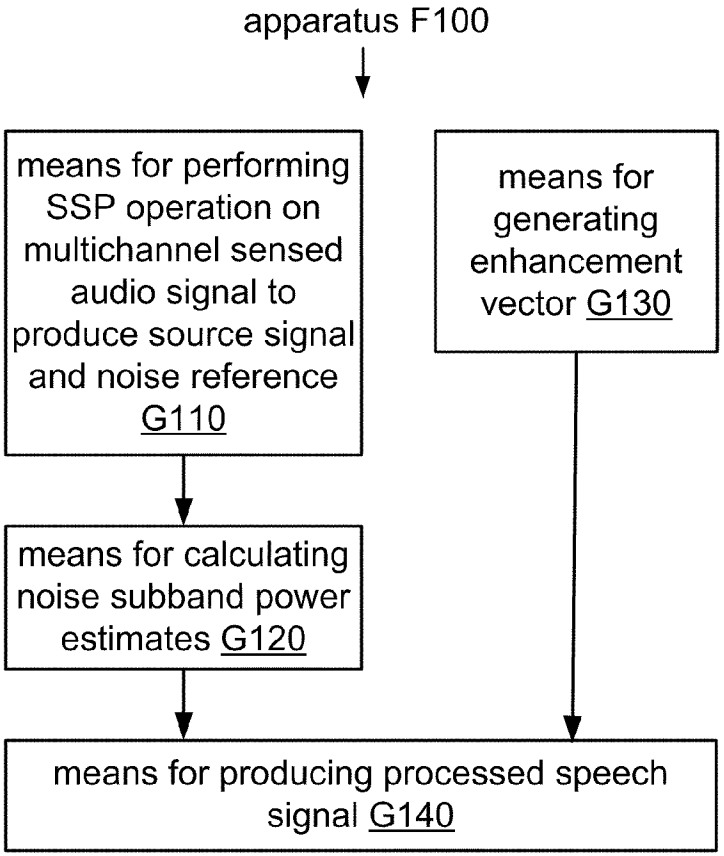

FIG. 83A shows a block diagram of an apparatus F100 for processing a speech signal according to a general configuration. Apparatus F100 includes means G110 for performing a spatially selective processing operation on a multichannel sensed audio signal (e.g., as described herein with reference to SSP filter SS10) to produce a source signal and a noise reference. For example, means G110 may be configured to concentrate energy of a directional component of the multichannel sensed audio signal into the source signal.

Apparatus F100 also includes means for performing a spectral contrast enhancement operation on the speech signal to produce the processed speech signal. Such means includes means G120 for calculating a plurality of noise subband power estimates based on information from the noise reference (e.g., as described herein with reference to noise subband power estimate calculator NP100). The means for performing a spectral contrast enhancement operation on the speech signal also includes means G130 for generating an enhancement vector based on information from the speech signal (e.g., as described herein with reference to enhancement vector generator VG100). The means for performing a spectral contrast enhancement operation on the speech signal also includes means G140 for producing a processed speech signal based on the plurality of noise subband power estimates, information from the speech signal, and information from the enhancement vector (e.g., as described herein with reference to gain control element CE100 and mixer X100, or gain factor calculator FC300 and gain control element CE110 or CE120), such that each of a plurality of frequency subbands of the processed speech signal is based on a corresponding frequency subband of the speech signal. Apparatus F100 may be implemented within a device that is configured to process audio signals (e.g., any of the audio sensing devices identified herein, such as a communications device), and numerous implementations of apparatus F100, means G110, means G120, means G130, and means G140 are expressly disclosed herein (e.g., by virtue of the variety of apparatus, elements, and operations disclosed herein).

It may be desirable to implement apparatus F100 such that the speech signal is based on the multichannel sensed audio signal. FIG. 83B shows a block diagram of such an implementation F110 of apparatus F101 in which means G130 is arranged to receive the source signal as the speech signal. In this case, means G140 is also arranged such that each of a plurality of frequency subbands of the processed speech signal is based on a corresponding frequency subband of the source signal (e.g., as described herein with reference to apparatus A110).

Alternatively, it may be desirable to implement apparatus F100 such that the speech signal is based on information from a decoded speech signal. Such a decoded speech signal may be obtained, for example, by decoding a signal that is received wirelessly by the device. FIG. 84A shows a block diagram of such an implementation F120 of apparatus F100 that includes means G150 for decoding an encoded speech signal that is received wirelessly by the device to produce the speech signal. For example, means G150 may be configured to decode the encoded speech signal according to one of the codecs identified herein (e.g., EVRC, SMV, AMR).

Figure 84B:
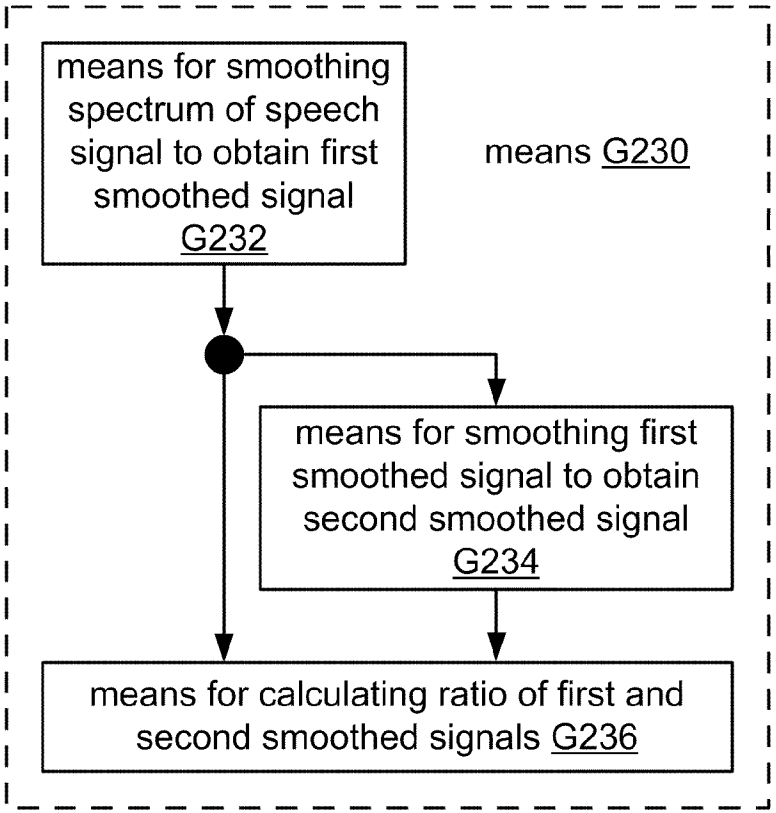
Figure 84A:
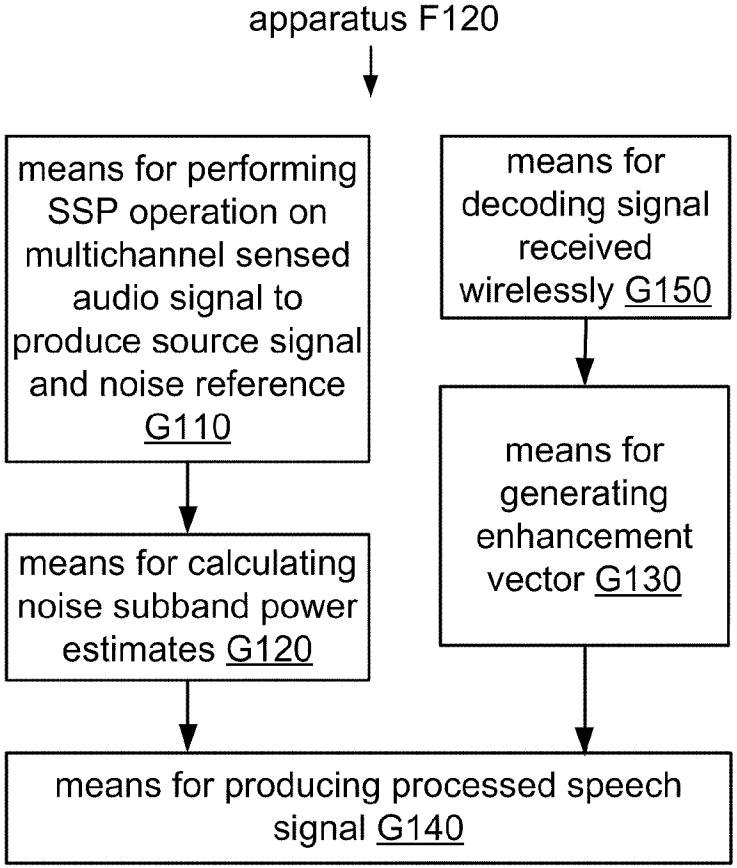

FIG. 84B shows a flowchart of an implementation G230 of means G130 for generating an enhancement vector that includes means G232 for smoothing a spectrum of the speech signal to obtain a first smoothed signal (e.g., as described herein with reference to spectrum smoother SM10), means G234 for smoothing the first smoothed signal to obtain a second smoothed signal (e.g., as described herein with reference to spectrum smoother SM20), and means G236 for calculating a ratio of the first and second smoothed signals (e.g., as described herein with reference to ratio calculator RC10). Means G130 or means G230 may also be configured to include means for reducing a difference between magnitudes of spectral peaks of the speech signal (e.g., as described herein with reference to pre-enhancement processing module PM10), such that the enhancement vector is based on a result of this difference-reducing operation.

Figure 85A:
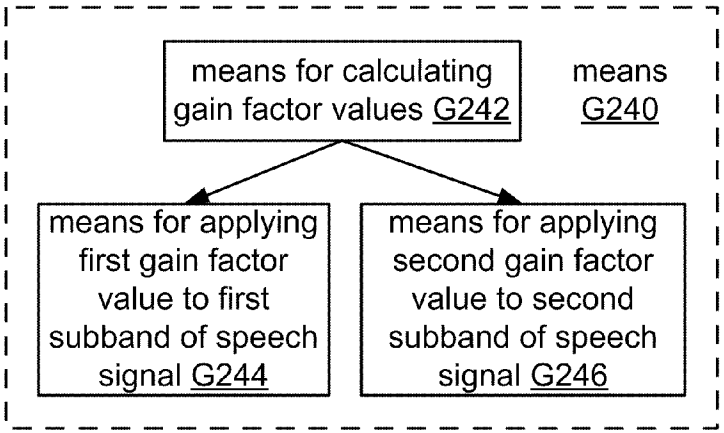

FIG. 85A shows a block diagram of an implementation G240 of means G140 that includes means G242 for calculating a plurality of gain factor values, based on the plurality of noise subband power estimates and on the information from the enhancement vector, such that a first of the plurality of gain factor values differs from a second of the plurality of gain factor values (e.g., as described herein with reference to gain factor calculator FC300). Means G240 includes means G244 for applying the first gain factor value to a first frequency subband of the speech signal to obtain a first subband of the processed speech signal and means G246 for applying the second gain factor value to a second frequency subband of the speech signal to obtain a second subband of the processed speech signal (e.g., as described herein with reference to gain control element CE110 and/or CE120).

Figure 85B:
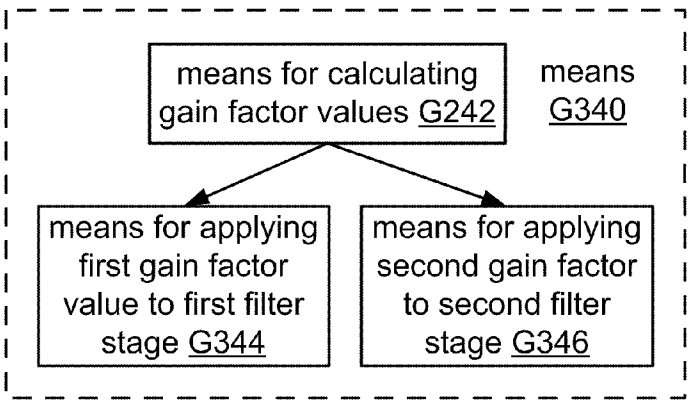

FIG. 85B shows a block diagram of an implementation G340 of means G240 that includes a cascade of filter stages arranged to filter the speech signal to produce the processed speech signal (e.g., as described herein with reference to subband filter array FA120). Means G340 includes an implementation G344 of means G244 for applying the first gain factor value to a first filter stage of the cascade and an implementation G346 of means G246 for applying the second gain factor value to a second filter stage of the cascade.

Figure 85C:
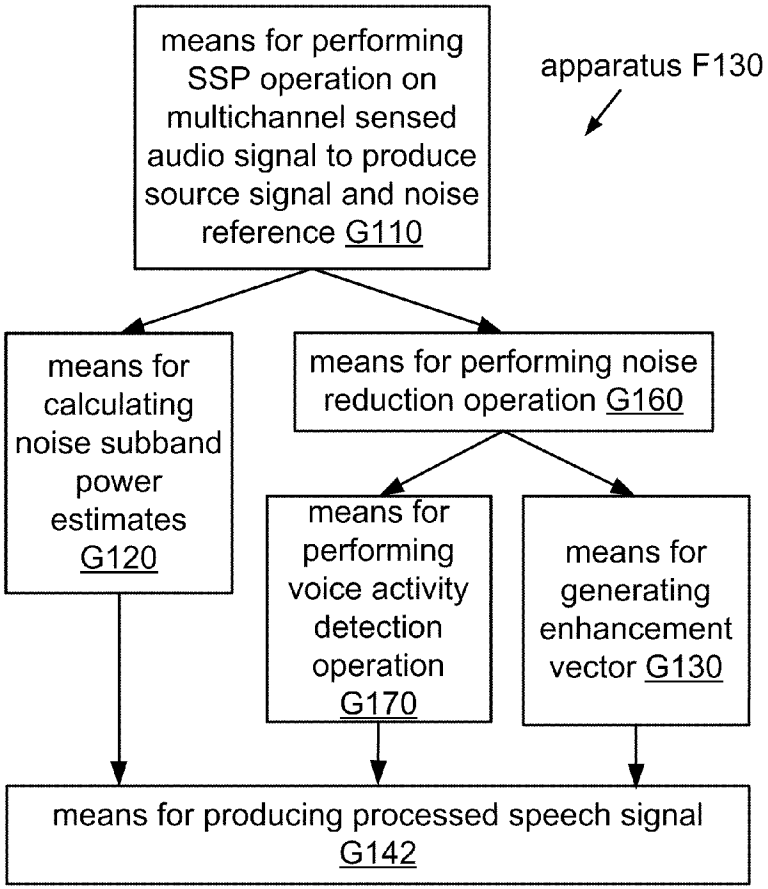

FIG. 85C shows a flowchart of an implementation F130 of apparatus F110 that includes means G160 for performing a noise reduction operation, based on information from the noise reference, on the source signal to obtain the speech signal (e.g., as described herein with reference to noise reduction stage NR10). In one example, means G160 is configured to perform a spectral subtraction operation on the source signal (e.g., as described herein with reference to noise reduction stage NR20). Apparatus F130 also includes means G170 for performing a voice activity detection operation based on a relation between the source signal and the speech signal (e.g., as described herein with reference to VAD V15). Apparatus F130 also includes an implementation G142 of means G140 for producing the processed speech signal based on a result of the voice activity detection operation (e.g., as described herein with reference to enhancer EN150).

Figure 86B:
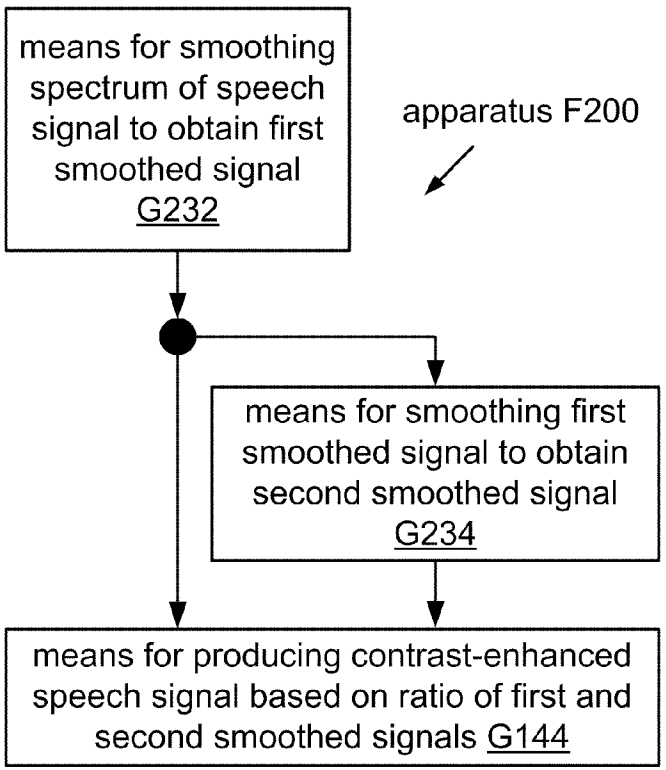
Figure 86A:
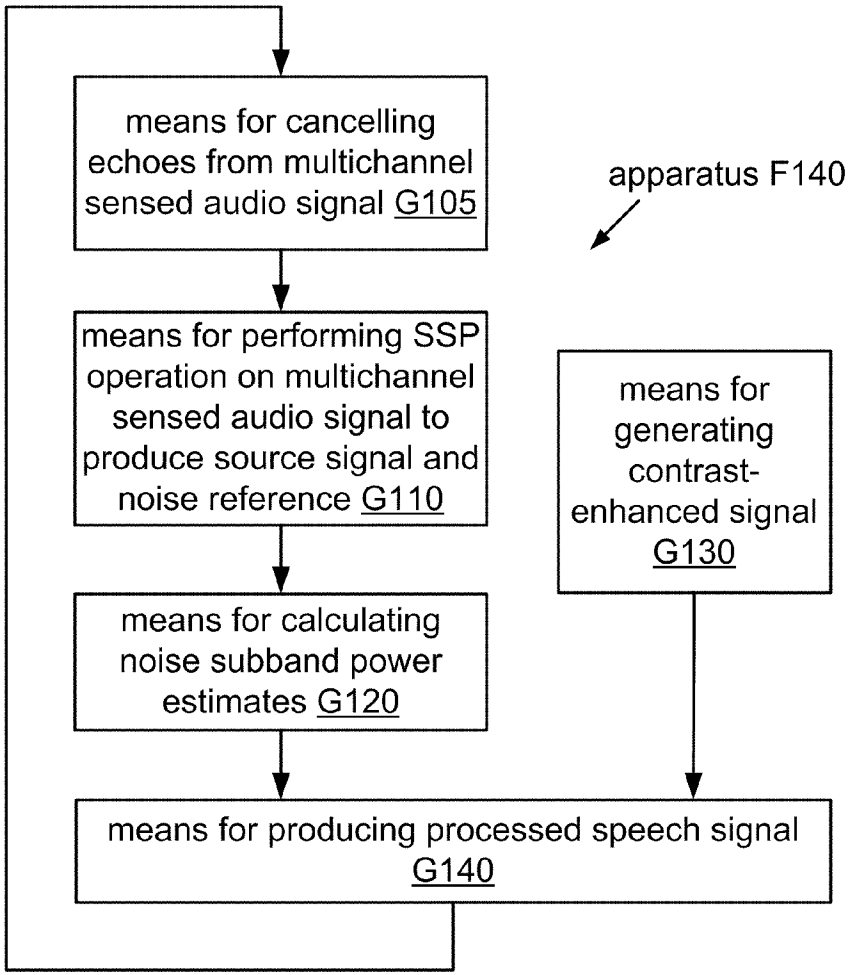

FIG. 86A shows a flowchart of an implementation F140 of apparatus F100 that includes means G105 for cancelling echoes from the multichannel sensed audio signal (e.g., as described herein with reference to echo canceller EC10). Means G105 is configured and arranged to be trained by the processed speech signal (e.g., as described herein with reference to audio preprocessor AP30).

FIG. 86B shows a block diagram of an apparatus F200 for processing a speech signal according to a general configuration. Apparatus F200 may be implemented within a device that is configured to process audio signals (e.g., any of the audio sensing devices identified herein, such as a communications device). Apparatus F200 includes means G232 for smoothing and means G234 for smoothing as described above. Apparatus F200 also includes means G144 for producing a contrast-enhanced speech signal that is based on a ratio of the first and second smoothed signals (e.g., as described herein with reference to enhancement vector generator VG110 and implementations of enhancer EN100, EN110, and EN120 that include such a generator). For example, means G144 may be configured to produce the contract-enhanced speech signal by controlling the gains of a plurality of subbands of the speech signal such that the gain for each subband is based on information from a corresponding subband of the ratio of the first and second smoothed signals.

Apparatus F200 may also be implemented to include means for performing an adaptive equalization operation, and/or means for reducing a difference between magnitudes of spectral peaks of the speech signal, to obtain an equalized spectrum of the speech signal (e.g., as described herein with reference to pre-enhancement processing module PM10). In such cases, means G232 may be arranged to smooth the equalized spectrum to obtain the first smoothed signal.

The foregoing presentation of the described configurations is provided to enable any person skilled in the art to make or use the methods and other structures disclosed herein. The flowcharts, block diagrams, state diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

It is expressly contemplated and hereby disclosed that communications devices disclosed herein may be adapted for use in networks that are packet-switched (for example, wired and/or wireless networks arranged to carry audio transmissions according to protocols such as VoIP) and/or circuit-switched. It is also expressly contemplated and hereby disclosed that communications devices disclosed herein may be adapted for use in narrowband coding systems (e.g., systems that encode an audio frequency range of about four or five kilohertz) and/or for use in wideband coding systems (e.g., systems that encode audio frequencies greater than five kilohertz), including whole-band wideband coding systems and split-band wideband coding systems.

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof.

Important design requirements for implementation of a configuration as disclosed herein may include minimizing processing delay and/or computational complexity (typically measured in millions of instructions per second or MIPS), especially for computation-intensive applications, such as playback of compressed audio or audiovisual information (e.g., a file or stream encoded according to a compression format, such as one of the examples identified herein) or applications for voice communications at higher sampling rates (e.g., for wideband communications).

The various elements of an implementation of an apparatus as disclosed herein (e.g., the various elements of apparatus A100, A110, A120, A130, A132, A134, A140, A150, A160, A165, A170, A180, A200, A210, A230, A250, A300, A310, A320, A400, A500, A550, A600, F100, F110, F120, F130, F140, and F200) may be embodied in any combination of hardware, software, and/or firmware that is deemed suitable for the intended application. For example, such elements may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips).

One or more elements of the various implementations of the apparatus disclosed herein (e.g., as enumerated above) may also be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of an apparatus as disclosed herein may also be embodied as one or more computers (e.g., machines including one or more arrays programmed to execute one or more sets or sequences of instructions, also called "processors"), and any two or more, or even all, of these elements may be implemented within the same such computer or computers.

A processor or other means for processing as disclosed herein may be fabricated as one or more electronic and/or optical devices residing, for example, on the same chip or among two or more chips in a chipset. One example of such a device is a fixed or programmable array of logic elements, such as transistors or logic gates, and any of these elements may be implemented as one or more such arrays. Such an array or arrays may be implemented within one or more chips (for example, within a chipset including two or more chips). Examples of such arrays include fixed or programmable arrays of logic elements, such as microprocessors, embedded processors, IP cores, DSPs, FPGAs, ASSPs, and ASICs. A processor or other means for processing as disclosed herein may also be embodied as one or more computers (e.g., machines including one or more arrays programmed to execute one or more sets or sequences of instructions) or other processors. It is possible for a processor as described herein to be used to perform tasks or execute other sets of instructions that are not directly related to a signal balancing procedure, such as a task relating to another operation of a device or system in which the processor is embedded (e.g., an audio sensing device). It is also possible for part of a method as disclosed herein to be performed by a processor of the audio sensing device (e.g., tasks T110, T120, and T130; or tasks T110, T120, T130, and T242) and for another part of the method to be performed under the control of one or more other processors (e.g., decoding task T150 and/or gain control tasks T244 and T246).

Those of skill will appreciate that the various illustrative modules, logical blocks, circuits, and operations described in connection with the configurations disclosed herein may be implemented as electronic hardware, computer software, or combinations of both. Such modules, logical blocks, circuits, and operations may be implemented or performed with a general purpose processor, a digital signal processor (DSP), an ASIC or ASSP, an FPGA or other programmable logic device, discrete gate or transistor logic, discrete hardware components, or any combination thereof designed to produce the configuration as disclosed herein. For example, such a configuration may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a general purpose processor or other digital signal processing unit. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. A software module may reside in RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, a CD-ROM, or any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

It is noted that the various methods disclosed herein (e.g., methods M100, M110, M120, M130, M140, and M200, as well as the numerous implementations of such methods and additional methods that are expressly disclosed herein by virtue of the descriptions of the operation of the various implementations of apparatus as disclosed herein) may be performed by a array of logic elements such as a processor, and that the various elements of an apparatus as described herein may be implemented as modules designed to execute on such an array. As used herein, the term "module" or "sub-module" can refer to any method, apparatus, device, unit or computer-readable data storage medium that includes computer instructions (e.g., logical expressions) in software, hardware or firmware form. It is to be understood that multiple modules or systems can be combined into one module or system and one module or system can be separated into multiple modules or systems to perform the same functions. When implemented in software or other computer-executable instructions, the elements of a process are essentially the code segments to perform the related tasks, such as with routines, programs, objects, components, data structures, and the like. The term "software" should be understood to include source code, assembly language code, machine code, binary code, firmware, macrocode, microcode, any one or more sets or sequences of instructions executable by an array of logic elements, and any combination of such examples. The program or code segments can be stored in a processor readable medium or transmitted by a computer data signal embodied in a carrier wave over a transmission medium or communication link.

The implementations of methods, schemes, and techniques disclosed herein may also be tangibly embodied (for example, in one or more computer-readable media as listed herein) as one or more sets of instructions readable and/or executable by a machine including an array of logic elements (e.g., a processor, microprocessor, microcontroller, or other finite state machine). The term "computer-readable medium" may include any medium that can store or transfer information, including volatile, nonvolatile, removable and non-removable media. Examples of a computer-readable medium include an electronic circuit, a semiconductor memory device, a ROM, a flash memory, an erasable ROM (EROM), a floppy diskette or other magnetic storage, a CD-ROM/DVD or other optical storage, a hard disk, a fiber optic medium, a radio frequency (RF) link, or any other medium which can be used to store the desired information and which can be accessed. The computer data signal may include any signal that can propagate over a transmission medium such as electronic network channels, optical fibers, air, electromagnetic, RF links, etc. The code segments may be downloaded via computer networks such as the Internet or an intranet. In any case, the scope of the present disclosure should not be construed as limited by such embodiments.

Each of the tasks of the methods described herein may be embodied directly in hardware, in a software module executed by a processor, or in a combination of the two. In a typical application of an implementation of a method as disclosed herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

It is expressly disclosed that the various methods disclosed herein may be performed by a portable communications device such as a handset, headset, or portable digital assistant (PDA), and that the various apparatus described herein may be included with such a device. A typical real-time (e.g., online) application is a telephone conversation conducted using such a mobile device.

In one or more exemplary embodiments, the operations described herein may be implemented in hardware, software, firmware, or any combination thereof. If implemented in software, such operations may be stored on or transmitted over a computer-readable medium as one or more instructions or code. The term "computer-readable media" includes both computer storage media and communication media, including any medium that facilitates transfer of a computer program from one place to another. A storage media may be any available media that can be accessed by a computer. By way of example, and not limitation, such computer-readable media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media.

An acoustic signal processing apparatus as described herein may be incorporated into an electronic device that accepts speech input in order to control certain operations, or may otherwise benefit from separation of desired noises from background noises, such as communications devices. Many applications may benefit from enhancing or separating clear desired sound from background sounds originating from multiple directions. Such applications may include human-machine interfaces in electronic or computing devices which incorporate capabilities such as voice recognition and detection, speech enhancement and separation, voice-activated control, and the like. It may be desirable to implement such an acoustic signal processing apparatus to be suitable in devices that only provide limited processing capabilities.

The elements of the various implementations of the modules, elements, and devices described herein may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may also be implemented in whole or in part as one or more sets of instructions arranged to execute on one or more fixed or programmable arrays of logic elements such as microprocessors, embedded processors, IP cores, digital signal processors, FPGAs, ASSPs, and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times). For example, two of more of subband signal generators SG100, EG100, NG100*a*, NG100*b*, and NG100*c* may be implemented to include the same structure at different times. In another example, two of more of subband power estimate calculators SP100, EP100, NP100*a*, NP100*b* (or NP105), and NP100*c* may be implemented to include the same structure at different times. In another example, subband filter array FA100 and one or more implementations of subband filter array SG10 may be implemented to include the same structure at different times (e.g., using different sets of filter coefficient values at different times).

It is also expressly contemplated and hereby disclosed that various elements that are described herein with reference to a particular implementation of apparatus A100 and/or enhancer EN10 may also be used in the described manner with other disclosed implementations. For example, one or more of AGC module G10 (as described with reference to apparatus A170), audio preprocessor AP10 (as described with reference to apparatus A500), echo canceller EC10 (as described with reference to audio preprocessor AP30), noise reduction stage NR10 (as described with reference to apparatus A130) or NR20, and voice activity detector V10 (as described with reference to apparatus A160) or V15 (as described with reference to apparatus A165) may be included in other disclosed implementations of apparatus A100. Likewise, peak limiter L10 (as described with reference to enhancer EN40) may be included in other disclosed implementations of enhancer EN10. Although applications to two-channel (e.g., stereo) instances of sensed audio signal S10 are primarily described above, extensions of the principles disclosed herein to instances of sensed audio signal S10 having three or more channels (e.g., from an array of three or more microphones) are also expressly contemplated and disclosed herein.

What is claimed is:

1. A method comprising performing each of the following acts within a device that is configured to process audio signals:

performing a spatially selective processing operation within a spatially selective processing filter on a multichannel sensed audio signal to produce a source signal and a noise reference; and performing a first spectral contrast enhancement operation within a first spectral contrast enhancer on a far end speech signal and the noise reference to produce a first processed speech signal.

2. The method of processing the far end speech signal according to claim 1, including decoding a signal that is received wirelessly by the device to obtain a decoded speech signal, wherein the far end speech signal is based on information from the decoded speech signal.

3. The method of claim 1, wherein the method comprises:

using an echo canceller to cancel echoes from the multichannel sensed audio signal; and using the first processed speech signal to train the echo canceller.

4. The method of claim 1, wherein the method comprises:

based on information from the noise reference, performing a noise reduction operation on the source signal to obtain the far end speech signal; and performing a voice activity detection operation based on a relation between the source signal and the far end speech signal, wherein the producing the first processed speech signal is based on a result of the voice activity detection operation.

5. The method of claim 1, wherein the performing the spatially selective processing operation includes determining a relation between phase angles of channels of the multichannel sensed audio signal at each of a plurality of different frequencies.

6. The method of claim 1, wherein the performing the first spectral contrast enhancement operation includes:

calculating a first plurality of subband factors based on information from the noise reference;

calculating a second plurality of subband factors based on information from the far-end speech signal;

generating a first-contrast enhanced signal by applying the second plurality of subband factors to the far-end speech signal; and producing the first processed speech signal by combining the first plurality of subband factors and the first contrast enhanced signal.

7. The method of claim 1, wherein the performing the spatially selective processing operation includes concentrating energy of a directional component of the multichannel sensed audio signal into the source signal, and wherein the multichannel sensed audio signal comprises a near end speech signal.

8. The method of claim 1, further comprises performing a second spectral contrast enhancement operation within a second spectral contrast enhancer on a near end speech signal to produce a second processed speech signal.

9. The method of claim 8, wherein the performing the second spectral contrast enhancement operation includes:

calculating a third plurality of subband factors based on information from the noise reference;

calculating a fourth plurality of subband factors based on information from the near-end speech signal;

generating a second contrast enhanced signal by applying the third plurality of subband factors to the near-end speech signal; and producing a second processed speech signal by combining the third plurality of subband factors and the second contrast enhanced signal.

10. The method of claim 9, wherein the producing the second processed speech signal includes filtering the near-end speech signal using a cascade of filter stages.

11. An apparatus comprising:

means for performing a spatially selective processing operation on a multichannel sensed audio signal to produce a source signal and a noise reference; and means for performing a first spectral contrast enhancement operation within a first spectral contrast enhancer on a far end speech signal and the noise reference to produce a first processed speech signal.

12. The apparatus of claim 11, includes means for decoding a signal that is received wirelessly by the apparatus to obtain a decoded speech signal, wherein the far end speech signal is based on information from the decoded speech signal.

13. The apparatus of 11, wherein the apparatus comprises means for cancelling echoes from the multichannel sensed audio signal, and wherein the means for cancelling echoes is configured and arranged to be trained by the first processed speech signal.

14. The apparatus of claim 11, wherein said apparatus comprises:

means for performing a noise reduction operation, based on information from the noise reference, on the source signal to obtain the far end speech signal; and means for performing a voice activity detection operation based on a relation between the source signal and the far end speech signal, wherein said means for producing a first processed speech signal is configured to produce the first processed speech signal based on a result of the voice activity detection operation.

15. The apparatus of claim 11, wherein the means for performing the first spectral contrast enhancement operation includes:

means for calculating a first plurality of subband factors based on information from the noise reference;

means for calculating a second plurality of subband factors based on information from the far end speech signal;

means for generating a first contrast enhanced signal by applying the second plurality of subband factors to the far end speech signal; and means for producing a first processed speech signal by means for combining the first plurality of subband factors and the first contrast enhanced signal.

16. The apparatus of claim 11, wherein means for the spatially selective processing operation includes concentrating energy of a directional component of the multichannel sensed audio signal into the source signal, and wherein the multichannel sensed audio signal comprises a near end speech signal.

17. The apparatus of claim 11, further comprising means for performing a second spectral contrast enhancement operation within a second spectral contrast enhancer on a near end speech signal and the noise reference to produce a second processed speech signal.

18. The apparatus of claim 17, wherein the means for performing the second spectral contrast enhancement operation includes:

means for calculating a third plurality of subband factors based on information from the noise reference;

means for calculating a fourth plurality of subband factors based on information from the near end speech signal;

means for generating a second contrast enhanced signal by applying the fourth plurality of subband factors to the near end speech signal; and means for producing a second processed speech signal by means for combining the third plurality of subband factors and the second contrast enhanced signal.

19. The apparatus of claim 18, wherein the means for producing the second processed speech signal a includes a cascade of filter stages arranged to filter the near end speech signal.

20. An apparatus comprising:

a spatially selective processing filter configured to perform a spatially selective processing operation on a multichannel sensed audio signal to produce a source signal and a noise reference; and a first spectral contrast enhancer, coupled to the spatially selective processing filter, configured to perform a spectral contrast enhancement operation on a far end speech signal and the noise reference to produce a first processed speech signal.

21. The apparatus of claim 20, wherein the apparatus comprises a decoder configured to decode a signal that is received wirelessly by the apparatus to obtain a decoded speech signal, and wherein the far end speech signal is based on information from the decoded speech signal.

22. The apparatus of claim 20, wherein the first spectral contrast enhancer comprises an echo canceller configured to cancel echoes from the multichannel sensed audio signal, and wherein the echo canceller is configured and arranged to be trained by the first processed speech signal.

23. The apparatus of claim 20, wherein the apparatus comprises:

a noise reduction stage configured to perform a noise reduction operation, based on information from the noise reference, on the source signal to obtain the far end speech signal; and a voice activity detector configured to perform a voice activity detection operation based on a relation between the source signal and the far end speech signal, wherein the first spectral contrast enhancer is configured to produce the first processed speech signal based on a result of the voice activity detection operation.

24. The apparatus of claim 20, wherein the first spectral contrast enhancer comprises:

a first subband factor calculator configured to calculate a first plurality of subband factors based on information from a noise reference;

a second subband factor calculator configured to calculate a second plurality of subband factors based on information from a far end speech signal;

a control element configured to generate a first contrast enhanced signal based on the second plurality of subband factors to the far end speech signal; and a mixer configured to combine the first plurality of subband factors and the first contrast enhanced signal.

25. The apparatus of claim 20, wherein the spatially selective processing operation includes concentrating energy of a directional component of the multichannel sensed audio signal into the source signal, and wherein the multichannel sensed audio signal comprises a near end speech signal.

26. The apparatus of claim 20, further comprising a second spectral contrast enhancer, coupled to a spatially selective processing filter, configured to perform a spectral contrast enhancement operation on a near end speech signal to produce a second processed speech signal.

27. The apparatus of claim 20, wherein the second spectral contrast enhancer comprises:

a third subband factor calculator configured to calculate a third plurality of subband factors based on information from the noise reference;

a fourth subband factor calculator configured to calculate a fourth plurality of subband factors based on information from the far end speech signal;

a control element configured to generate a second contrast enhanced signal based on the second plurality of subband factors to the far end speech signal; and a mixer configured to combine the third plurality of subband factors and the second contrast enhanced signal.

28. A non-transitory computer-readable medium comprising instructions which when executed by at least one processor cause the at least one processor to perform a method comprising:

instructions which when executed by a processor cause the processor to perform a spatially selective processing operation on a multichannel sensed audio signal to produce a source signal and a noise reference; and instructions which when executed by a processor cause the processor to perform a first spectral contrast enhancement operation within a first spectral contrast enhancer on a speech signal and the noise reference to produce a first processed speech signal, wherein the speech signal comprises a far end speech signal.

29. The non-transitory computer-readable medium according to claim 28, wherein the medium comprises instructions which when executed by a processor cause the processor to decode a signal that is received wirelessly by a device that includes said medium to obtain a decoded speech signal, and wherein far end speech signal is based on information from the decoded speech signal.

30. The non-transitory computer-readable medium according to claim 28, wherein the medium comprises:

instructions which when executed by a processor cause the processor to cancel echoes from the multichannel sensed audio signal; and wherein the instructions which when executed by a processor cause the processor to cancel echoes are configured and arranged to be trained by the first processed speech signal.

31. The non-transitory computer-readable medium according to claim 28, wherein said medium comprises:

instructions which when executed by a processor cause the processor to perform a noise reduction operation, based on information from the noise reference, on the source signal to obtain the far end speech signal; and instructions which when executed by a processor cause the processor to perform a voice activity detection operation based on a relation between the source signal and the far end speech signal, wherein the instructions which when executed by a processor cause the processor to produce a first processed speech signal are configured to produce the first processed speech signal based on a result of the voice activity detection operation.

32. A non-transitory computer-readable medium comprising instructions which when executed by at least one processor cause the at least one processor to perform the first spectral contrast enhancement operation comprising:

instructions which when executed by a processor cause the processor to calculate a first plurality of subband factors based on information from the noise reference;

instructions which when executed by a processor cause the processor to calculate a second plurality of subband factors based on information from the far end speech signal;

instructions which when executed by a processor cause the processor to generate a contrast enhanced signal by applying the second plurality of subband factors to the far end speech signal subbands; and instructions which when executed by a processor cause the processor to combine the first plurality of subband factors and the first contrast enhanced signal.

33. The non-transitory computer-readable medium according to claim 28, wherein the instructions which when executed by a processor cause the processor to perform a spatially selective processing operation include instructions which when executed by a processor cause the processor to concentrate energy of a directional component of the multichannel sensed audio signal into the source signal, and wherein the multichannel sensed audio signal comprises a near end speech signal.

34. The non-transitory computer-readable medium according to claim 28, further comprising performing a second spectral contrast enhancement operation within a second spectral contrast enhancer on a near end speech signal to produce a second processed speech signal.

35. The non-transitory computer-readable medium according to claim 34, comprising instructions which when executed by at least one processor cause the at least one processor to perform the second spectral contrast enhancement operation comprising:

instructions which when executed by a processor cause the processor to calculate a third plurality of subband factors based on information from the noise reference;

instructions which when executed by a processor cause the processor to calculate a fourth plurality of subband factors based on information from the near end speech signal;

instructions which when executed by a processor cause the processor to generate a contrast enhanced signal by applying the fourth plurality of subband factors to the near end speech signal subbands; and instructions which when executed by a processor cause the processor to combine the third plurality of subband factors and the second contrast enhanced signal.

* * * * *